US010537214B2

(12) United States Patent
Talley

(10) Patent No.: US 10,537,214 B2
(45) Date of Patent: Jan. 21, 2020

(54) TOILET SEAT AND LID ASSEMBLY WITH INTEGRAL COLLAPSIBLE URINAL

(71) Applicant: Jonathan Ross Talley, Nampa, ID (US)

(72) Inventor: Jonathan Ross Talley, Nampa, ID (US)

( * ) Notice: Subject to any disclaimer, the term of this patent is extended or adjusted under 35 U.S.C. 154(b) by 0 days.

(21) Appl. No.: 16/057,258

(22) Filed: Aug. 7, 2018

(65) Prior Publication Data

US 2019/0059664 A1 Feb. 28, 2019

Related U.S. Application Data

(60) Provisional application No. 62/551,832, filed on Aug. 30, 2017.

(51) Int. Cl.
*A47K 13/24* (2006.01)

(52) U.S. Cl.
CPC ..... *A47K 13/24* (2013.01)

(58) Field of Classification Search
CPC ..... A47K 13/14
USPC ..... 4/234, 144.1
See application file for complete search history.

(56) References Cited

U.S. PATENT DOCUMENTS

2008/0244817 A1* 10/2008 Saller ..... A47K 13/24 4/300.3
2013/0212792 A1* 8/2013 Osborne ..... A47K 11/12 4/144.1
2016/0106276 A1* 4/2016 Hou ..... E03D 11/025 4/300.3
2017/0335557 A1* 11/2017 Valdez ..... A47K 13/24

* cited by examiner

*Primary Examiner* — Huyen D Le

(57) ABSTRACT

The present invention is a western style toilet seat and lid assembly, containing an integral urinal. The most basic embodiment presented herein features a front opening in a modified toilet lid, positioned directly over a rigidly attached urine pan, forming a urine receptacle conveniently located for standing users. Another embodiment features a removable and collapsible "dry" urinal cartridge, and a self-engaging lid braking system that allows users to quickly adjust the urinal position to their height. Other embodiments presented herein incorporate water rinse systems, supplied through concealed plumbing, and operated by manual or automatic pneumatic controls. The comprehensive designs integrate numerous user-friendly features including a self-opening cartridge, funnel spout seals that prevents drips during seated use, debris screening, odor control accommodations, and rotational dampening systems. For each embodiment presented herein, the toilet seat and lid operate just as conventional components, providing all the benefits of traditional seat and lid assemblies.

20 Claims, 84 Drawing Sheets

017
101
024
517A
018
855
419A
102
006
A40
367A
455
101
336
A41

325
333
006
456
344A
344B
101
A42

555
024
855
A44
102
416
008
A43

024
563
026
A46
400
564
479
855
102
798
008
A45

102
A47
006
367A
101
345
336
A48
399

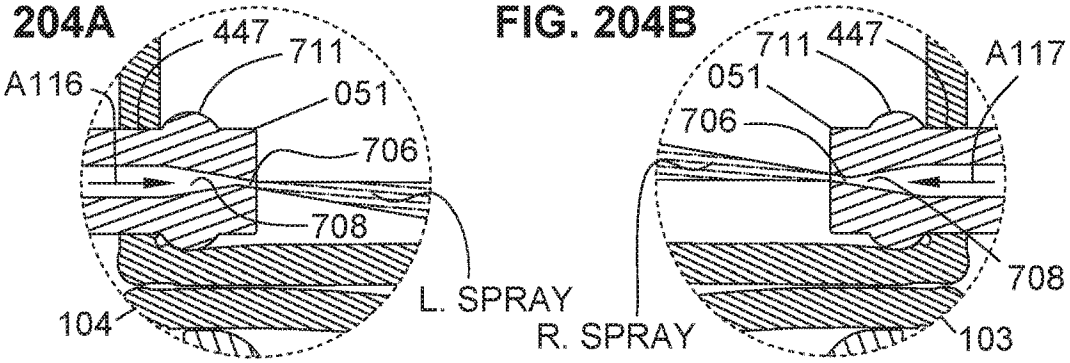
FIG. 204A
FIG. 204B
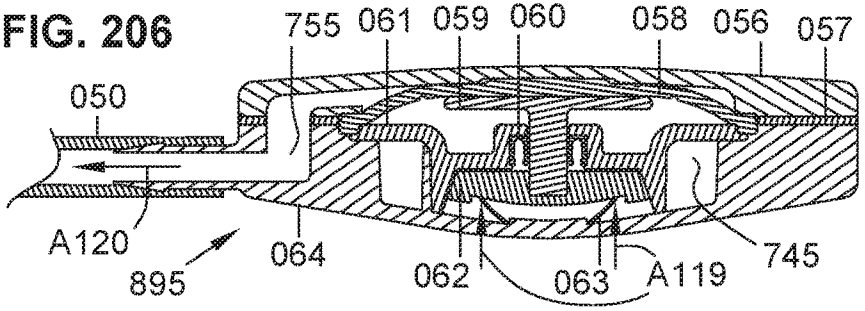
FIG. 206
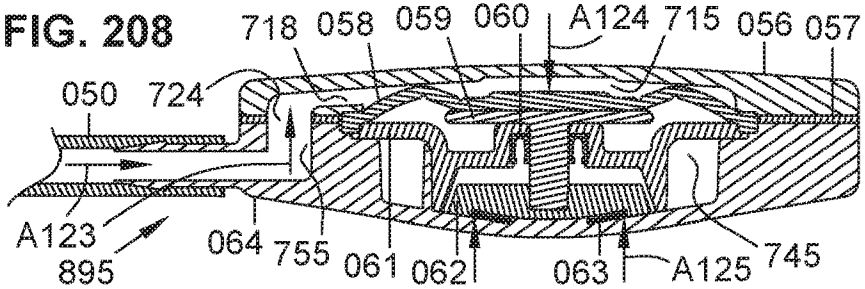
FIG. 208
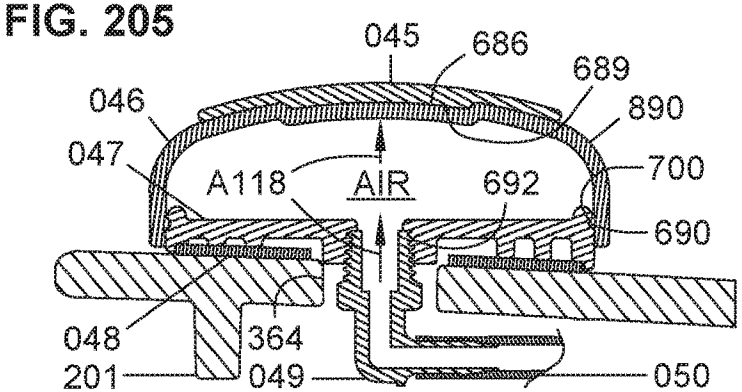
FIG. 205
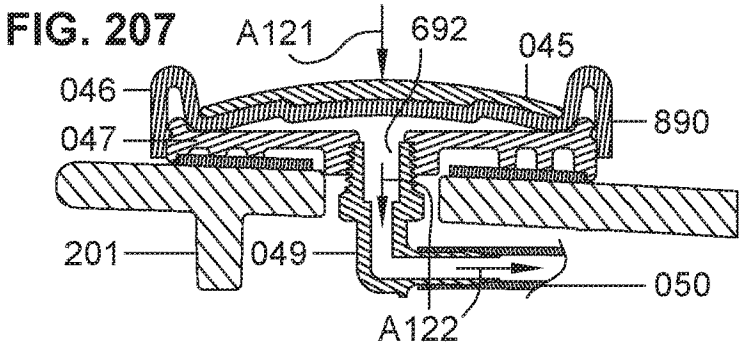
FIG. 207

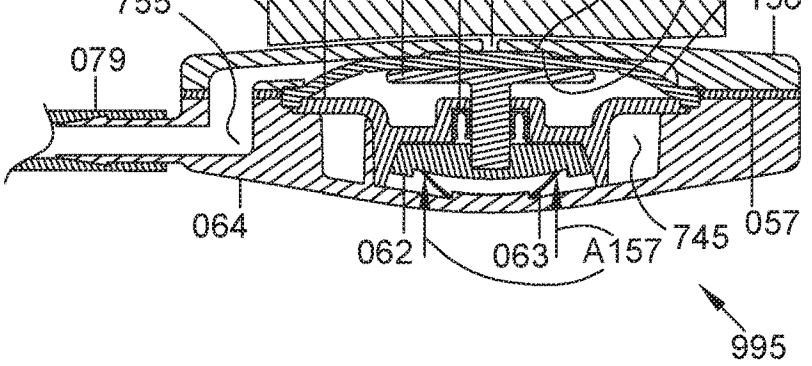
FIG. 223
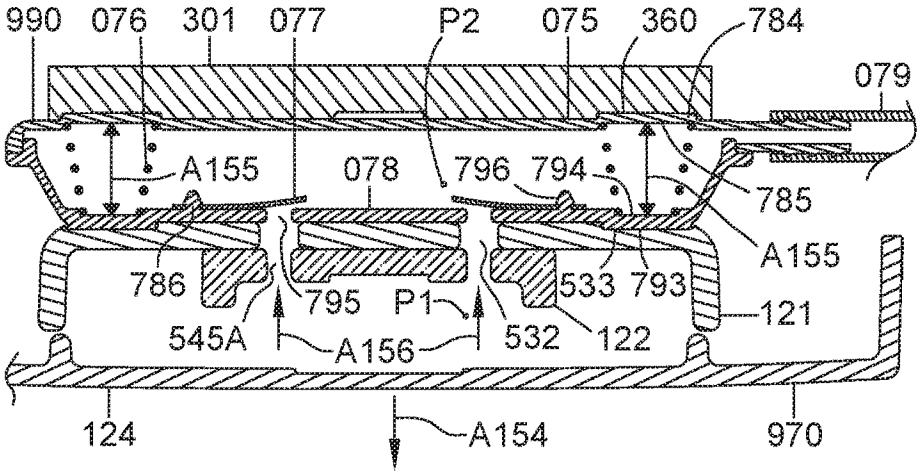
FIG. 222
FIG. 225
FIG. 224

TOILET SEAT AND LID ASSEMBLY WITH INTEGRAL COLLAPSIBLE URINAL

This application claims benefit of Provisional Application 62/551,832, filed 2017 Aug. 30, and entitled "TOILET SEAT AND LID ASSEMBLY WITH INTERGRAL COLLAPSIBLE URINAL", the entire disclosure of which is incorporated herein by this reference.

BACKGROUND OF THE INVENTION

1. Prologue

In this disclosure, the terms "western style", "western bathroom" and more generally "western" have been used in the context of water closets, also known as flush toilets, to describe the traditional bathroom fixture predominantly used in the western hemisphere, and many other developed countries that have been strongly influenced by western culture. The intent is to distinguish the "western toilet" from the "squat toilet" common to East Asia and other regions.

2. Field of the Invention

The present invention generally illustrates a modified traditional western style water closet lid containing an integral forward urinal, designed to receive urine from standing users. The present invention further illustrates numerous advantageous improvements, including, but not limited to: height adjustment features allowing the urinal to be quickly and strategically positioned in very close proximity to each user's groin; substantial shielding to prevent collateral urine contamination of the surroundings; optional water rinse features to further promote cleanliness.

3. Background

While men have been blessed with the ability to urinate while standing, women around the globe will attest that it isn't always a sanitary process. Although the western style water closet with conventional hardware addresses many functional and hygienic issues well, it does not practically address the numerous means of collateral contamination by which urine and septic contaminants can sully anything, and everything, in proximity. And, the not-so-common practice of raising the seat typically obligates the user to close the seat after use, to preserve peace with any females who share the water closet.

Although western style water closets present a rather large receptacle, males of all ages prove daily that it is possible to miss this large target. Young boys, though shorter, tend to be less attentive and display less control, so they often overshoot the water closet bowl altogether. Taller children, teenagers, and adults may have improved attention and control, but their urine stream originates further above the water closet bowl. Thus, a slight miscalculation in trajectory, a split stream, or a variation in bladder pressure can result in a mess on the water closet, the floor, or other undesirable locations. And, even if the marksman hits his target precisely, the bowl splash can be significant, resulting in septic contaminants on everything in proximity. Raising the water closet lid and seat before urinating only helps to protect the top surface of these components. In practicality, urine typically ends up in various undesired locations, even if not immediately evident. Anyone who has cleaned a bathroom where males urinate standing will attest that the process is generally unsanitary.

Stationary urinals can address these concerns in part, but with profound limitations: Because they require significant space, they can be difficult to fit into a residential bathroom. And, because they require significant plumbing, they can be extremely difficult and costly to retrofit into any bathroom. But, more importantly, once mounted, a stationary urinal has a set height, so it only works well for some users. Those who are too short to reach will not have good success. Likewise, those who are too tall, relative to the urinal, may have the same collateral contamination problems that tall men experience when urinating into a water closet while standing.

In the past, there have been attempts to address these concerns with add-on urinal devices, but they consistently fail to address many consumer needs and have therefore never gained significant popularity. These 'add-on' urinals take up valuable bathroom space, and do not store away easily. In most bathrooms, there is no convenient means to overcome the conspicuity of these utility-driven designs that many would consider eyesores. Those that are rigidly mounted must be located outside the water closet user's workspace, while still being in close proximity to the water closet for draining purposes. So, it becomes difficult to find an acceptable mounting location that is still easily accessible. These devices do not typically have large collection points, or substantial shielding to prevent collateral overspray. Some use corrugated hoses which are not easily cleaned, and allow bacteria to grow, causing unpleasant odors. Most spill the effluent urine stream directly into the standing water within the water closet, creating unnecessary embarrassing noise, and collateral splash. But, perhaps their biggest shortfall is shared with stationary urinals and western style water closets: They do not provide means to quickly adjust height for different users. As previously contemplated, when the urine receptacle is not in close proximity to the user, it's very easy to make a mess. In essence, these devices require significant compromise for residential use, and they only address consumer needs in part.

Because the current solutions fall short, a device that comprehensively addresses all of these issues would be desirable, especially if it integrates seamlessly into the core components of a western bathroom, without disrupting the benefits of traditional hardware. Thus, it would be advantageous to have a traditional western style water closet lid containing an integral urinal. It would be more advantageous if: the urinal was forward mounted for close proximity to users and included substantial side shielding and back shielding to prevent collateral contamination; for seated use, the seat and lid would operate exactly as a traditional western style water closet seat and lid assembly; the urinal presented a large urine receptacle but would collapse into a very compact space; the urinal would occupy no additional bathroom space and would be practically inconspicuous when stored; the device included a mechanism for users to quickly adjust and fix the urinal height with the urine receptacle very close to their groin; the height adjustment mechanism would automatically engage during normal use of the device; the height adjusted mechanism allowed the user to adjust the urinal further upward even after the mechanism is engaged; the urinal would deposit urine directly onto the inner porcelain wall of the water closet bowl, rather than onto standing water, to prevent splashing and promote quiet urination; the urinal would be sealed when closed, to prevent undesirable dripping; the urinal would function while the water closet seat is closed, eliminating the potential for users to leave the seat up; the device included accommodations to facilitate quiet closing of the water closet seat and lid; the device could be easily operated by persons of all ages; the device could be easily cleaned, with no special tools or cleaners required; optionally, the urinal could be removed by the user, as a singular assembly, for ease of cleaning; that removable assembly was comprised entirely of dishwasher safe components, allowing users to sanitize the device in a common dishwasher; optionally, the device included accommodations for the use of odor control agents; optionally, the device included debris screening; optionally, the device would include a urinal spray rinse feature; optionally, the spray rinse feature could be controlled manually by the user; optionally, the spray rinse feature would automatically initiate during normal use of the device; the device could be easily installed by common people with minimal mechanical aptitude; the device would accommodate modern bathroom accessories, such as nightlights and water closet seat covers; the device could be used by females for standing urination; the urinal could be used pets.

Since no product on the market comprehensively addresses these concerns, there is a current need for such a device.

SUMMARY OF THE INVENTION

The present invention advantageously addresses the aforementioned deficiencies with a western style water closet seat and lid assembly containing an integral urinal. The embodiments depicted here demonstrate various optional functions and features that systematically address the current consumer needs. The present invention provides a robust mechanism for standing urination. It comprehensively addresses collection and disposition to inhibit collateral contamination during the process, while also offering innovative features to address sanitary storage and maintenance cleaning.

1. Basic Form of the Current Invention

In its most basic form the present invention is a western style water closet seat and lid assembly with components added to create a functional urinal within the lid. A front opening in the water closet lid is positioned directly over a urine pan, rigidly attached to the bottom side of the water closet lid. These form a urine receptacle conveniently located for standing users. The floor of the urine pan slopes downward towards the center of the water closet bowl, over the water closet seat, and above the central opening of the water closet seat. So, deposited urine will flow from the receptacle to the exit point, through the water closet seat opening and into the water closet bowl. Users need not lift the water closet seat, so they can't forget to put it down. In this basic form, the urinal may also be used by pets with no additional accommodations required.

2. Optional Features Illustrated by this Specification

The present invention may also include optional systems and features to enhance its functionality: An upper component may be included over the receptacle to shield the above surroundings from vertical overshoot. Side-shield components or features may be included, positioned to either side of the urine receptacle, to prevent lateral overshoot. The upper component may be an articulating hatch that opens for use, and closes to cover the stored urinal. The articulating hatch may also contain latching features, allowing the hatch to be latched closed. The side-shields may be flexible or articulating components or features. By combining the urine pan with an articulating hatch and flexible side shields, the urinal may be configured as a collapsible urine cartridge having a substantial urine receptacle that will, when collapsed, store neatly away within the water closet lid. The collapsible cartridge may also contain features to concentrate and direct the urine flow. The urinal cartridge may have self-opening attributes, causing the hatch to articulate open after the user unlatches it. Other components may be included to seal the urinal when stored, preventing any unwanted drips. The urinal may also contain features allowing the interior of the urine receptacle to be illuminated in low light conditions. Optionally, a collapsible urine cartridge could be removed to aid in cleaning. A removable urine cartridge may also be dishwasher safe, allowing users to sanitize it in a common dishwasher.

By integrating the urinal into the water closet lid, the urinal may be positioned at various heights, simply by rotating the water closet lid open, to a preferred position commensurate to the user's height. An optional lid braking mechanism may be included to prevent downward rotation of the lid, when engaged, allowing the user to quickly and easily adjust the height of the urine receptacle with each use. The braking mechanism may automatically engage during normal use of the urinal. One lid braking mechanism that may be incorporated in the current invention would provide incremental adjustment to distinct adjustment points. Another braking mechanism that may be incorporated in the current invention would provide infinitesimal adjustment within the adjustment range. Either braking mechanism would allow the user to adjust the lid upward, when the brake is engaged.

The seat and lid assembly may include slow-close features, preventing the water closet lid, the water closet seat, or both, from falling suddenly closed, to prevent unnecessary noise and potential damage or injury. The current invention may also include modified pivot hardware with concealed internal passages through which pressurized water may be supplied to the water closet lid to support other features. The invention may include a spray rinse function that will direct water jets into the urinal, to rinse its interior surfaces. The spray rinse function may be manually controlled by the user. Or, optionally, the spray rinse function may be automatically initiated during normal use of the urinal.

The current invention may also include façade components with aesthetic curves to hide mechanical systems from user view. Furthermore, the functional components described above may adhere to these same aesthetic curves creating a uniform lower façade surface to dress the device and cover unsightly mechanical systems during seated use.

3. Optional Features Comprehended, but not Illustrated within this Specification The current invention may also include other features that have been comprehended, which are not illustrated by the embodiments described in this specification, including, but not limited to: A manually activated personal hygienic rinse component that will attach to, or be an integral part of, the water closet seat, allowing a seated user to rinse after defecating; A small diameter "child" seat that will pivot into location, above the main water closet seat, for seated use by children and other people of small stature; An auto-release feature that would release the braking mechanism after a set period of time; A self-sealing mechanism within the removable urinal cartridge described above, that would cause the removable urinal cartridge to seal upon removal, thus preventing drips during transportation; A fresh water dispenser for pets, integrated into the top of the water closet lid, to discourage them from drinking water from the water closet bowl; An automatic water closet flush system causing the water closet to flush when another event occurs, such as closure of the urinal cartridge lid, or actuation of the urinal rinse.

4. Functional Advantages of the Current Invention

Comparing functionality of the current invention to previous designs, the current invention addresses the various problems associated with standing urination much more comprehensively. Unlike an 'add-on' device, the current invention is a sturdy and robust assembly. It fully replaces a standard water closet seat and lid assembly, with no loss of functionality; for traditional water closet use, the seat and lid assembly operates exactly as a traditional western style water closet seat and lid assembly operates; the collapsed urinal cartridge requires no additional space and stores away, practically out of sight. And, it operates within the same workspace as the water closet. So, with the present invention, the challenges of fitting and mounting an external receptacle in the bathroom disappear. With the present invention, the added functionality of an adjustable height urinal is gained without any compromise by water closet users who are accustomed to their standard seat and lid assembly.

The urinal cartridge provides an appreciable open area for collecting urine, with substantial side shielding and back shielding to prevent collateral overspray, even from the youngest users who seem to have the least control. It can be easily operated by toddlers who only need to open the hatch. But, the auto-engaging brake mechanism makes it simple to quickly adjust the urinal height for users of any age or size, essentially bringing the "target" to the "shooter". Furthermore, the current invention deposits effluent urine directly onto the inner porcelain wall of most water closet bowls, rather than into standing water. So, the splash factor that users find when urinating directly into a water closet disappears with the current invention, as well as the potentially embarrassing noise.

The urinal cartridge of the current invention seals, when closed, to prevent any dripping. A user need not lift the water closet seat to urinate, so the common question of "who left the seat up" disappears with the current invention. And, slow-close hydraulic hinge components ensure the lid cannot be slammed shut or dropped. Optional accessories of the current invention comprehensively address odor control. The "dry" embodiments presented here (those embodiments without spray rinse features) are easily cleaned with an occasional rinse from a spray bottle; an off-the-shelf drain brush will also allow the user to scrub the interior of "dry" urinal cartridge. The removable "dry" cartridge option makes comprehensive cleaning even easier. And, for those who aren't squeamish, the dishwasher safe removable dry cartridge can be thoroughly sanitized in a dish cycle. The "wet" embodiments, with spray rinse features, provide regular rinsing with each use, so additional cleaning steps should be required infrequently. For any of the embodiments presented here, no special tools or cleaners are required for maintenance cleaning. Like a standard water closet seat and lid, the current invention can be easily installed by users with minimal mechanical aptitude. And, the current invention works with common bathroom accessories like nightlights and water closet seat covers. The current invention comprehensively addresses the current need; it's a robust solution for a cleaner bathroom.

5. Structural Advantages of the Current Invention

Comparing structural components of the current invention with previous designs yields little comparison. Previous inventors sought to add a urinal function to a water closet without modifying the seat and lid assembly, forcing inventors to "work around" the seat and lid assembly, core components of the western bathroom. In those cases, the seat and lid assembly became an impediment, or an obstacle, for the inventor to overcome, causing these inventors to focus on attachment and flow channeling means that are not conducive to consumer friendly design. For this reason, the components of previous inventions are significantly different in structure, compared to the current invention.

Catch Basin Size and Bathroom Aesthetics:

Because the collection basins (urine receptacles) are always visible with these previous inventions, the basin size directly affects consumer appeal. For functionality, a large collection basin is preferable, conducive to cleanly capturing the user's urine while avoiding collateral overspray. But, as an add-on device, always visible in the bathroom, a smaller catch basin is visually much more appealing than a large basin. So, with previous inventions, consumer appeal and functionality were competing constraints. In comparison, the current invention presents a substantially sized urine receptacle that collapses and stores between the water closet seat and water closet lid, while sharing common aesthetic curvature with the surrounding components, making it practically "out of sight and out of mind" when stored.

Connection Components:

Add-on devices require an effluent channel, typically a drain hose, for the urine to flow back into the water closet bowl. This drain hose becomes another eye-sore, and another component which needs cleaned. In comparison to such inventions, the current invention does not require a drain hose.

Closed when Stored:

Add-on devices do not typically include features to cover their collection basin (urine receptacle) when stored. The current invention advantageously includes accommodations to substantially cover and seal the urinal when not in use. Compared to an open collection basin, a functional consequence of this closed-when-stored receptacle may be significantly reduced bathroom odors.

6. Addition Objectives of the Present Invention

Among other things, it is an objective of the present invention to provide a robust mechanism for standing urination that does not suffer from any of the problems or deficiencies associated with standing urination into a water closet or into prior add-on urinal inventions.

It is further an objective of the present invention to provide an economical alternative to fixed urinals for public meeting areas such as parks, schools, and businesses, where these would traditionally be used.

It is further an objective of the present invention to provide a family friendly design that is easily used and operated by users of all ages, allowing urinal functionality to be economically integrated into any western bathroom, thus soliciting greater acceptance and consumer appeal than prior residential urinal devices have solicited.

It is still further an objective of the present invention to create a device that solicits international and cross-cultural appeal, bridging the gap between modern cultures.

The present invention now will be described more fully hereinafter, with reference to the accompanying drawings. The drawings should be considered in conjunction with both this summary, the detailed description and the several embodiments specifically disclosed herein. This invention may, however, be embodied in many different forms and should not be construed as limited to the embodiments set forth herein; rather, these embodiments are provided as examples only, to ensure that this disclosure is thorough, and complete, and will convey the full scope of the current invention to those skilled in the art.

BRIEF DESCRIPTION OF THE DRAWINGS

FIG. 60A is a detail view of modified WC seat 230, as indicated by the view window labeled DET. 60A in FIG. 60.

FIG. 92 is an additional perspective view of wet pivot shaft 069.

FIG. 93 is a perspective view of thumb-nut 072.

FIG. 94 is a perspective view of the components comprising automatic actuator 990, relatively positioned in an exploded state.

FIG. 95 is a perspective view of auto-flush actuator body 075 and auto-flush diaphragm 078.

FIG. 96 is a perspective view of auto-flush diaphragm 078.

FIG. 96A is a detail view of auto-flush diaphragm 078, as indicated by the view window labeled DET. 96A in FIG. 96.

FIG. 97 is a perspective view of the components comprising dry seat assembly 875, relatively positioned in an exploded state.

FIG. 98 is a perspective view of the components comprising wet seat assembly 975, relatively positioned in an exploded state.

FIG. 99 is a perspective view of the components comprising simple hinge assembly 800, relatively positioned in an exploded state.

FIG. 100 is a perspective view of the components comprising incremental right hinge assembly 885, relatively positioned in an exploded state.

FIG. 101 is a perspective view of the components comprising analog right hinge assembly 985, relatively positioned in an exploded state.

FIG. 102 is a perspective view of the components and assemblies comprising embodiment (master assembly 1001), relatively positioned in an exploded state.

Figure 103:
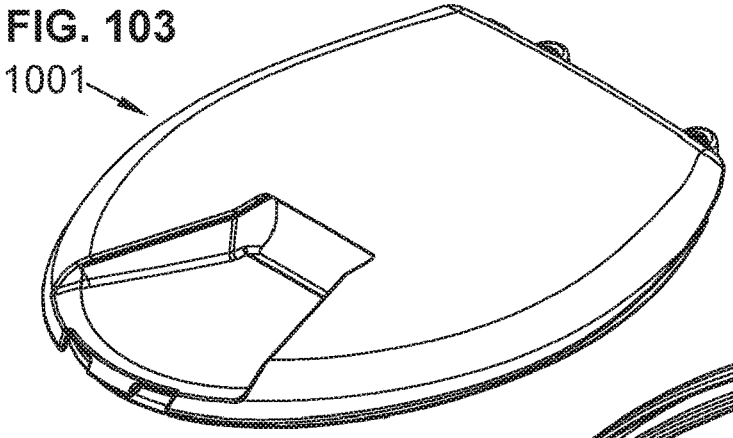

FIG. 103 is a perspective view of embodiment 1 (master assembly 1001).

Figure 104:
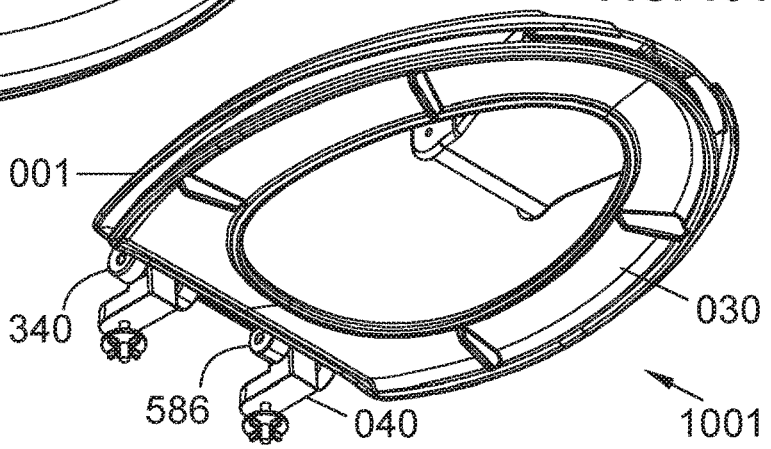

FIG. 104 is an additional perspective view of embodiment 1 (master assembly 1001).

Figure 105:
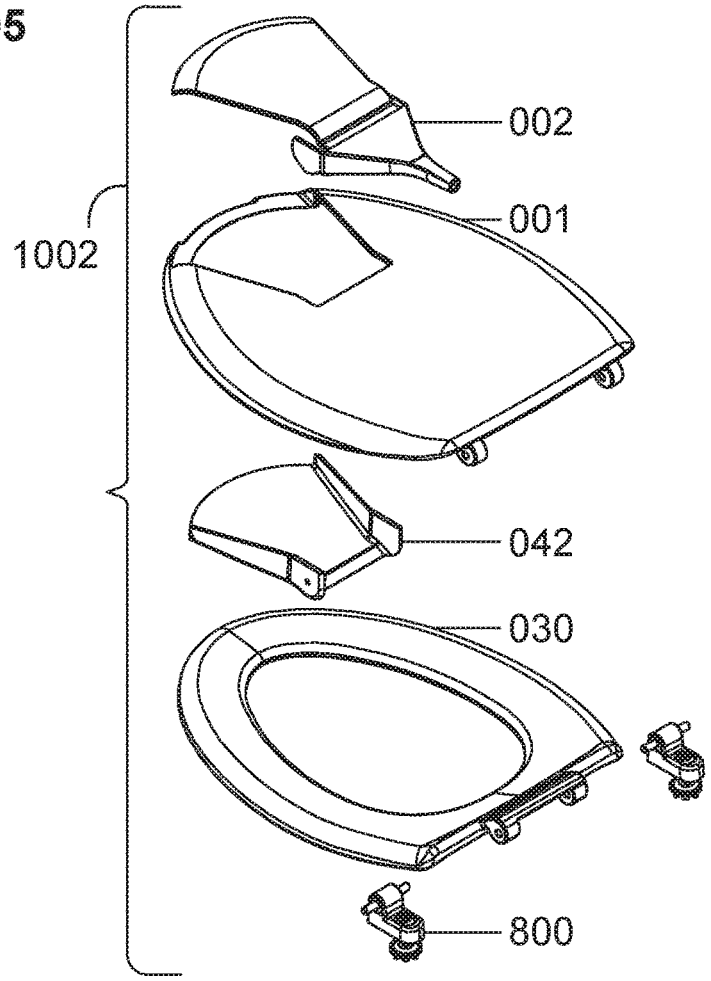

FIG. 105 is a perspective view of the components and assemblies comprising embodiment (master assembly 1002), relatively positioned in an exploded state.

Figure 106:
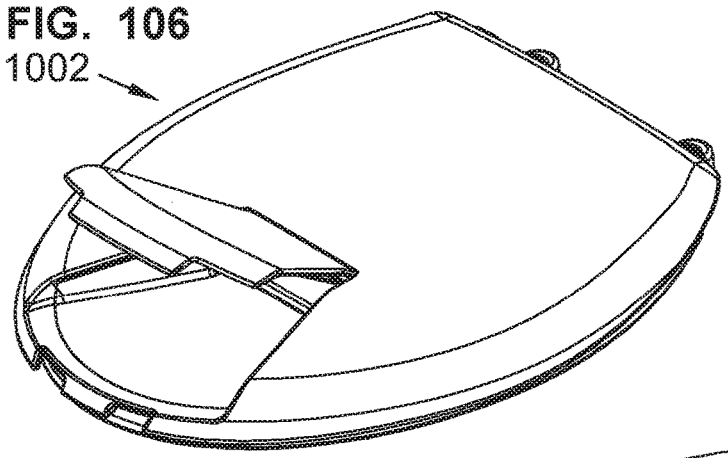

FIG. 106 is a perspective view of embodiment 2 (master assembly 1002), with receptacle lid and funnel 002 in an open position.

Figure 107:
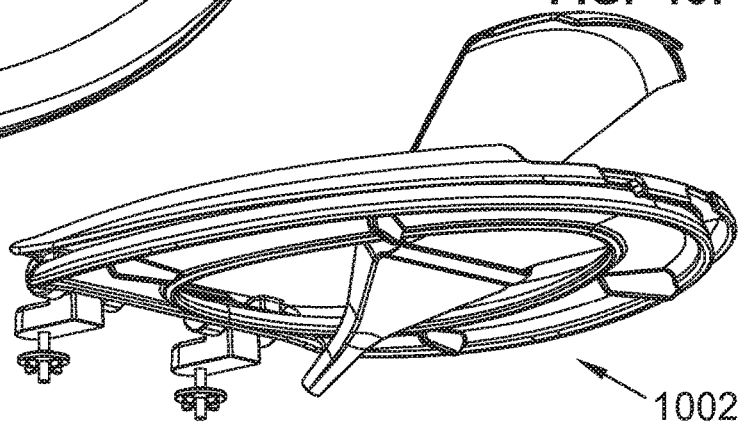

FIG. 107 is an additional perspective view of embodiment 2 (master assembly 1002), with receptacle lid and funnel 002 in an open position.

Figure 108:
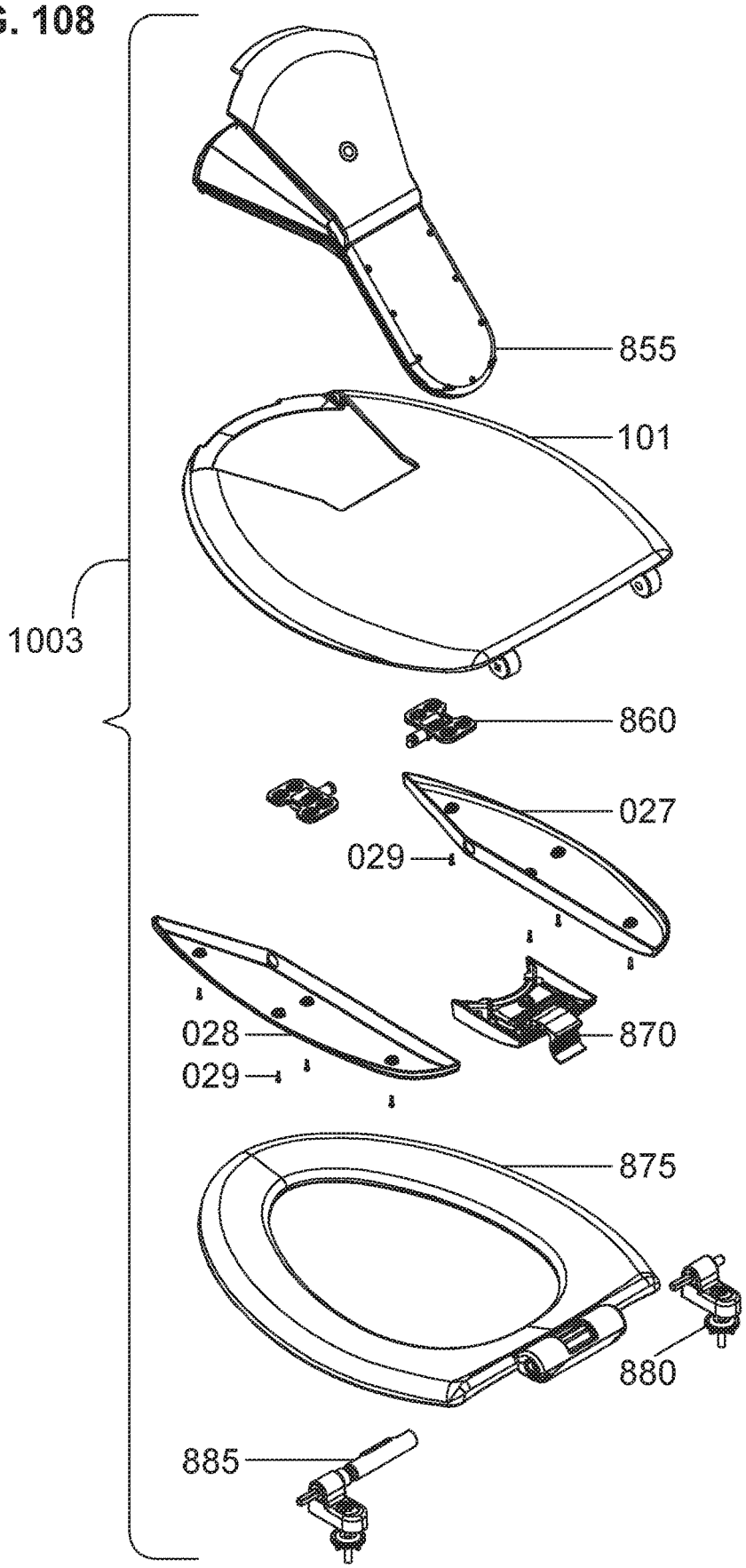

FIG. 108 is a perspective view of the components and assemblies comprising embodiment (master assembly 1003), relatively positioned in an exploded state.

Figure 109:
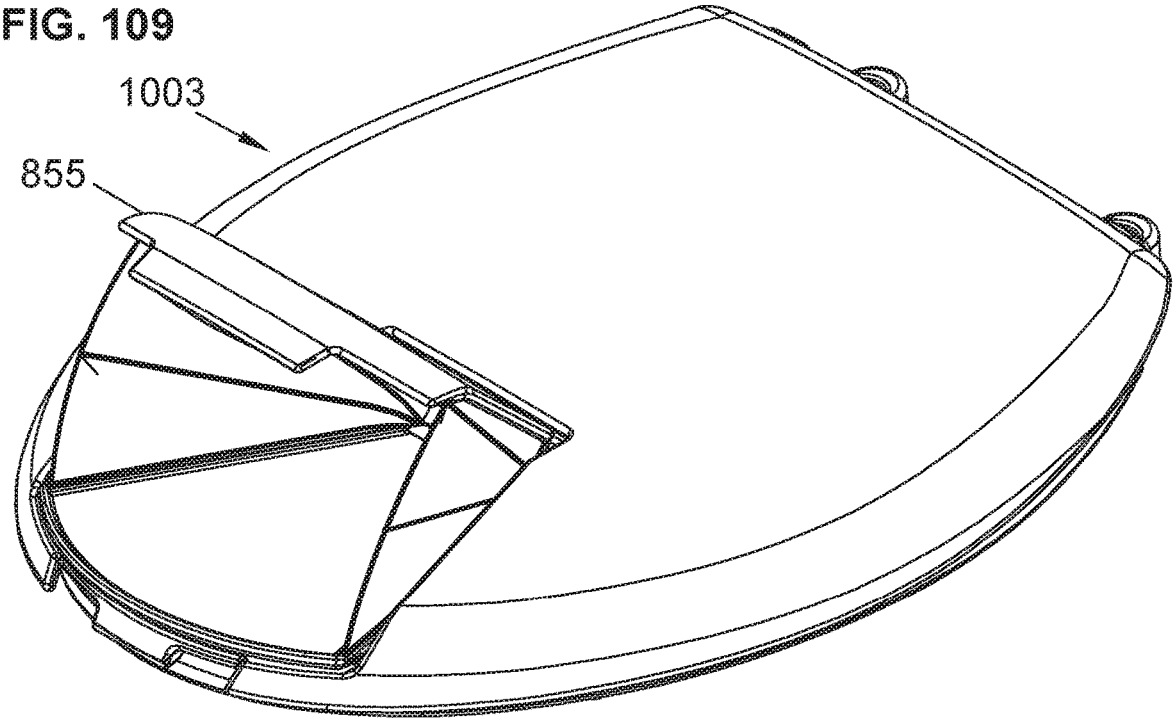

FIG. 109 is a perspective view of embodiment 3 (master assembly 1003), with removable dry cartridge 855 in an open position.

Figure 110:
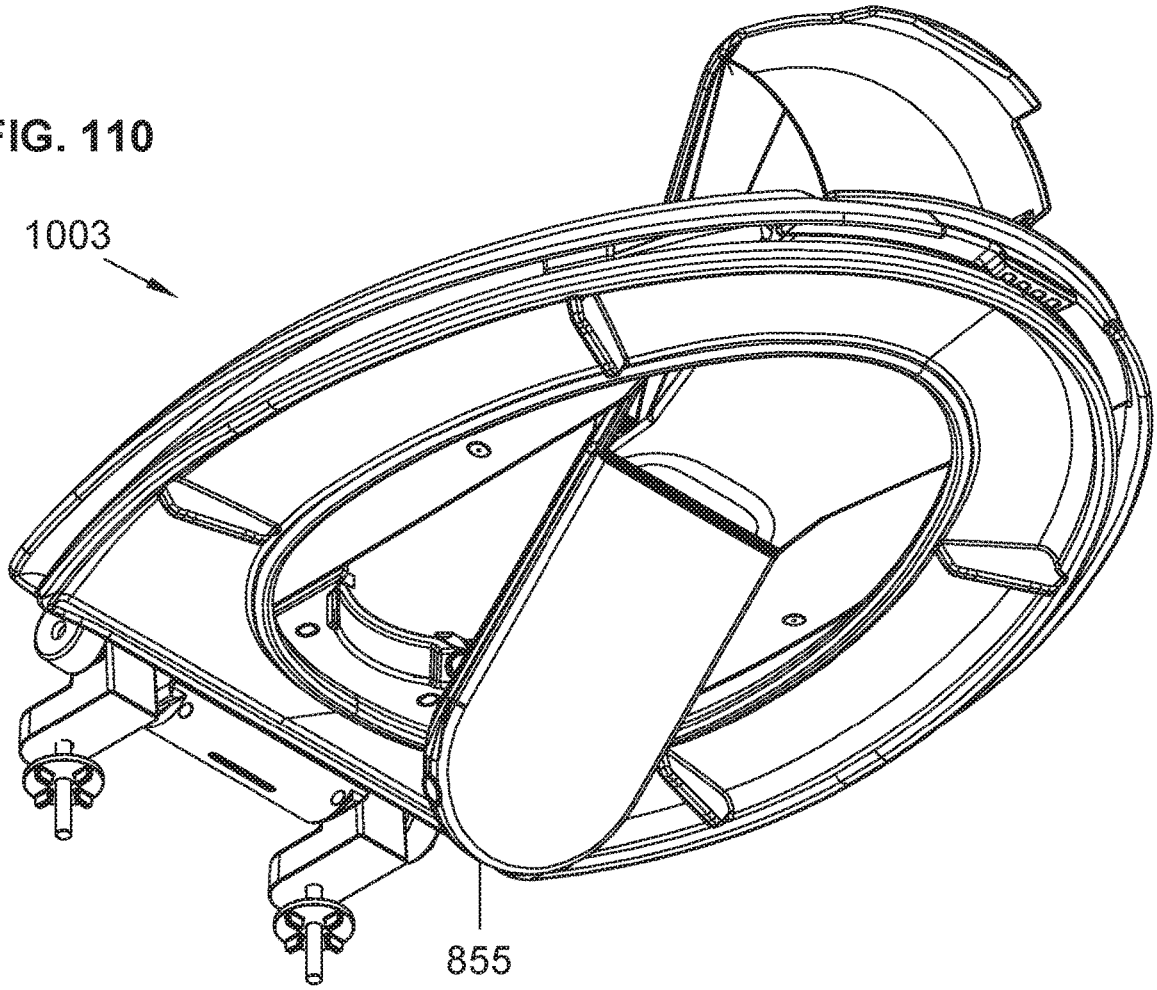

FIG. 110 is an additional perspective view of embodiment 3 (master assembly 1003), with removable dry cartridge 855 in an open position.

Figure 111:
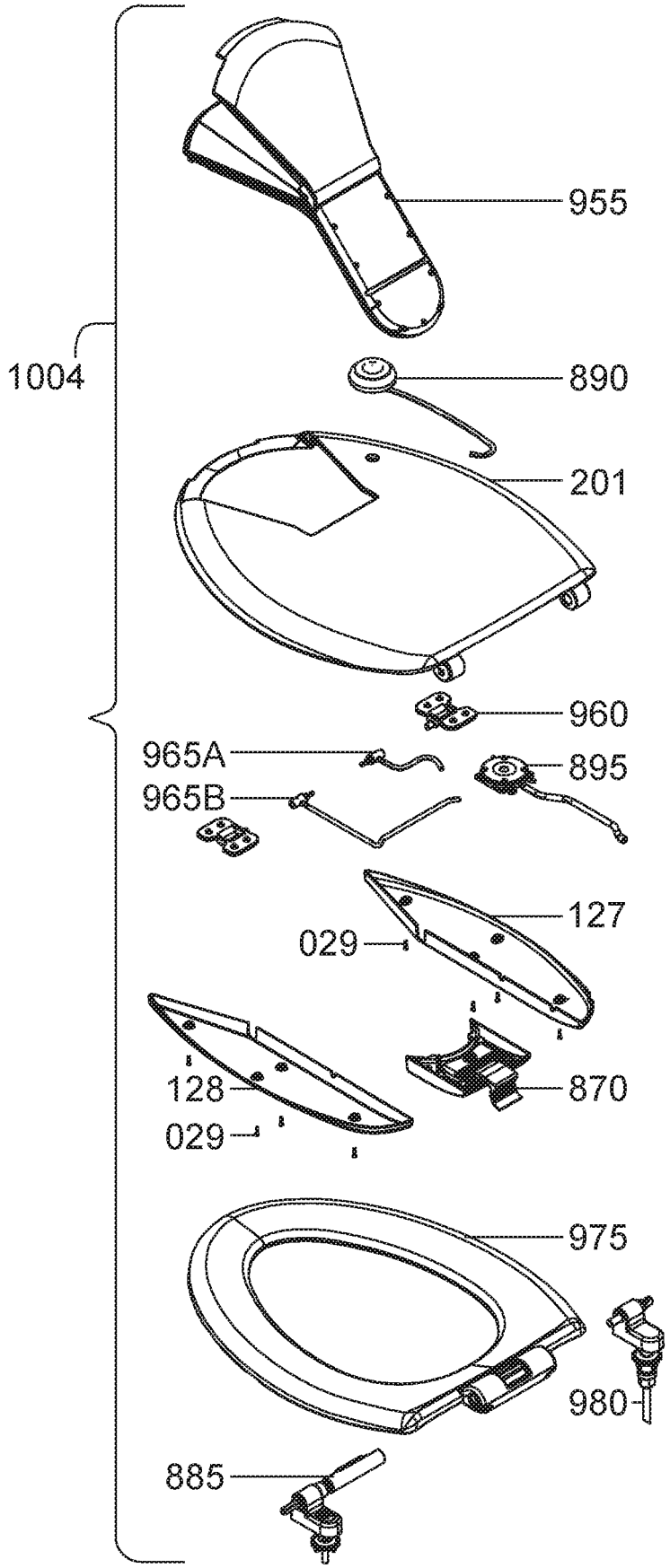

FIG. 111 is a perspective view of the components and assemblies comprising embodiment (master assembly 1004), relatively positioned in an exploded state.

Figure 112:
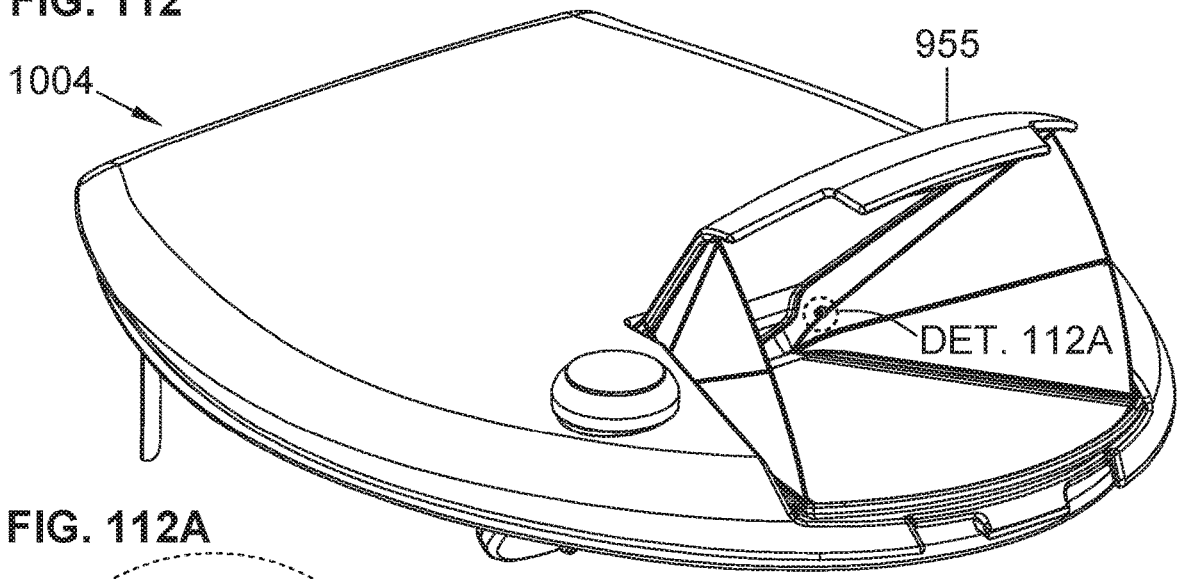

FIG. 112 is a perspective view of embodiment 4 (master assembly 1004), with fixed wet cartridge 955 in an open position.

Figure 112A:
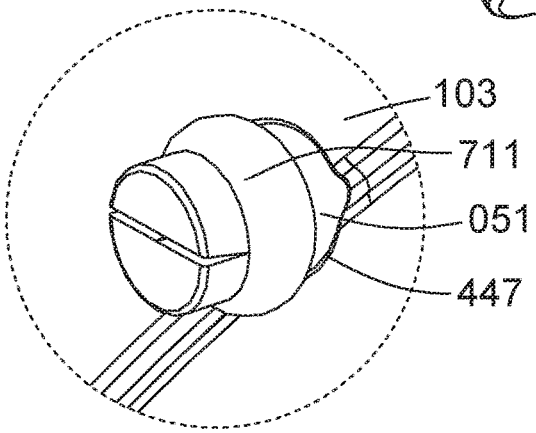

FIG. 112A is a detail view of embodiment 4 (master assembly 1004), as indicated by the view window labeled DET. 112A in FIG. 112.

Figure 113:
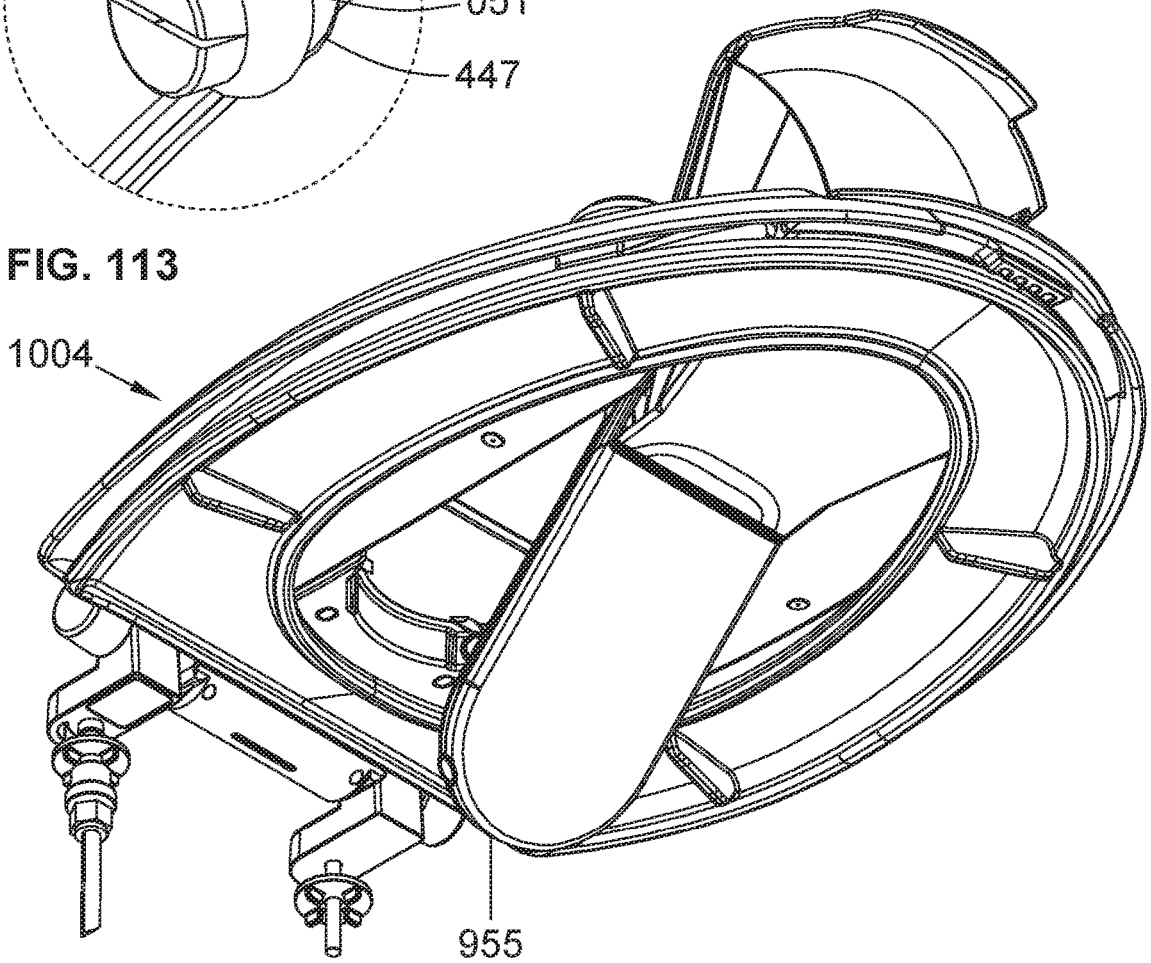

FIG. 113 is an additional perspective view of embodiment 4 (master assembly 1004), with fixed wet cartridge 955 in an open position.

Figure 114:
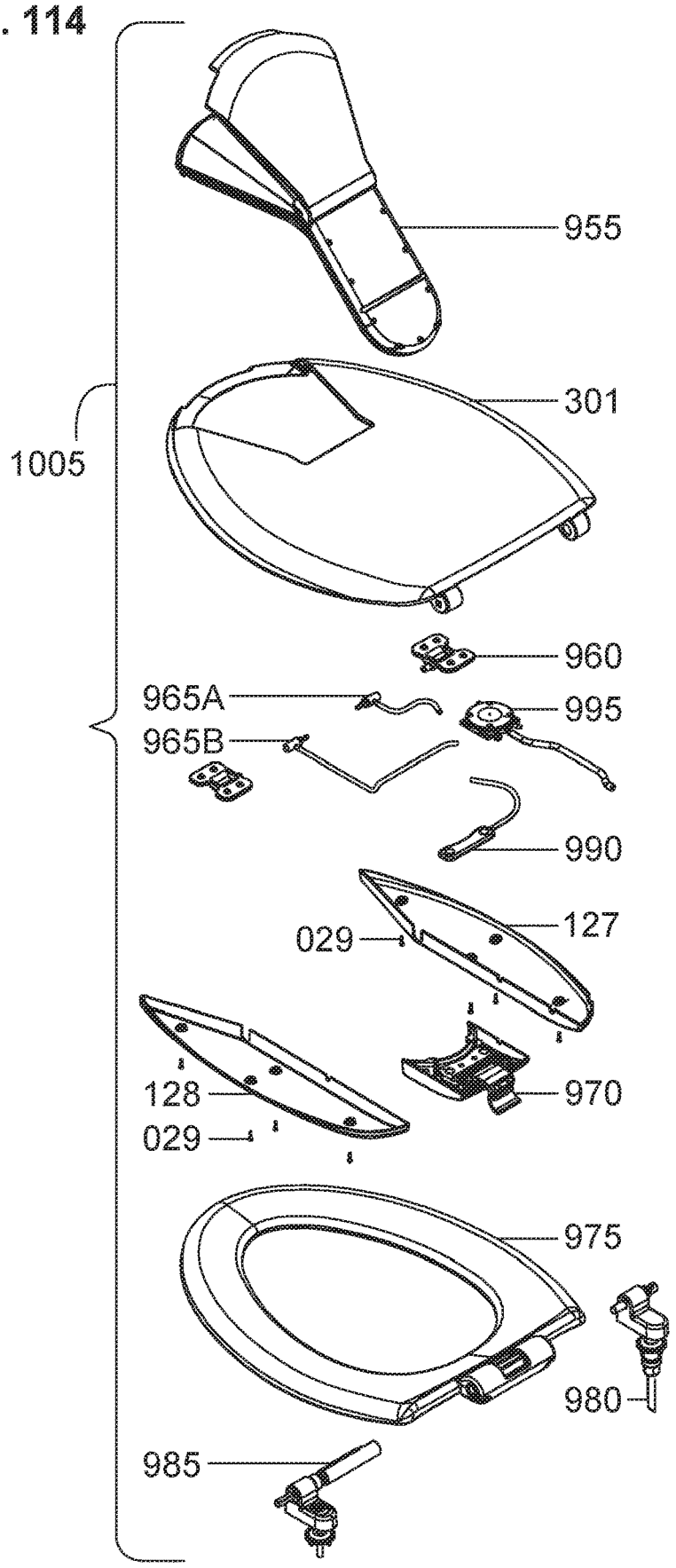

FIG. 114 is a perspective view of the components and assemblies comprising embodiment (master assembly 1005), relatively positioned in an exploded state.

Figure 115:
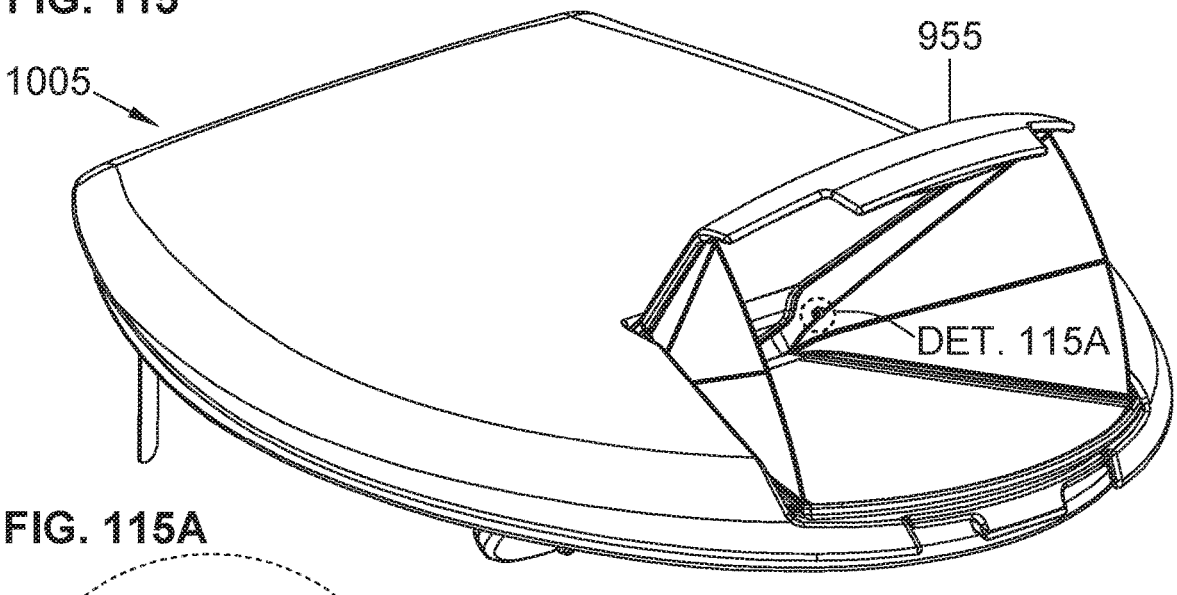

FIG. 115 is a perspective view of embodiment 5 (master assembly 1005), with fixed wet cartridge 955 in an open position.

Figure 115A:
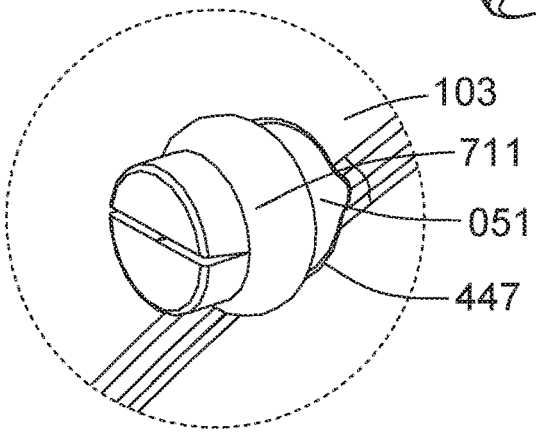

FIG. 115A is a detail view of embodiment 5 (master assembly 1005), as indicated by the view window labeled DET. 115A in FIG. 115.

Figure 116:
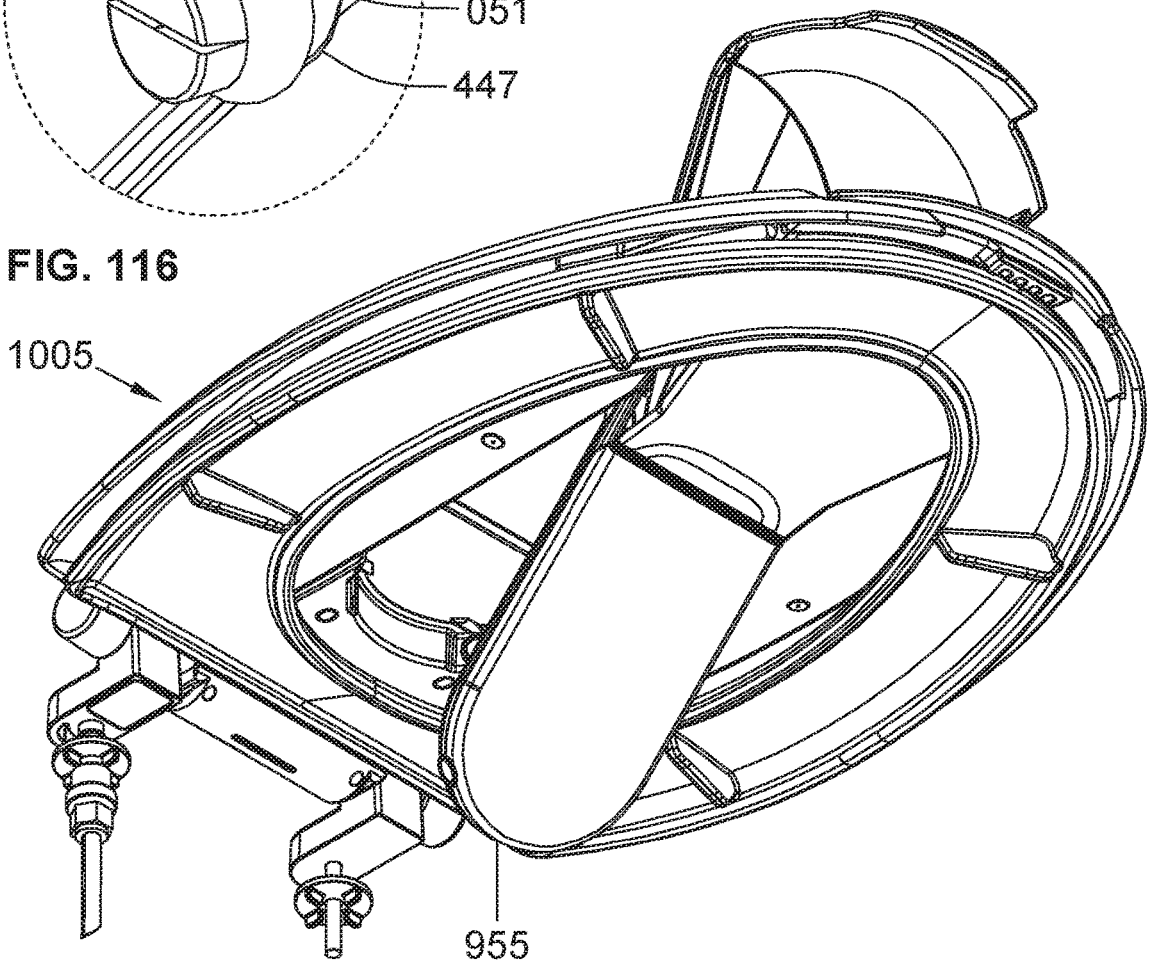

FIG. 116 is an additional perspective view of embodiment 5 (master assembly 1005), with fixed wet cartridge 955 in an open position.

Figure 117:
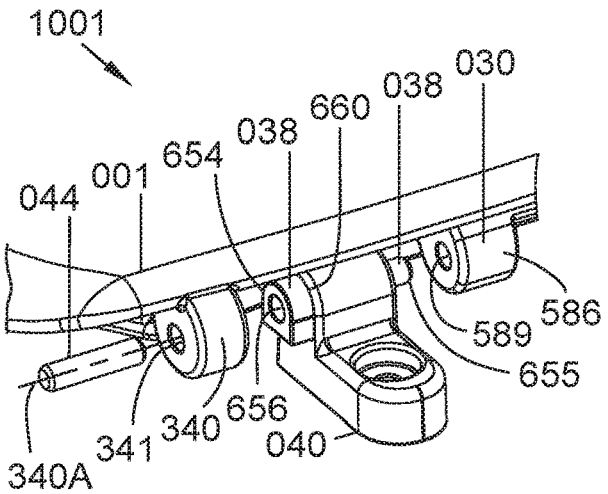

FIG. 117 is a perspective view of components of embodiment 1 (master assembly 1001) associated with the right side of the assembly hinge pivot system, in a partially exploded state.

Figure 118:
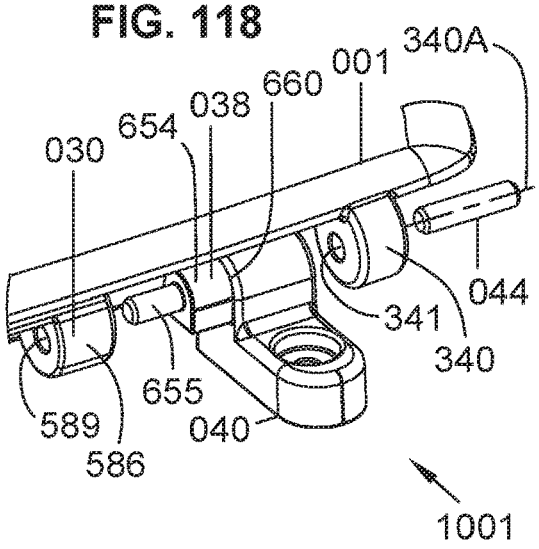

FIG. 118 is a perspective view of components of embodiment 1 (master assembly 1001) associated with the left side of the assembly hinge pivot system, in a partially exploded state.

Figure 119:
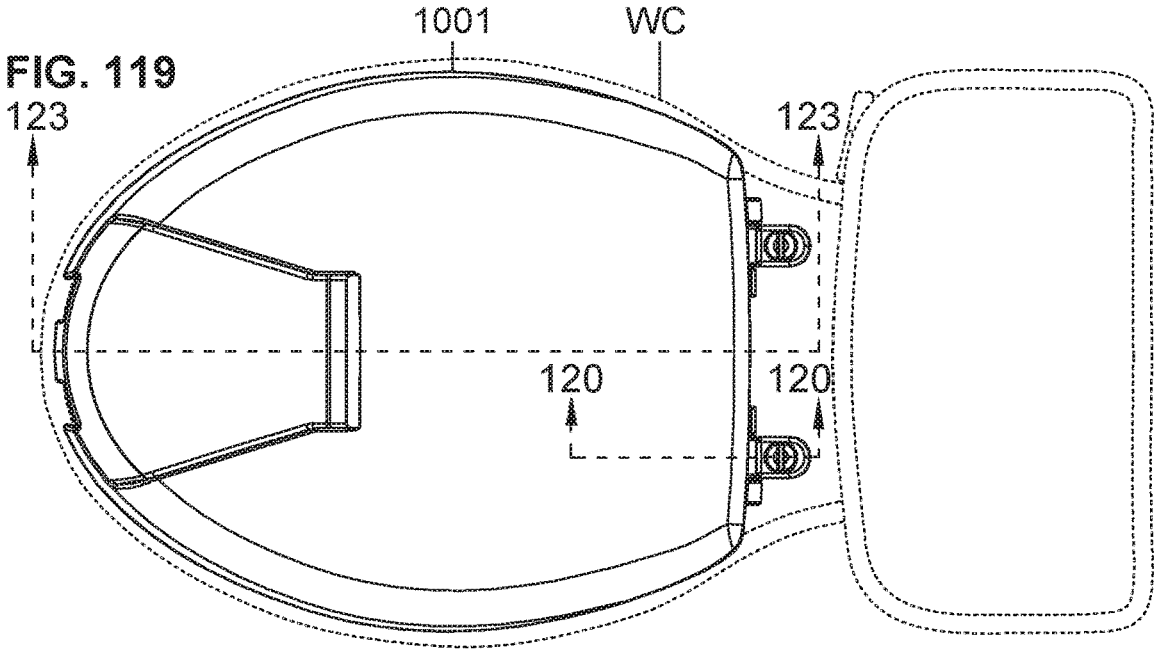

FIG. 119 is a top plan view of embodiment 1 (master assembly 1001) installed on a fixed water closet (WC) for use.

Figure 120:
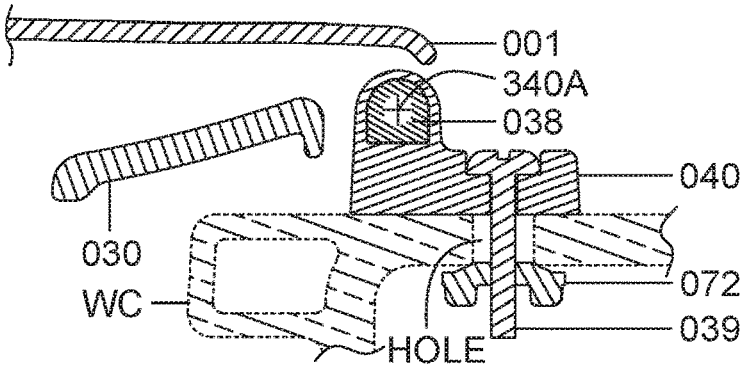

FIG. 120 is a localized section view taken through section line 120 in FIG. 119, passing through components of embodiment 1 (master assembly 1001) associated with the right side of the assembly hinge pivot system.

Figure 121:
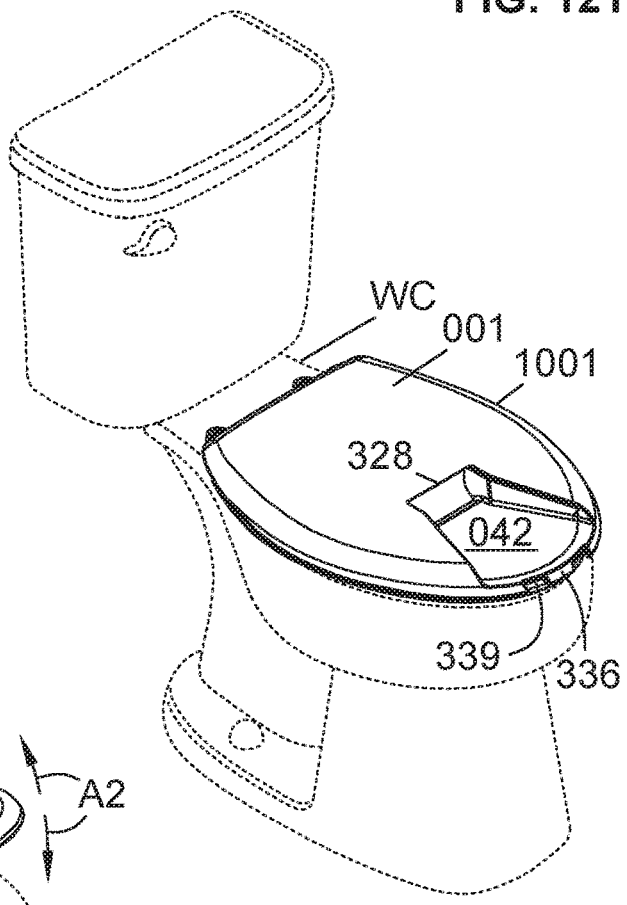

FIG. 121 is a perspective view of embodiment 1 (master assembly 1001) mounted on a water closet (WC) for use, with modified WC lid 001 in its closed and stored position.

Figure 122:
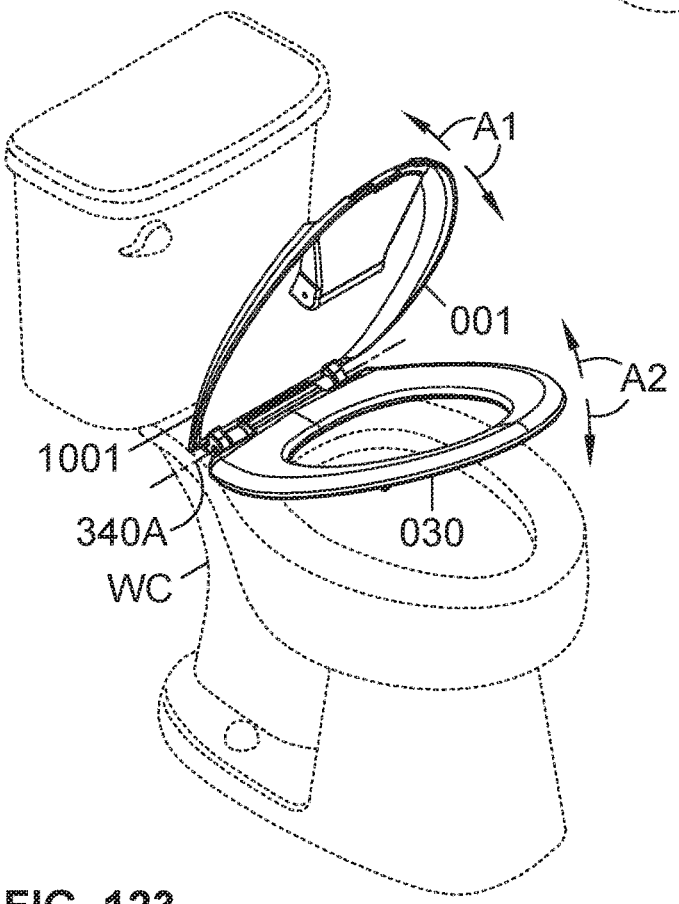

FIG. 122 is a perspective view of embodiment 1 (master assembly 1001) mounted on a water closet (WC) for use, with modified WC lid 001 and modified WC seat 030 rotated to partially open positions.

Figure 123:
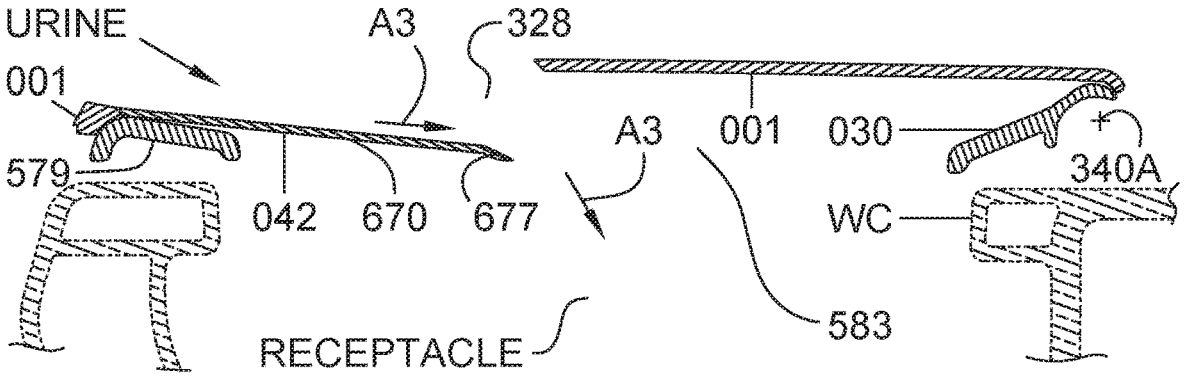

FIG. 123 is a section view passing through components of embodiment 1 (master assembly 1001) and the water closet (WC) of FIG. 119, taken through section line 123 in FIG. 119.

Figure 124A:
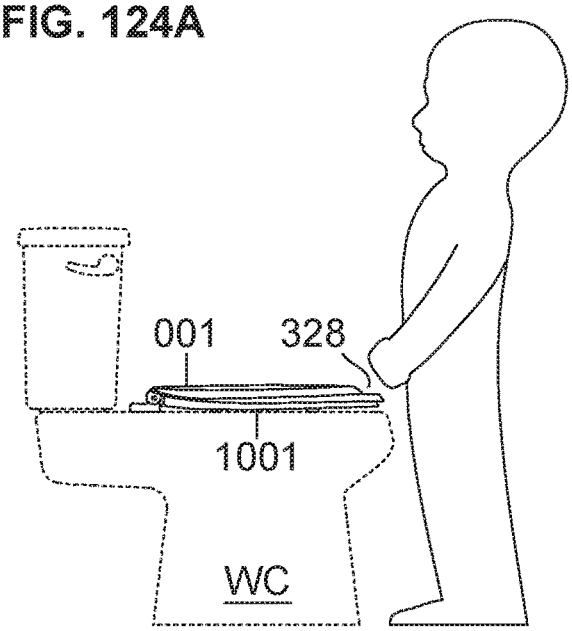

FIG. 124A is a side view of a short user urinating in embodiment 1 (master assembly 1001) mounted to a water closet (WC).

Figure 124B:
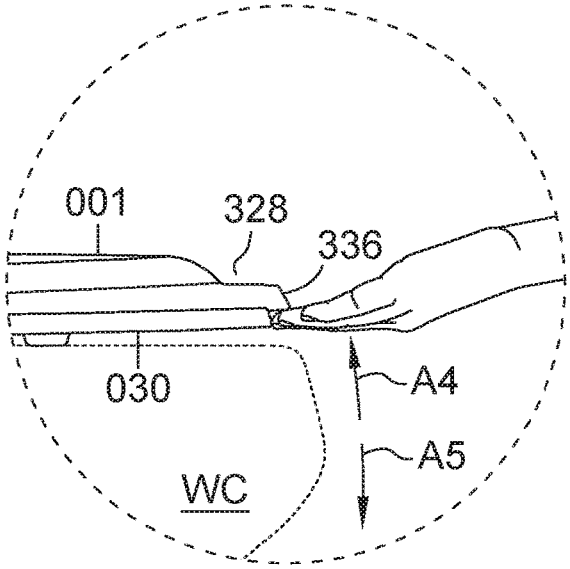

FIG. 124B represents a localized side view of a user preparing to open modified WC lid 001.

Figure 124C:
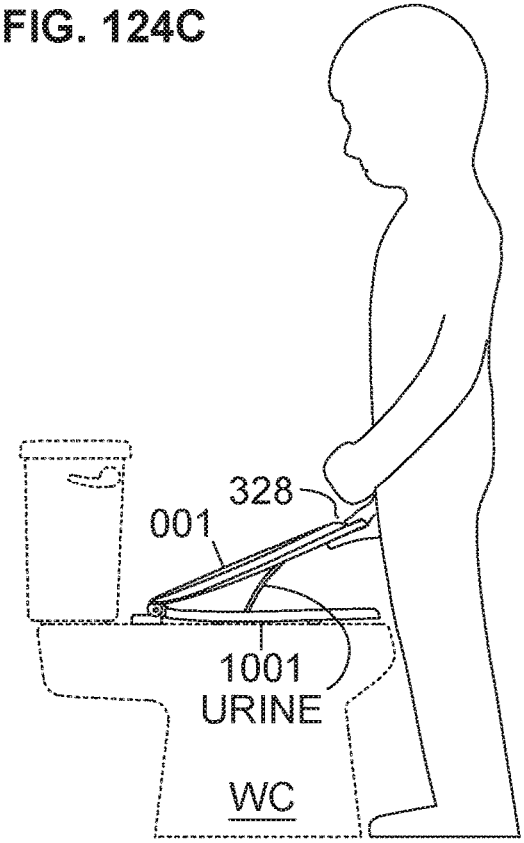

FIG. 124C is a side view of a tall user urinating in embodiment 1 (master assembly 1001) mounted to a water closet (WC).

Figure 125:
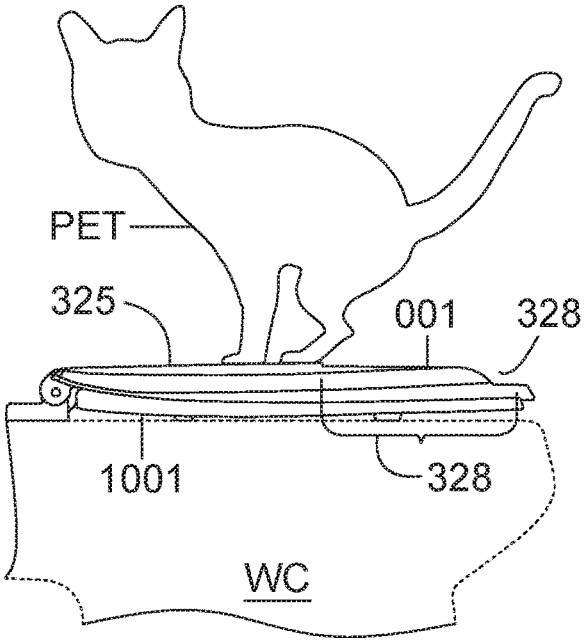

FIG. 125 represents a localized side view of a pet urinating in embodiment 1 (master assembly 1001) mounted to a water closet (WC).

Figure 126A:
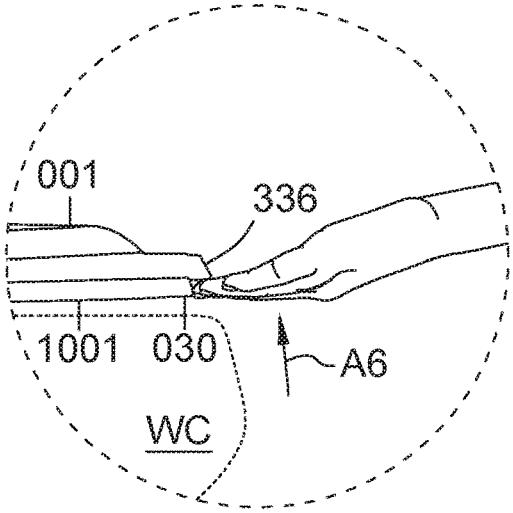

FIG. 126A represents a localized side view of a user preparing to open modified WC lid 001.

Figure 126B:
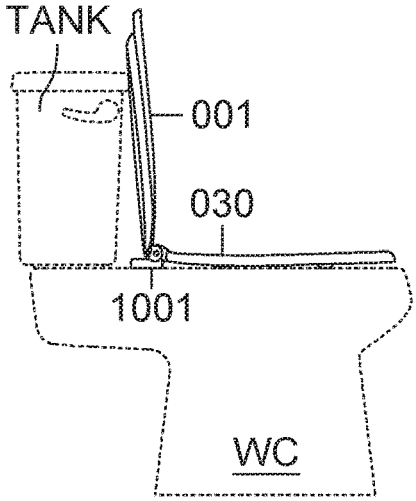

FIG. 126B is a side view of embodiment 1 (master assembly 1001) mounted to a water closet (WC), with modified WC lid 001 open for seated use of the current invention.

Figure 126C:
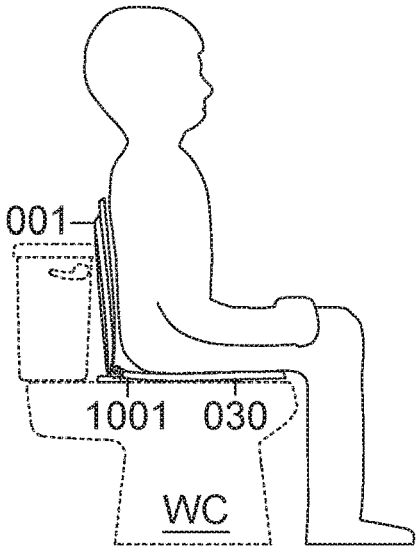

FIG. 126C is a side view of a user employing embodiment 1 (master assembly 1001) on a water closet (WC), for seated use.

Figure 126D:
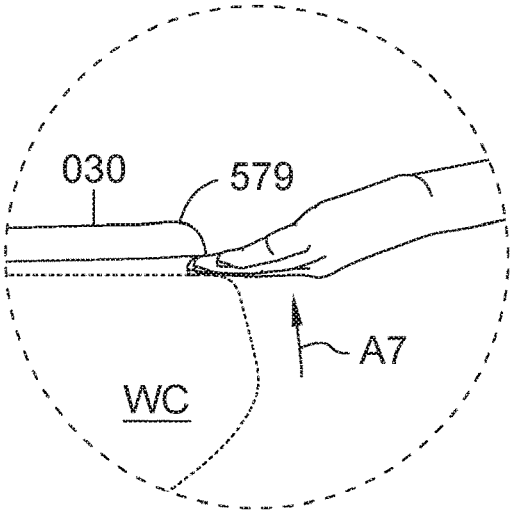

FIG. 126D represents a localized side view of a user preparing to open modified WC seat 030.

Figure 126E:
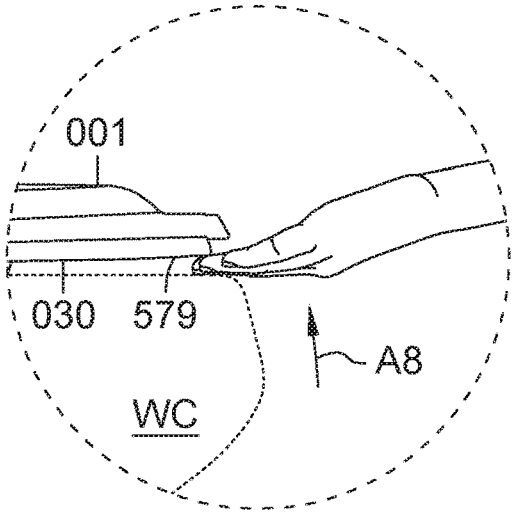

FIG. 126E represents a localized side view of a user preparing to open modified WC lid 001 and modified WC seat 030.

Figure 126F:
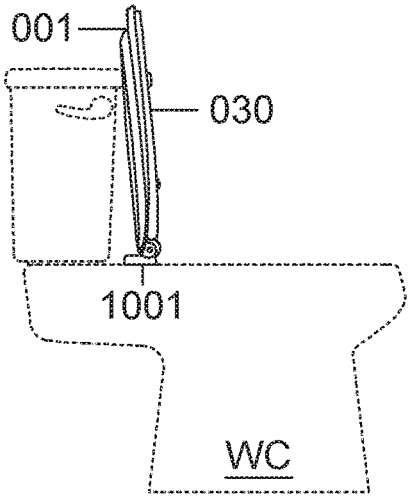

FIG. 126F is a side view of embodiment 1 (master assembly 1001) on a water closet (WC), with modified WC lid 001 and modified WC seat 030 open for water closet cleaning.

Figure 127:
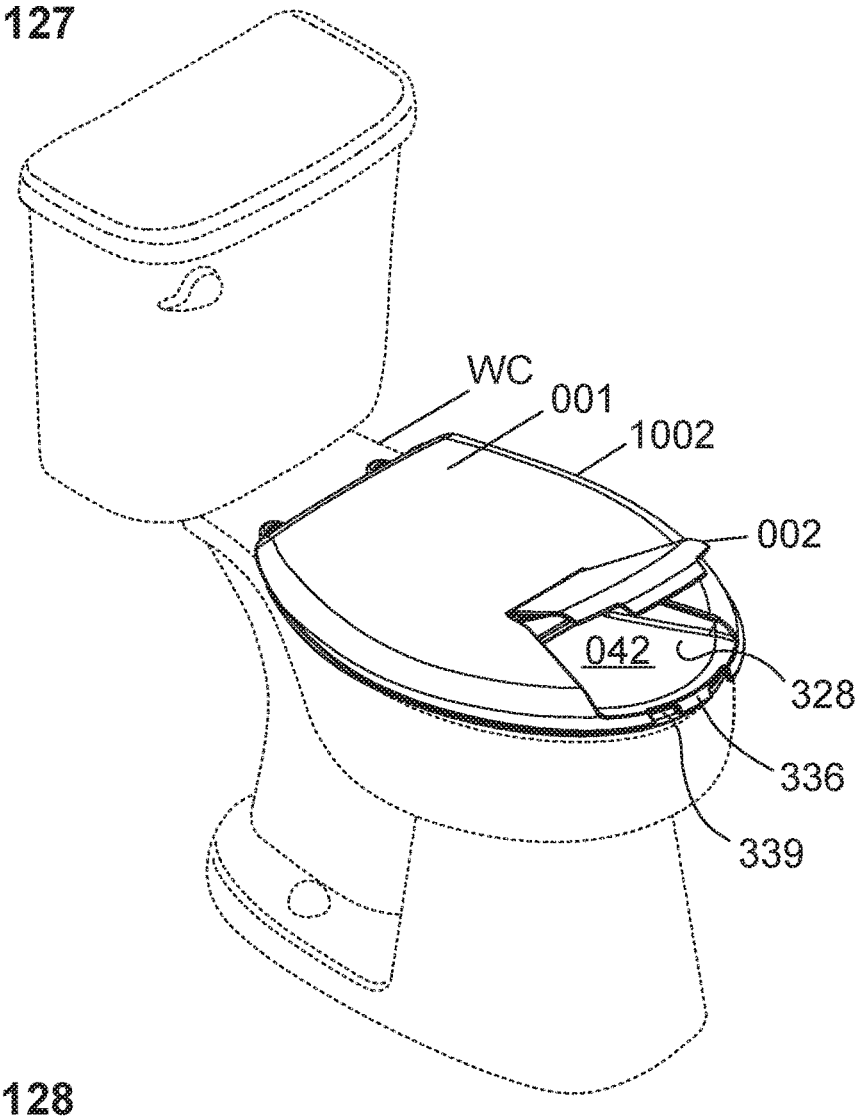

FIG. 127 is a perspective view of embodiment 2 (master assembly 1002) mounted on a water closet (WC) for use, with receptacle lid and funnel 002 in its open position.

Figure 128:
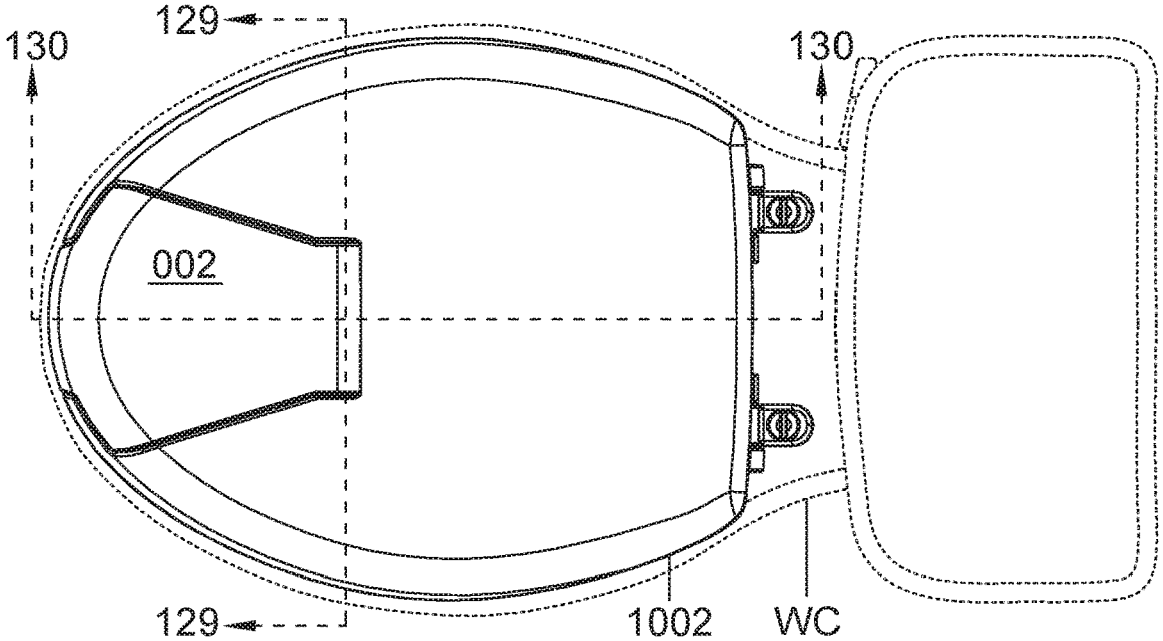

FIG. 128 is a top plan view of embodiment 2 (master assembly 1002) installed on a water closet (WC) for use.

Figure 129:
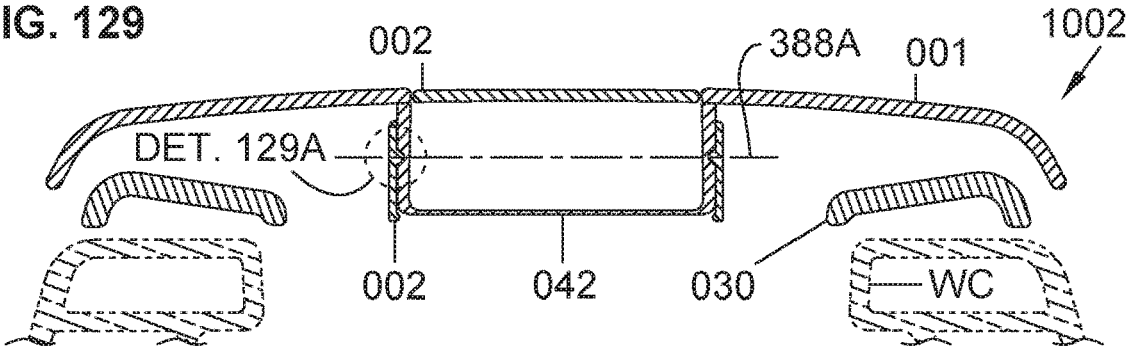

FIG. 129 is a section view passing through components of embodiment 2 (master assembly 1002) and the water closet (WC) of FIG. 128, taken through section line 129 in FIG. 128.

Figure 129A:
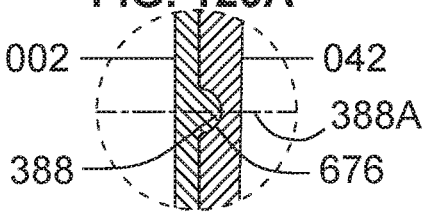

FIG. 129A is a detail view from FIG. 129, as indicated by the view window labeled DET. 129A.

Figure 130:
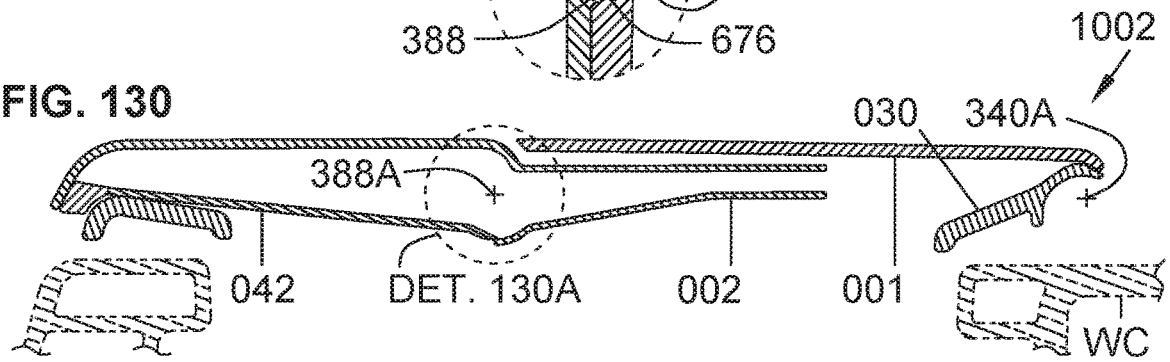

FIG. 130 is a section view passing through components of embodiment 2 (master assembly 1002) and the water closet (WC) of FIG. 128, taken through section line 130 in FIG. 128.

Figure 130A:
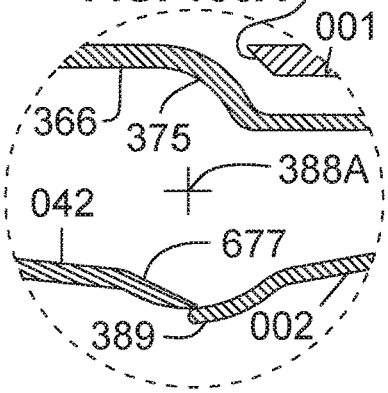

FIG. 130A is a detail view from FIG. 130, as indicated by the view window labeled DET. 130A.

Figure 131A:
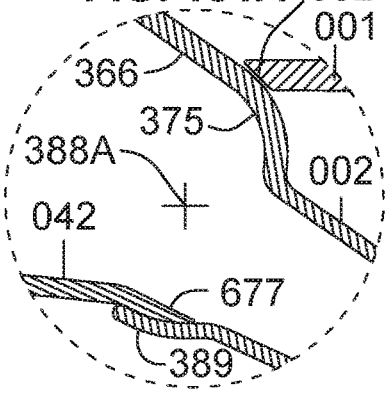
Figure 131:
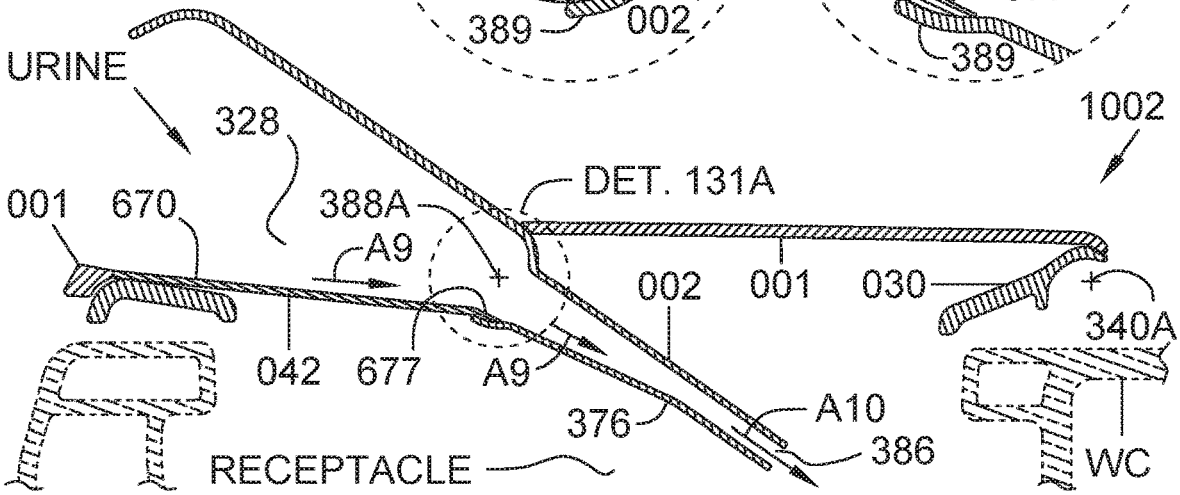

FIG. 131 is a progression from the section view of FIG. 130, after receptacle lid and funnel 002 has been rotated to its open position.

FIG. 131A is a detail view from FIG. 131, as indicated by the view window labeled DET. 131A.

Figure 132A:
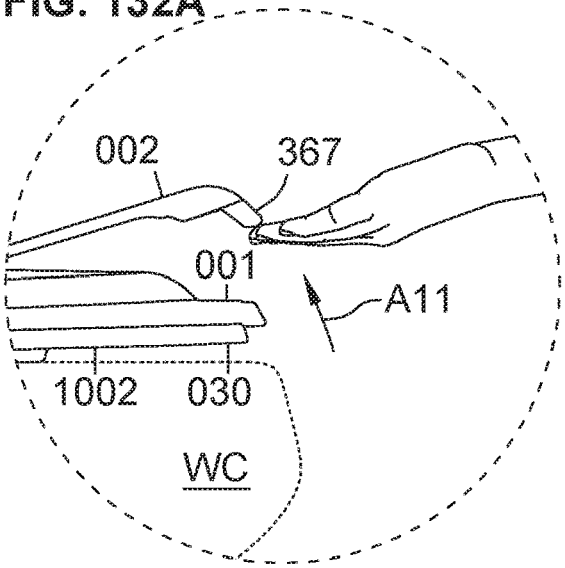

FIG. 132A represents a localized side view of a user opening receptacle lid and funnel 002, of embodiment 2 (master assembly 1002).

Figure 132B:
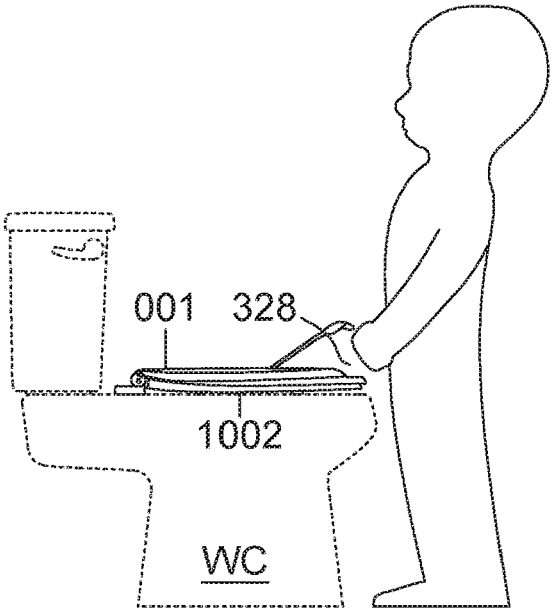

FIG. 132B is a side view of a short user urinating in embodiment 2 (master assembly 1002) mounted to a water closet (WC).

Figure 132C:
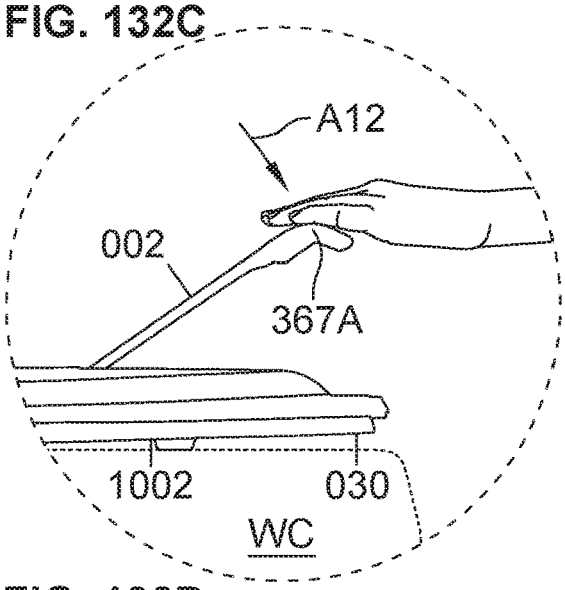

FIG. 132C represents a localized side view of a user preparing to close receptacle lid and funnel 002.

Figure 132D:
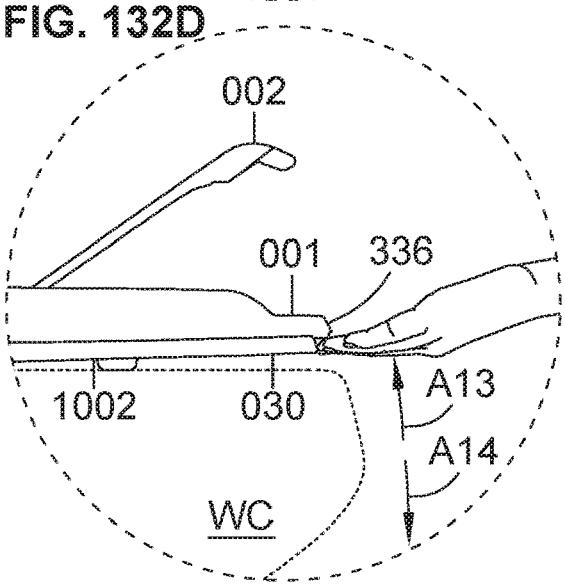

FIG. 132D represents a localized side view of a user preparing to open modified WC lid 001.

Figure 132E:
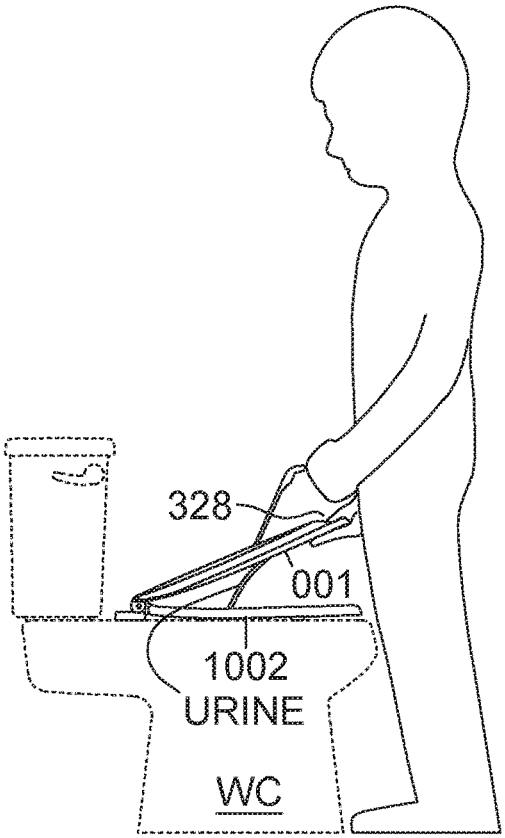

FIG. 132E is a side view of a tall user urinating in embodiment 2 (master assembly 1002), while holding modified WC lid 001 partially open.

Figure 133A:
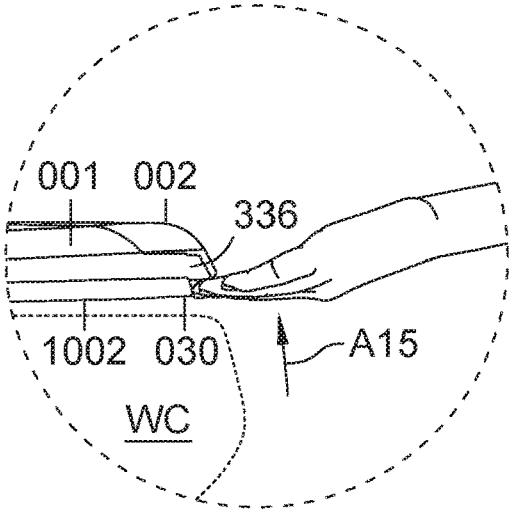

FIG. 133A represents a localized side view of a user preparing to open modified WC lid 001, of embodiment 2 (master assembly 1002).

Figure 133B:
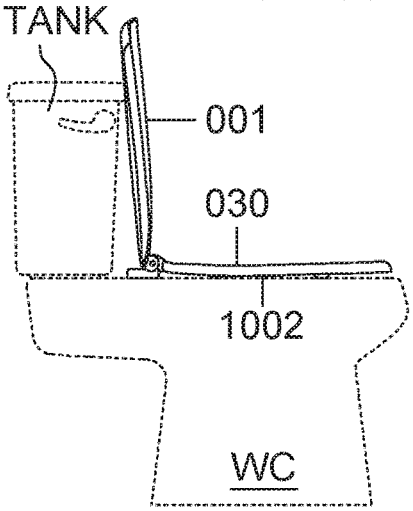

FIG. 133B is a side view of embodiment 2 (master assembly 1002) mounted to a water closet (WC), with modified WC lid 001 open for seated use of the current invention.

Figure 133C:
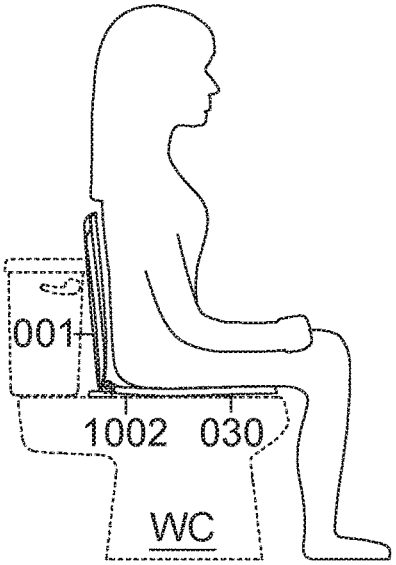

FIG. 133C is a side view of a user employing embodiment 2 (master assembly 1002) on a water closet (WC), for seated use.

Figure 133D:
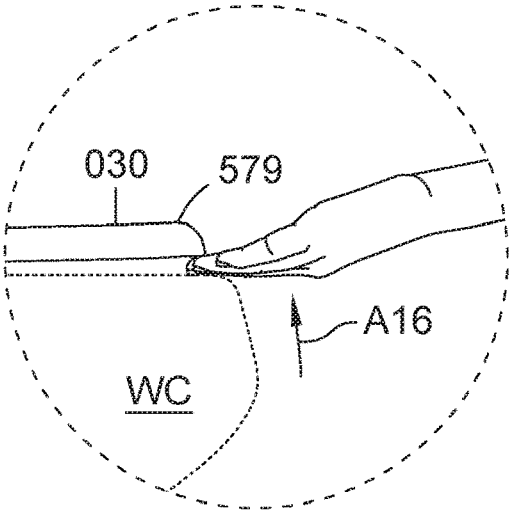

FIG. 133D represents a localized side view of a user preparing to open modified WC seat 030.

Figure 133E:
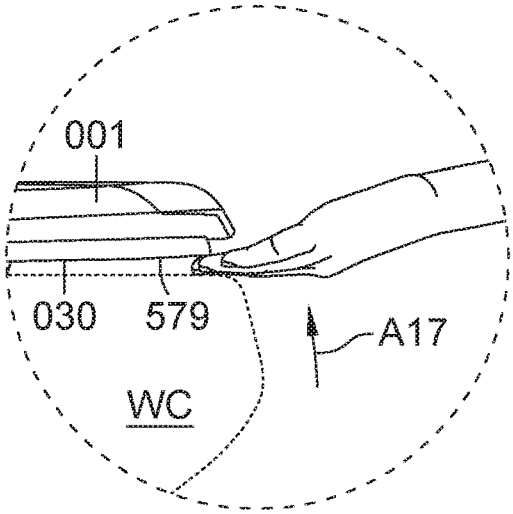

FIG. 133E represents a localized side view of a user preparing to open modified WC lid 001 and modified WC seat 030.

Figure 133F:
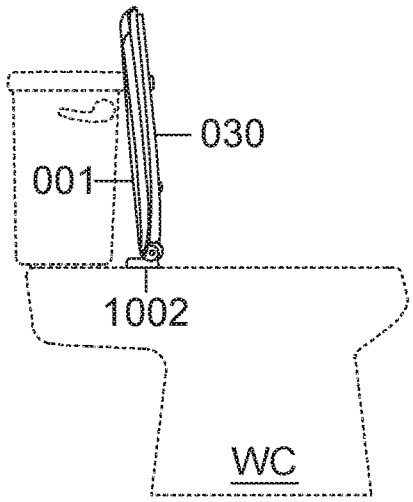

FIG. 133F is a side view of embodiment 2 (master assembly 1002) on a water closet (WC), with modified WC lid 001 and modified WC seat 030 open for water closet cleaning.

Figure 134:
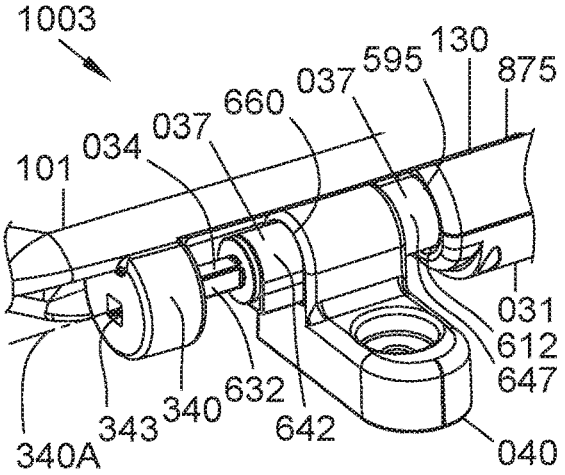

FIG. 134 is a perspective view of components of embodiment 3 (master assembly 1003) associated with the right side of the assembly hinge pivot system, in a partially exploded state.

Figure 135:
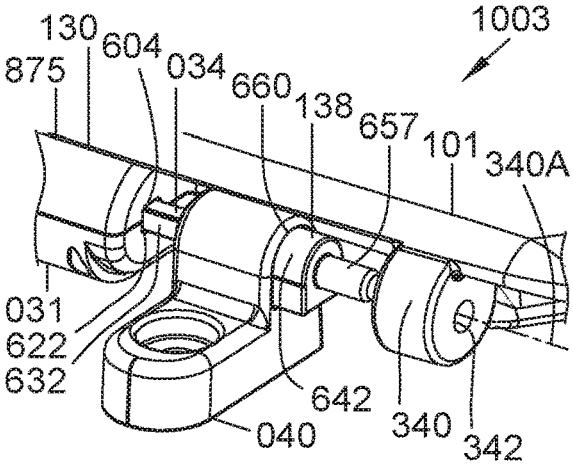

FIG. 135 is a perspective view of components of embodiment 3 (master assembly 1003) associated with the left side of the assembly hinge pivot system, in a partially exploded state.

Figure 136:
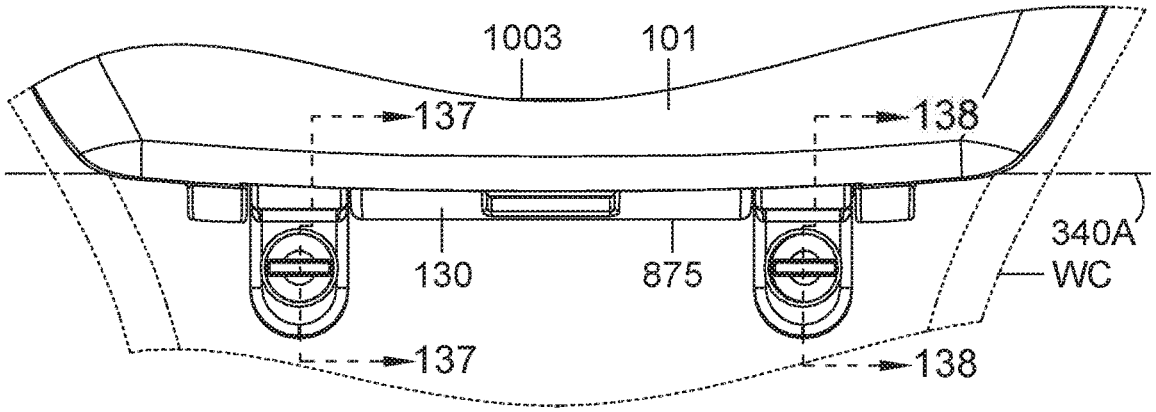

FIG. 136 is a cutaway top plan view of embodiment 3 (master assembly 1003) installed on a fixed water closet (WC) for use.

Figure 137:
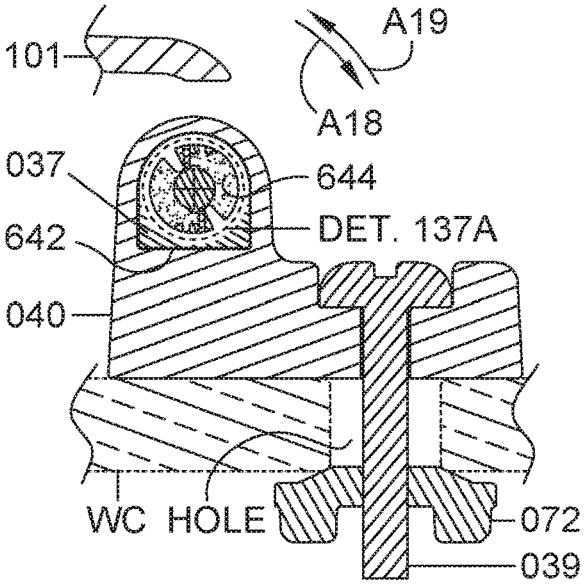
Figure 138:
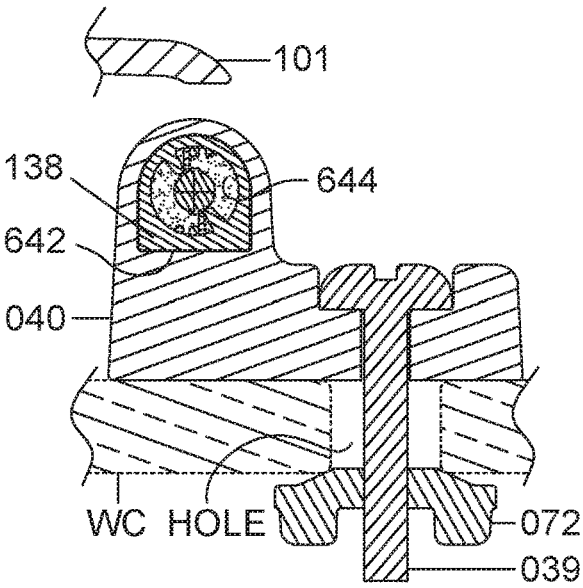

FIG. 137 is a localized section view taken through the jogged section line 137 in FIG. 136, passing through components of embodiment 3 (master assembly 1003) associated with the right side of the assembly hinge pivot system. (FIG. 138 is addressed below.)

Figure 137A:
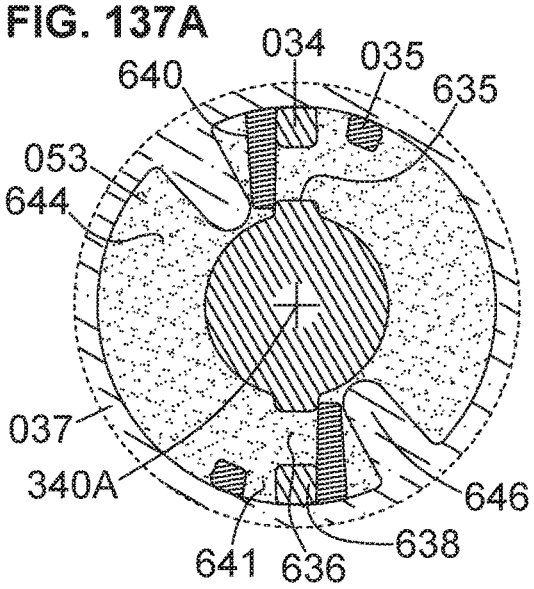

FIG. 137A is a detail section view of assembly hinge pivot system components, as indicated by the view window labeled DET. 137A in FIG. 137.

Figure 137B:
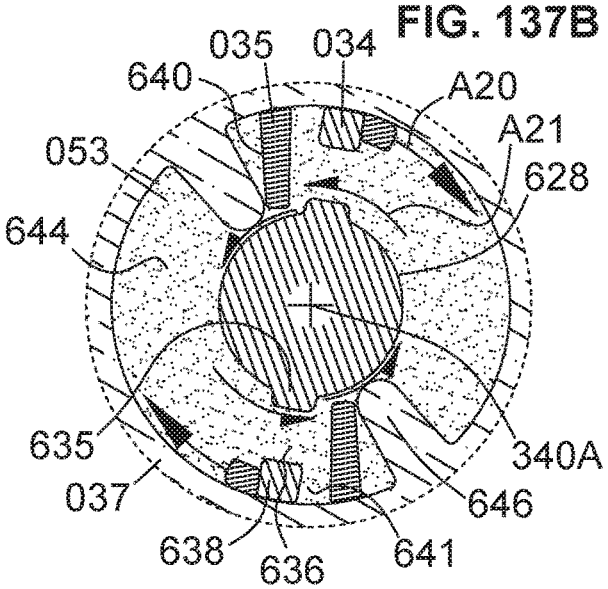

FIG. 137B is a progression from the detail section view of FIG. 137A, after hinge shaft 034 has been rotated clockwise.

Figure 137C:
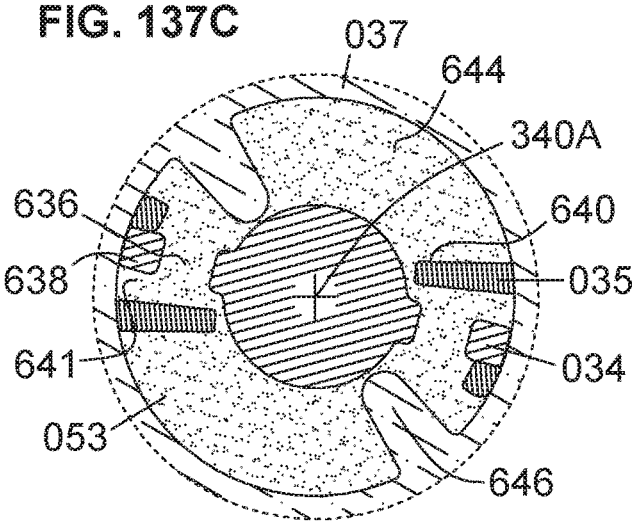

FIG. 137C is a progression from the detail section view of FIG. 137B, after hinge shaft 034 and wiper seals 035 have been rotated clockwise.

Figure 137D:
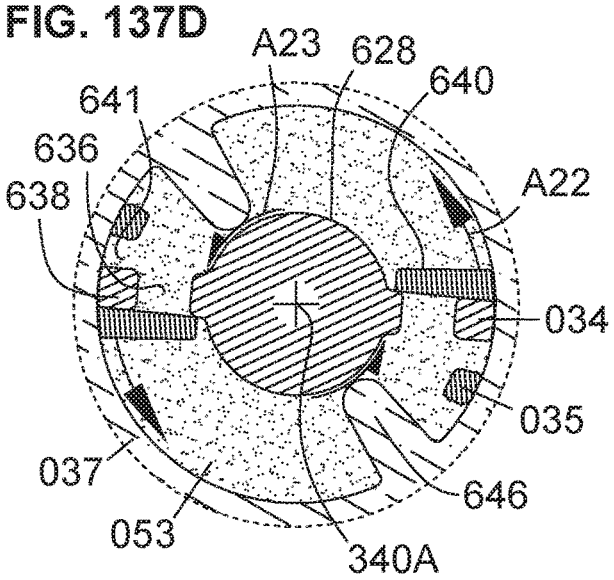

FIG. 137D is a progression from the detail section view of FIG. 137C, after hinge shaft 034 has been rotated counterclockwise.

Figure 137E:
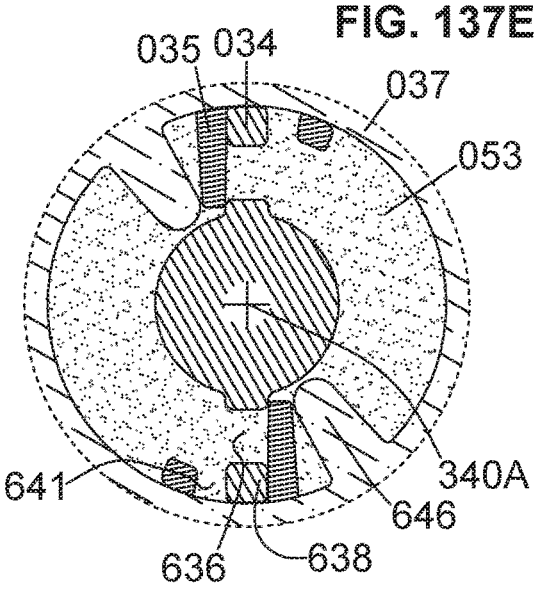

FIG. 137E is a progression from the detail section view of FIG. 137D, after hinge shaft 034 and wiper seals 035 have been rotated counterclockwise.

FIG. 138 (Similar to, and located next to FIG. 137) is a localized section view taken through the jogged section line 138 in FIG. 136, passing through components of embodiment 3 (master assembly 1003) associated with the left side of the assembly hinge pivot system.

Figure 139:
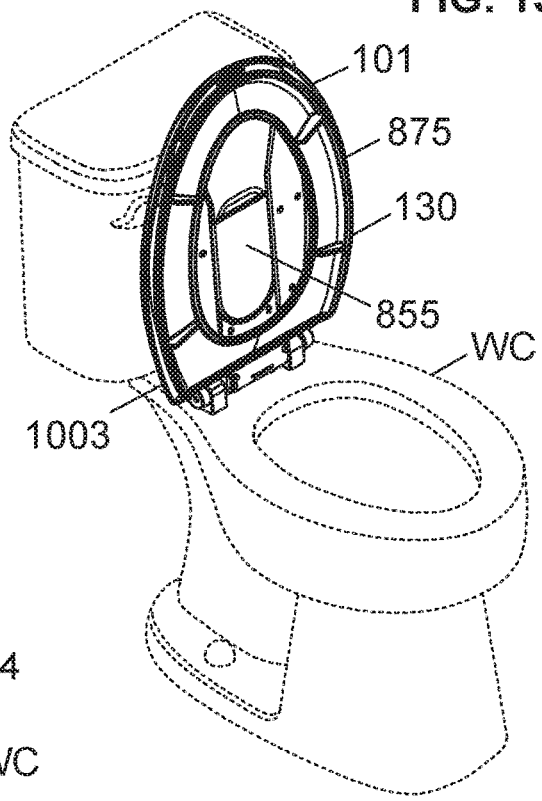

FIG. 139 is a perspective view of embodiment 3 (master assembly 1003) mounted on a water closet (WC) for use, with modified WC lid 101 and dry seat assembly 875 both in fully open positions.

Figure 140:
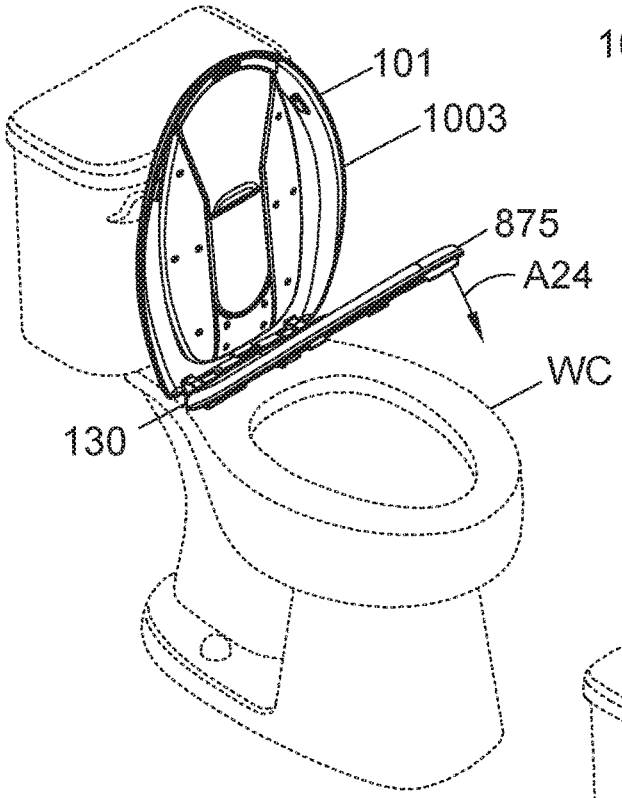

FIG. 140 is a perspective view of embodiment 3 (master assembly 1003) mounted on a water closet (WC) for use, with modified WC lid 101 in its fully open position, as dry seat assembly 875 rotates closed.

Figure 141:
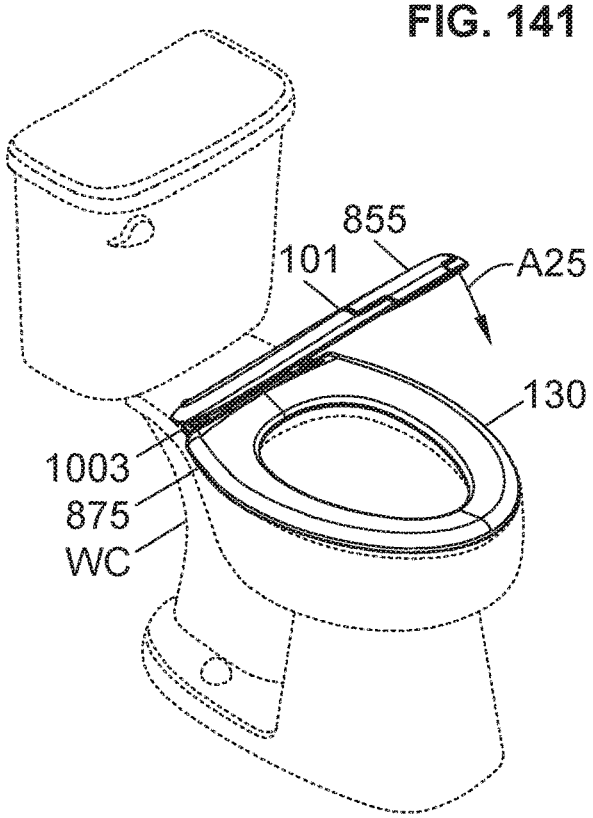

FIG. 141 is a perspective view of embodiment 3 (master assembly 1003) mounted on a water closet (WC) for use, with dry seat assembly 875 in its closed position, as modified WC lid 101 rotates closed.

Figure 142:
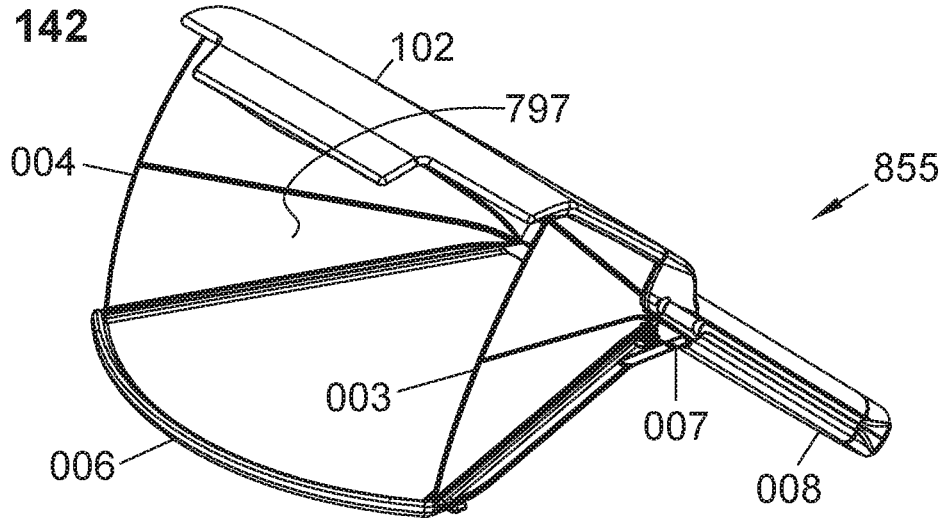

FIG. 142 is a perspective view of removable dry cartridge 855 in its fully open (expanded) state.

Figure 143:
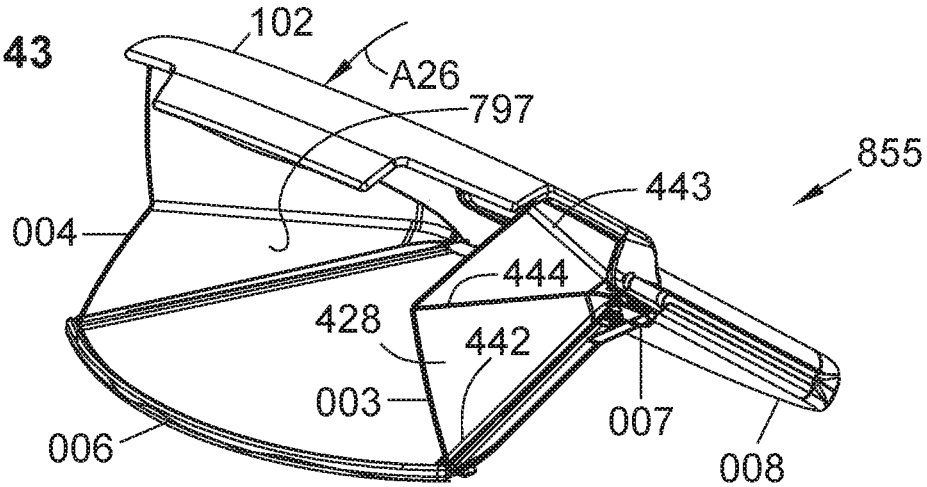

FIG. 143 is a perspective view of removable dry cartridge 855 in a partially open state.

Figure 144:
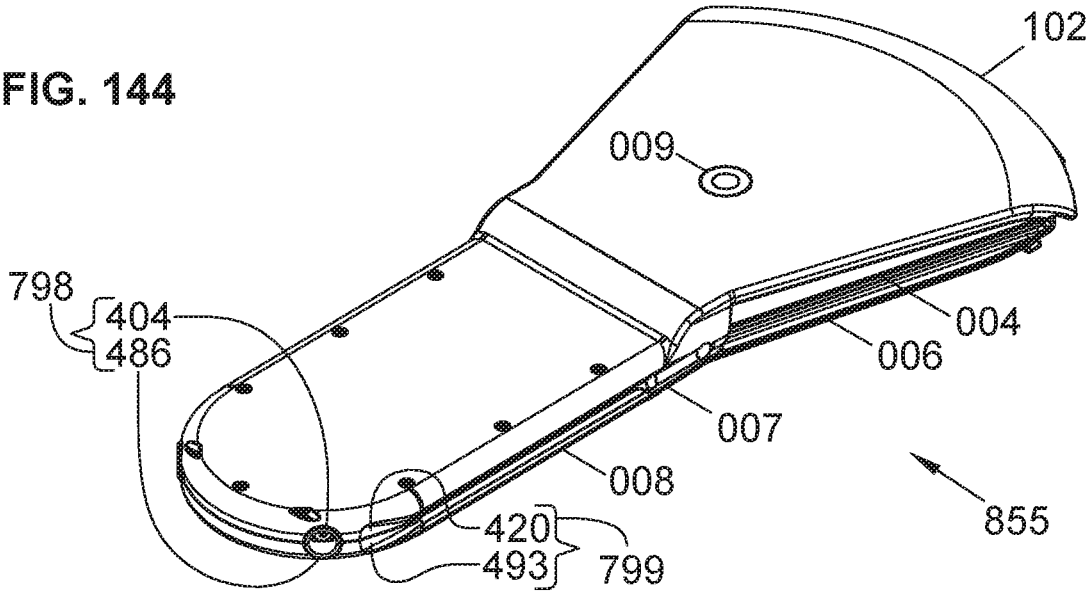

FIG. 144 is a perspective view of removable dry cartridge 855 in its fully closed (collapsed) state.

Figure 145:
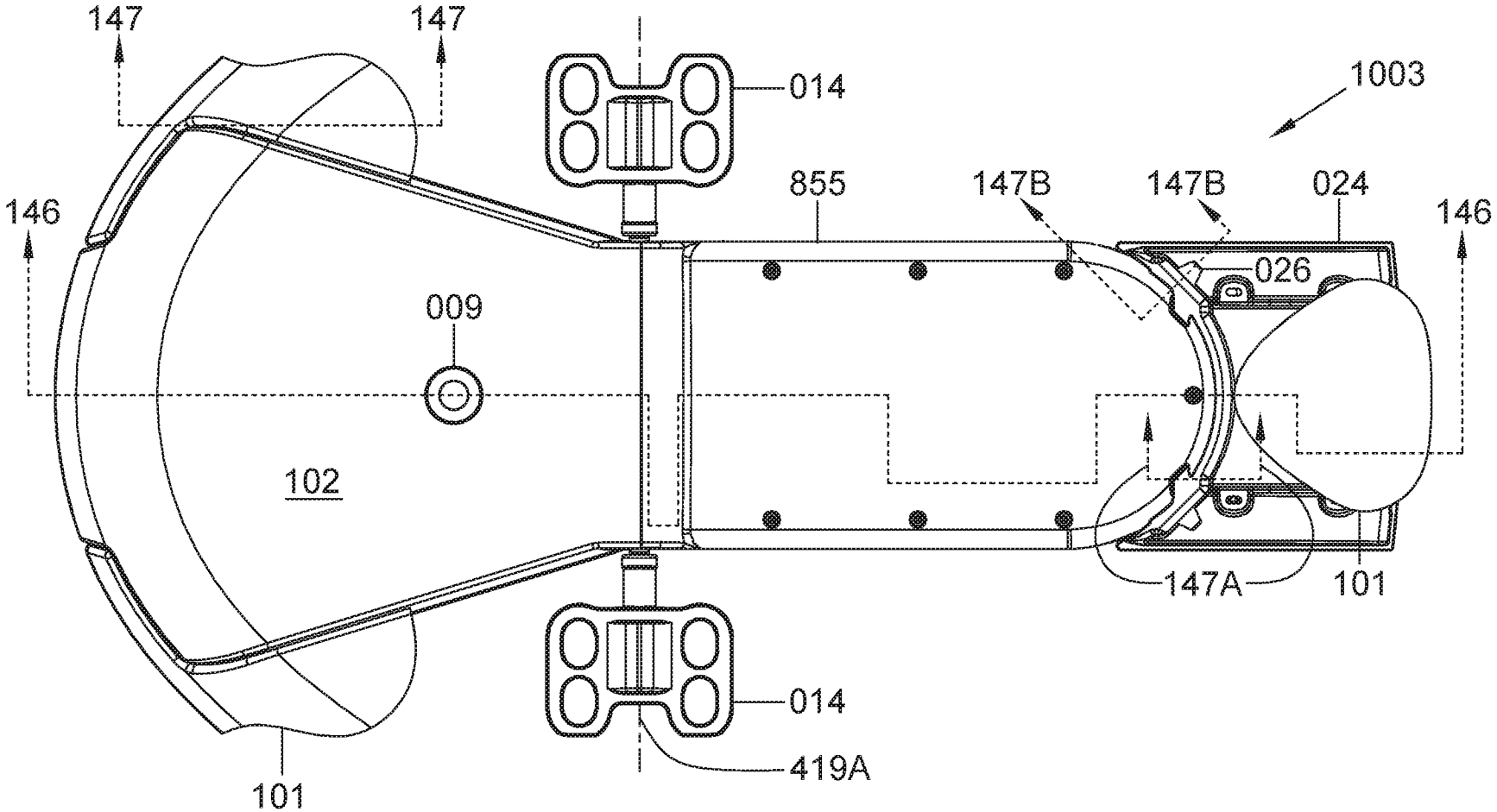

FIG. 145 is a cutaway top plan view of embodiment 3 (master assembly 1003), including components of master assembly 1003 critical to the collapsible cartridge system.

Figure 146:
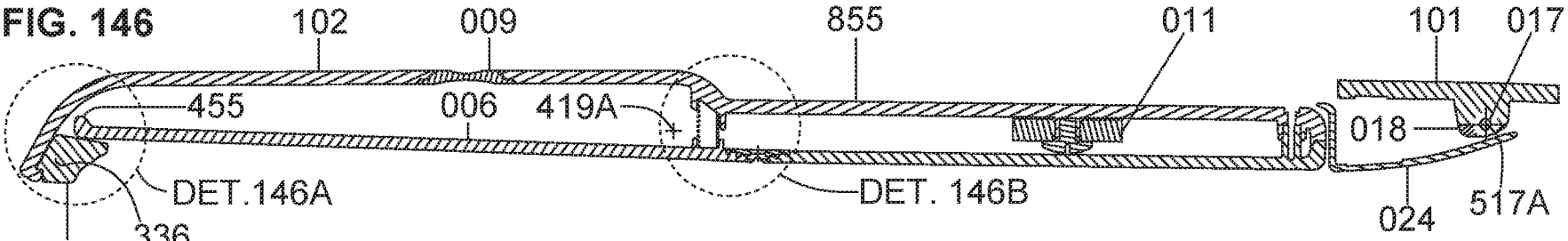

FIG. 146 is a section view passing through components of embodiment 3 (master assembly 1003), taken through the jogged section line 146 in FIG. 145.

Figure 146B:
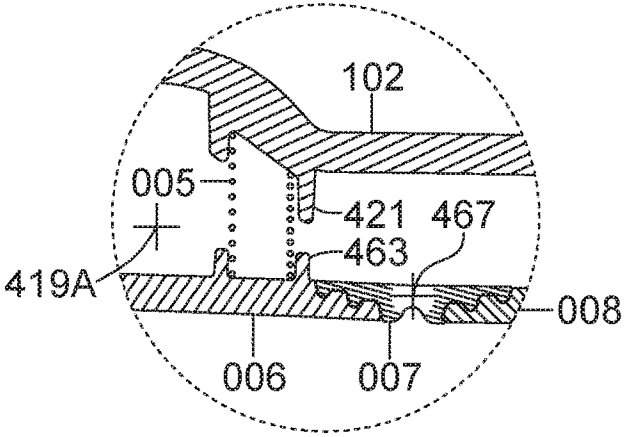
Figure 146A:
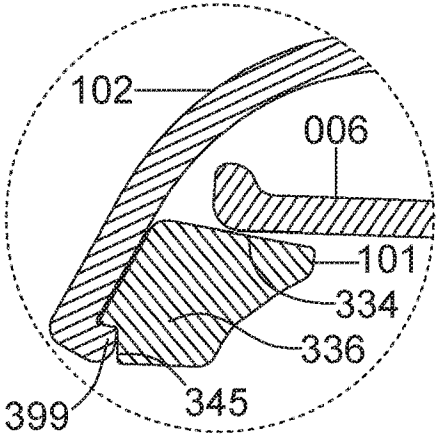

FIG. 146A is a detail view from FIG. 146, as indicated by the view window labeled DET. 146A.

FIG. 146B is a detail view from FIG. 146, as indicated by the view window labeled DET. 146B.

Figure 147B:
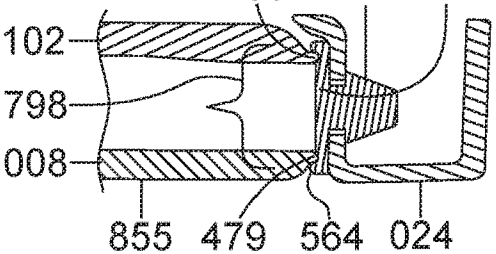
Figure 147A:
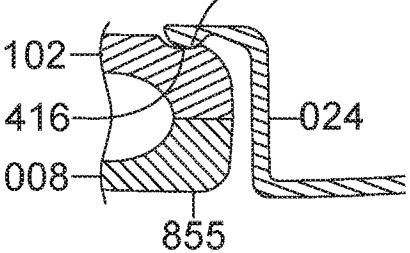
Figure 147:
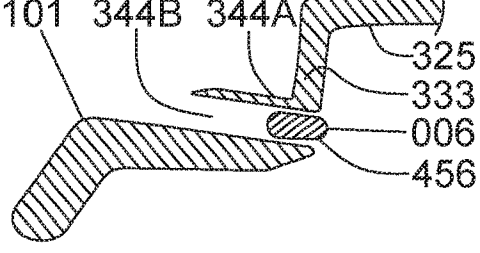

FIG. 147 is a section view passing through components of embodiment 3 (master assembly 1003), taken through section line 147 in FIG. 145, illustrating the relationship between the sectioned components.

FIG. 147A is a section view passing through components of embodiment 3 (master assembly 1003), taken through section line 147A in FIG. 145, illustrating the relationship between the sectioned components.

FIG. 147B is a section view passing through components of embodiment 3 (master assembly 1003), taken through section line 147B in FIG. 145, illustrating the relationship between the sectioned components.

Figure 148:
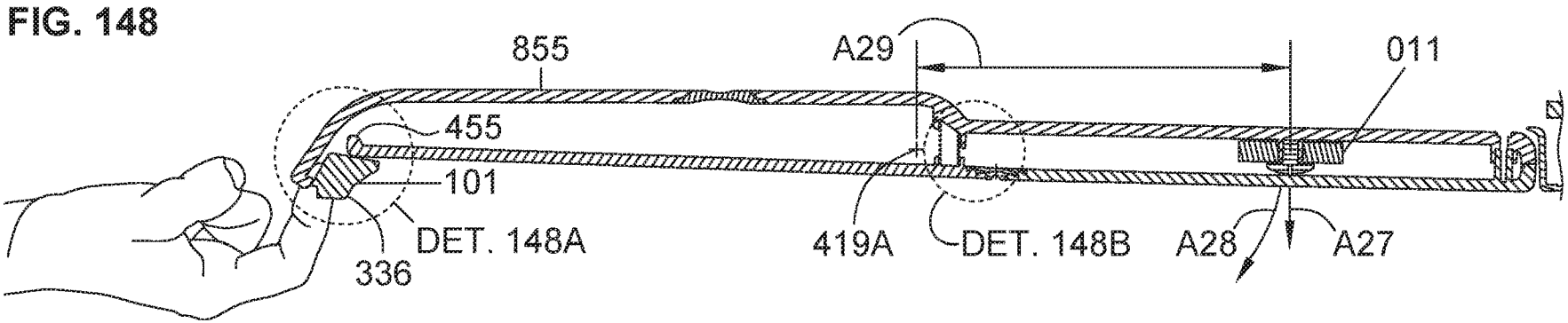

FIG. 148 is a progression from the section view of FIG. 146, as a user unlatches removable dry cartridge 855 for use.

Figure 148B:
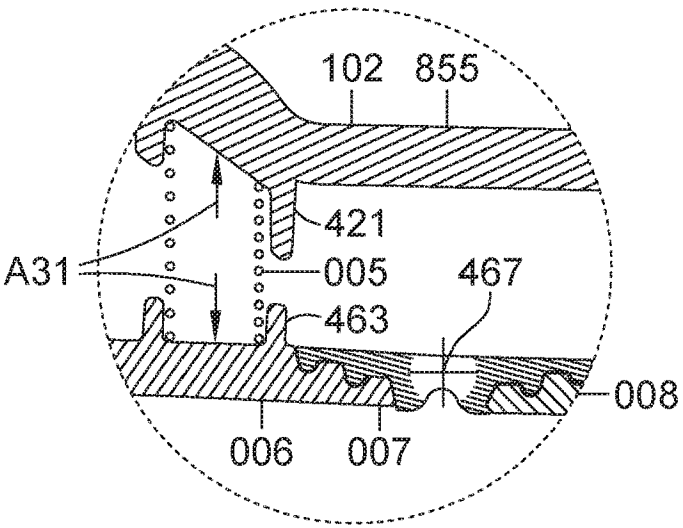
Figure 148A:
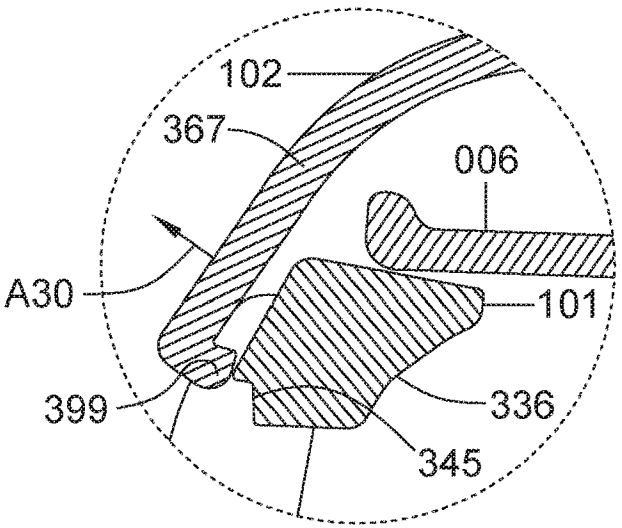

FIG. 148A is a detail view from FIG. 148, as indicated by the view window labeled DET. 148A.

FIG. 148B is a detail view from FIG. 148, as indicated by the view window labeled DET. 148B.

Figure 149B:
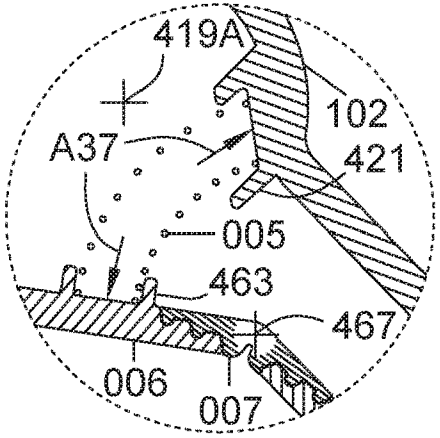
Figure 149:
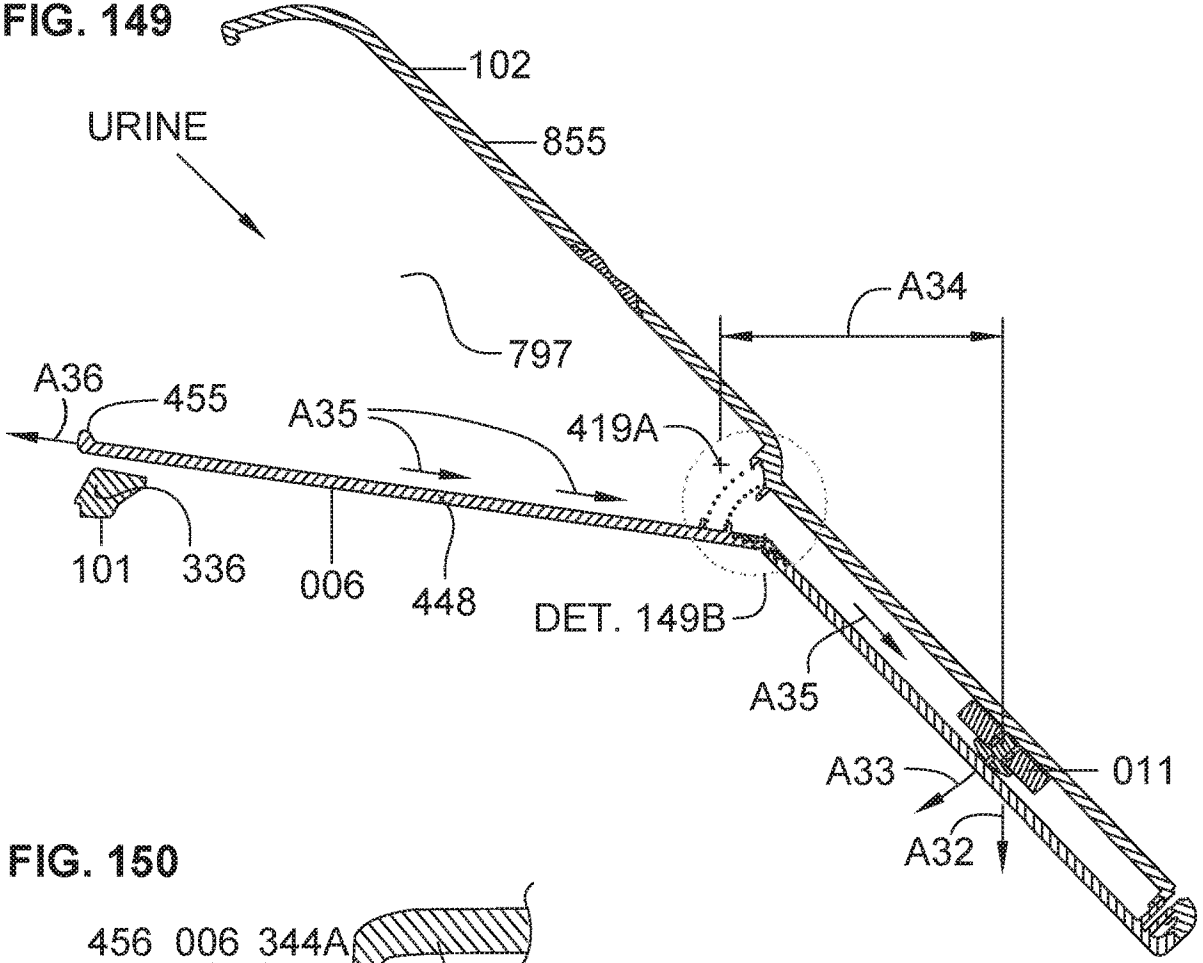

FIG. 149 is a progression from the section view of FIG. 148, after removable dry cartridge 855 has rotated open.

FIG. 149B is a detail view from FIG. 149, as indicated by the view window labeled DET. 149B. FIG. 149B also represents a progression from FIG. 146B.

Figure 150B:
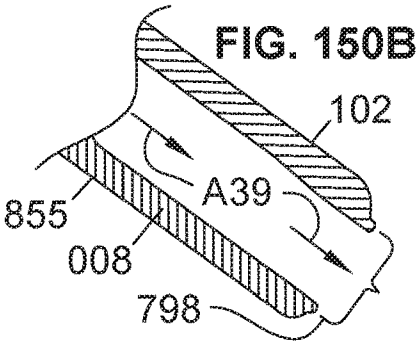
Figure 150:
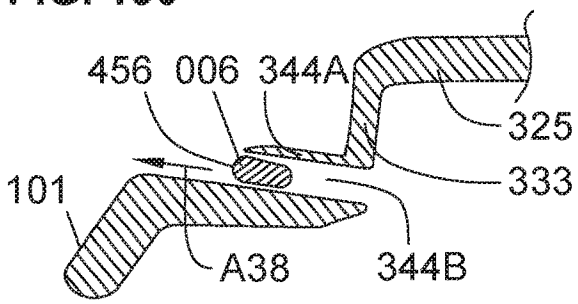

FIG. 150 is a progression from the section view of FIG. 147, consistent with the cartridge state represented in FIG. 149.

FIG. 150B is a progression from the section view of FIG. 147B, consistent with the cartridge state represented in FIG. 149.

Figures 151, 152, 152A, 152B, 153:
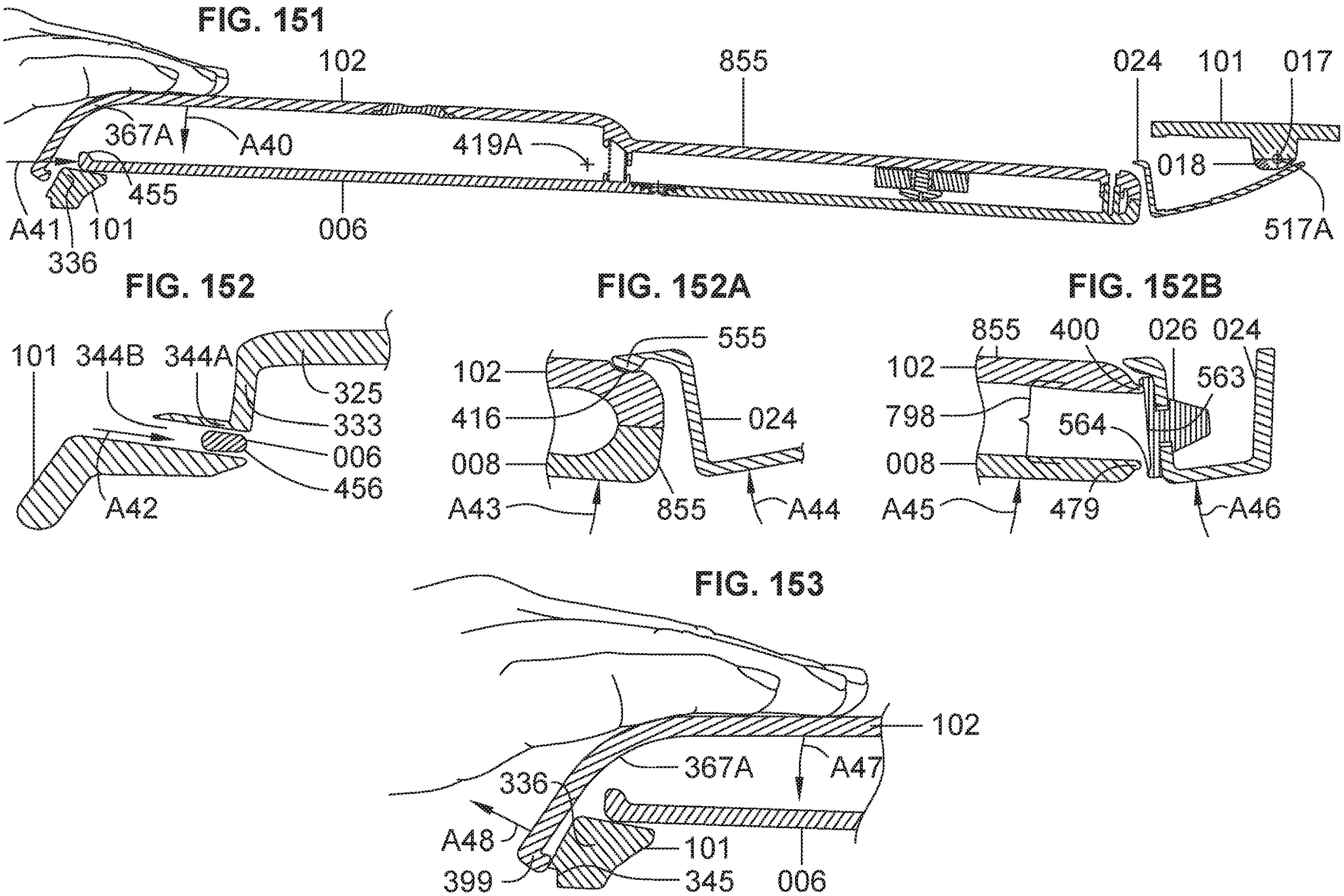

FIG. 151 is a progression from the section view of FIG. 149, as the user closes removable dry cartridge 855.

FIG. 152 is a progression from the section views of FIGS. 147 and 150, consistent with the cartridge state represented in FIG. 151.

FIG. 152A is a progression from the section view of FIG. 147A, consistent with the cartridge state represented in FIG. 151.

FIG. 152B is a progression from the section views of FIGS. 147B and 150B, consistent with the cartridge state represented in FIG. 151.

FIG. 153 is a localized view representing a detail progression from the section view of FIG. 151, as the user presses down on upper cartridge segment 102 to latch it closed.

Figure 154:
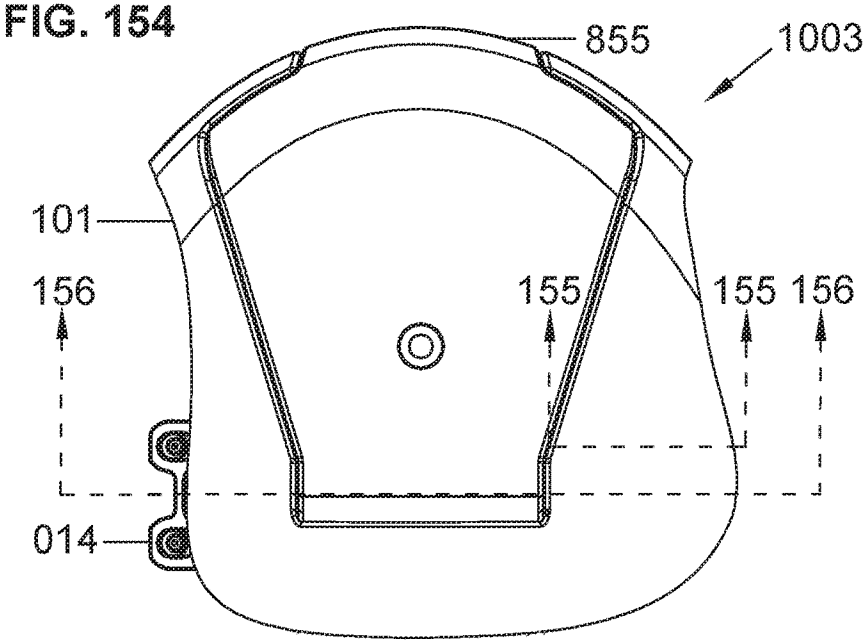

FIG. 154 is a cutaway top plan view of embodiment 3 (master assembly 1003), including components of master assembly 1003 critical to the removable cartridge system.

Figure 155:
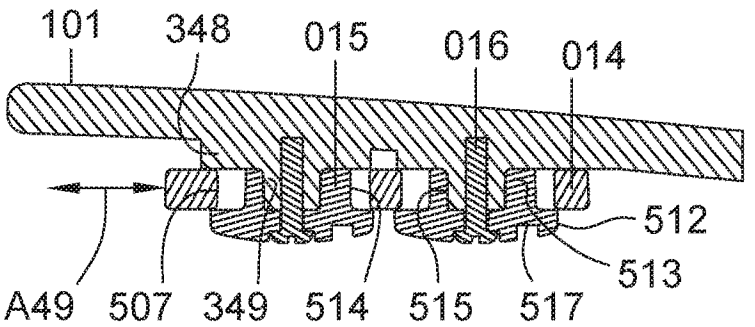

FIG. 155 is a section view passing through components of embodiment 3 (master assembly 1003), taken through section line 155 in FIG. 154.

Figure 156:
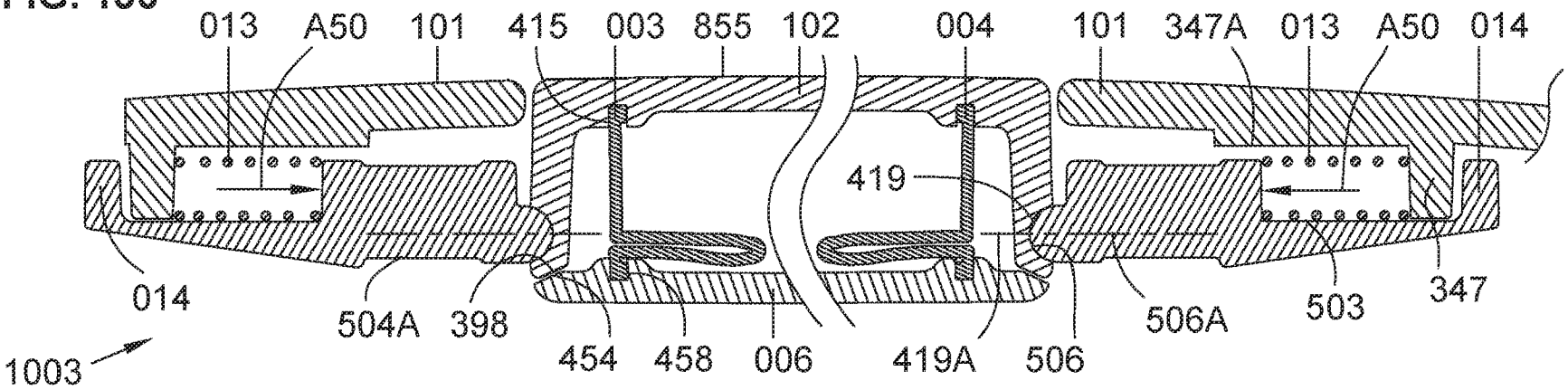

FIG. 156 is a section view passing through components of embodiment 3 (master assembly 1003), taken through section line 156 in FIG. 154.

Figure 157:
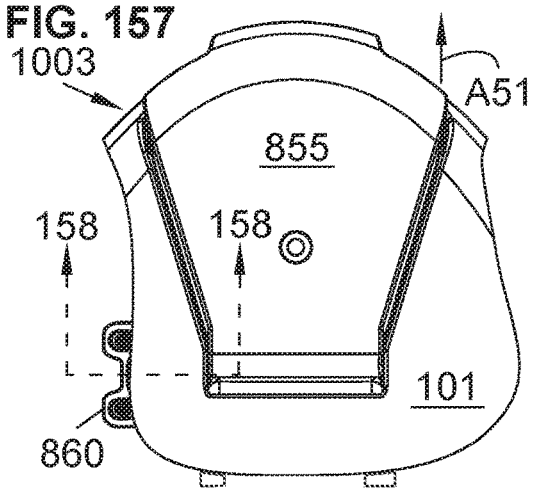

FIG. 157 is a progression from the top plan view of FIG. 154, as the extraction of removable dry cartridge 855 begins.

Figure 158:
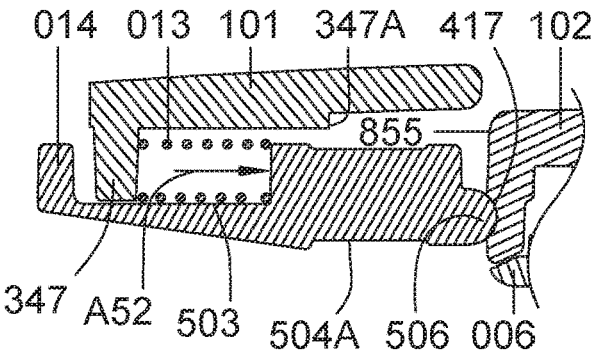

FIG. 158 is a section view passing through components of embodiment 3 (master assembly 1003), taken through section line 158 in FIG. 157.

Figure 159:
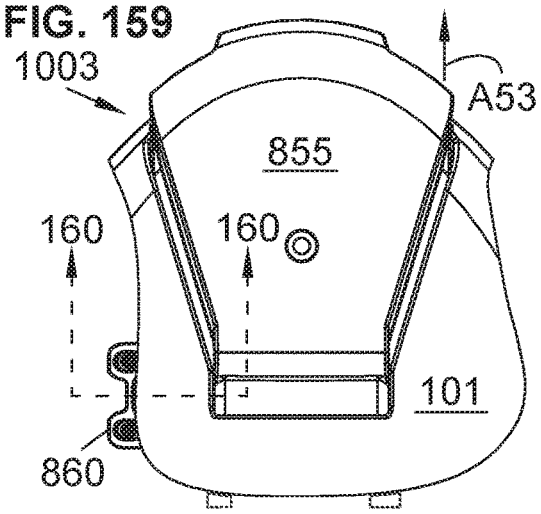

FIG. 159 is a progression from the top plan view of FIG. 157, as the extraction of removable dry cartridge 855 progresses.

Figure 160:
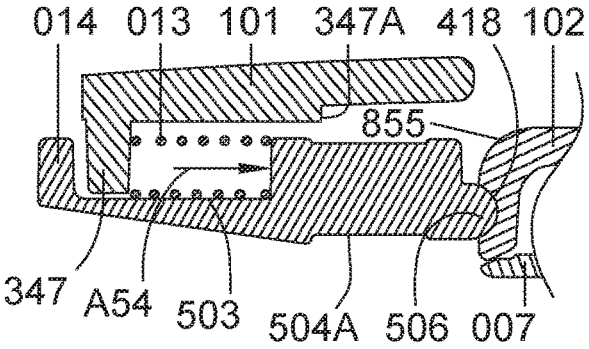

FIG. 160 is a section view passing through components of embodiment 3 (master assembly 1003), taken through section line 160 in FIG. 159.

Figure 161:
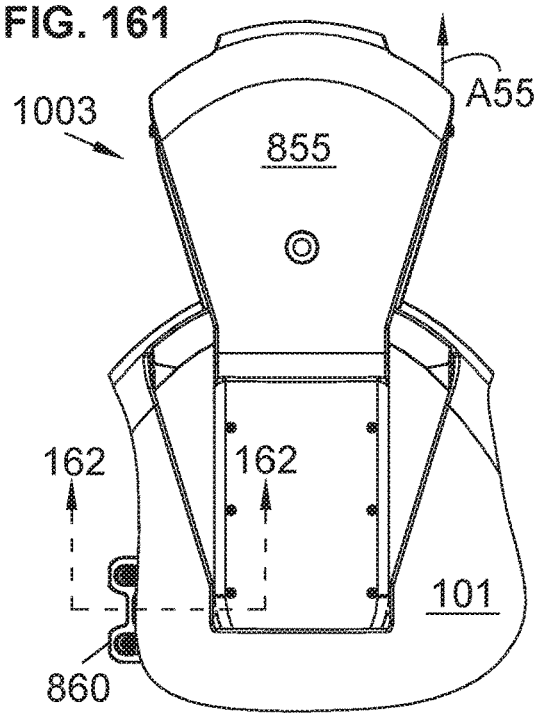

FIG. 161 is a progression from the top plan view of FIG. 159, as the extraction of removable dry cartridge 855 progresses.

Figure 162:
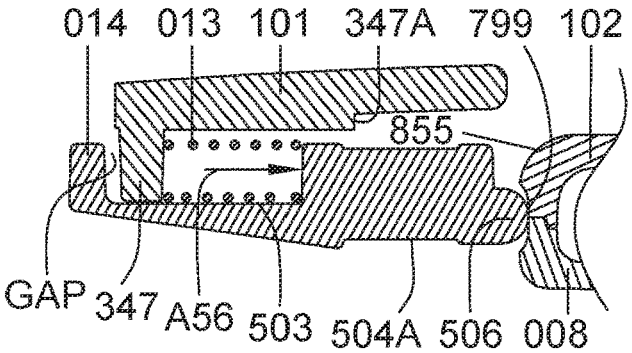

FIG. 162 is a section view passing through components of embodiment 3 (master assembly 1003), taken through section line 162 in FIG. 161.

Figure 163:
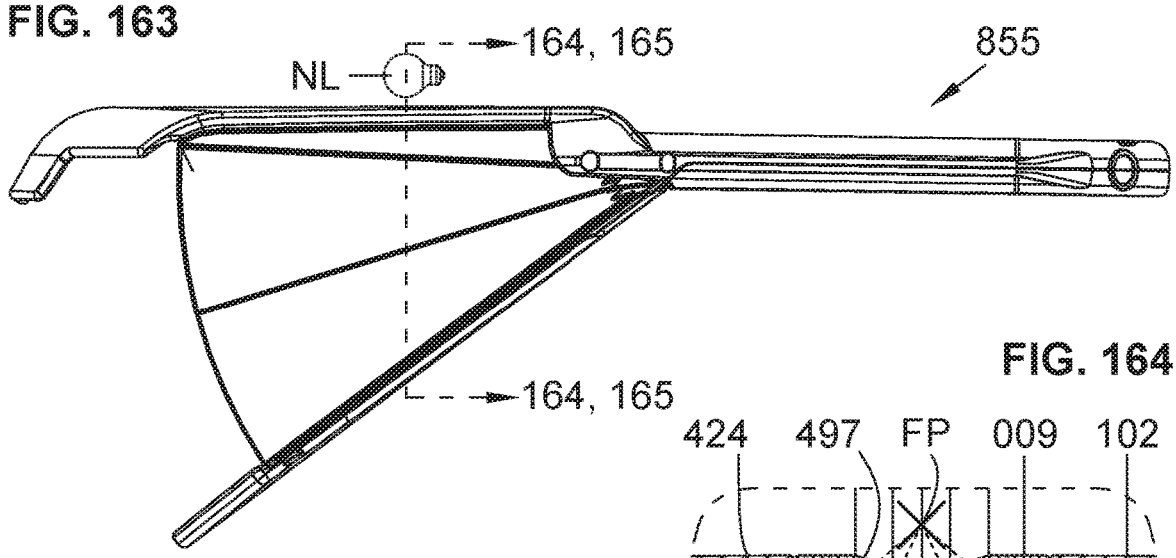

FIG. 163 is a side elevation view of removable dry cartridge 855, in an open state, with a nightlight (NL) in close proximity.

Figure 164:
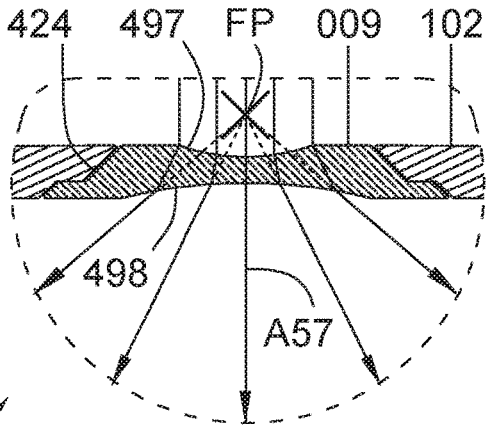

FIG. 164 is a localized section view passing through components of removable dry cartridge 855, taken through section line 164, 165 in FIG. 163.

Figure 165:
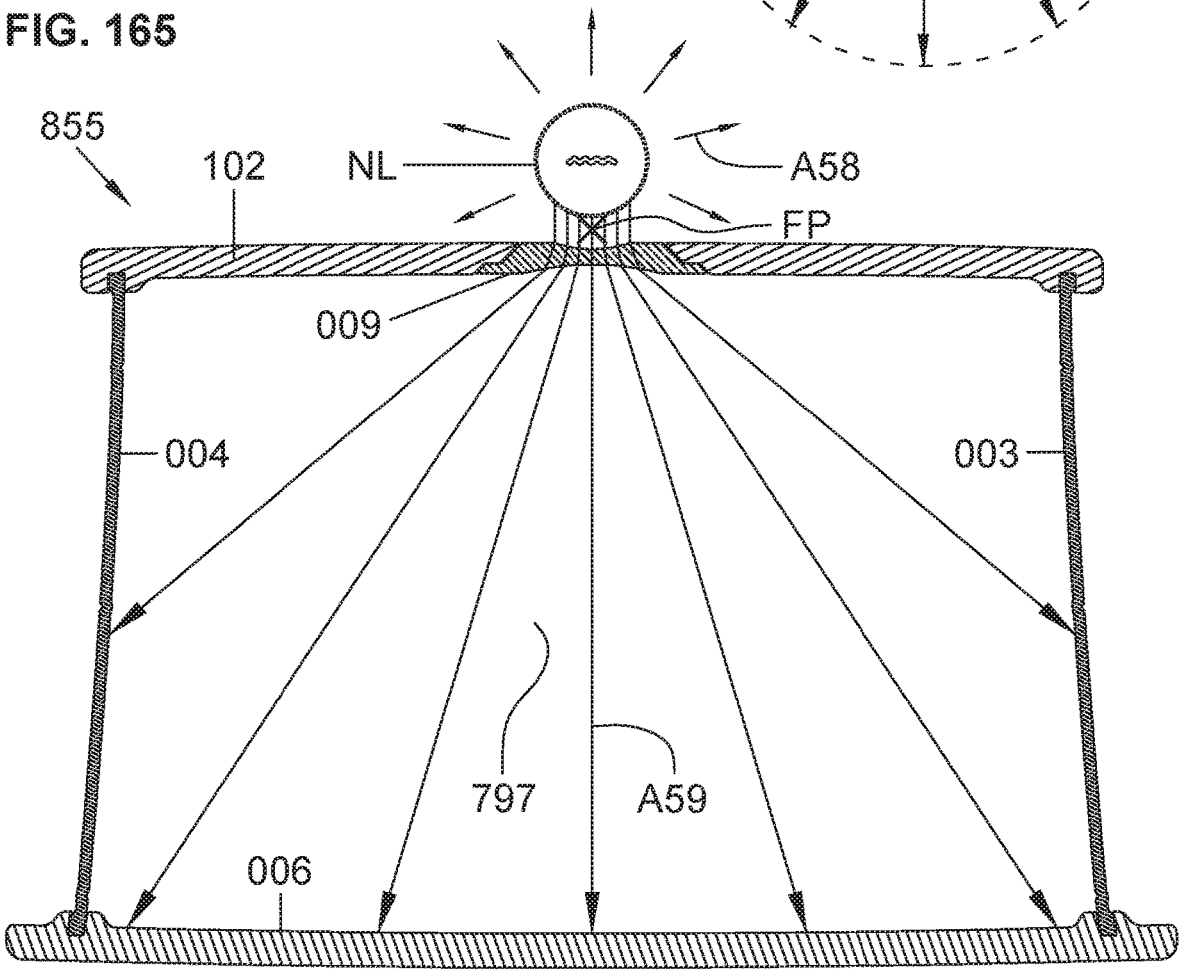

FIG. 165 is a section view passing through components of removable dry cartridge 855 and the nightlight (NL) of FIG. 163, taken through section line 164, 165 in FIG. 163.

Figure 166:
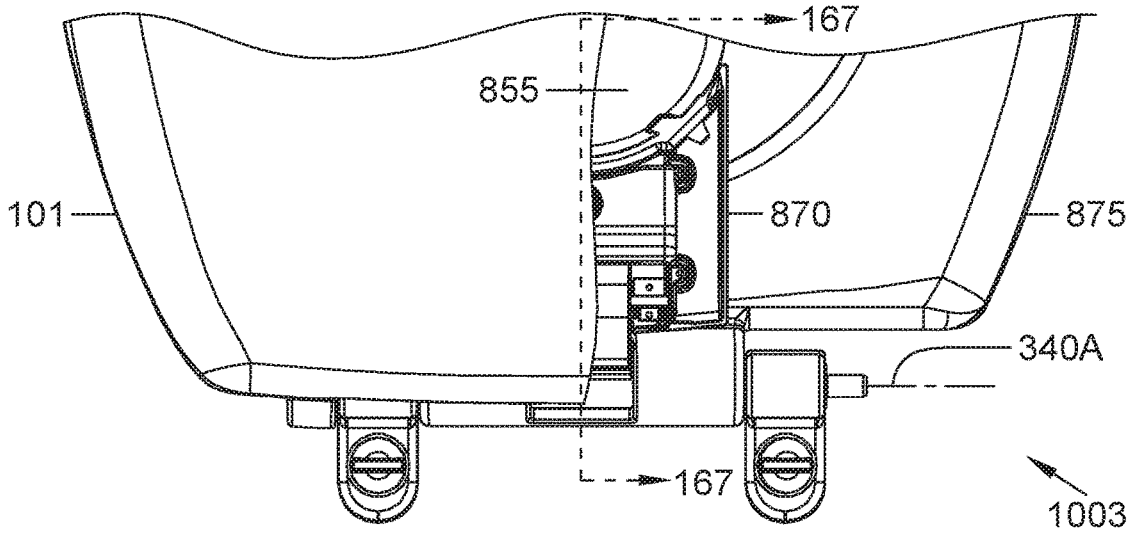

FIG. 166 is a cutaway top plan view of embodiment 3 (master assembly 1003), including components of master assembly 1003 critical to the incremental braking system.

Figure 167:
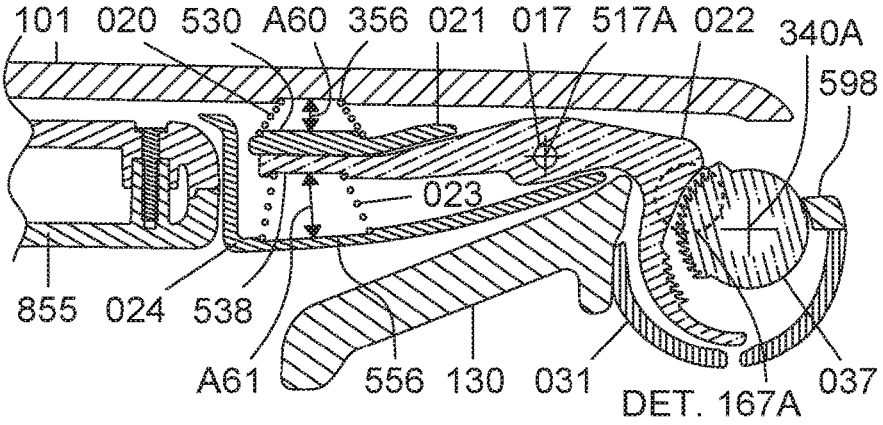

FIG. 167 is a section view passing through components of embodiment 3 (master assembly 1003), taken through section line 167 in FIG. 166.

Figure 167A:
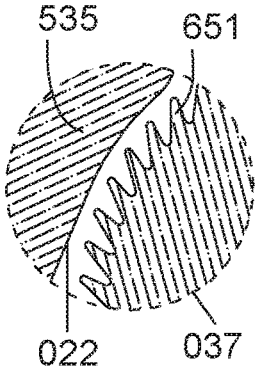

FIG. 167A is a detail view from FIG. 167, as indicated by the view window labeled DET. 167A.

Figure 168:
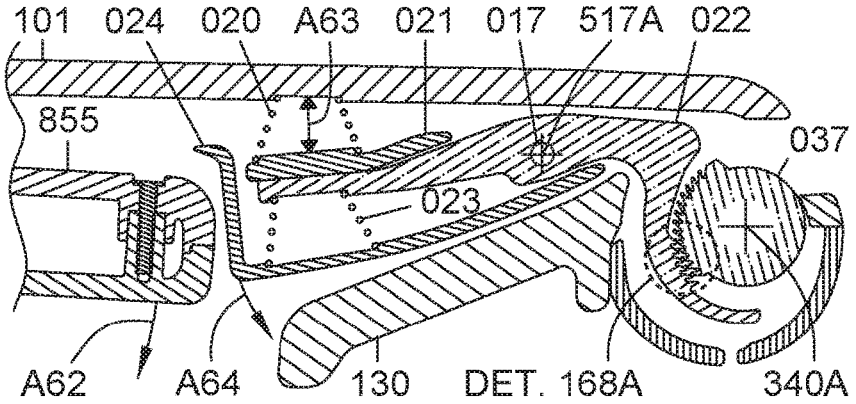

FIG. 168 is a progression from the section view of FIG. 167, as removable dry cartridge 855 opens.

Figure 168A:
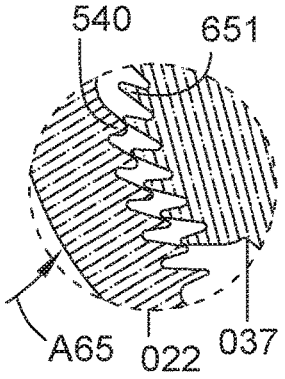

FIG. 168A is a detail view from FIG. 168, as indicated by the view window labeled DET. 168A.

Figure 169:
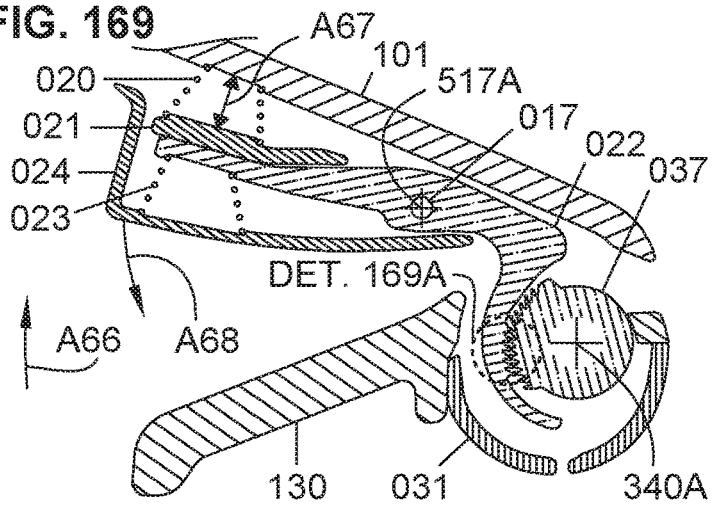

FIG. 169 is a progression from the section view of FIG. 168, as modified WC lid 101 is rotated open.

Figure 169A:
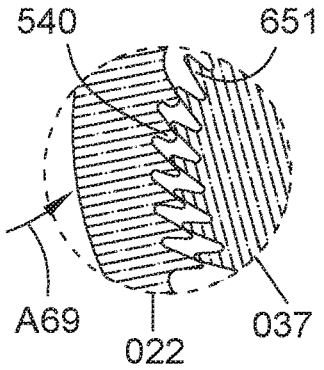

FIG. 169A is a detail view from FIG. 169, as indicated by the view window labeled DET. 169A.

Figure 170:
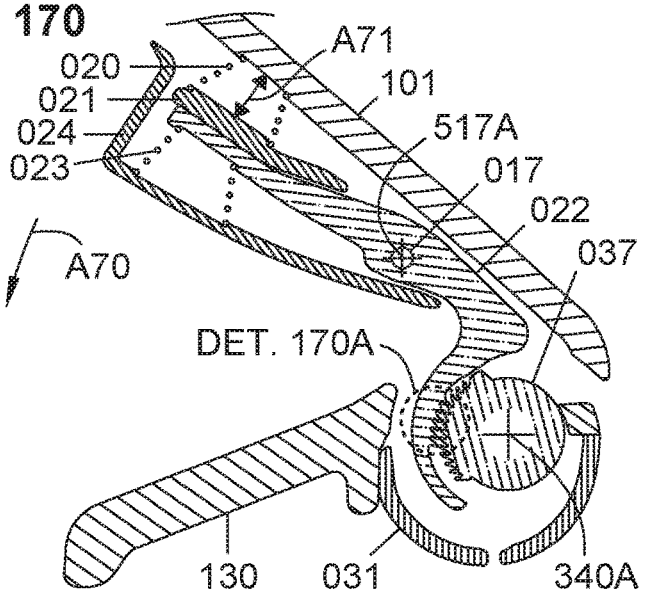

FIG. 170 is a progression from the section view of FIG. 169, as modified WC lid 101 rotates slightly closed allowing the incremental braking system to engage.

Figure 170A:
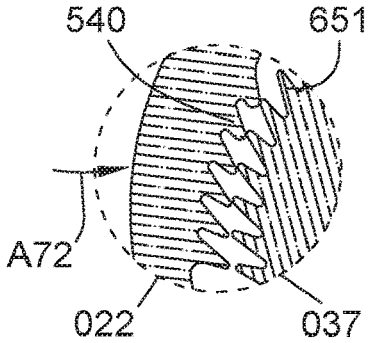

FIG. 170A is a detail view from FIG. 170, as indicated by the view window labeled DET. 170A.

Figure 171:
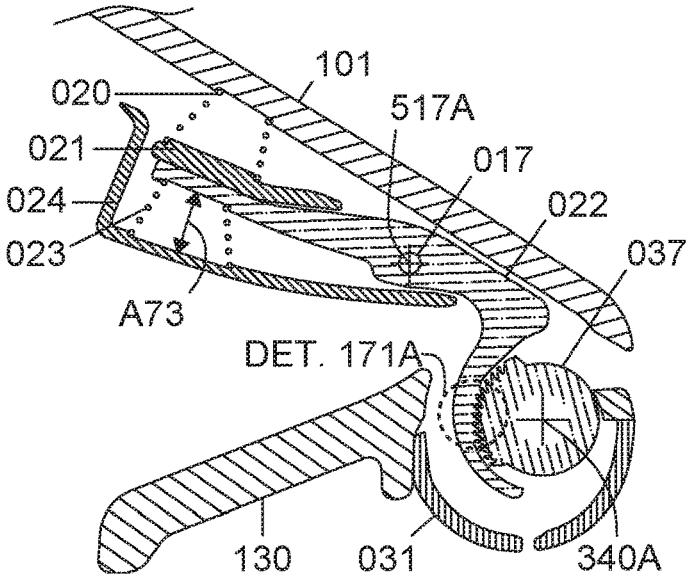

FIG. 171 is a progression from the section view of FIG. 170, representing modified WC lid 101 held in a partially open state by the incremental braking system.

Figure 171A:
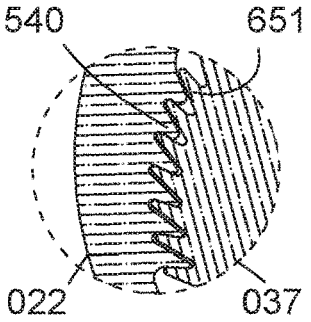

FIG. 171A is a detail view from FIG. 171, as indicated by the view window labeled DET. 171A.

Figure 172:
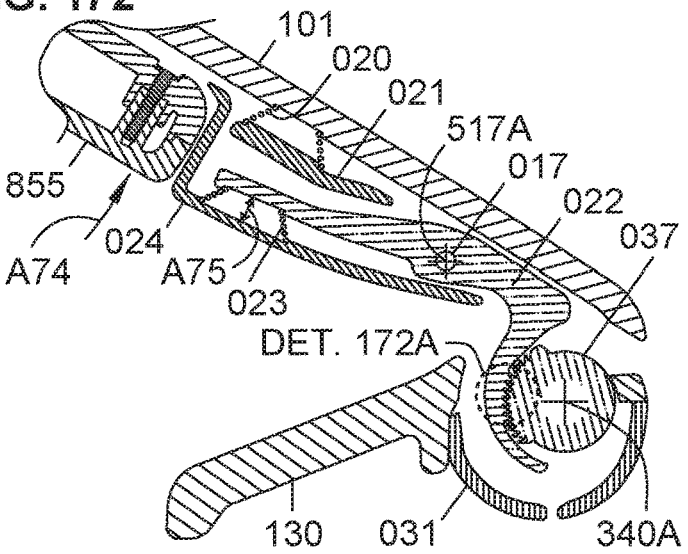

FIG. 172 is a progression from the section view of FIG. 171, representing modified WC lid 101 still held in a partially open state by the incremental braking system, as removable dry cartridge 855 is closed.

Figure 172A:
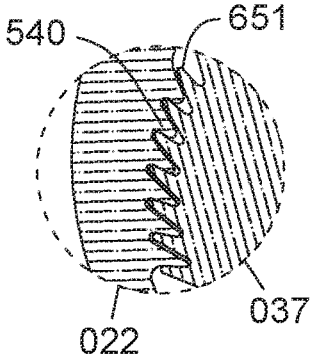

FIG. 172A is a detail view from FIG. 172, as indicated by the view window labeled DET. 172A.

Figure 173:
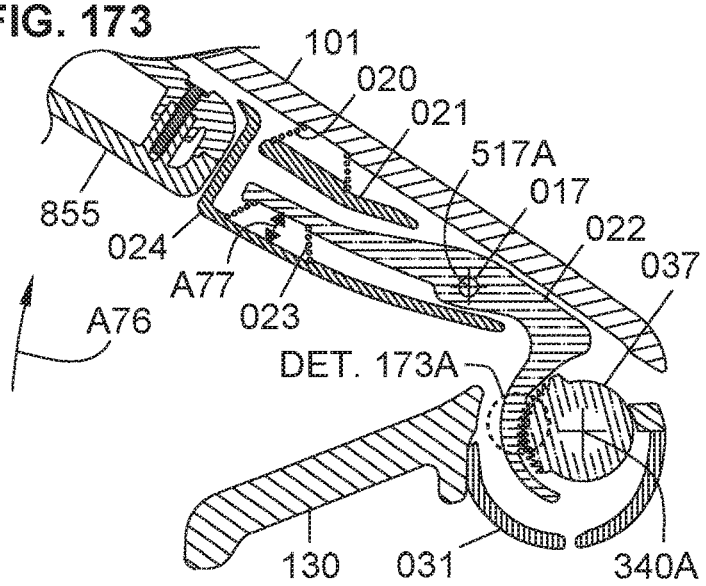

FIG. 173 represents a progression from the section view of FIG. 172, as modified WC lid 101 is rotated slightly open to release the incremental braking system.

Figure 173A:
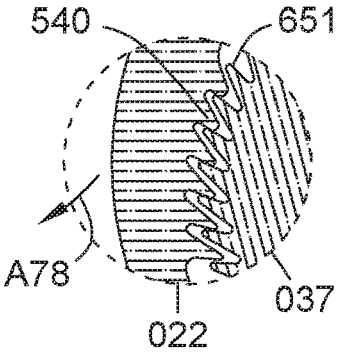

FIG. 173A is a detail view from FIG. 173, as indicated by the view window labeled DET. 173A.

Figure 174:
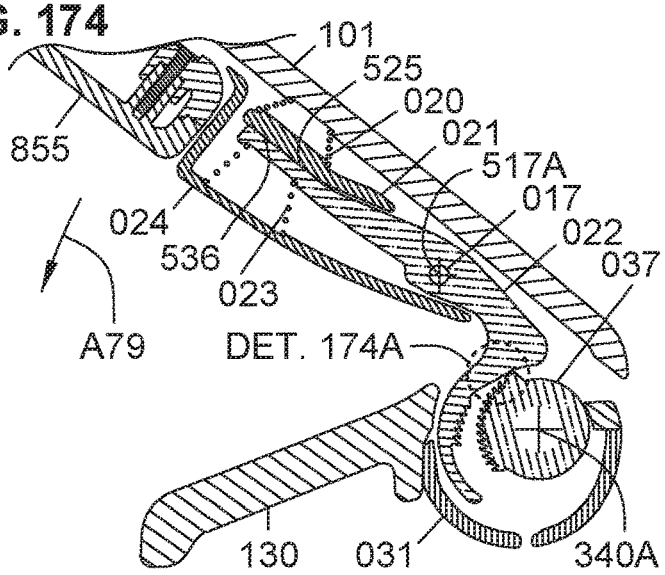

FIG. 174 is a progression from the section view of FIG. 173, as modified WC lid 101 rotates closed after the incremental braking system has been released.

Figure 174A:
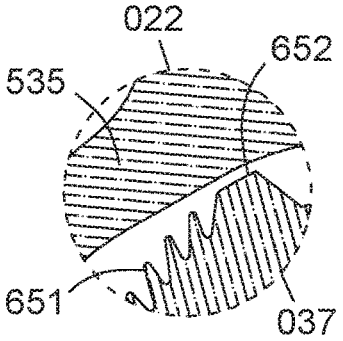

FIG. 174A is a detail view from FIG. 174, as indicated by the view window labeled DET. 174A.

Figure 175A:
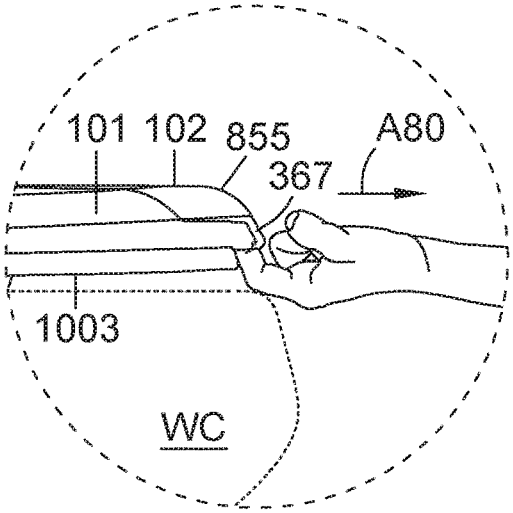

FIG. 175A represents a localized side view of a user unlatching upper cartridge segment 102, of embodiment 3 (master assembly 1003).

Figure 175B:
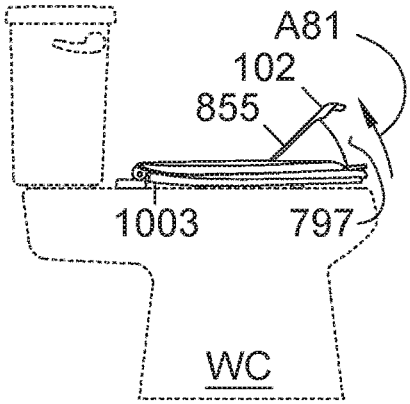

FIG. 175B is a side view of embodiment 3 (master assembly 1003) mounted to a water closet (WC), after the self-opening function has caused removable dry cartridge 855 to open.

Figure 175C:
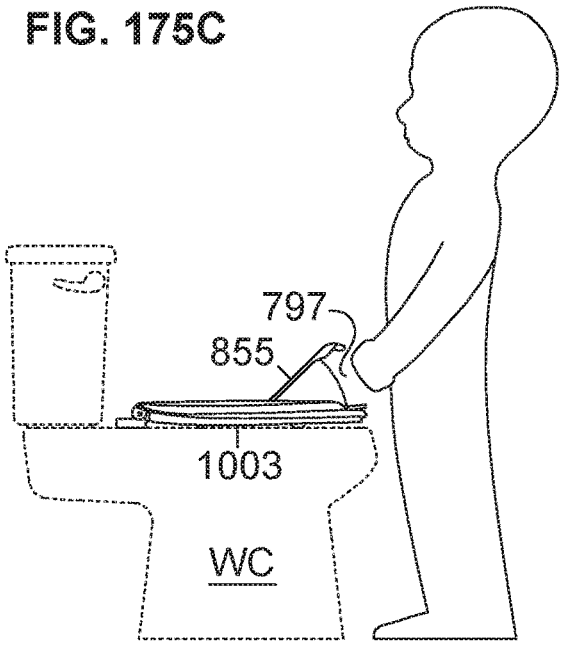

FIG. 175C is a side view of a short user urinating in embodiment 3 (master assembly 1003) mounted to a water closet (WC).

Figure 175D:
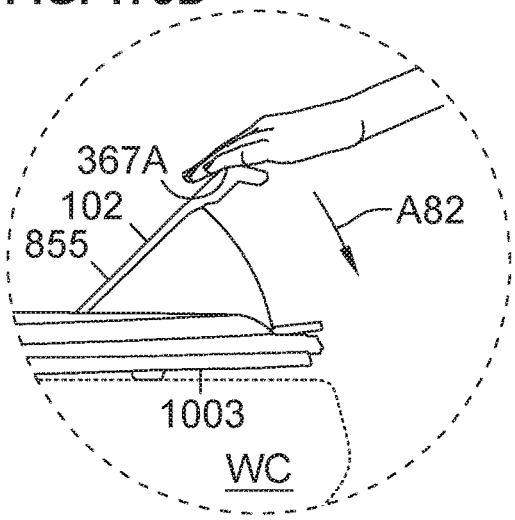

FIG. 175D represents a localized side view of a user preparing to close upper cartridge segment 102.

Figure 175E:
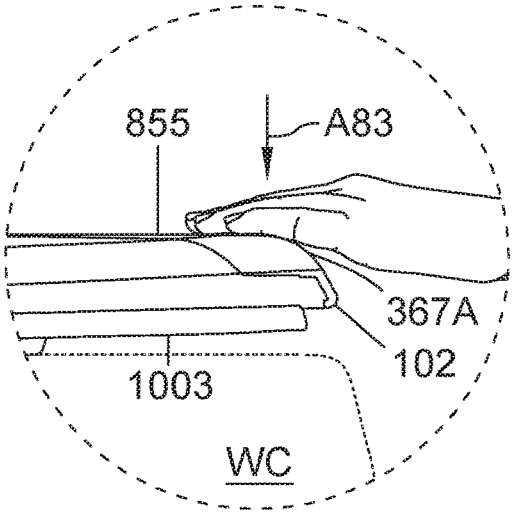

FIG. 175E represents a localized side view of a user pressing down on upper cartridge segment 102, to latch it closed.

Figure 176A:
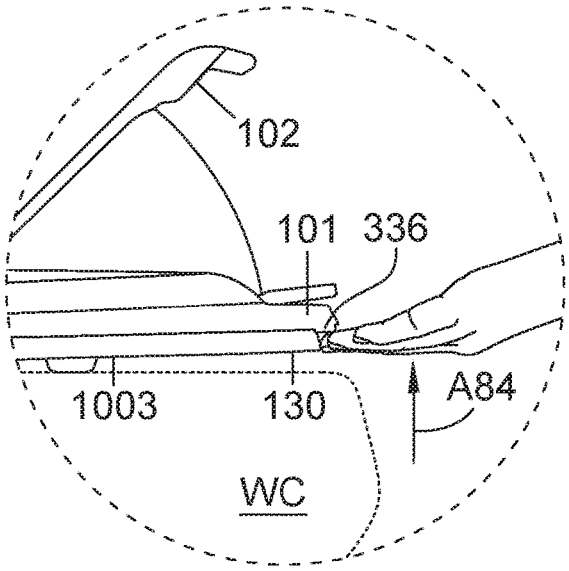

FIG. 176A represents a localized side view of a user preparing to rotate modified WC lid 101 open.

Figure 176B:
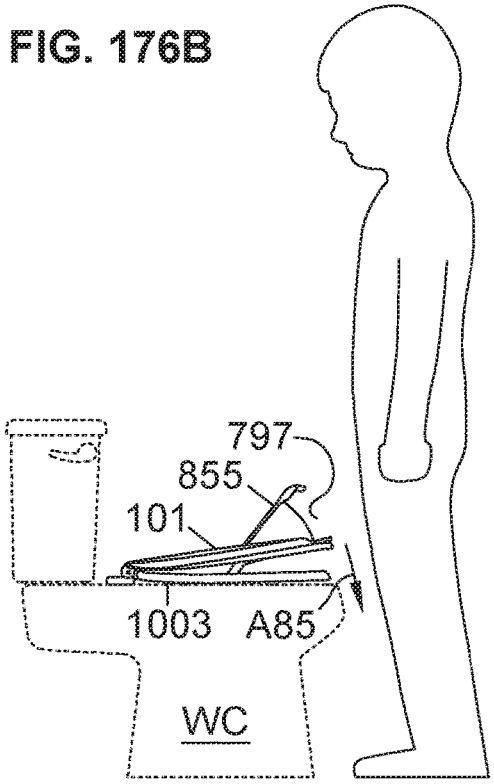

FIG. 176B is a side view of a tall user standing in front of embodiment 3 (master assembly 1003) mounted to a water closet (WC); master assembly 1003 is illustrated being improperly adjusted for the user's height.

Figure 176C:
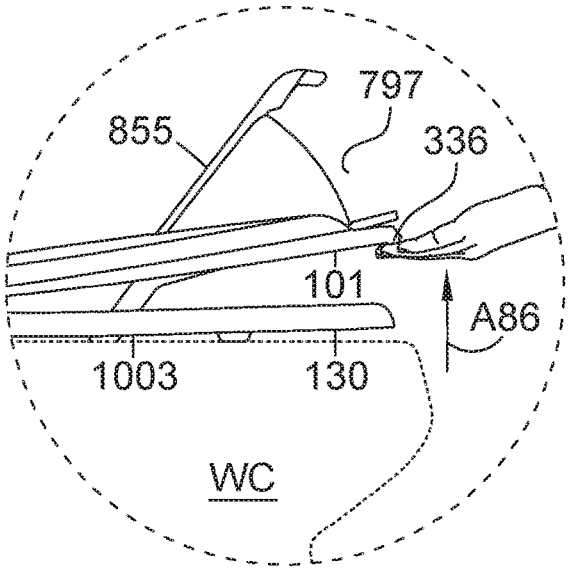

FIG. 176C represents a localized side view of a user preparing to rotate modified WC lid 101 further open.

Figure 176D:
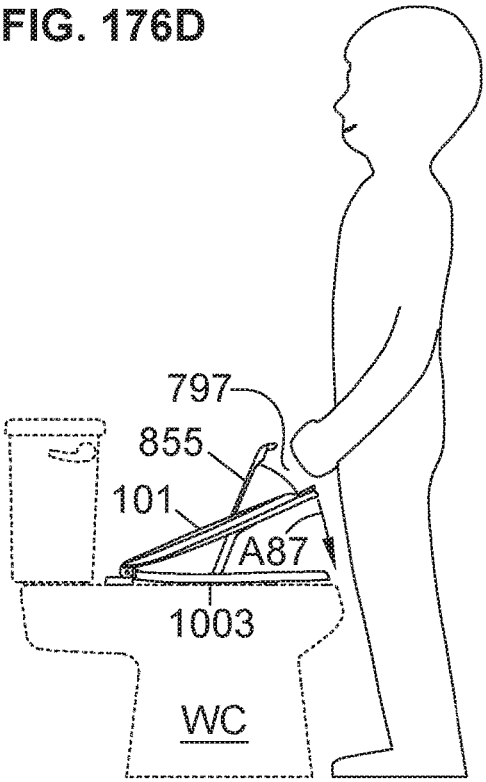

FIG. 176D is a side view of a tall male user urinating in embodiment 3 (master assembly 1003), properly adjusted for the user's height.

Figure 176E:
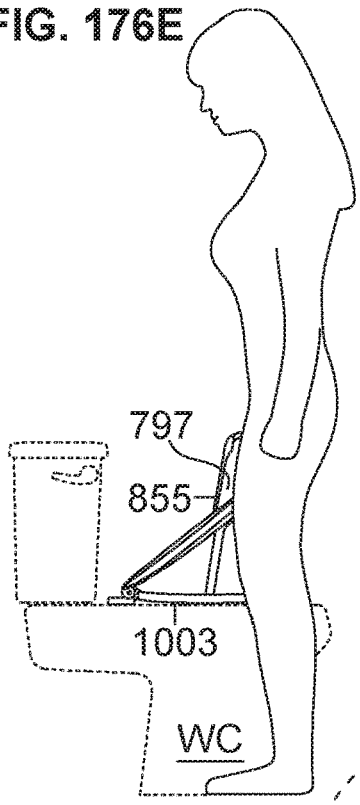

FIG. 176E is a side view of a tall female user urinating in embodiment 3 (master assembly 1003), properly adjusted for the user's height.

Figure 176F:
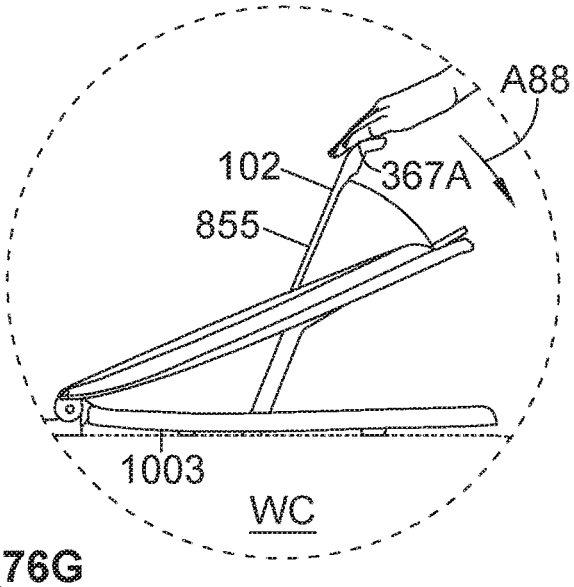

FIG. 176F represents a localized side view as a user prepares to close removable dry cartridge 855.

Figure 176G:
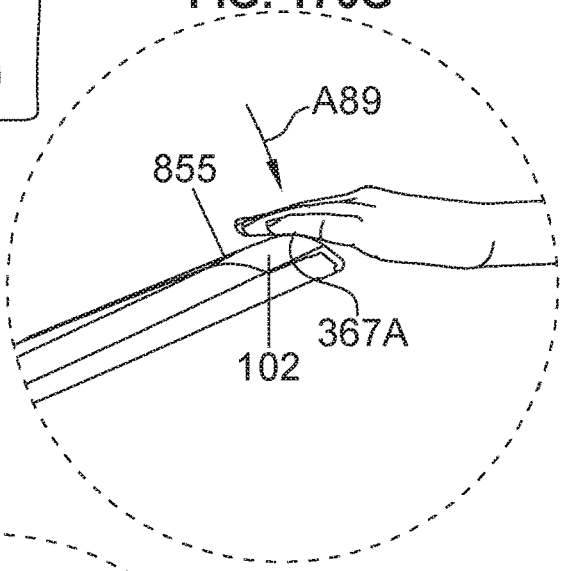

FIG. 176G represents a localized side view as a user latches removable dry cartridge 855 closed.

Figure 176H:
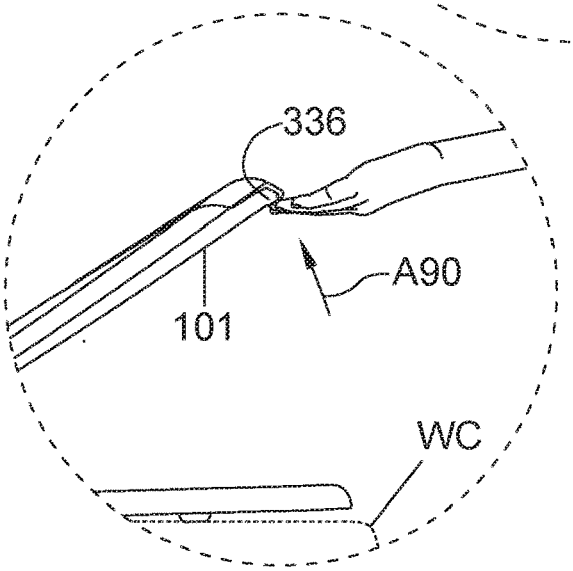

FIG. 176H represents a localized side view of a user preparing to rotate modified WC lid 101 slightly open, to release the incremental braking system.

Figure 176J:
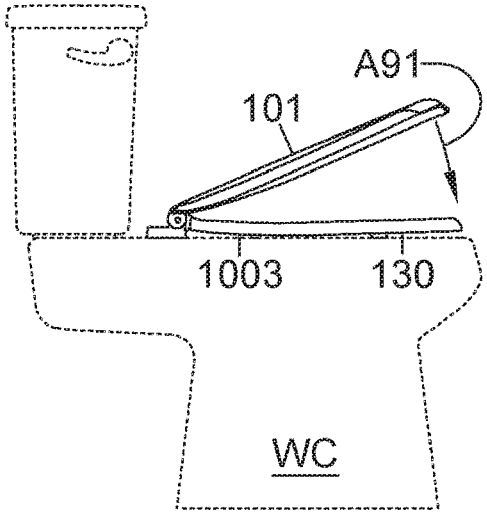

FIG. 176J is a side view of embodiment 3 (master assembly 1003) mounted to a water closet (WC), as modified WC lid 101 rotates slowly closed, dampened by the slow-close rotational dampening system.

Figures 177, 178:
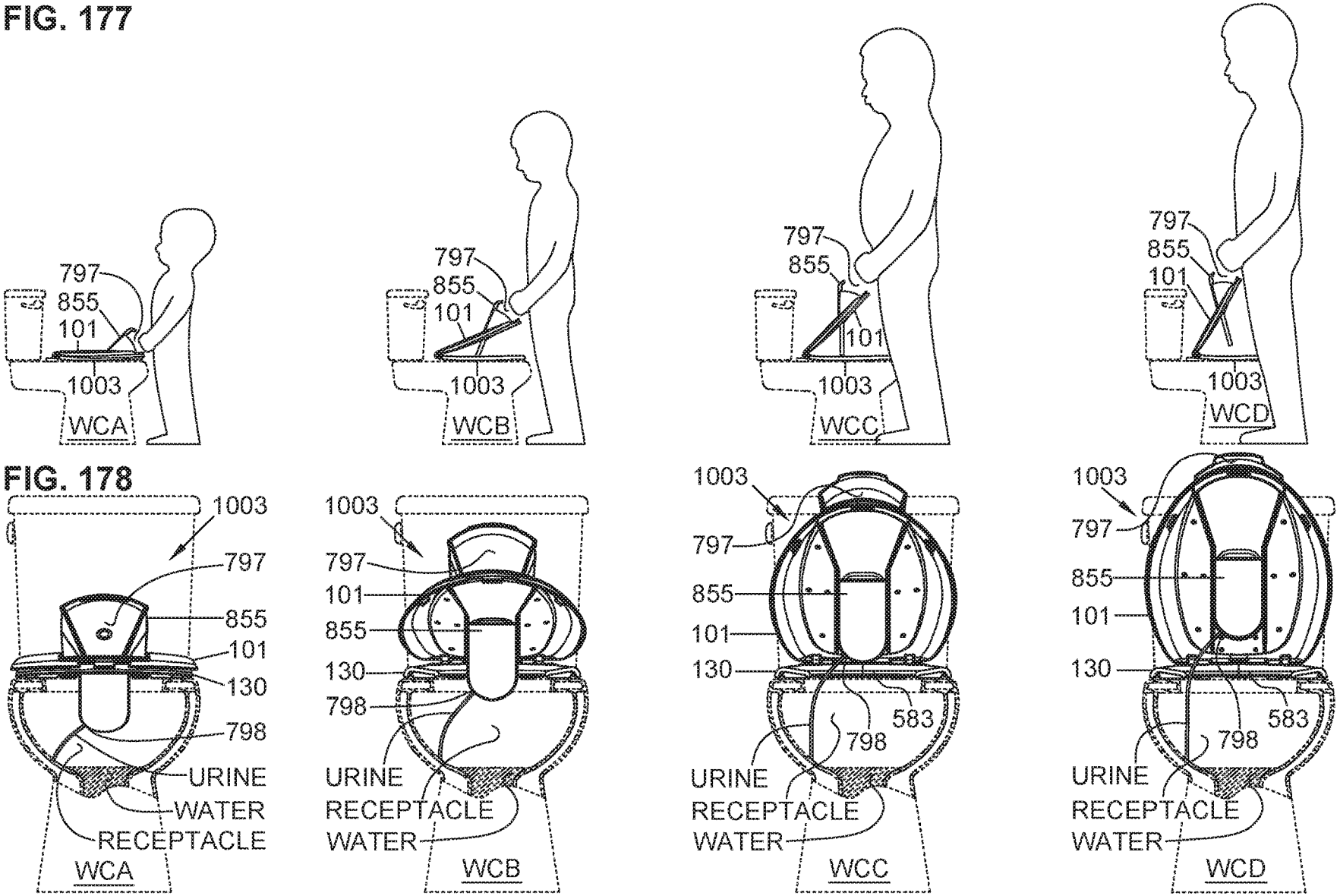

FIG. 177 is a side view of four water closets, and four male users of disparate heights; on each water closet, embodiment 3 (master assembly 1003) is mounted for use, and adjusted to the height of the corresponding user.

FIG. 178 is a cutaway front view of four water closets, corresponding to the water closets of FIG. 177; on each water closet, embodiment 3 (master assembly 1003) is adjusted to reflect the corresponding positions of FIG. 177.

Figure 179:
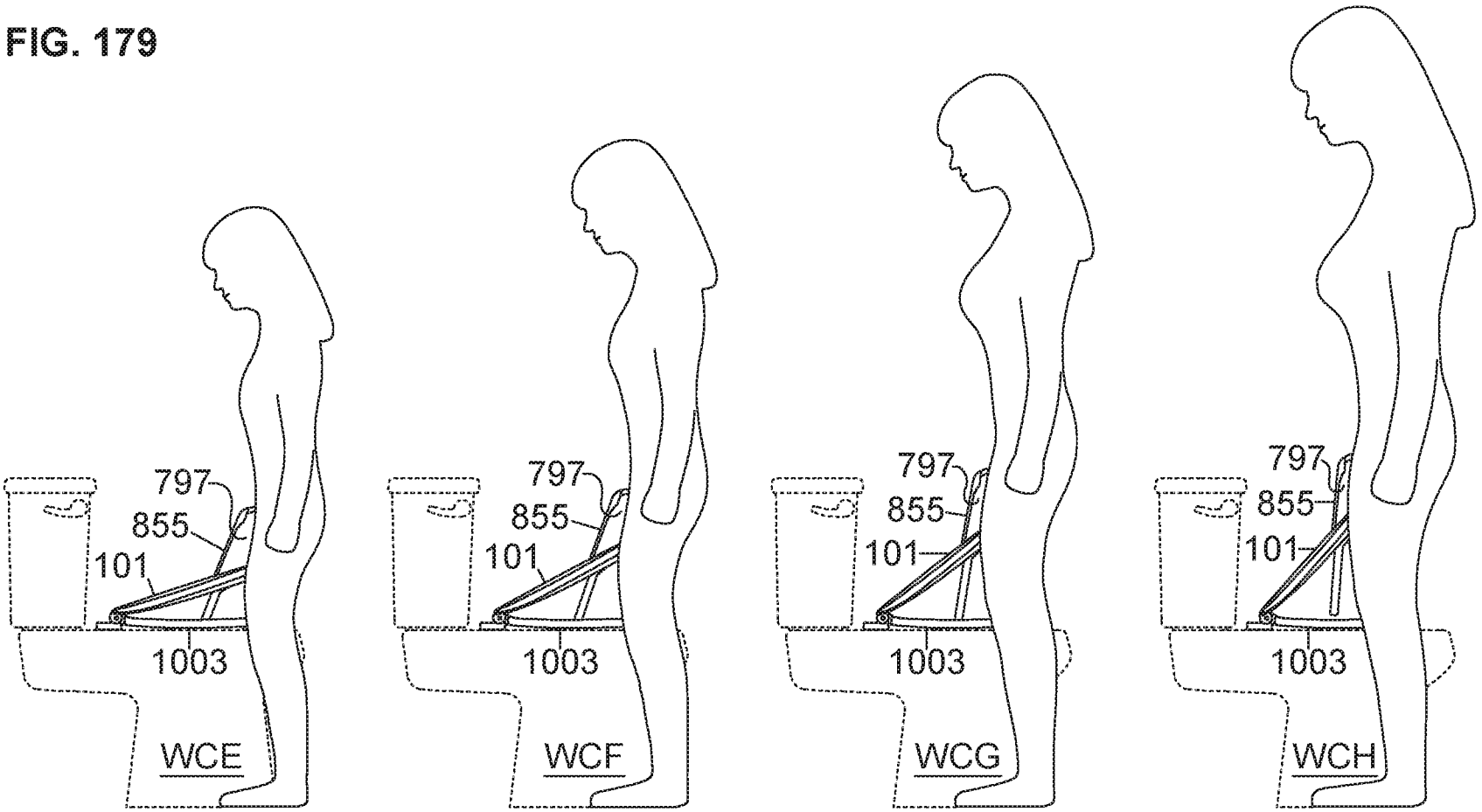

FIG. 179 is a side view of four water closets, and four female users of disparate heights; on each water closet, embodiment 3 (master assembly 1003) is mounted for use, and adjusted to the height of the corresponding user.

Figure 180A:
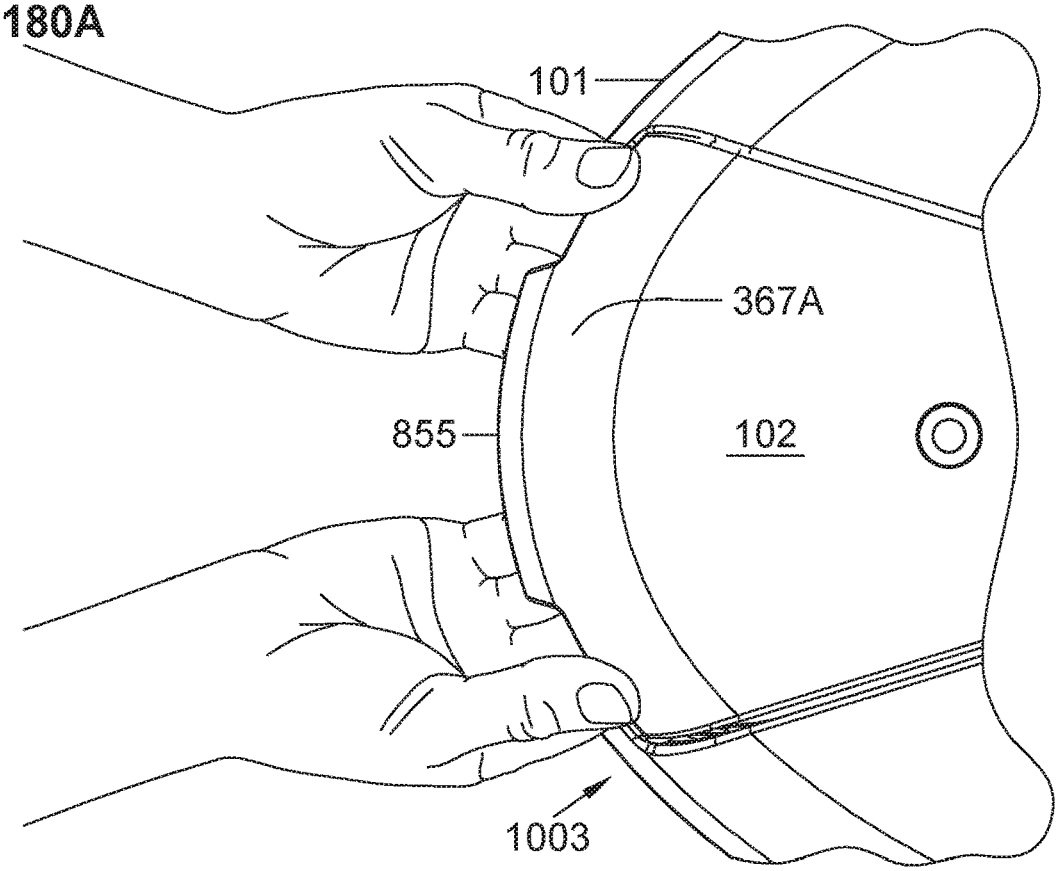

FIG. 180A is a cutaway top view of embodiment 3 (master assembly 1003), as a user grasps removable dry cartridge 855 for extraction from master assembly 1003.

Figure 180B:
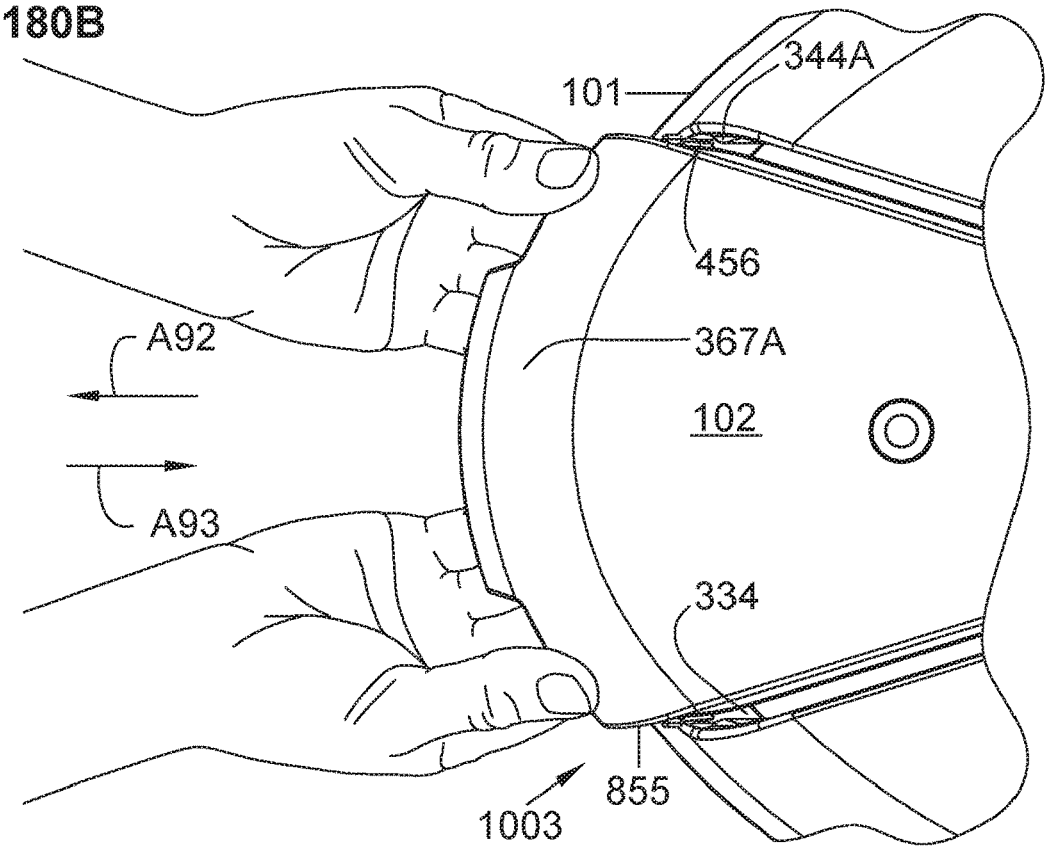

FIG. 180B is a progression from the cutaway view of FIG. 180A, as extraction of removable dry cartridge 855 progresses.

Figure 180C:
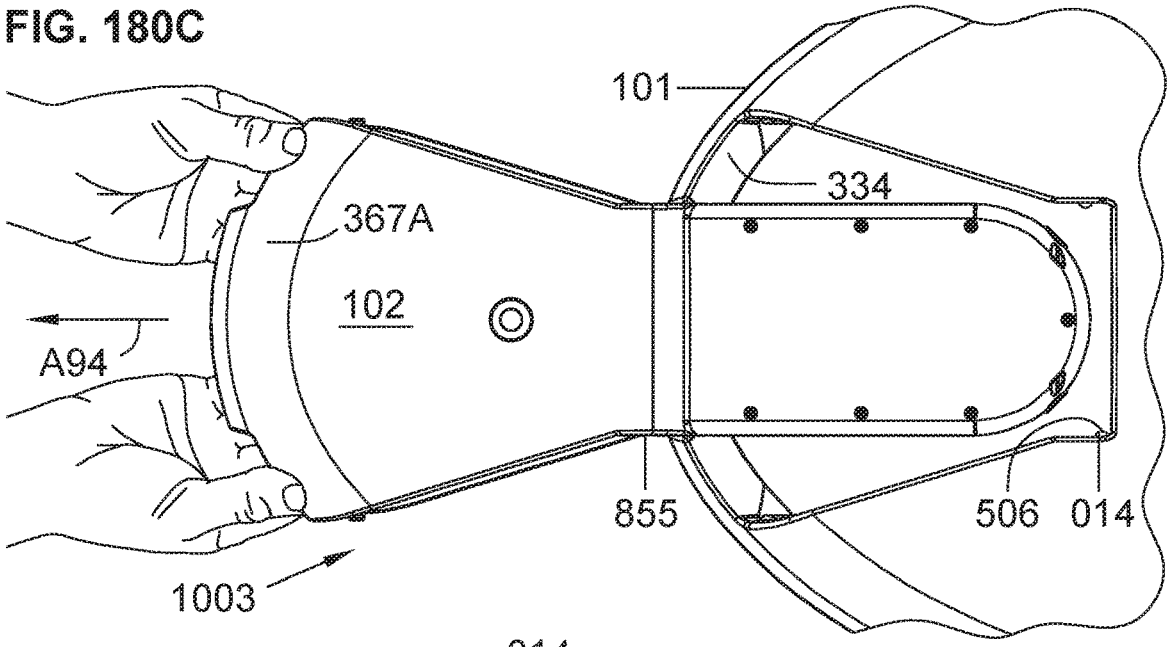

FIG. 180C is a progression from the cutaway view of FIG. 180B, as the user completes extraction of removable dry cartridge 855 from master assembly 1003.

Figure 180D:
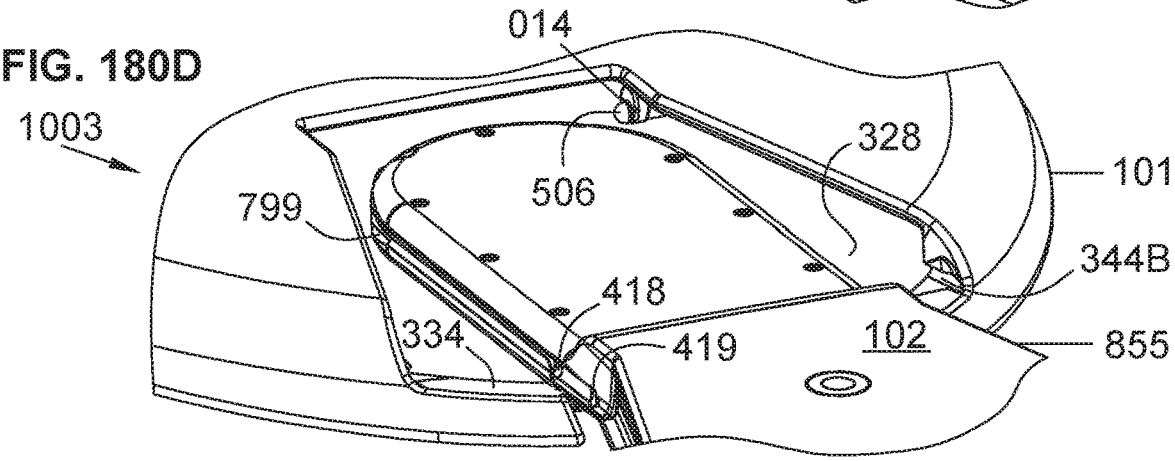

FIG. 180D is a perspective view of embodiment 3 (master assembly 1003), illustrating features that the user visually aligns in preparation to re-install removable dry cartridge 855.

Figure 180E:
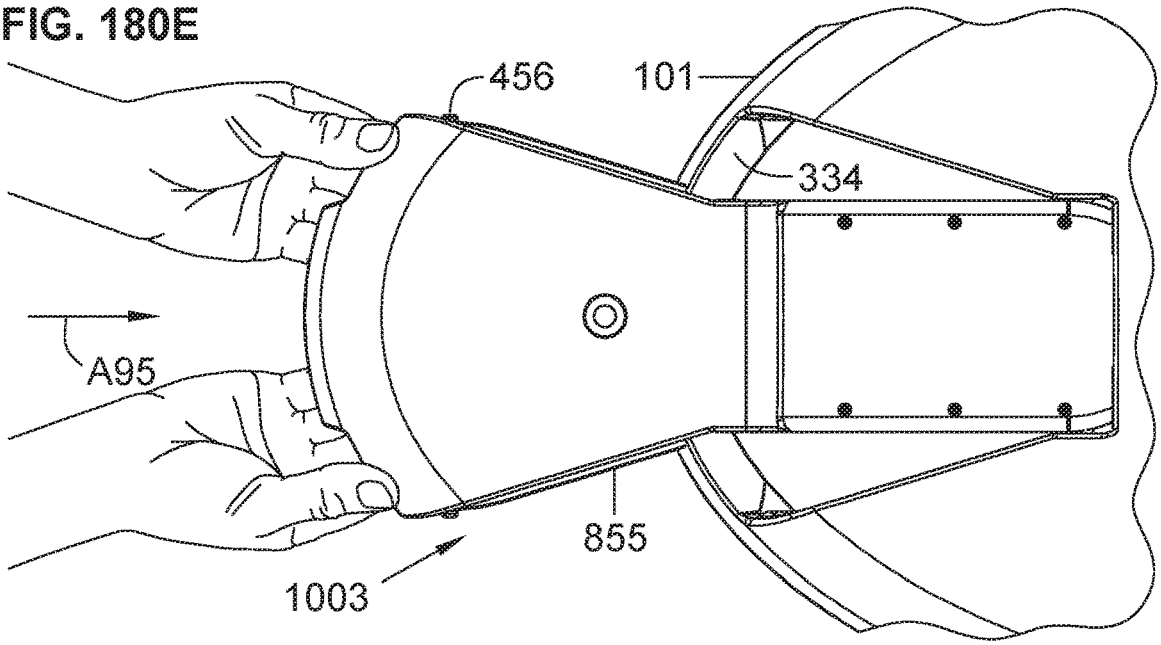

FIG. 180E is a cutaway top view of embodiment 3 (master assembly 1003), illustrating a user reinstalling removable dry cartridge 855.

Figure 181:
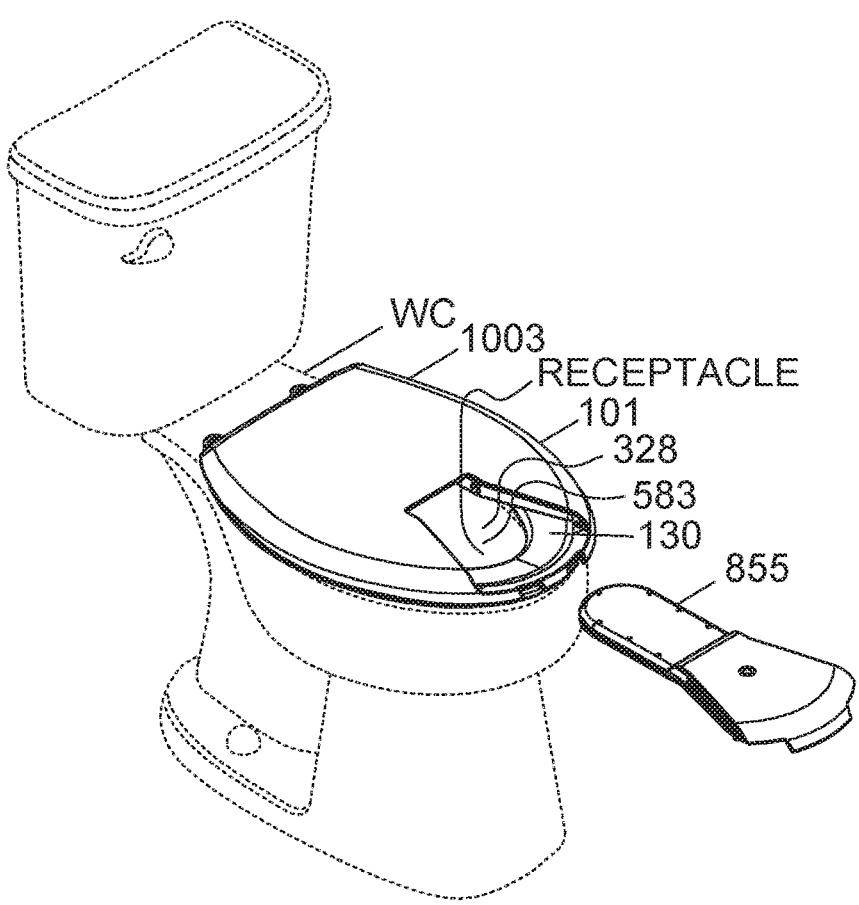

FIG. 181 is a perspective view of embodiment 3 (master assembly 1003) mounted on a water closet (WC) for use; modified WC lid 101 is closed, and removable dry cartridge 855 is extracted from master assembly 1003.

Figure 182:
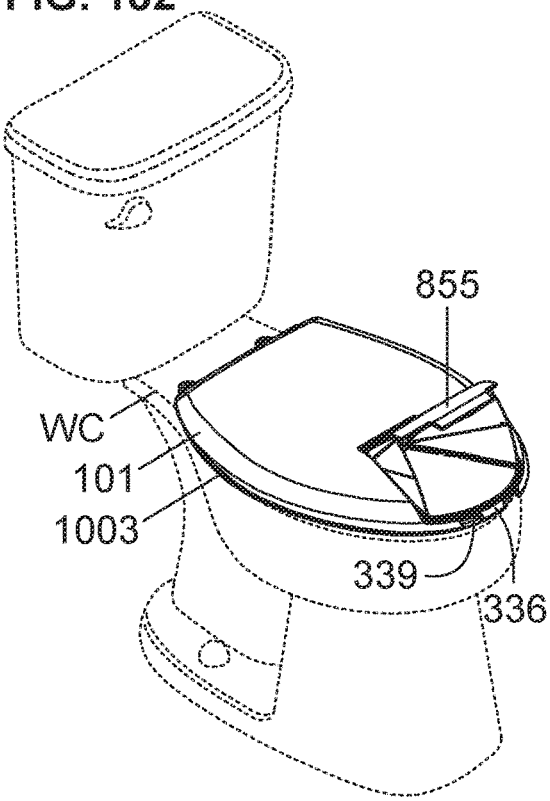

FIG. 182 is a perspective view of embodiment 3 (master assembly 1003) mounted on a water closet (WC) for use, with modified WC lid 101 closed; removable dry cartridge 855 is installed and open for use.

Figure 183:
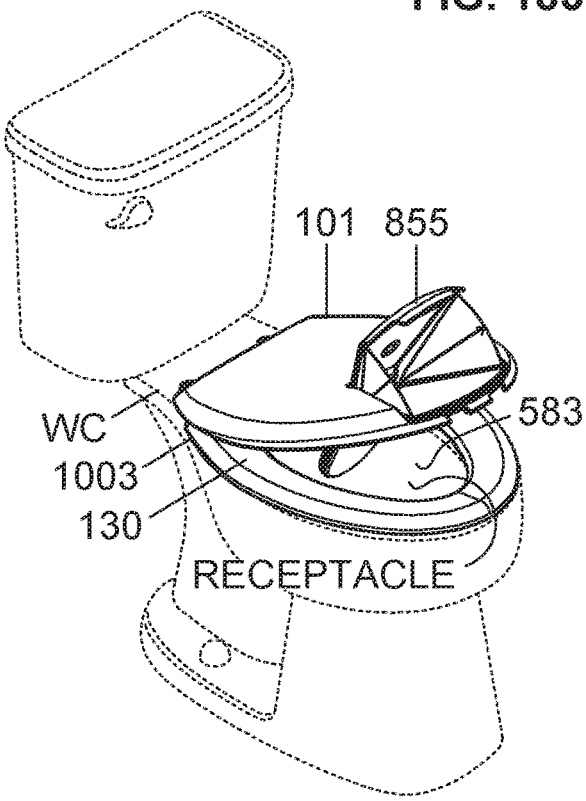

FIG. 183 is a perspective view of embodiment 3 (master assembly 1003) mounted on a water closet (WC) for use; removable dry cartridge 855 is open for use, and modified WC lid 101 is held in a partially open position by the incremental braking system.

Figure 183A:
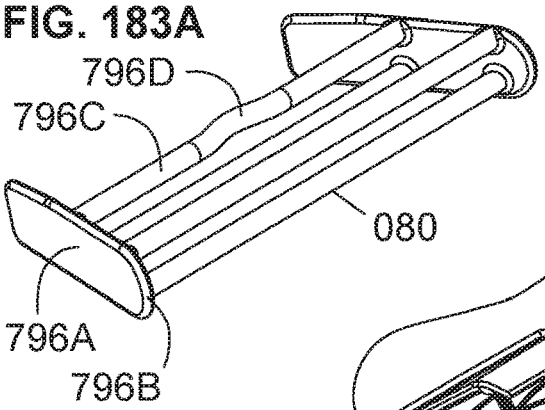

FIG. 183A is perspective view of debris screen and bead rack 080.

Figure 183B:
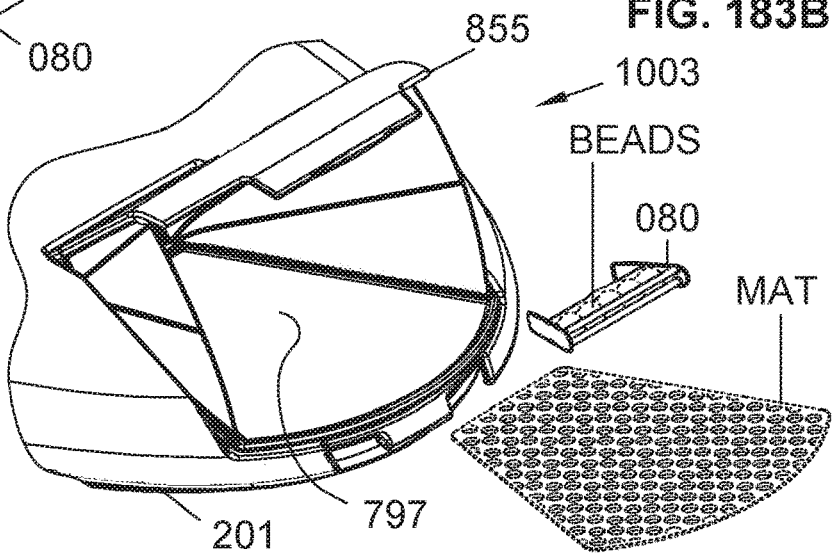

FIG. 183B is a cutaway perspective view of embodiment 3 (master assembly 1003), illustrating the orientation of accessories for insertion into removable dry cartridge 855.

Figure 183C:
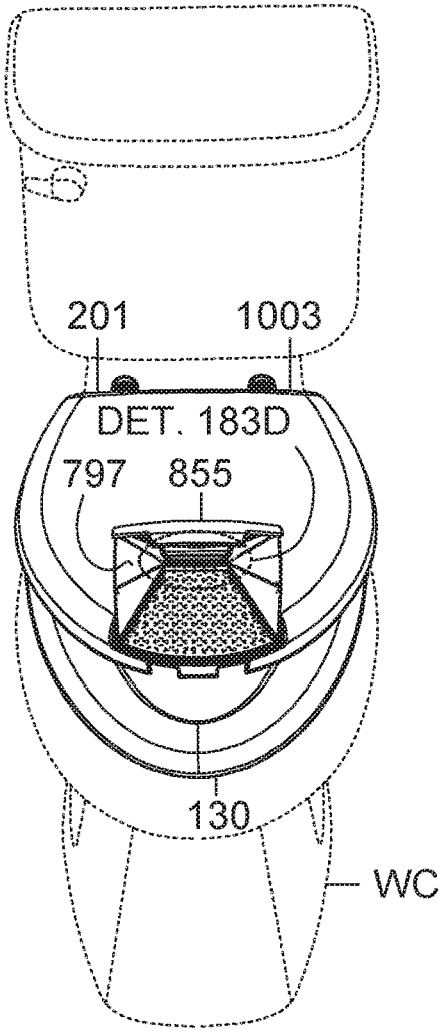

FIG. 183C is a perspective view of embodiment 3 (master assembly 1003) mounted on a water closet (WC) for use; modified WC lid 101 is held in a partially open position by the incremental braking system, and removable dry cartridge 855 is open revealing accessories inside related to the odor control system.

Figure 183D:
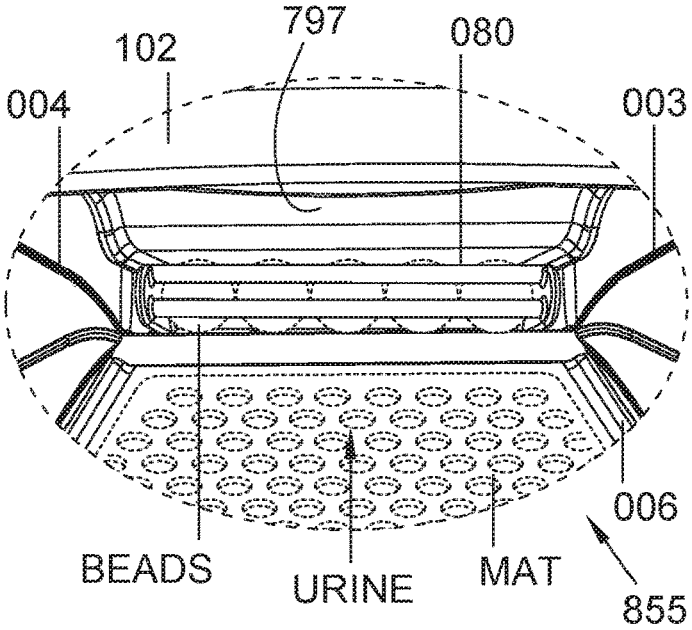

FIG. 183D is a detail view from FIG. 183C, as indicated by the view window labeled DET. 183D in FIG. 183C, illustrating installed odor control accessories within removable dry cartridge 855.

Figure 184:
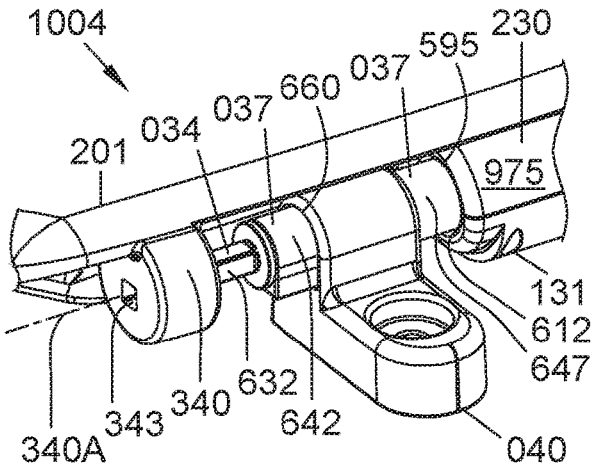

FIG. 184 is a perspective view of components of embodiment 4 (master assembly 1004) associated with the right side of the assembly hinge pivot system, in a partially exploded state.

Figure 185:
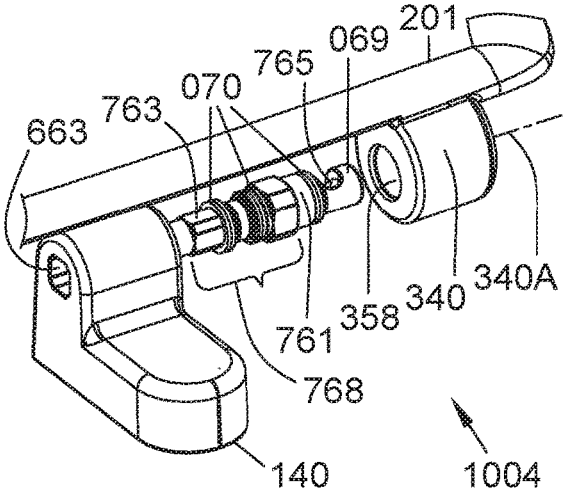

FIG. 185 is a perspective view of components of embodiment 4 (master assembly 1004) associated with the left side of the assembly hinge pivot system, in a partially exploded state.

Figure 186:
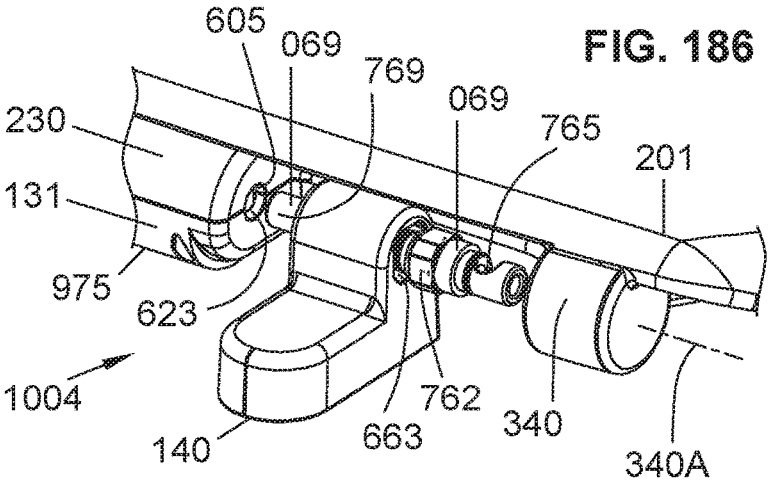

FIG. 186 is another perspective view of components of embodiment 4 (master assembly 1004) associated with the left side of the assembly hinge pivot system; the components of FIG. 186 are oriented and arranged in a distinctly different partially exploded state, compared to that of FIG. 185.

Figure 187:
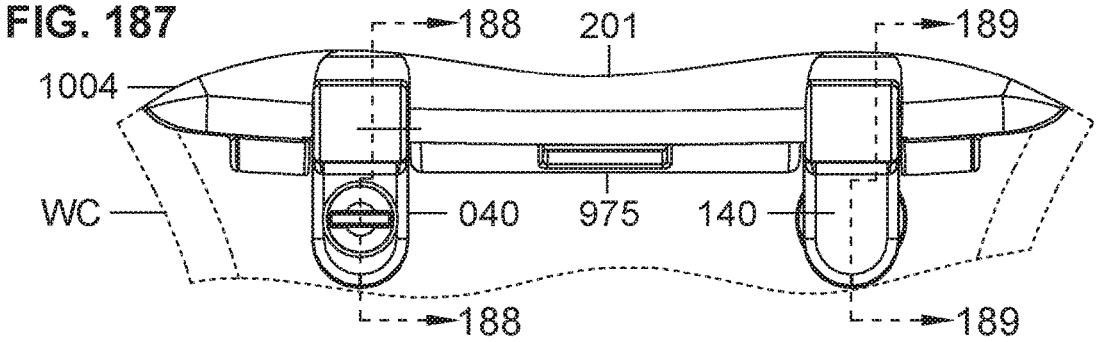

FIG. 187 is a cutaway top plan view of embodiment 4 (master assembly 1004) installed on a fixed water closet (WC) for use.

Figure 188:
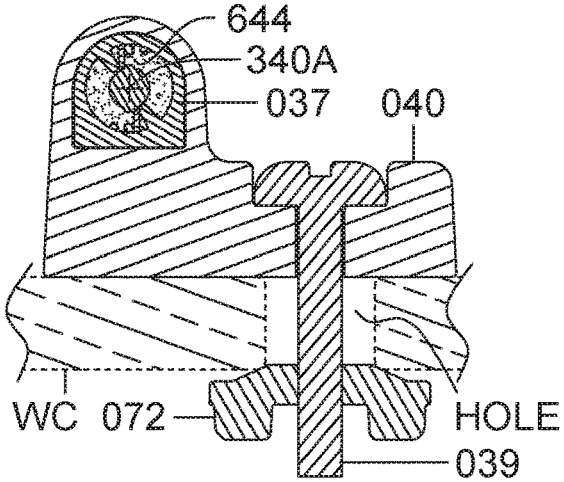

FIG. 188 is a localized section view taken through the jogged section line 188 in FIG. 187, passing through components of embodiment 4 (master assembly 1004) associated with the right side of the assembly hinge pivot system.

Figure 189:
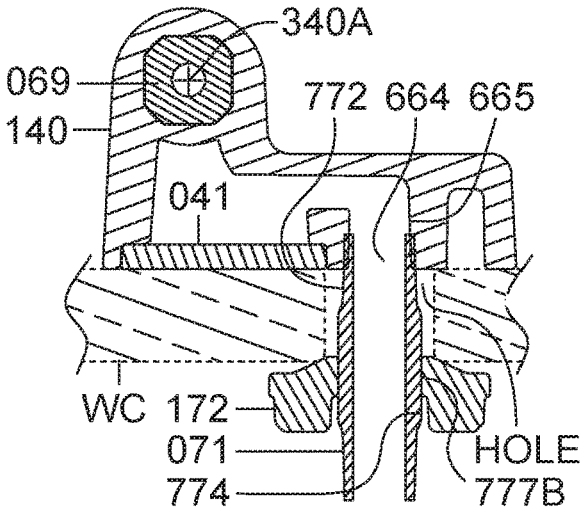

FIG. 189 is a localized section view taken through the jogged section line 189 in FIG. 187, passing through components of embodiment 4 (master assembly 1004) associated with the left side of the assembly hinge pivot system.

Figure 190:
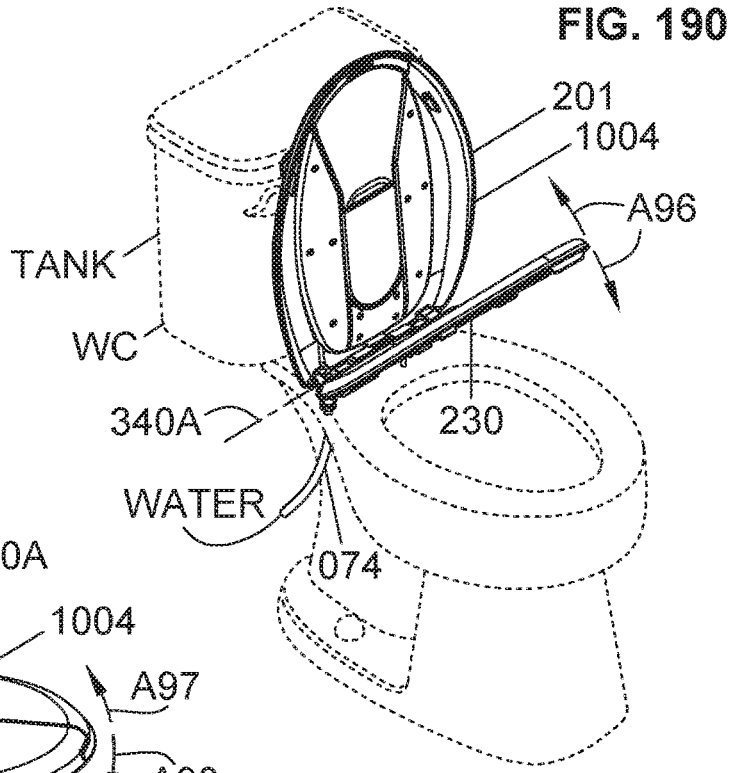

FIG. 190 is a perspective view of embodiment 4 (master assembly 1004) mounted on a water closet (WC) for use, with modified WC lid 201 fully open, and modified WC seat 230 in a partially closed position.

Figure 191:
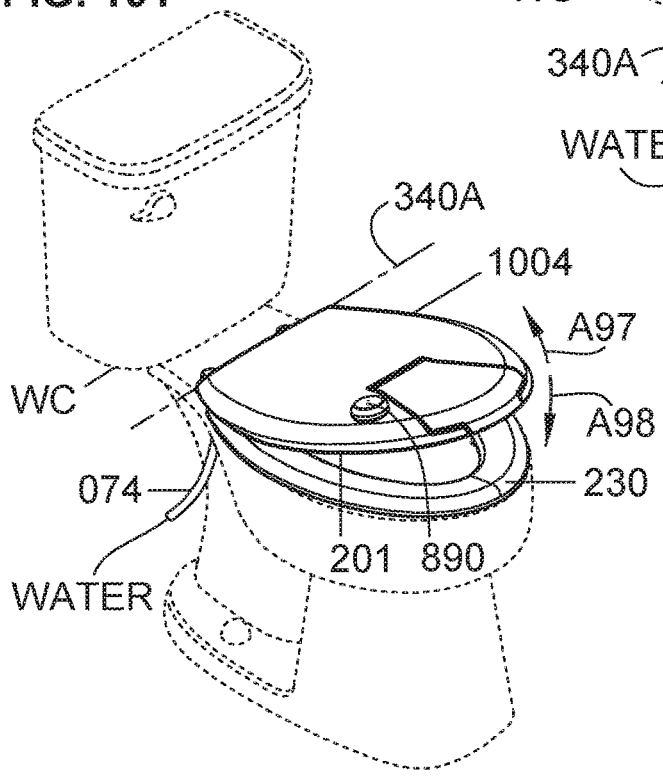

FIG. 191 is a perspective view of embodiment 4 (master assembly 1004) mounted on a water closet (WC) for use, with modified WC seat 230 closed and modified WC lid 201 partially open.

Figure 192:
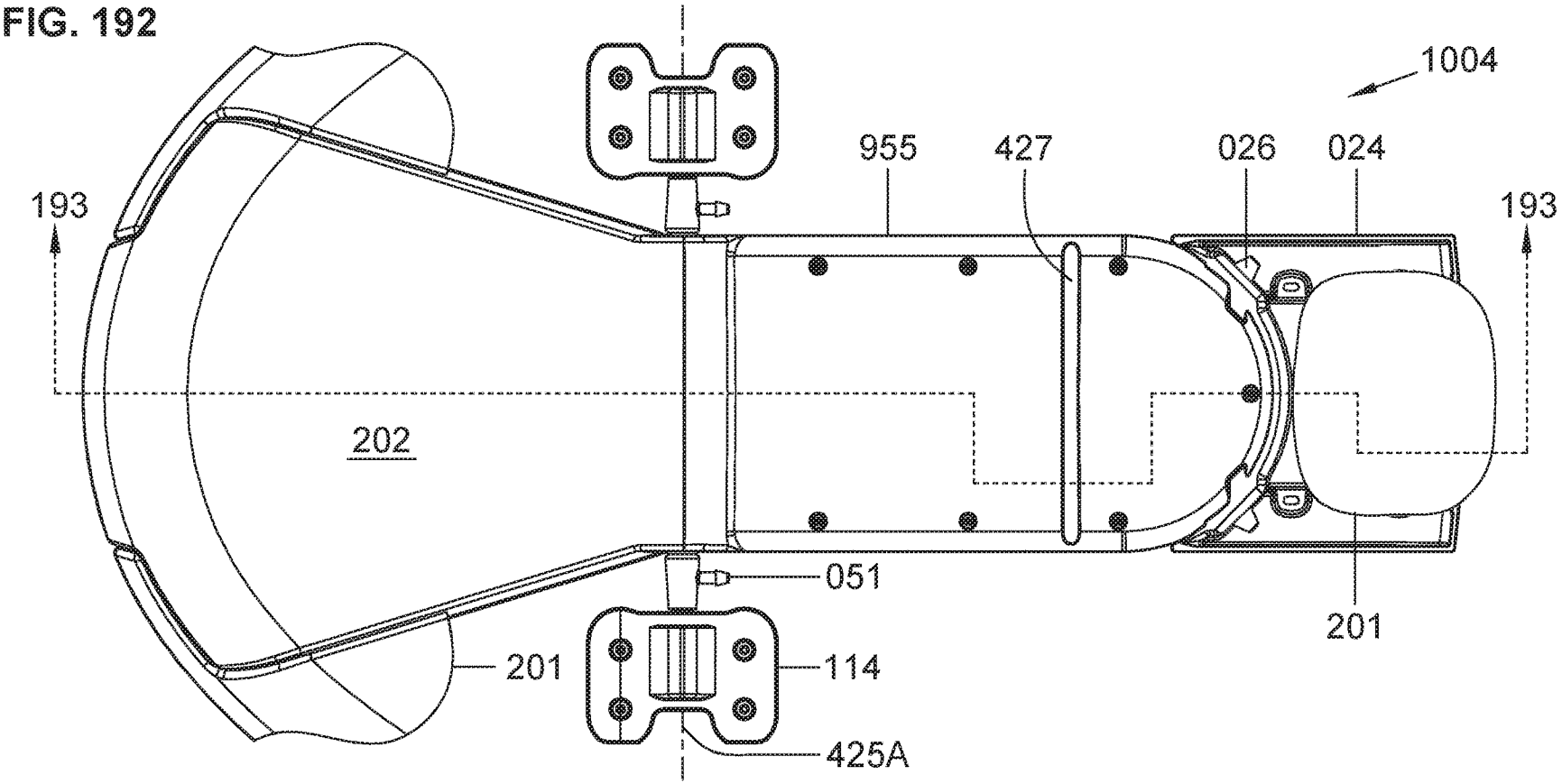

FIG. 192 is a cutaway top plan view of embodiment 4 (master assembly 1004), including components of master assembly 1004 critical to the collapsible cartridge system.

Figure 193:
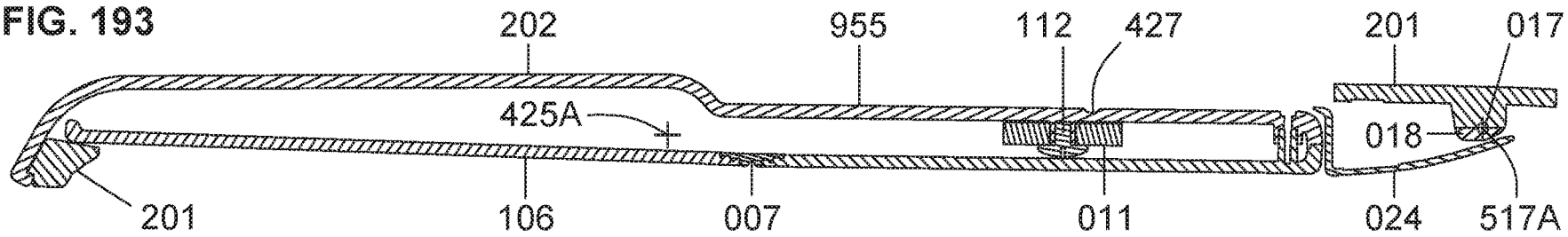

FIG. 193 is a section view passing through components of embodiment 4 (master assembly 1004), taken through the jogged section line 193 in FIG. 192.

Figure 194:
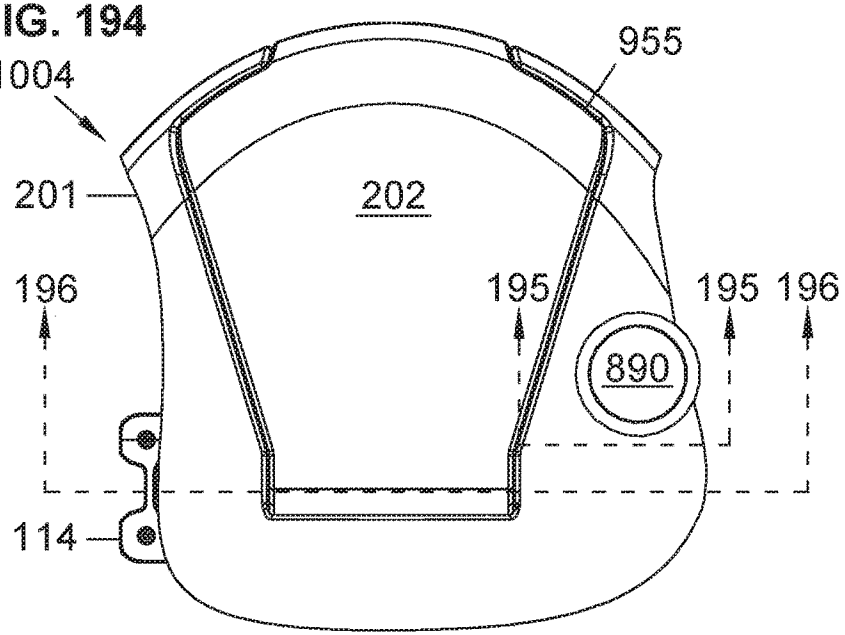

FIG. 194 is a cutaway top plan view of embodiment 4 (master assembly 1004), including components of master assembly 1004 critical to the fixed cartridge pivot system.

Figure 195:
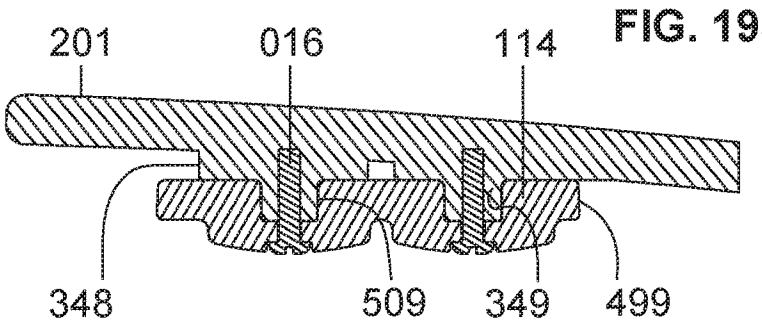

FIG. 195 is a section view passing through components of embodiment 4 (master assembly 1004), taken through section line 195 in FIG. 194.

Figure 196:
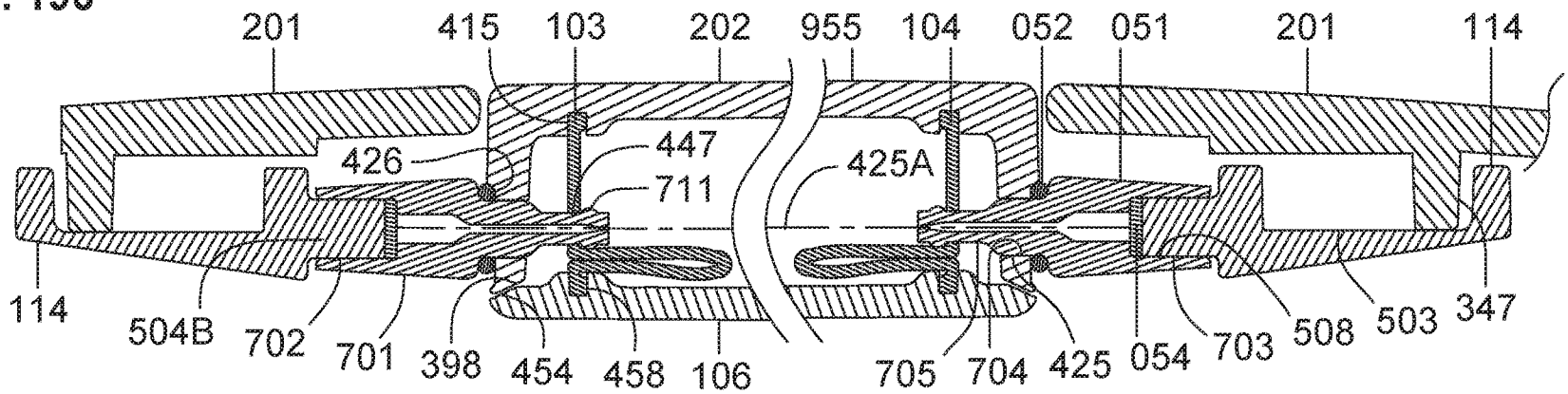

FIG. 196 is a section view passing through components of embodiment 4 (master assembly 1004), taken through section line 196 in FIG. 194.

Figure 197:
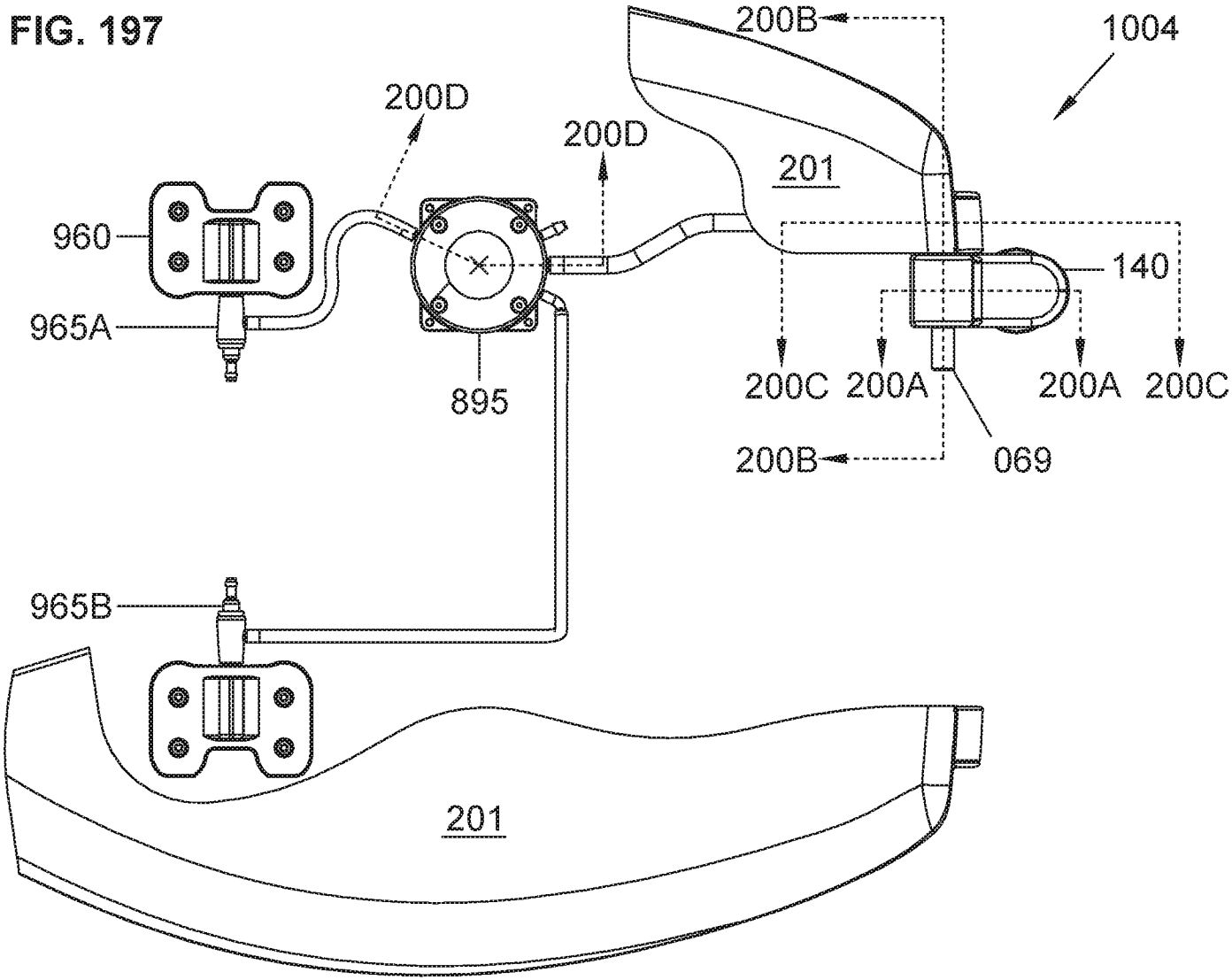

FIG. 197 is a cutaway top plan view of embodiment 4 (master assembly 1004), including components of master assembly 1004 critical to the cartridge rinse system.

Figure 198:
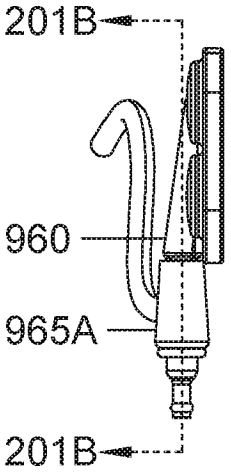

FIG. 198 is a forward elevation view of fixed pivot plate assembly 960 and left spray nozzle assembly 965A, assembled together.

Figure 199:
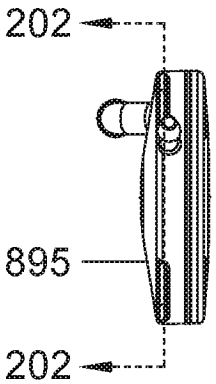

FIG. 199 is a forward elevation view of manual flush valve 895.

Figure 200C:
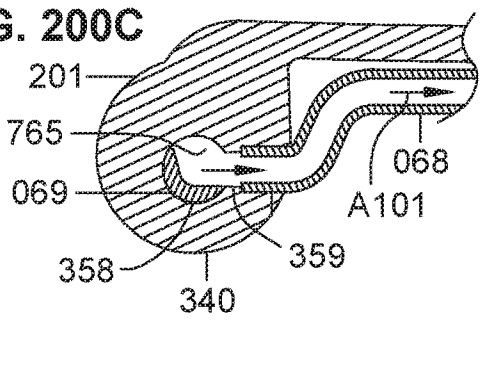
Figure 200B:
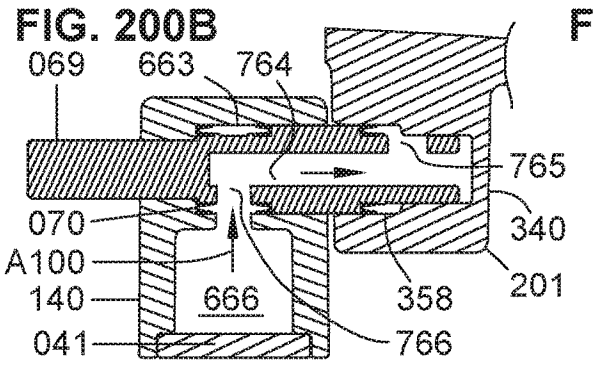
Figure 200D:
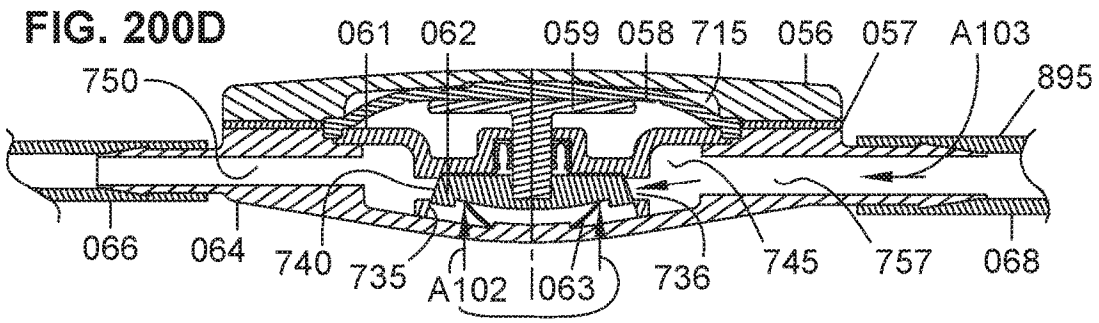
Figure 200A:
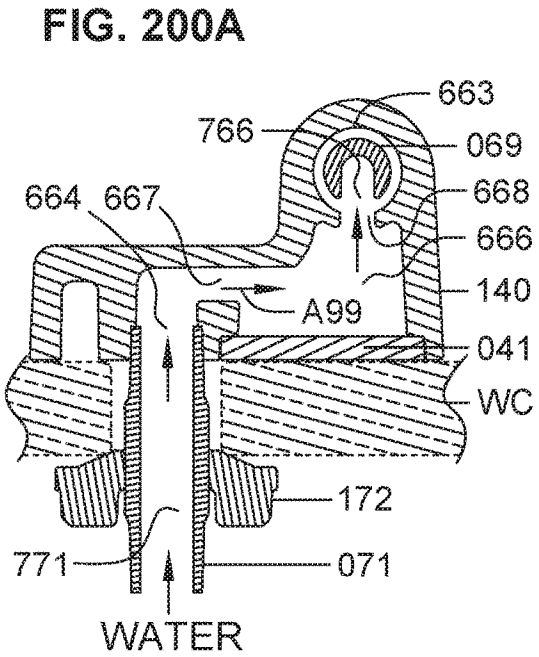

FIG. 200A is a section view passing through components of embodiment 4 (master assembly 1004), taken through section line 200A in FIG. 197, and illustrating the water flow path.

FIG. 200B is a section view passing through components of embodiment 4 (master assembly 1004), taken through section line 200B in FIG. 197, and illustrating the water flow path.

FIG. 200C is a section view passing through components of embodiment 4 (master assembly 1004), taken through section line 200C in FIG. 197, and illustrating the water flow path.

FIG. 200D is a bi-planar section view passing through the center of manual flush valve 895, taken through section line 200D in FIG. 197, and illustrating manual flush valve 895 in its closed state.

Figure 201A:
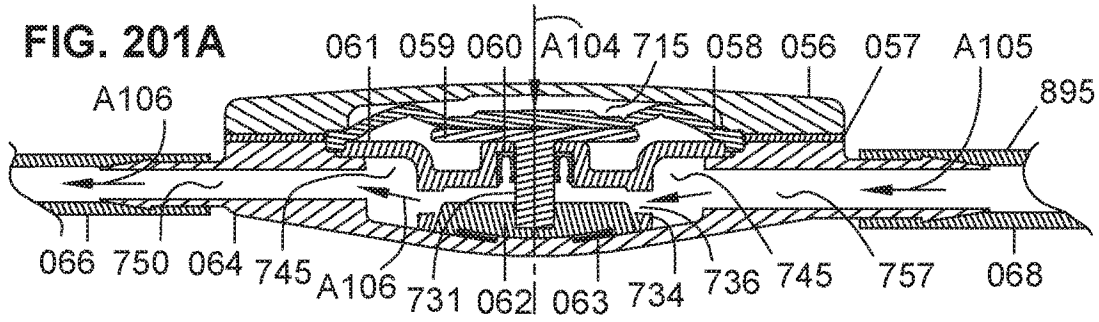

FIG. 201A is a progression from the section view of FIG. 200D, illustrating manual flush valve 895 in its open state.

Figure 201B:
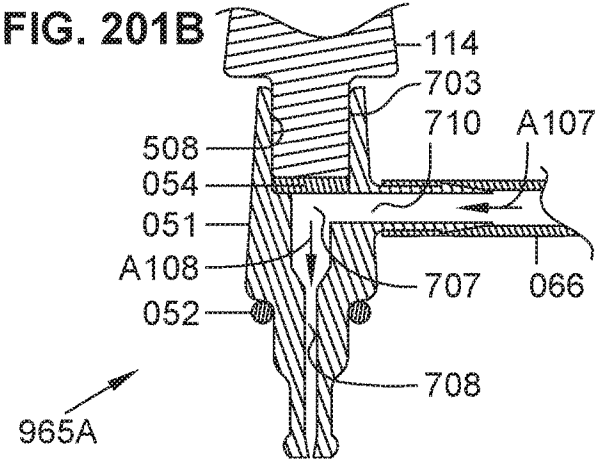

FIG. 201B is a section view passing through fixed pivot plate assembly 960 and left spray nozzle assembly 965A, taken through section line 201B in FIG. 198, and illustrating the water flow path.

Figure 202:
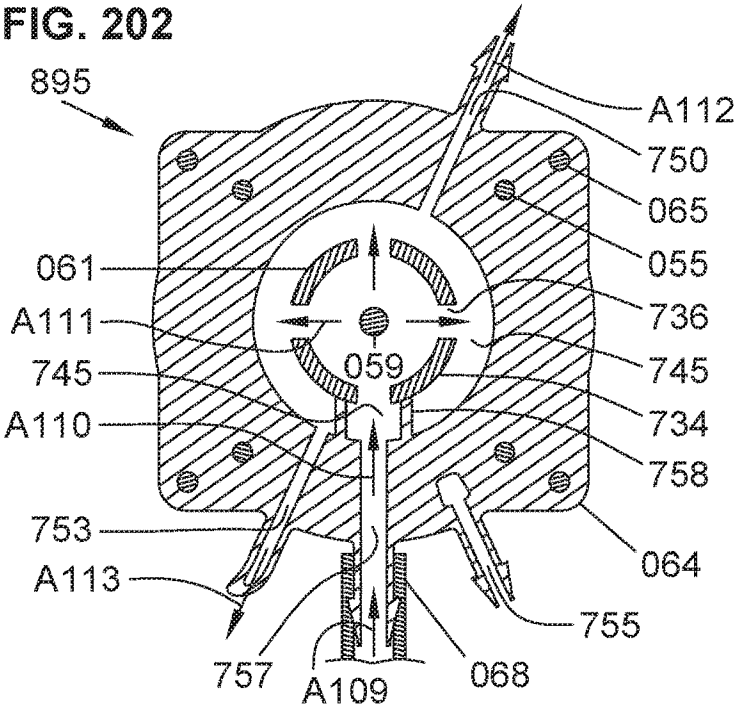

FIG. 202 is a section view passing through manual flush valve 895, taken through section line 202 in FIG. 199, and illustrating the water flow path within manual flush valve 895.

Figure 203:
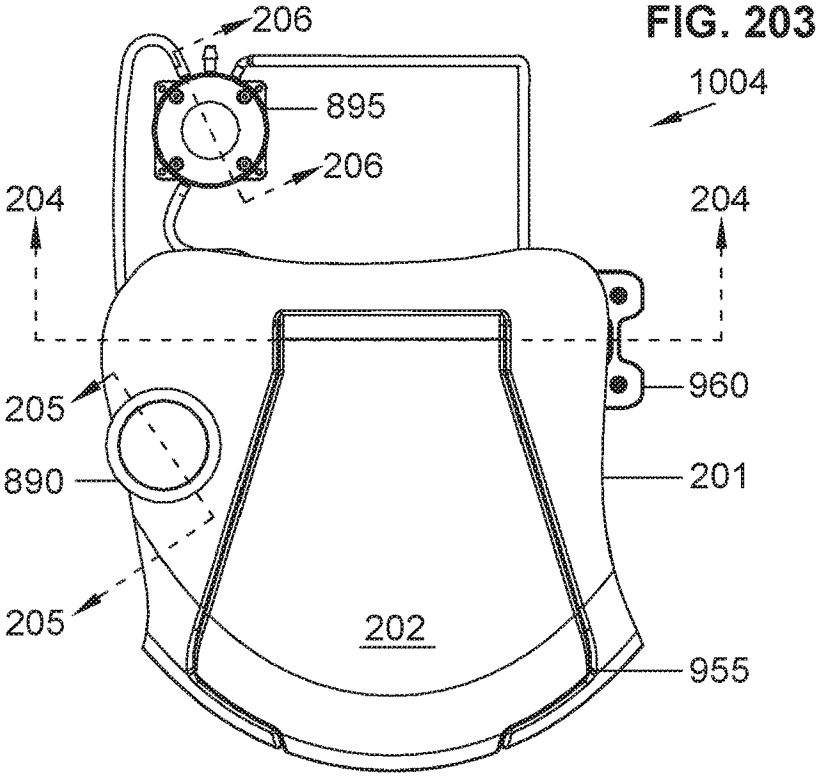

FIG. 203 is a cutaway top plan view of embodiment 4 (master assembly 1004), including components of master assembly 1004 critical to rinse water distribution and the manual pneumatic actuation system.

Figure 204:
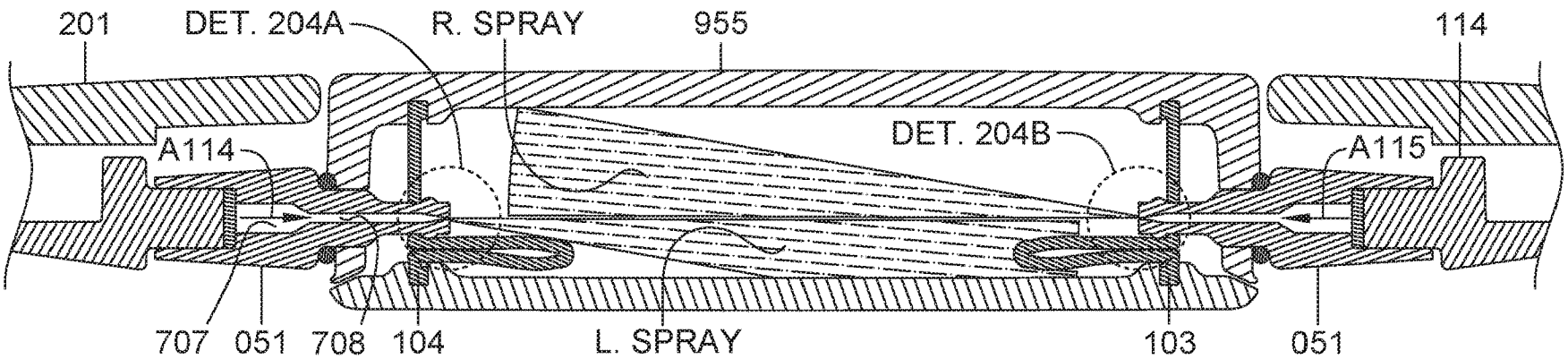

FIG. 204 is a localized section view passing through components of embodiment 4 (master assembly 1004), taken through section line 204 in FIG. 203, and illustrating delivery of the spray rinse water.

FIG. 204A is a detail view from FIG. 204, as indicated by the view window labeled DET. 204A, illustrating details of the left pivot jet 051.

FIG. 204B is a detail view from FIG. 204, as indicated by the view window labeled DET. 204B, illustrating details of the right pivot jet 051.

FIG. 205 is a section view passing through manual actuator 890, taken through section line 205 in FIG. 203.

FIG. 206 is a section view passing through manual flush valve 895, taken through section line 206 in FIG. 203.

FIG. 207 is a progression from the section view of FIG. 205, after flush button cap 045 has been depressed, causing flush button diaphragm 046 to flex downward.

FIG. 208 is a progression from the section view of FIG. 206, consistent with the progressed state of FIG. 207, and representing manual flush valve 895 in an open state.

Figure 209:
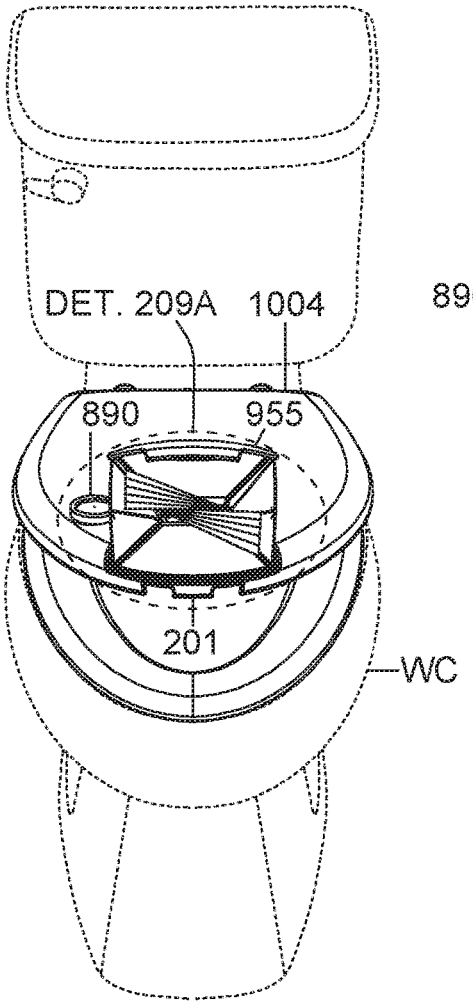

FIG. 209 is a perspective view of embodiment 4 (master assembly 1004) mounted on a water closet (WC) for use; fixed wet cartridge 955 is open for use, and modified WC lid 201 is held in a partially open position by the incremental braking system; manual actuator 890 is depressed, and water rinses the interior of fixed wet cartridge 955.

Figure 209A:
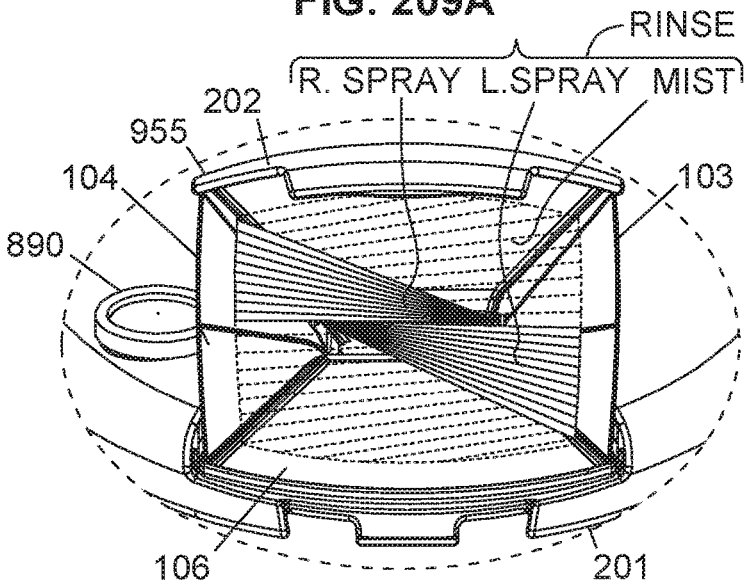

FIG. 209A is a detail view from FIG. 209, as indicated by the view window labeled DET. 209A, illustrating details of the cartridge rinse system.

Figure 210B:
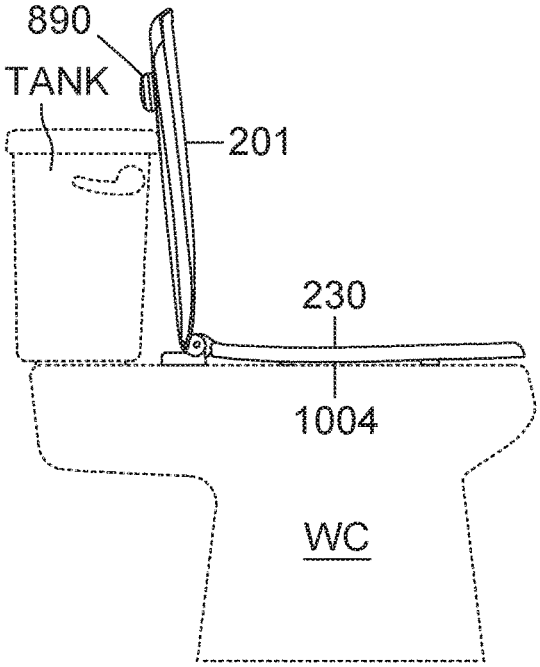
Figure 210A:
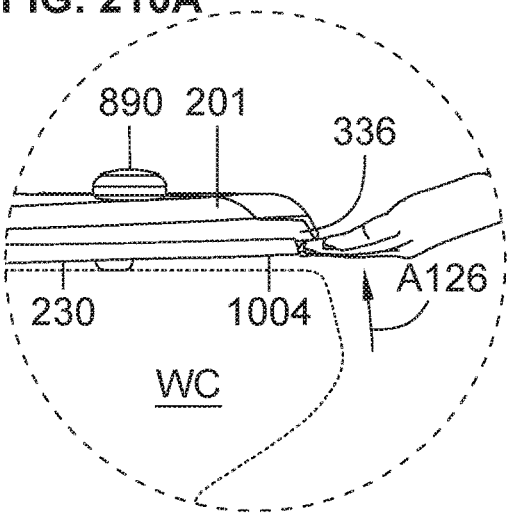

FIG. 210A represents a localized side view of a user preparing to rotate modified WC lid 201 open.

FIG. 210B is a side view of embodiment 4 (master assembly 1004) mounted to a water closet (WC), with modified WC lid 201 open for seated use of the current invention.

Figure 211A:
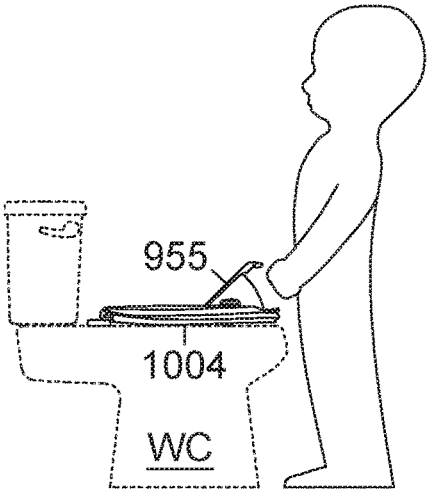

FIG. 211A is a side view of a short user urinating in embodiment 4 (master assembly 1004) mounted to a water closet (WC).

Figure 211B:
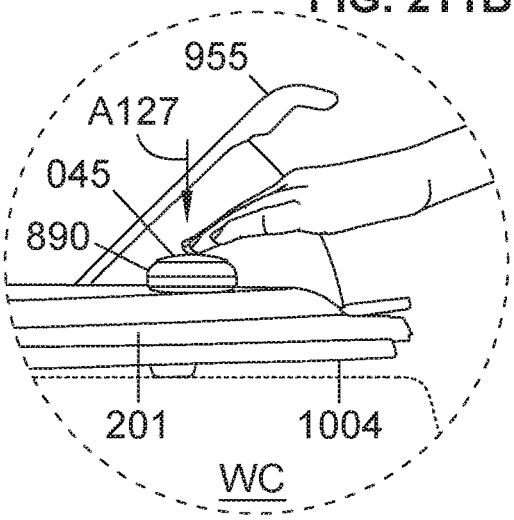

FIG. 211B represents a localized side view of the short user preparing to depress manual actuator 890, to activate the cartridge rinse system with fixed wet cartridge 955 open.

Figure 211C:
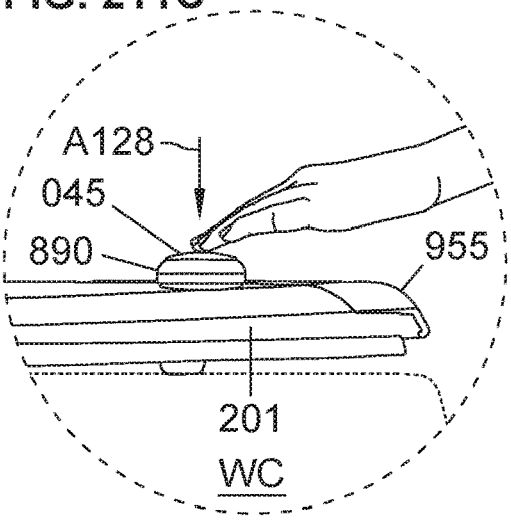

FIG. 211C represents a localized side view of the short user preparing to depress manual actuator 890, to alternatively activate the cartridge rinse system with fixed wet cartridge 955 closed.

Figure 211D:
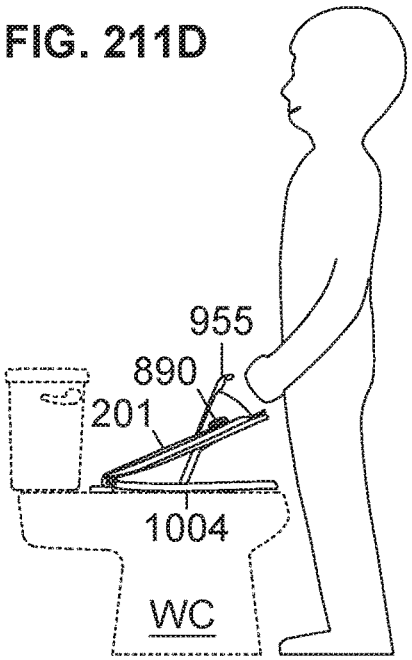

FIG. 211D is a side view of a tall male user urinating in embodiment 4 (master assembly 1004).

Figure 211E:
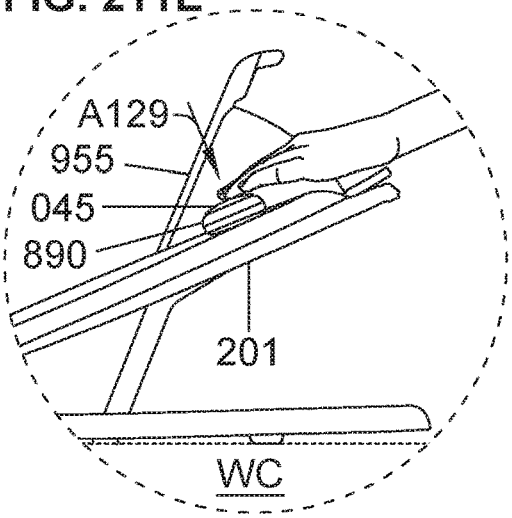

FIG. 211E represents a localized side view of a tall user preparing to depress manual actuator 890, to activate the cartridge rinse system with fixed wet cartridge 955 open.

Figure 211F:
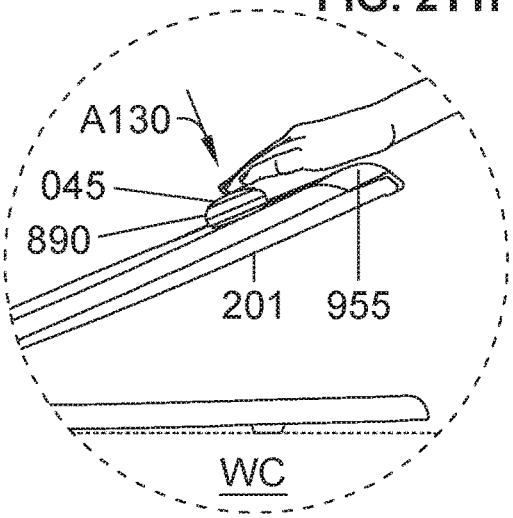

FIG. 211F represents a localized side view of a tall user preparing to depress manual actuator 890, to alternatively activate the cartridge rinse system with fixed wet cartridge 955 closed.

Figure 212:
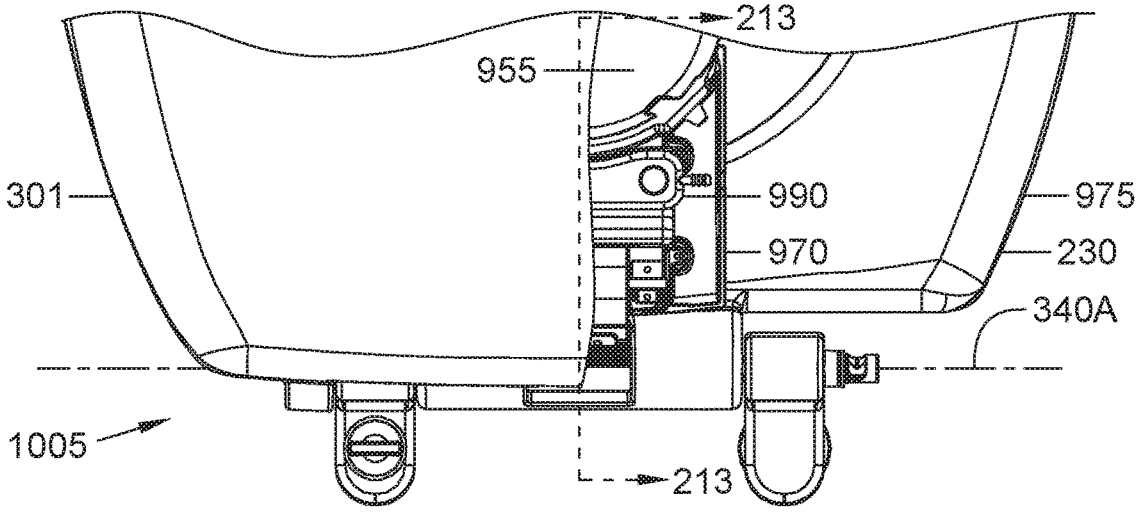

FIG. 212 is a cutaway top plan view of embodiment 5 (master assembly 1005), including components of master assembly 1005 critical to the analog braking system.

Figure 213:
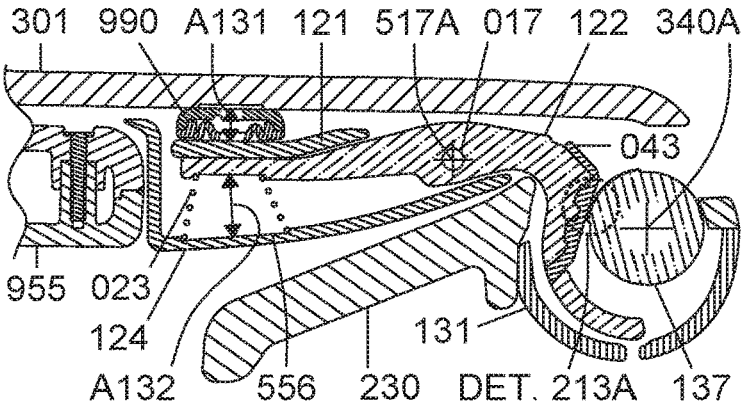

FIG. 213 is a section view passing through components of embodiment 5 (master assembly 1005), taken through section line 213 in FIG. 212.

Figure 213A:
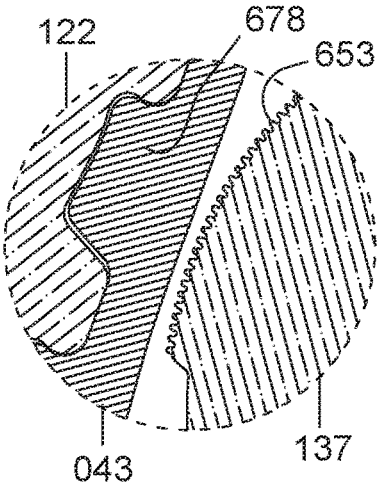

FIG. 213A is a detail view from FIG. 213, as indicated by the view window labeled DET. 213A.

Figure 214:
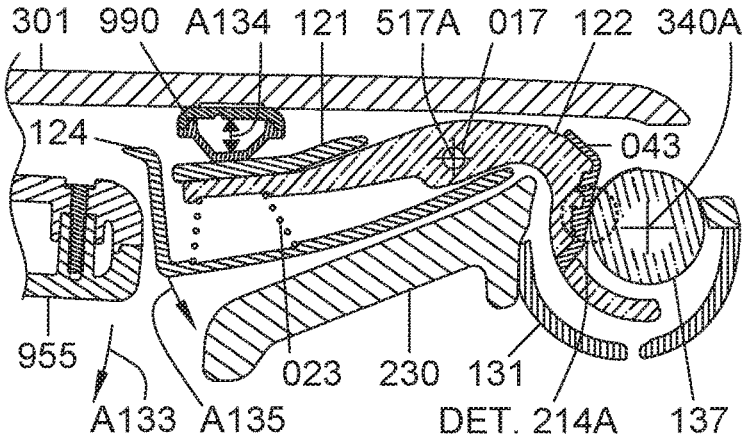

FIG. 214 is a progression from the section view of FIG. 213, as fixed wet cartridge 955 opens.

Figure 214A:
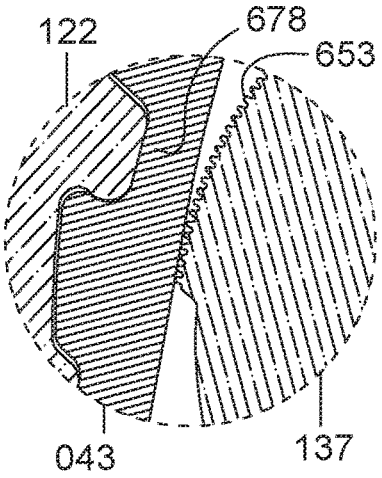

FIG. 214A is a detail view from FIG. 214, as indicated by the view window labeled DET. 214A.

Figure 215:
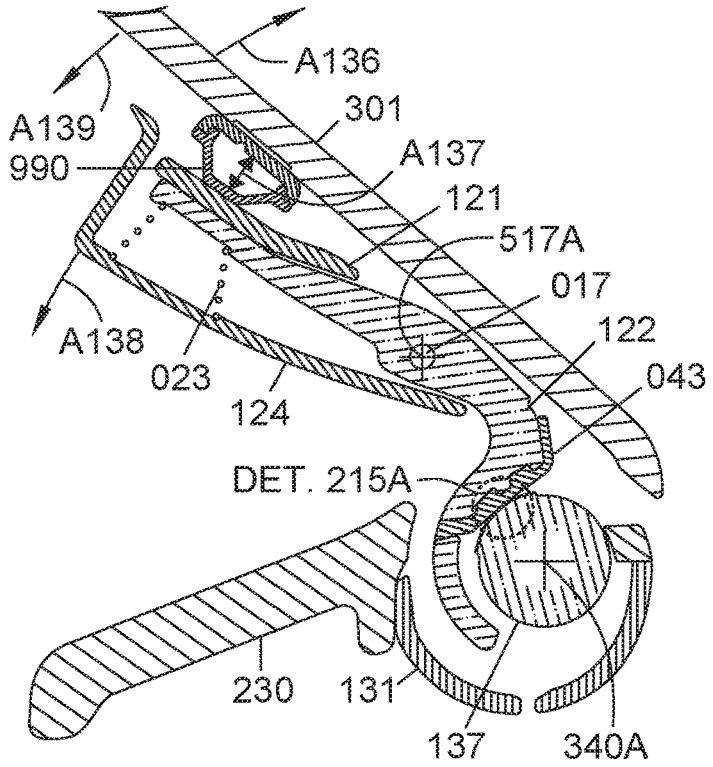

FIG. 215 is a progression from the section view of FIG. 214, after modified WC lid 301 has been rotated open.

Figure 215A:
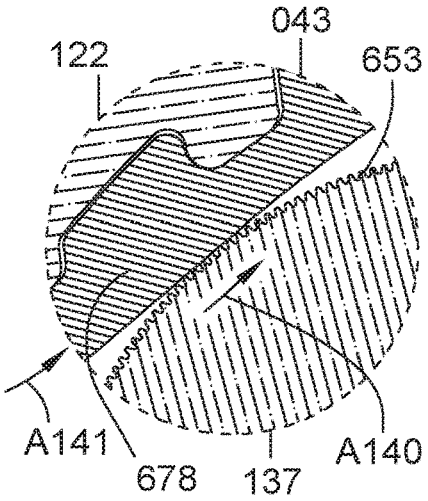

FIG. 215A is a detail view from FIG. 215, as indicated by the view window labeled DET. 215A.

Figure 216:
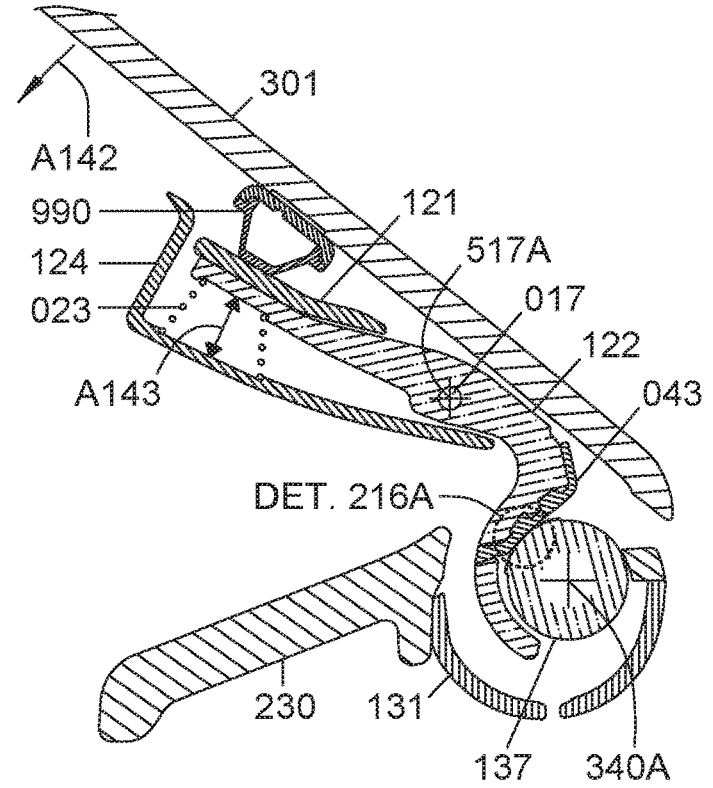

FIG. 216 is a progression from the section view of FIG. 215, as modified WC lid 301 rotates slightly closed allowing the analog braking system to engage.

Figure 216A:
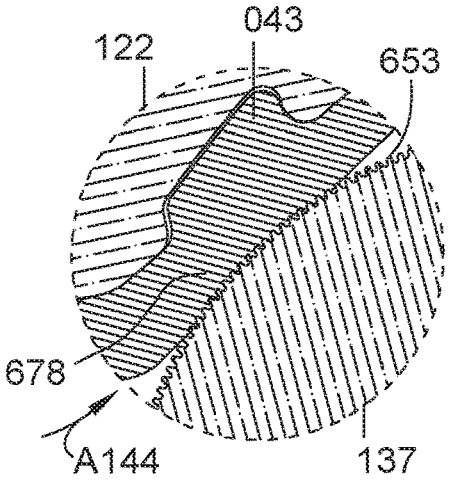

FIG. 216A is a detail view from FIG. 216, as indicated by the view window labeled DET. 216A.

Figure 217:
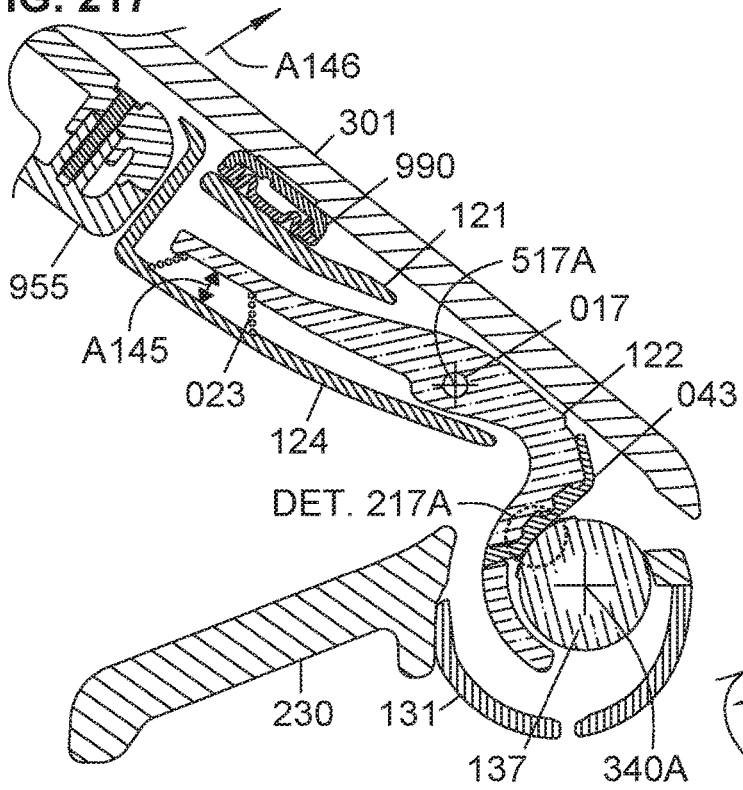

FIG. 217 represents a progression from the section view of FIG. 216, as modified WC lid 301 is rotated slightly open to release the analog braking system.

Figure 217A:
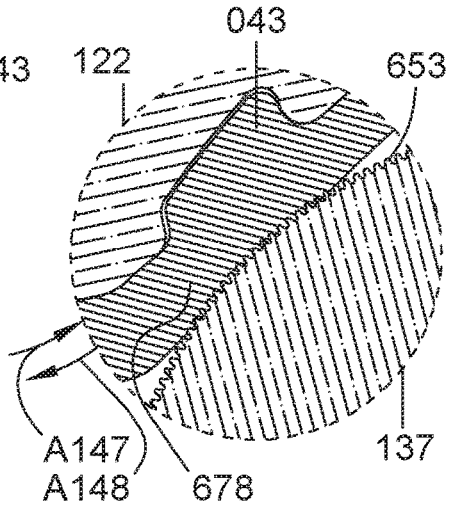

FIG. 217A is a detail view from FIG. 217, as indicated by the view window labeled DET. 217A in FIG. 217.

Figure 218:
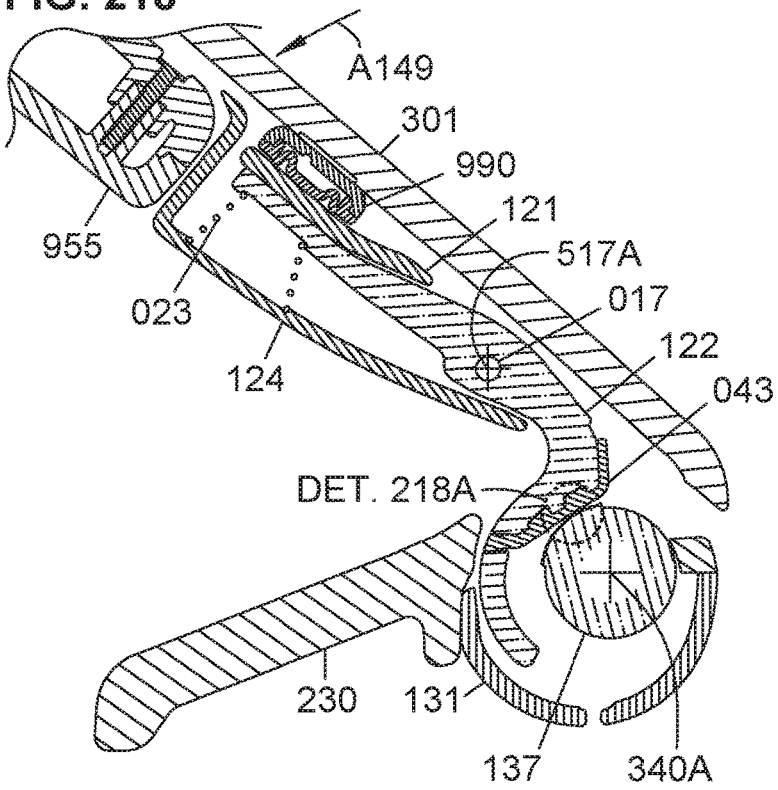

FIG. 218 is a progression from the section view of FIG. 217, as modified WC lid 301 rotates closed after the analog braking system has been released.

Figure 218A:
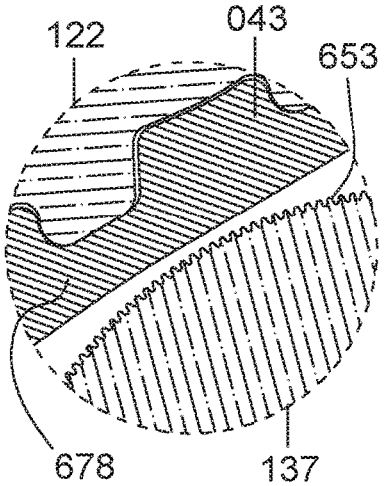

FIG. 218A is a detail view from FIG. 218, as indicated by the view window labeled DET. 218A in FIG. 218.

Figure 219:
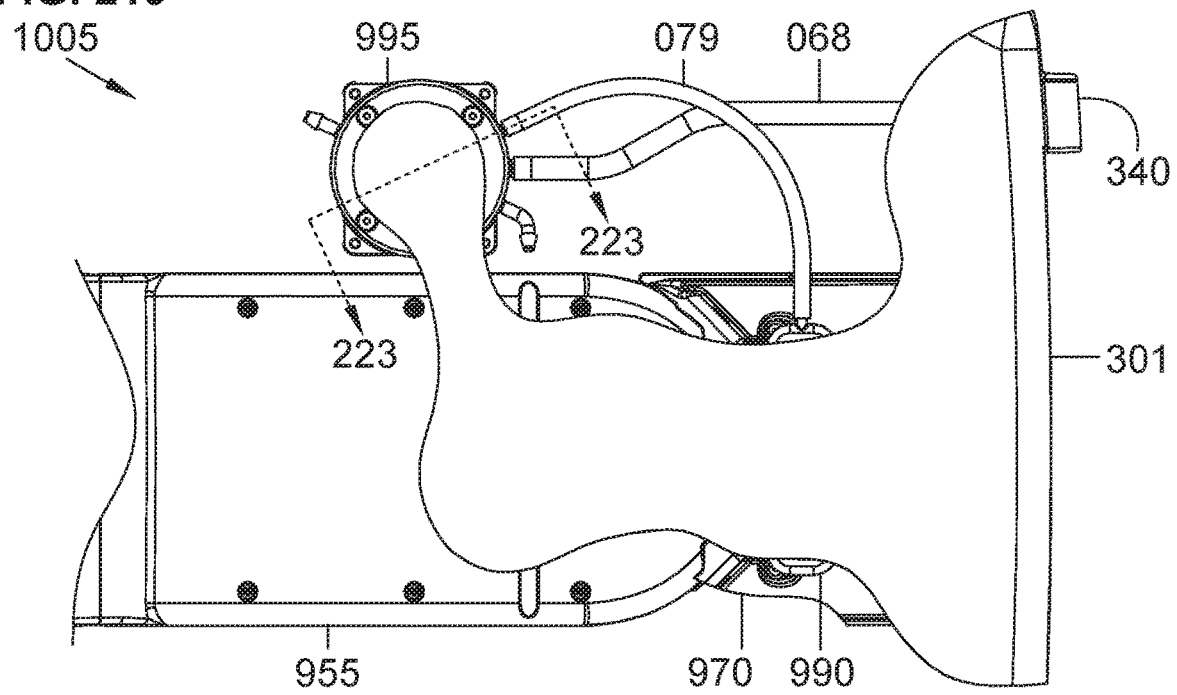

FIG. 219 is a cutaway top plan view of embodiment 5 (master assembly 1005), including components of master assembly 1005 critical to the automatic actuation system.

Figure 220:
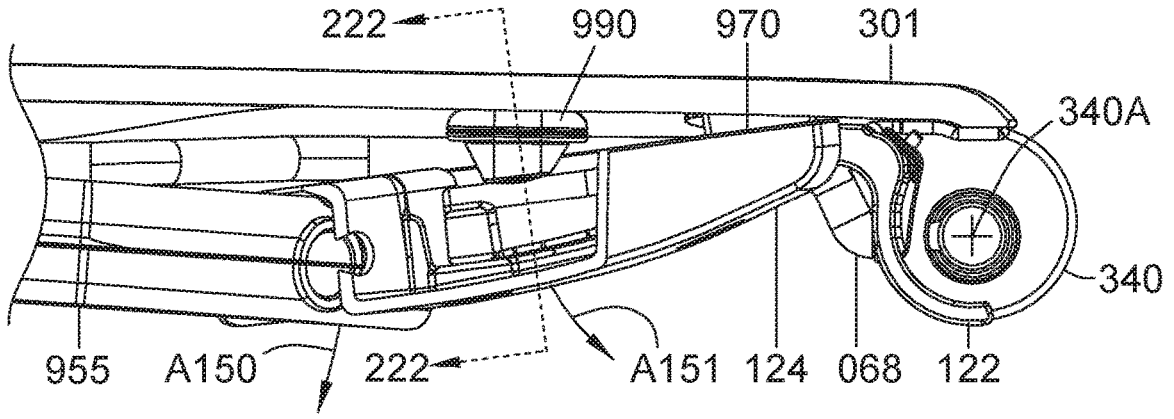

FIG. 220 is a side elevation view of the same components represented in FIG. 219, as fixed wet cartridge 955 rotates open, and brake cover 124 rotates open in response.

Figure 221:
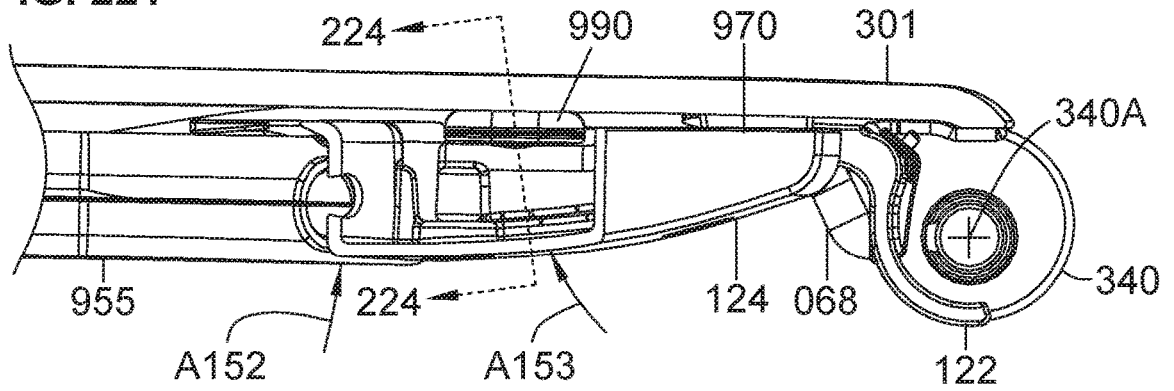

FIG. 221 is also a side elevation view of the same components represented in FIG. 219, but as fixed wet cartridge 955 rotates closed, and brake cover 124 rotates closed in response.

FIG. 222 is a section view passing through the approximate center of automatic actuator 990, taken through section line 222 in FIG. 220.

FIG. 223 is a section view passing through the center of automatic flush valve 995, taken through section line 223 in FIG. 219, representing automatic flush valve 995 in its closed state.

FIG. 224, a progression from FIG. 222, is a section view passing through the approximate center of automatic actuator 990, taken through section line 224 in FIG. 221.

FIG. 225 is a progression from FIG. 223, representing automatic flush valve 995 in an open state, consistent with the progressed state of FIG. 224.

Figure 226:
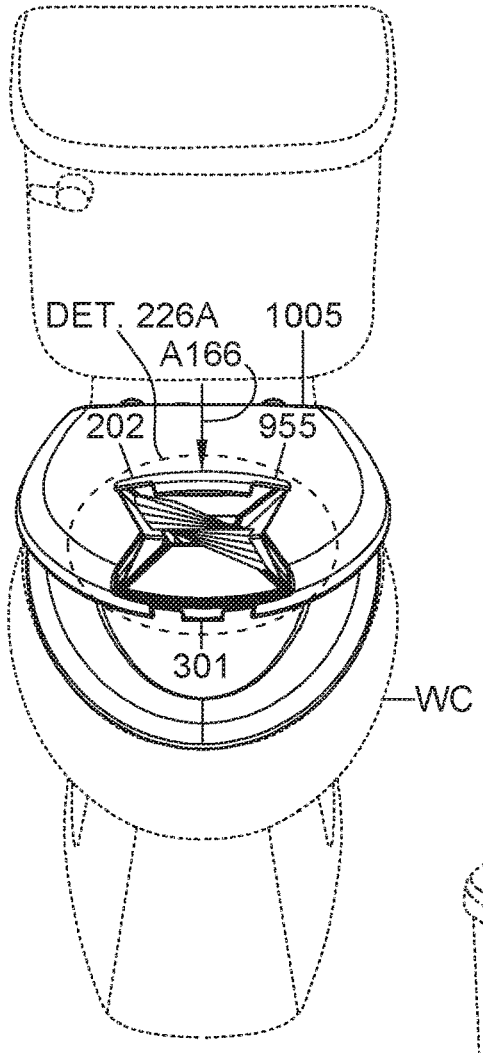

FIG. 226 is a perspective view of embodiment 5 (master assembly 1005) mounted on a water closet (WC) for use. As fixed wet cartridge 955 closes and activates the cartridge rinse system, water rinses the interior of fixed wet cartridge 955.

Figure 226A:
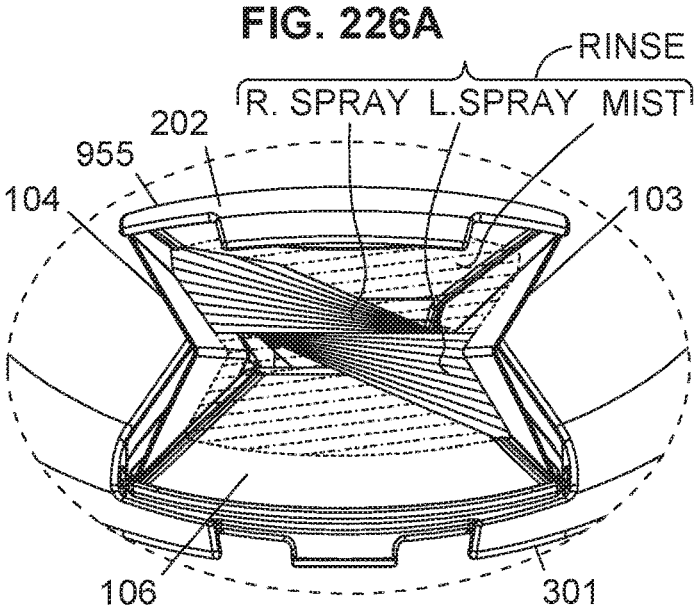

FIG. 226A is a detail view from FIG. 226, as indicated by the view window labeled DET. 226A, illustrating details of the cartridge rinse system.

Figure 227:
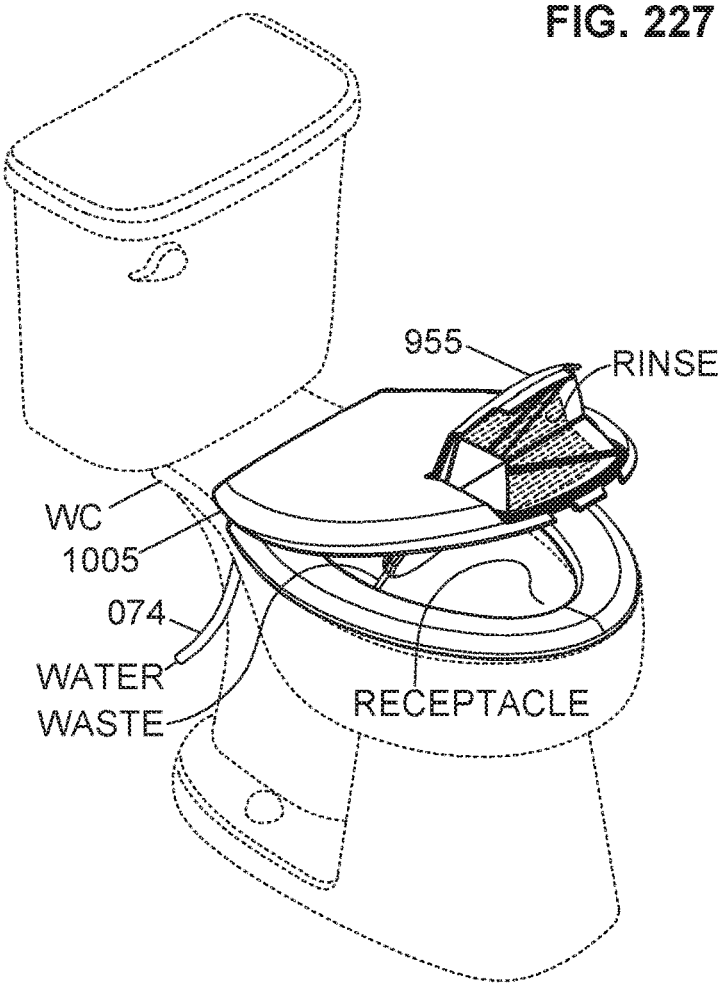

FIG. 227, similar to FIG. 226, is a perspective view of embodiment 5 (master assembly 1005) mounted on a water closet (WC) for use. As fixed wet cartridge 955 closes and activates the cartridge rinse system, water rinses the interior of fixed wet cartridge 955.

DETAILED DESCRIPTION OF THE INVENTION

1. Overview of the Detailed Description

To clearly demonstrate the elements which may comprise the current invention, and the numerous advantageous improvements comprehended through development, five embodiments are depicted in this specification. The embodiments are presented in order of progressive functionality, each comprised of numerous individual components and assemblies. In some instances, different embodiments share identical components or assemblies; in other instances, different embodiments utilize similar components, or similar assemblies, having minor differences. To help demonstrate the commonality of these components while clearly differentiating similar components, reference identifiers and assembly numbers are organized sequentially.

To concisely describe the fit, form, and function of these multiple embodiments, and to disclose the large volume of information in an organized fashion, the detailed description is arranged as follows:

Section 2, "Summary of the Embodiments" presents a brief overview of the functional systems included in each embodiment.

Section 3, "Structural Description of the Components" describes each component with detail given to its individual features. To more comprehensively illustrate these individual features, numerous cross-references are included to demonstrate the interdependence of features between related components, and to establish how the individual components fit together and relate within the assemblies.

Section 4, "Description of the Assemblies" methodically describes each assembly as a collection of its individual components. Also in this section, each embodiment is described as a master assembly, comprised of individual assemblies and components.

In section 5, "Description of the Functional Systems and Usage", the various functional aspects of each embodiment are addressed systematically, by illustrating the core components of each functional system, and comprehensively describing the interactive relationships of the individual components during operation. Also in this section, consumer usage is illustrated and described for each embodiment, as best contemplated by the inventor.

Section 6, "Comprehensive Interpretation of the Current Invention", asserts that the functional benefits of the current invention are not limited to the specific embodiments presented here, and the current invention should therefore be interpreted comprehensively with respect to this specification This top-down arrangement provides a means to methodically address fit, form, function and usage of the multiple embodiments presented herein. Furthermore, it allows progressive illustration of similar parts and subassemblies. Although this document is arranged to be read sequentially, the components hereof may be formulated in any order conducive to the reader's comprehension of the current invention.

2. Summary of the Embodiments

Below are brief descriptions of the functional systems incorporated in each embodiment presented here, to provide a functional overview and illustrate the similarities and differences between each embodiment.

Embodiment 1

This embodiment represents a very basic form of the present invention. It incorporates a simple assembly hinge pivot system, allowing rotation of the water closet seat and lid, and an open top urinal with a rigidly mounted urinal pan.

Embodiment 2

This embodiment is substantially identical to embodiment 1, notwithstanding the addition of a rotating component that acts as a receptacle lid and a urine funnel. Embodiment 2 uses the same simple assembly hinge pivot system of embodiment 1.

Embodiment 3

This embodiment, significantly more advanced than embodiments 1 and 2, includes the following functional systems: an assembly hinge pivot system with integrated slow-close rotational dampening, slowing downward rotation of both the water closet seat and lid; a collapsible and removable urinal cartridge which includes a sealing funnel spout and nightlight accommodations; an incremental braking system that allows the user to quickly and easily adjust urinal height with each use. An optional accessory may be used with embodiment 3 to screen debris and hold chemical beads for odor control.

Embodiment 4

This embodiment includes the following functional systems: an assembly hinge pivot system with integrated slow-close rotational dampening, slowing downward rotation of the water closet lid; a collapsible fixed urinal cartridge with the same sealing funnel spout feature of embodiment 3; the same incremental braking system of embodiment 3, allowing the user to quickly adjust urinal height; concealed water supply plumbing and a manually controlled cartridge rinse system. The optional accessory noted above may also be used with embodiment 4 for debris screening and odor control.

Embodiment 5

Embodiment 5 is very similar to embodiment 4, except that embodiment 5 incorporates an analog braking system, instead of the incremental braking system of embodiments 3 and 4. Also, unlike the manually controlled cartridge rinse system of embodiment 4, embodiment 5 uses an automatic controller to activate the cartridge rinse system with each use. The optional accessory noted above may also be used with embodiment 5 for debris screening and odor control.

3. Structural Description of the Components

Preface

The below points pertain to the organization of the numerous, and often similar, parts described here.

Identifier Sequence:

The reference identifiers listed here are not arranged simply by conventional numeric sequence, but they are organized sequentially to aid in the description of similar components.

Part reference identifiers have each been assigned a three digit number, in a format represented by "AXX", where "XX" represents a two-digit member numeral, and "A" represents a single-digit progression indicator. If that member occurs in multiple embodiments, having minor differences between the occurrences, "A" is used to indicate the progression of the part.

In example, the member "Modified WC Lid" occurs in multiple embodiments, with minor feature differences between the occurrences. The first instance of the Modified WC Lid is assigned reference identifier "001", the second instance is assigned reference identifier "101", the next instance is assigned reference identifier "201", and so on.

To aid in the description of similar components, the part numbers below are sorted first by the member numeral "XX", and secondly by the progression indicator "A". So, part 002 is followed by part 102, and then part 202, the final instance of this progression. Immediately following part 202 are parts 003, and 103. Singular parts, not part of a progressive sequence, will only appear one time, with a progression indicator of "0".

Similar Geometry:

Where similar parts do exist, the structural descriptions are organized to clearly identify the geometric similarities and to avoid the repetition of describing those similar features in multiple instances. In some instances, common geometry is first described, followed by the distinguishing characteristics of each part. In other instances, the first part in a progression is described, and the next part in the progression is described comparatively. In each case, the progressive parts are described in the most concise manner determined.

Coordinate and Surface References:

To build a more comprehensive illustration of the components depicted here, the parts herein are often described with respect to their location and orientation within the respective master assembly. Where pertinent to functionality, surfaces are also referenced to complimentary surfaces shared by adjacent parts within the respective master assembly. In the case that complimentary surfaces articulate relative to one another during use, such references include verbiage to clarify the relative position of reference, such as "within the respective stored master assembly", indicating that the particular relationship being drawn between complimentary surfaces may only be valid when the respective master assembly is in a stored (closed) state.

Modified WC Lid 001/101/201/301 Common Geometry—

Figure 1:
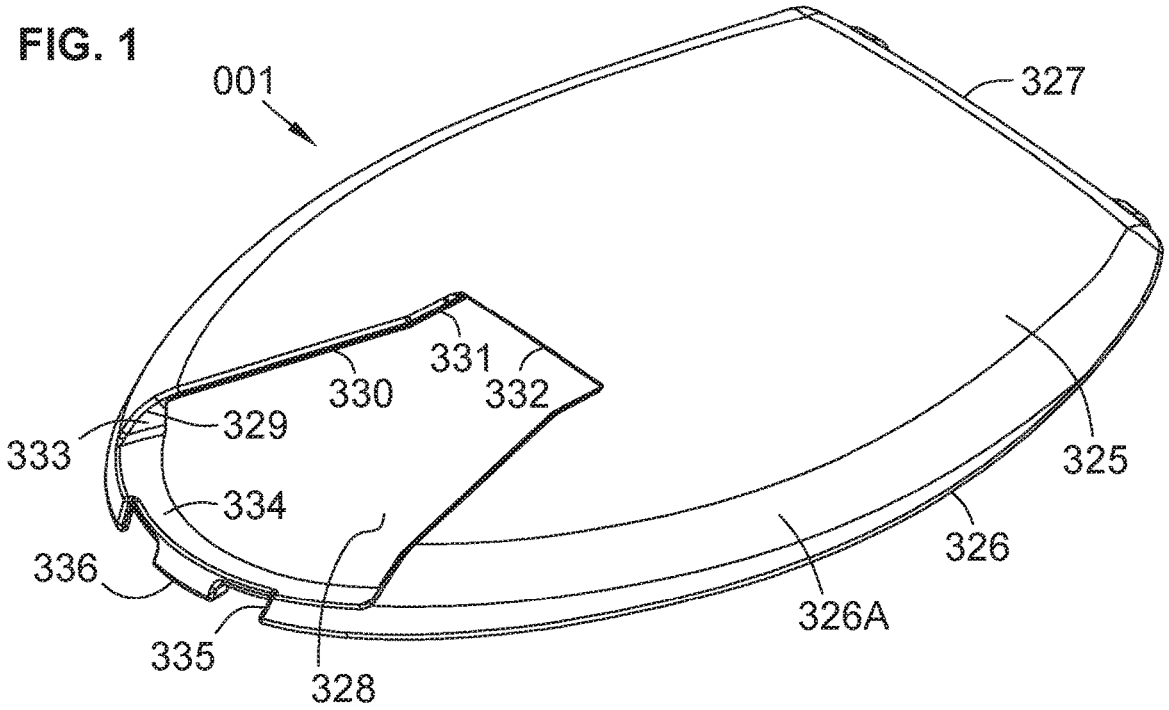
FIG. 1 is perspective view of modified WC lid 001.

These parts, preferably formed of molded plastic, are similar in several aspects to traditional western style water closet lids, and bear the following common features: Referring to FIG. 1, a thin, large, softly domed upper elliptical shaped plate member 325; plate member 325, having elliptical width approximately two-thirds of its length; the width of plate member 325 further being slightly smaller than the corresponding overall width of the rim (RIM, FIG. 56A) of the water closet (WC, FIG. 56A) it is intended to cap; plate member 325 further curling downward around its elliptical boundary into a shallow perimeter lip 326; the area encompassed by perimeter lip 326 being slightly greater than the overall dimensions of modified WC seat 030/130; the downward curl adjoining plate member 325 to perimeter lip 326 hereafter being identified as perimeter blend radius 326A; the elliptical shape of plate member 325 further being trimmed to the rear of its longitudinal axis, in a substantially vertical plane; plate member 325 further curling downward at its rear edge, forming rear lip 327; rear lip 327 further blending into perimeter lip 326 at either end; a vertical cut passing through plate member 325, creating receptacle opening 328 near the front of plate member 325; receptacle opening 328 being bound by two short forward parallel sides 329, two converging angled sides 330 with rearward convergence, two rear parallel sides 331, and a transverse contoured rear surface 332, occurring near the center of plate member 325; two short drop walls 333 extending downward from the forward parallel sides 329 of receptacle opening 328 in plate member 325, and terminating at a horizontal radial bridge 334; radial bridge 334 spanning the foremost edge of receptacle opening 328; perimeter lip 326 continuing around the forward sides of radial bridge 334 and terminating in two oblique edge breaks 335; oblique edge breaks 335, both sloping inwardly downward, further being symmetrically centered about the longitudinal center plane of the part; the upper surface of radial bridge 334 having a slight downward slope toward the center of the part; a thickened protrusion, having length about half the distance occurring between oblique edge breaks 335, extending below the central portion of radial bridge 334; the thickened protrusion, hereafter identified as contact post 336, providing a substantial member for hand contact with this part.

Figure 2:
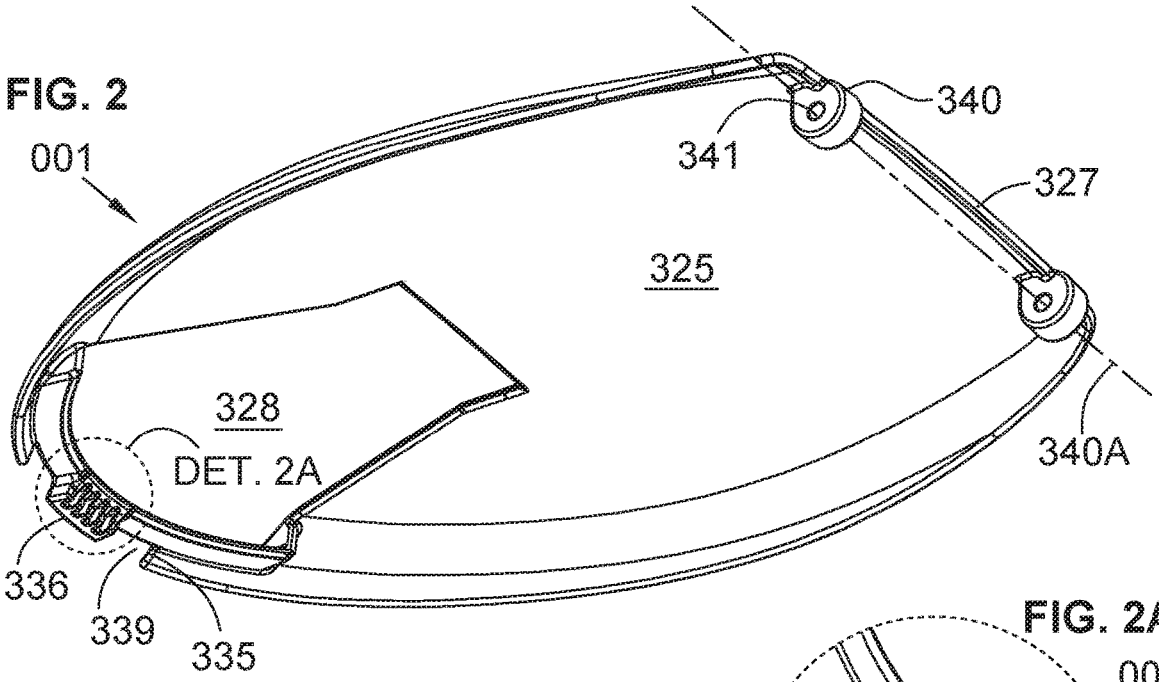
FIG. 2 is an additional perspective view of modified WC lid 001.
Figure 2A:
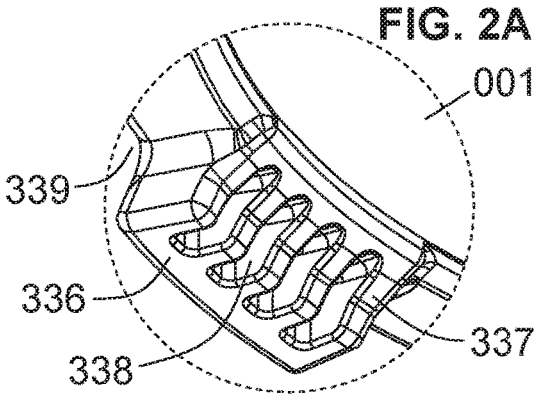
FIG. 2A is a detail view of modified WC lid 001, as indicated by the view window labeled DET. 2A in FIG. 2.

Referring to FIG. 2, and then FIG. 2A, contact post 336 further including a lower concave interior region, hereafter identified as seat contact 337; seat contact 337 being proportioned to mate with modified WC seat 030/130/230, when the respective master assembly is in its stored position, to provide resting support of this part; four coring cuts 338, interrupting seat contact 337, and substantially thinning unnecessary material within contact post 336, to aid in fabrication.

Referring to FIG. 2, occurring between contact post 336 and each oblique edge break 335, a substantial void occurring, constituting finger openings 339; finger openings 339 being symmetrically positioned about the longitudinal center plane of the part, and providing user access for operation of the respective master assembly; two short cylindrical hinge protrusions 340 extending downward from the rearmost edge of plate member 325, and interrupting rear lip 327; hinge protrusions 340 being equally spaced about the longitudinal center plane of the part; hinge protrusions 340 further being positioned and proportioned to span hinge pivot blocks 040/140 (Reference FIG. 104), within the respective master assembly; a horizontal axis passing concentrically through hinge protrusions 340, hereafter being identified as hinge pivot axis 340A; hinge pivot axis 340A occurring substantially parallel to rear lip 327, and being located a short distance below the rearmost edge of rear lip 327.

Modified WC Lid 001—

In addition to the common geometry of modified WC lid 001/101/201/301, this part further includes the following features, as shown in FIG. 2: Two small diameter through-holes laterally piercing hinge protrusions 340; the through-holes further being substantially concentric to hinge pivot axis 340A, and comprising hinge bearing ports 341; hinge bearing ports 341 further being proportioned to receive hinge pin 044 or bearing stem 655 of hinge cylinder 038 (Reference FIG. 69); this part further having material properties allowing solvent welding of urine pan 042 to modified WC lid 001.

Modified WC Lid 101—

Figure 3:
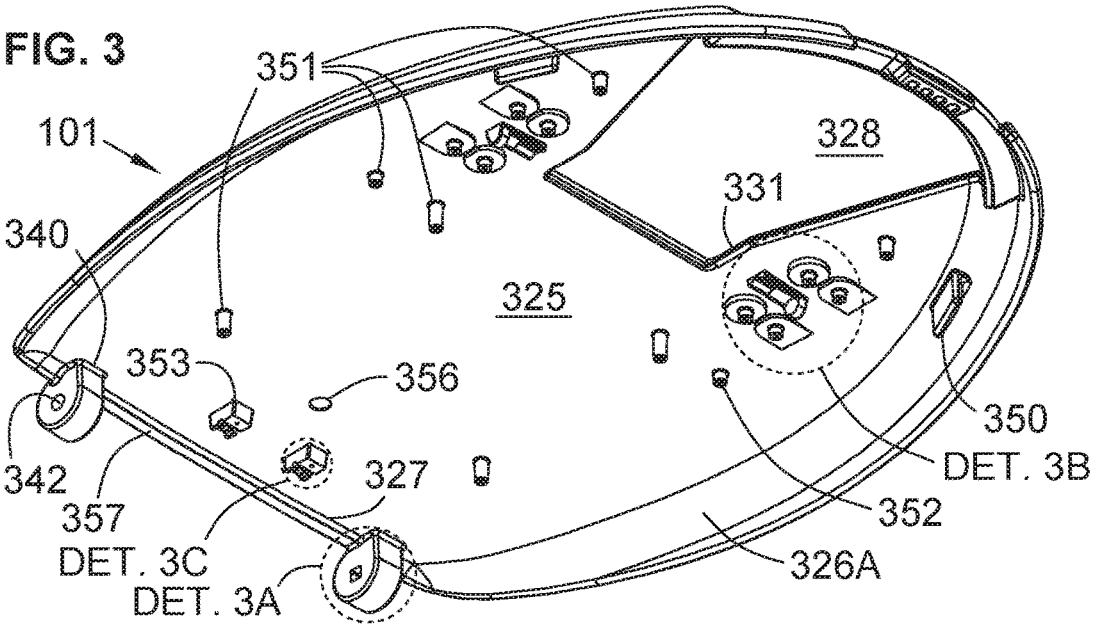
FIG. 3 is a perspective view of modified WC lid 101.
Figure 3A:
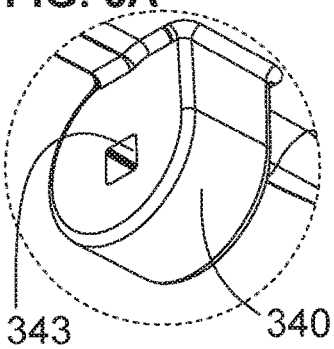
FIG. 3A is a detail view of modified WC lid 101, as indicated by the view window labeled DET. 3A in FIG. 3.

In addition to the common geometry of modified WC lid 001/101/201/301, this part further includes the following features:

Hinge Bearing Port and Keyed Bearing Port:

Referring to FIG. 3, a single small diameter through-hole piercing the leftmost hinge protrusion 340, creating hinge bearing port 342; referring to FIG. 3A, a similarly sized square profile through-hole piercing the rightmost hinge protrusion 340, creating keyed bearing port 343; both through-holes being substantially concentric to hinge protrusions 340.

Figure 4:
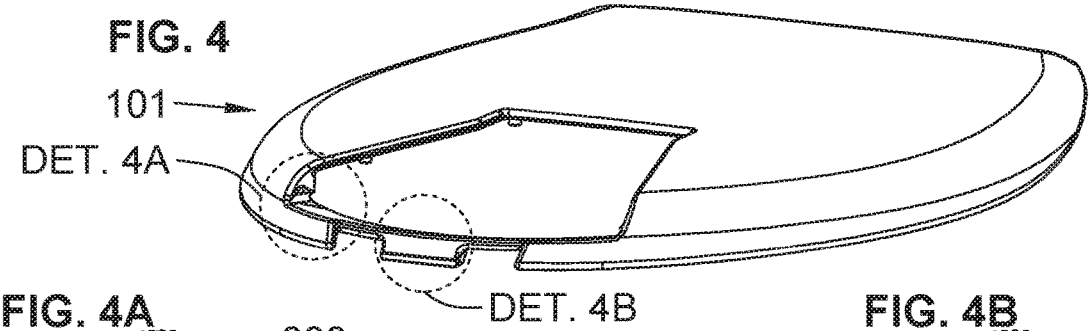
FIG. 4 is an additional perspective view of modified WC lid 101.
Figure 4A:
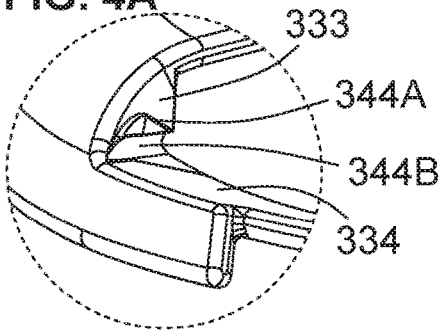
FIG. 4A is a detail view of modified WC lid 101, as indicated by the view window labeled DET. 4A in FIG. 4.
Figure 23:
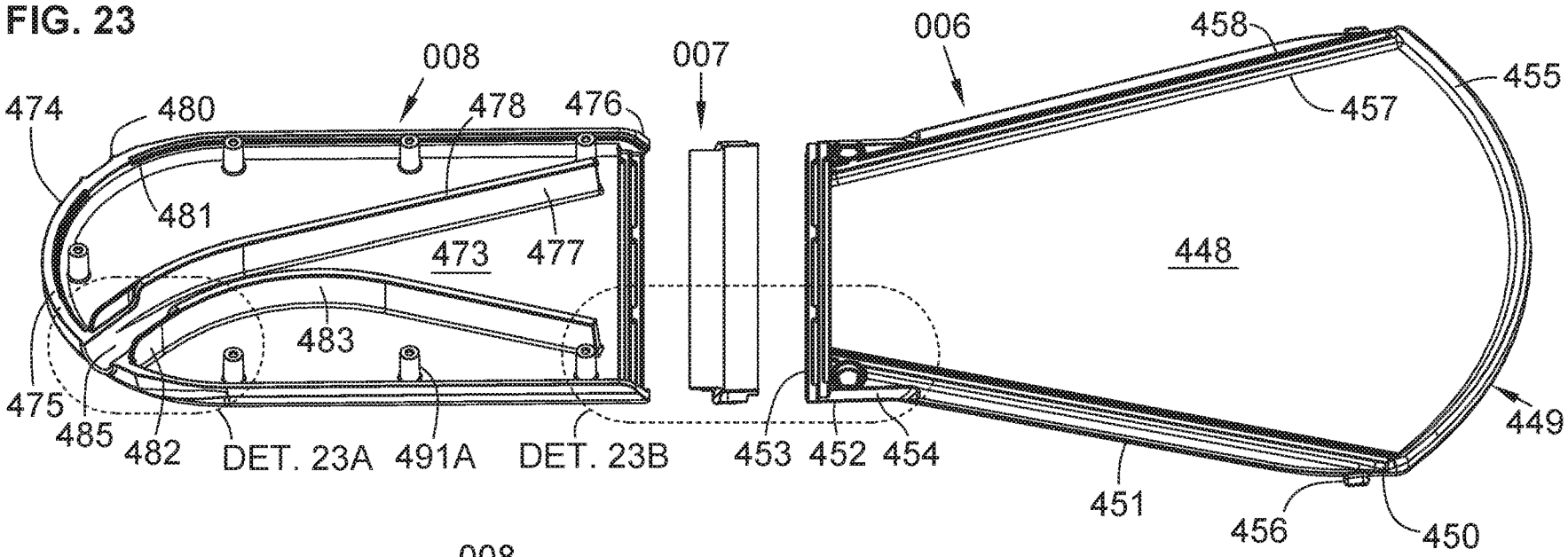
FIG. 23 is a perspective view of forward cartridge base 006, cartridge hinge 007 and rear cartridge base 008.

Slide Channels:

Referring to FIG. 4, and then FIG. 4A, two shallow contoured ledges, protruding inward a short distance from drop walls 333 near the mid-height of drop walls 333, and having length about half that of drop walls 333, constituting slide guides 344A; slide guides 344A protruding furthest from drop walls 333 near their mid-length, and blending tangentially into the interior surfaces of drop walls 333 near their forward extremities; two parallel cylindrical grooves occurring immediately below slide guides 344A and tangentially intersecting the top surface of radial bridge 334, creating slide channels 344B; slide channels 344B having a slight downward slope toward the rear of the part, complimenting the local slope of radial bridge 334; slide channels 344B further being proportioned to receive guide protrusions 456 of forward cartridge base 006/106 (Reference FIG. 23.).

Figure 4B:
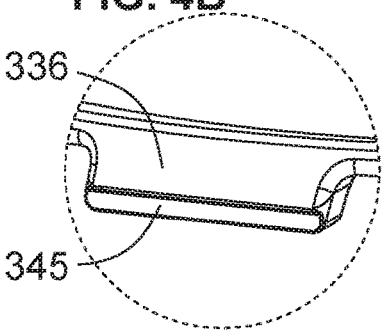
FIG. 4B is a detail view of modified WC lid 101, as indicated by the view window labeled DET. 4B in FIG. 4.
Figure 11:
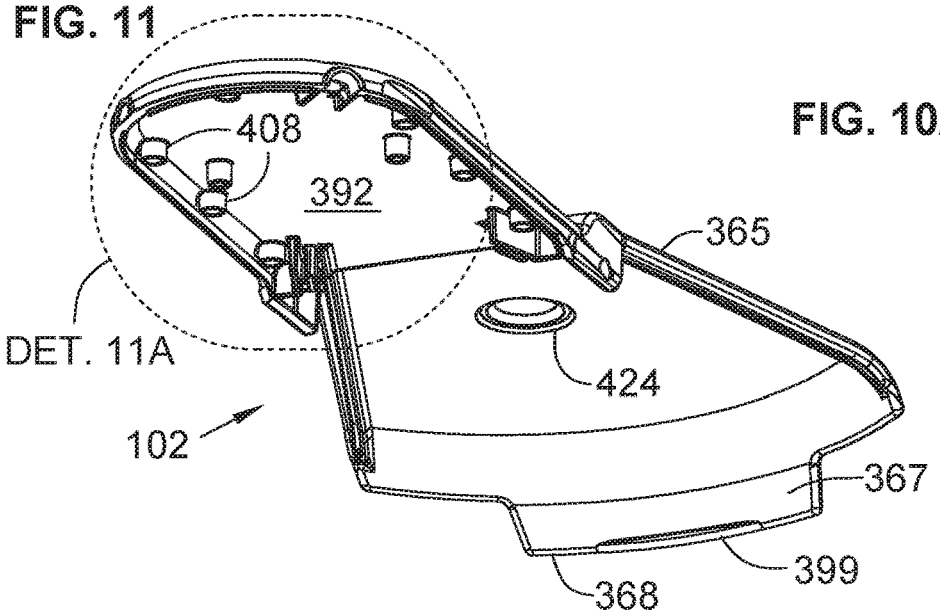
FIG. 11 is an additional perspective view of upper cartridge segment 102.

Latch Groove:

Referring to FIG. 4, and then FIG. 4B, a latch groove 345, having a linearly extruded square profile, occurring on the bottom forward edge of contact post 336, and proportioned to receive latch protrusion 399 of upper cartridge segment 102/202 (Reference FIG. 11.).

Figure 3B:
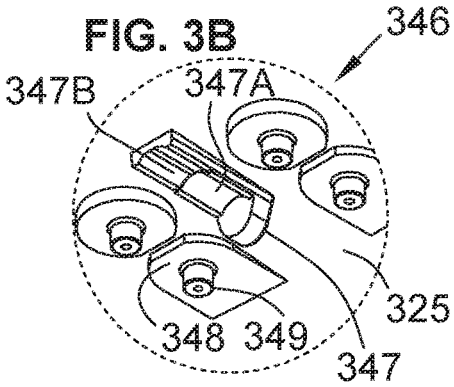
FIG. 3B is a detail view of modified WC lid 101, as indicated by the view window labeled DET. 3B in FIG. 3.

Pivot Plate Feature Sets:

Referring to FIG. 3, and then FIG. 3B, a pivot plate feature set 346 occurring a short distance to either side of the rear parallel sides 331 (FIG. 3) of receptacle opening 328 (FIG. 3); referring to FIG. 3B, each pivot plate feature set 346 being comprised of a centrally positioned reference protrusion 347 adjoined to a spring saddle 347A, and four coplanar pads 348 with centrally disposed pivot mount bosses 349 arrayed about each reference protrusion 347; the comprising features of pivot plate feature sets 346 all protruding downward from the bottom of plate member 325; each reference protrusion 347 being a short linearly extruded member, with a profile of extrusion, as seen from its exterior side, comprised of a triangle with one side substantially coincident to the bottom surface of plate member 325, and the point formed by the two lower sides being tangentially trimmed by a connecting radius; the connecting radius being slightly larger than the outer radius of pivot slide springs 013; each spring saddle 347A being comprised of a horizontal rectangular protrusion extending shallowly downward from the bottom surface of plate member 325 with a lower convex trough longitudinally and symmetrically penetrating its lower surface; each lower convex trough being proportioned to receive pivot slide spring 013; each reference protrusion 347 and adjacent spring saddle 347A sharing common forward terminal surfaces and rear terminal surfaces; the lower radial surface of each reference protrusion 347 and the lower convex trough of each adjacent spring saddle 347A substantially sharing a common horizontal axis, oriented transversely to the longitudinal center plane of the part; each reference protrusion 347 and adjacent spring saddle 347A further being proportioned to fit within the cylindrical cavity 503 of pivot plate 014/114 (Reference FIG. 31); the interior half of each spring saddle 347A further being very shallowly intersected by a cylindrical trim, effecting a slight step in the corresponding spring saddle 347A, hereafter identified as diametral step 347B.

Still referring to FIG. 3B, the four coplanar pads 348 of each pivot plate feature set 346 being positioned in a rectangular pattern; the two interior coplanar pads 348 of each pivot plate feature set 346 having circular top view profiles; the two exterior coplanar pads 348 of each pivot plate feature set 346 having profiles, as seen from above, each comprised of a rectangle with a bold radius at each interior corner; each coplanar pad 348 protruding a very short distance downward from the lower surface of plate member 325, and terminating in a common horizontal plane; the coplanar pads 348 substantially forming a series of planar horizontal mounting surfaces proportioned to receive the upper surfaces of plate member 499 of pivot plate 014/114 (Reference FIG. 31); each pivot mount boss 349 being comprised of an internally threaded cylindrical screw boss protruding downward from the lower surface of a coplanar pad 348; each pivot mount boss 349 being concentrically aligned with the cylindrical surfaces of the corresponding coplanar pad 348; the pivot mount bosses 349, further being positioned and proportioned to fit screw boss ports 509 of pivot plate 114 (Reference FIG. 34); the internal threads of pivot mount bosses 349 further being proportioned to receive pivot plate fasteners 016.

Support Chairs:

Referring to FIG. 3, two narrow forward rectangular ribs, constituting support chairs 350, protruding downward from perimeter blend radius 326A, near the periphery of the part; support chairs 350 being spaced and proportioned for linear contact with the top surface of modified WC seat 130/230.

Façade Screw Bosses:

As shown in FIG. 3, eight screw bosses for facade mounting, four on each side of the part, protruding downward from plate member 325, including four left facade bosses 351 and four right facade bosses 352; left facade bosses 351 being positioned near the outside left edge of the part; left facade bosses 351 further being positioned to align with screw wells 573 of left facade 027/127; right facade bosses 352 further being symmetric mirror images of left facade bosses 351, with the plane of symmetry being the vertical longitudinal center plane of the part.

Figure 3C:
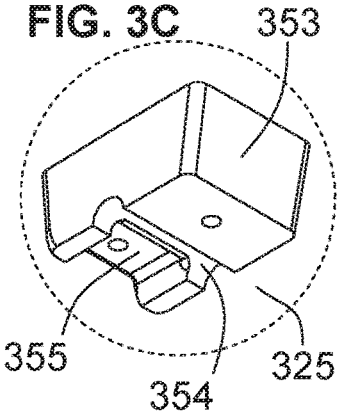
FIG. 3C is a detail view of modified WC lid 101, as indicated by the view window labeled DET. 3C in FIG. 3.
Figure 37:
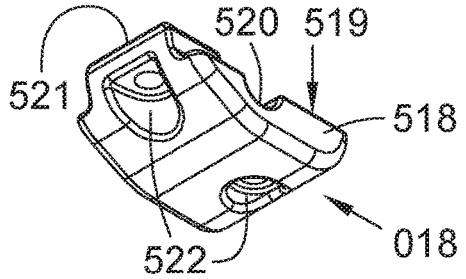
FIG. 37 is an additional perspective view of pivot rod retainer 018.

Pivot Blocks:

Referring to FIG. 3 two pivot blocks 353, narrowly and symmetrically spaced about the longitudinal axis of the part, and positioned near rear lip 327; referring to FIG. 3C, pivot blocks 353 having a small rectangular profile as seen from above, protruding a short distance downward from the bottom surface of plate member 325, and terminating in a horizontal plane; the interstitial space between pivot blocks 353 being proportioned to receive brake lever 022/122; referring to FIG. 3C, a cylindrical pivot saddle 354, oriented transversely to the longitudinal axis of the part, shallowly penetrating the bottom surface of each pivot block 353, being proportioned to receive pivot rod 017; two rectangular rear trim cuts 355, being slightly narrower than pivot blocks 353, shallowly intersecting the bottom surface of each pivot block 353 behind the proximate pivot saddle 354; each rear trim cut 355 further being laterally centered on the corresponding pivot block 353, and proportioned to receive recess land 521 of pivot rod retainer 018 (Reference FIG. 37); each pivot block 353 further being proportioned to receive pivot rod retainers 018; each pivot block 353 further including two internally threaded screw ports, proportioned to receive retainer fasteners 019.

Spring Positioning Divot:

As illustrated in FIG. 3, a shallow circular divot intersecting the bottom of plate member 325, centrally located on the longitudinal axis of the part and slightly forward of pivot blocks 353, constituting a spring positioning divot 356.

Rear Lip Trim:

Referring to FIG. 3, the segment of rear lip 327 occurring between hinge protrusions 340 further being substantially removed by a trim cut, hereafter identified as rear lip trim 357.

Modified WC Lid 201—

Figure 5:
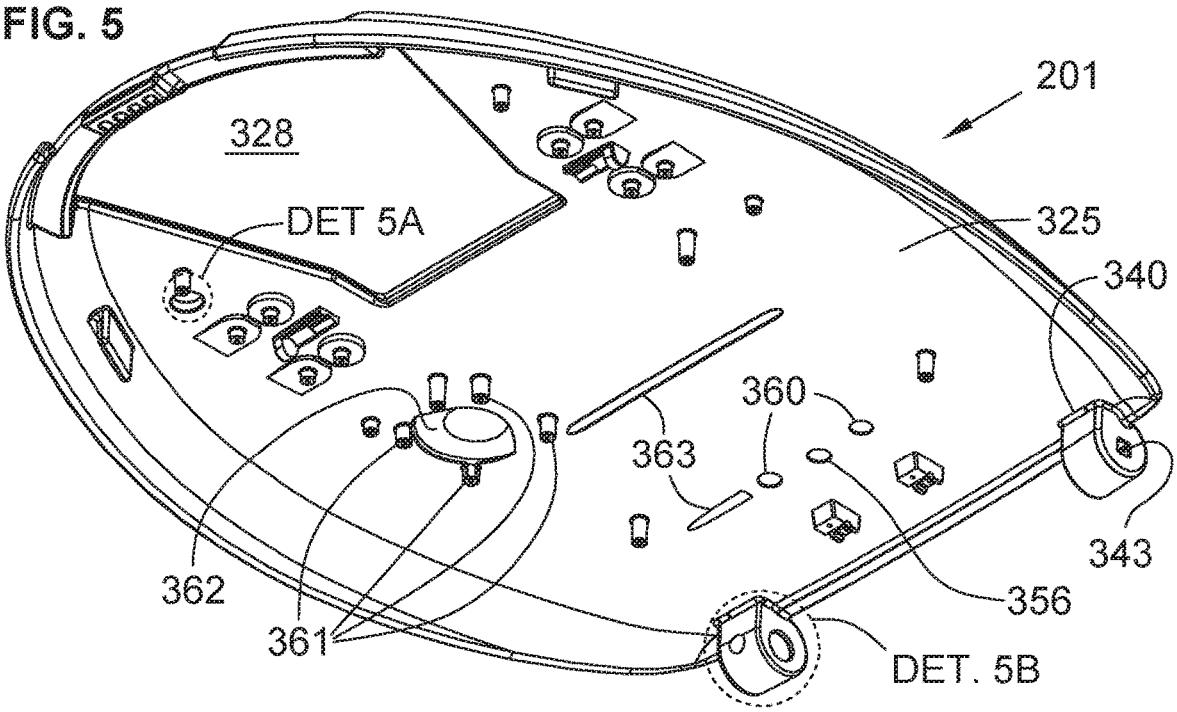
FIG. 5 is a perspective view of modified WC lid 201.

This part is substantially identical to modified WC lid 101 notwithstanding the following differences: Referring to FIG. 5 and then FIG. 5B, hinge bearing port 342 in the leftmost hinge protrusion 340 of modified WC lid 101 (as illustrated in FIG. 3) is replaced in modified WC lid 201 by wet hinge port 358 (FIG. 5B); wet hinge port 358 being comprised of [(i) a small-diameter flat-bottom blind-depth bore concentrically penetrating the leftmost hinge protrusion 340 from its interior side, with depth approximately equal to one-half the width of the leftmost hinge protrusion 340; (ii) a second flat-bottom blind-depth bore concentrically penetrating the leftmost hinge protrusion 340 from its interior side having diameter about four fifths that of the first bore, and having depth approximately equal to seven-eighths of the width of the leftmost hinge protrusion 340]; wet hinge port 358 further being proportioned to receive cup seal 070 and lid insert 770 of wet pivot shaft 069 (Reference FIG. 92.).

Figure 5A:
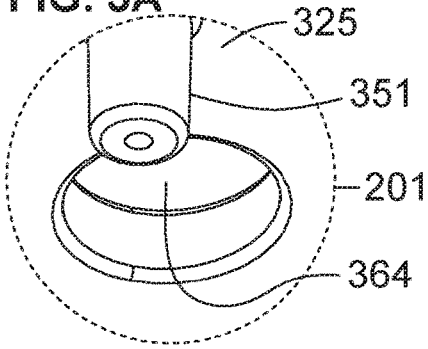
FIG. 5A is a detail view of modified WC lid 201, as indicated by the view window labeled DET. 5A in FIG. 5.
Figure 5B:
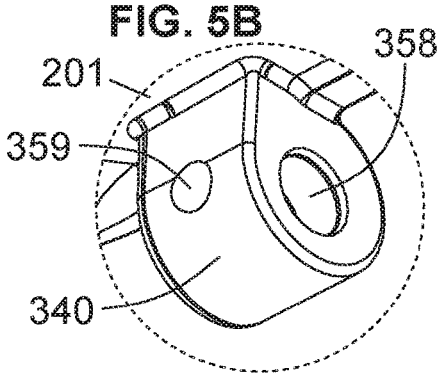
FIG. 5B is a detail view of modified WC lid 201, as indicated by the view window labeled DET. 5B in FIG. 5.

Modified WC Lid 201 Further Includes the Following Features not Present in Modified WC Lid 101:

Outlet Port:

Referring to FIG. 5B, a horizontal blind-bottom outlet port 359 piercing the front side of the leftmost hinge protrusion 340, oriented perpendicular to, and intersecting wet hinge port 358; outlet port 359 further being proportioned to receive valve supply tube 068.

Actuator Positioning Divots:

Referring to FIG. 5, two shallow cylindrical cuts intersecting the bottom surface of plate member 325, comprising actuator positioning divots 360; actuator positioning divots 360 further being similar to, and symmetrically positioned a short distance to each side of, spring positioning divot 356.

Valve Mounting Bosses:

As illustrated in FIG. 5, four internally threaded screw bosses, hereafter identified as valve mounting bosses 361 protruding from the bottom of plate member 325, near the central left side of the part; valve mounting bosses 361 being relatively positioned in a square pattern, proportioned to align with mounting holes 760 of valve base 064, within the respective master assembly (Reference FIG. 89); valve mounting bosses 361 further being internally threaded to receive valve mounting fasteners 065.

Valve Interference Trim:

As illustrated in FIG. 5, a cylindrical disk-shaped trim cut, shallowly intersecting the bottom of plate member 325; the cylindrical disk-shaped trim cut further being centrally positioned between valve mounting bosses 361, and comprising valve interference trim 362 (FIG. 5).

Tubing Interference Trims:

Two trim cuts, oriented transverse to the longitudinal axis of the part, creating localized shallow trenches on the bottom of plate member 325, hereafter identified as tubing interference trims 363 (FIG. 5).

Manual Actuator Signal Port:

Referring to FIG. 5, a small diameter cylindrical aperture with axis oriented vertically, piercing plate member 325, near the left front of the part, and to the left side of receptacle opening 328, creating manual actuator signal port 364 (FIG. 5A).

Modified WC Lid 301—

Figure 6:
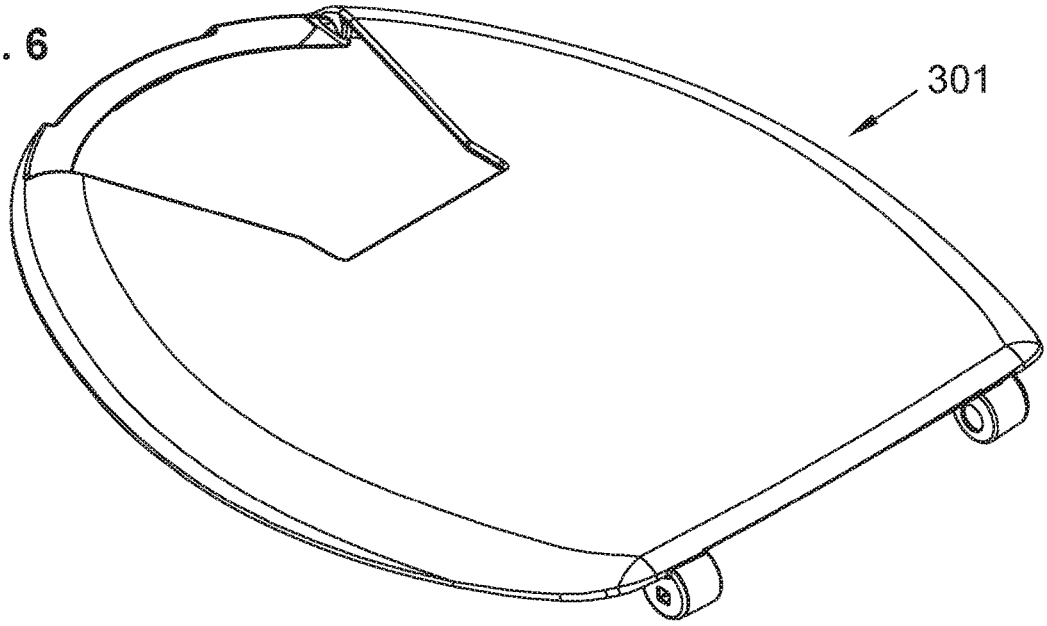
FIG. 6 is a perspective view of modified WC lid 301.

Referring to FIG. 6, this part is substantially identical to modified WC lid 201 notwithstanding the following difference: Manual actuator signal port 364 (FIG. 5A) of modified WC lid 201 is not present in modified WC lid 301.

Common Receptacle Lid—

Figure 7:
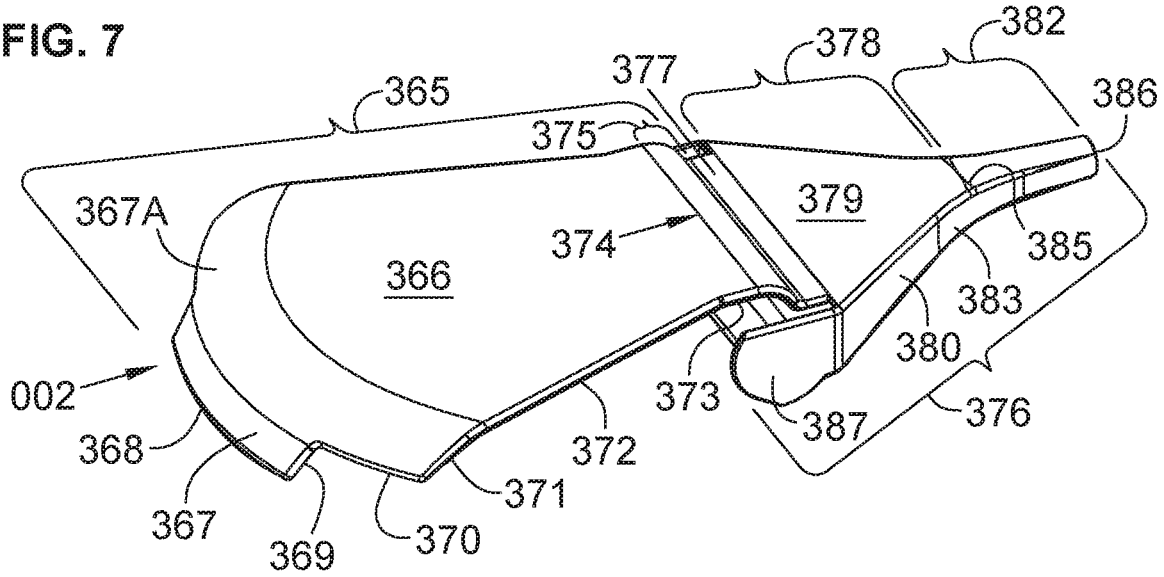
FIG. 7 is a perspective view of receptacle lid and funnel 002.

Receptacle lid and funnel 002, and upper cartridge segments 102/202, preferably formed of molded plastic, share a common forward geometry, hereafter identified as receptacle lid 365 (FIG. 7). Referring to FIG. 7, receptacle lid 365 includes the following features: A thin, large, softly domed upper elliptical-shaped plate member 366 oriented horizontally; the domed curvature of plate member 366 being identical to the domed curvature of plate member 325 of modified WC lid 001/101/201/301 (Reference FIG. 1); plate member 366 substantially being an apparent continuation of plate member 325 of modified WC lid 001/101/201/301 (Reference FIG. 1), within the respective stored master assembly; plate member 366 further curling downward around its elliptical boundary into a shallow perimeter lip 367; perimeter lip 367 substantially being a radial continuation of perimeter lip 326 of modified WC lid 001/101/201/301 (Reference FIG. 1), within the respective stored master assembly; the downward curl adjoining plate member 366 to perimeter lip 367 hereafter being identified as perimeter blend radius 367A; perimeter blend radius 367A substantially being a continuation of perimeter blend radius 326A of modified WC lid 001/101/201/301 (Reference FIG. 1.).

Still referring to FIG. 7, receptacle lid 365 being terminated about its perimeter to fit and fill receptacle opening 328 of modified WC lid 001/101/201/301 within the respective stored master assembly (Reference FIG. 1); receptacle lid 365 further being bound by the following surfaces: [(i) a bottom horizontal surface terminating the foremost edge of receptacle lid 365, hereafter identified as forward terminal surface 368; within the respective stored master assembly, forward terminal surface 368 being substantially coincident with the bottom surface of perimeter lip 326 of modified WC lid 001/101/201/301 (Reference FIG. 1); (ii) two angled planar walls, constituting oblique edge breaks 369, symmetrically mirrored about the longitudinal centerline of the part; within the respective stored master assembly, oblique edge breaks 369 being offset slightly inward from oblique edge breaks 335 of modified WC lid 001/101/201/301 (Reference FIG. 1); (iii) an upper horizontal surface, hereafter identified as radial bridge trim surface 370; within the respective stored master assembly, radial bridge trim surface 370 being offset slightly upward from the topmost surface of radial bridge 334 of modified WC lid 001/101/201/301 (Reference FIG. 1); (iv) two short forward parallel sides 371; within the respective stored master assembly, forward parallel sides 371 being offset slightly inward from forward parallel sides 329 of modified WC lid 001/101/201/301 (Reference FIG. 1); (v) two rearward converging angled sides 372; within the respective stored master assembly, converging angled sides 372 being offset slightly inward from converging angled sides 330 of modified WC lid 001/101/201/301 (Reference FIG. 1); (vi) two rear parallel sides 373; within the respective stored master assembly, rear parallel sides 373 being offset slightly inward from the rear parallel sides 331 of modified WC lid 001/101/201/301 (Reference FIG. 1); (vii) a rear vertical plane, oriented transversely to the longitudinal axis of the part, hereafter identified as the rear terminus of the plate 374]; appended to the rear terminus of the plate 374, a vertical transition, constituting step-down extension 375; step-down extension 375 having a two-stage radial profile, as viewed from the side, first curving downward, then curving rearward, and terminating in a vertical plane; the lateral ends of step-down extension 375 further terminating in the planes of rear parallel sides 373.

Receptacle Lid and Funnel 002—

Referring to FIG. 7, in addition to the common receptacle lid 365, this part further includes a rear pivoting urine funnel 376 described as follows: Beginning at the rear terminus of step-down extension 375, a planar extension 377 continuing horizontally rearward for a short distance; a lower thin-walled converging funnel 378 beginning at the rear edge of planar extension 377, and having a rearward converging vertical rectangular cross section; converging funnel 378 being formed by the following members: [(i) a thin funnel roof member 379, having width slightly greater than planar extension 377; funnel roof member 379 extending horizontally rearward from planar extension 377; (ii) two moderately converging thin funnel walls 380; (iii) a thin funnel floor member 381 (FIG. 8) softly sloping upward and rearward]; adjoined to the rear of converging funnel 378, a thin-walled funnel spout 382 (FIG. 7); the profile of funnel spout 382 progressively converging from a forward rectangular cross-section, to a slightly smaller round cross-section at its rear; two radial wall segments 383 (FIG. 7) tangentially connecting the rear of funnel walls 380 to the forward end of funnel spout 382; referring to FIG. 8, a short radial floor segment 384 tangentially connecting the rear of funnel floor member 381 to the lower forward edge of funnel spout 382; referring to FIG. 7, a very short radial roof segment 385 tangentially connecting the rear of funnel roof member 379 to the upper forward edge of funnel spout 382; the rear opening of funnel spout 382 forming funnel exit 386; the two funnel walls 380 further extending forward in parallel wall segments to form two pivot tabs 387; pivot tabs 387 being substantially parallel to each other, and having semi-cylindrical profiles curving first downward and forward, then upward and forward, then upward and rearward, terminating at the top surface of converging funnel 378.

Figure 8:
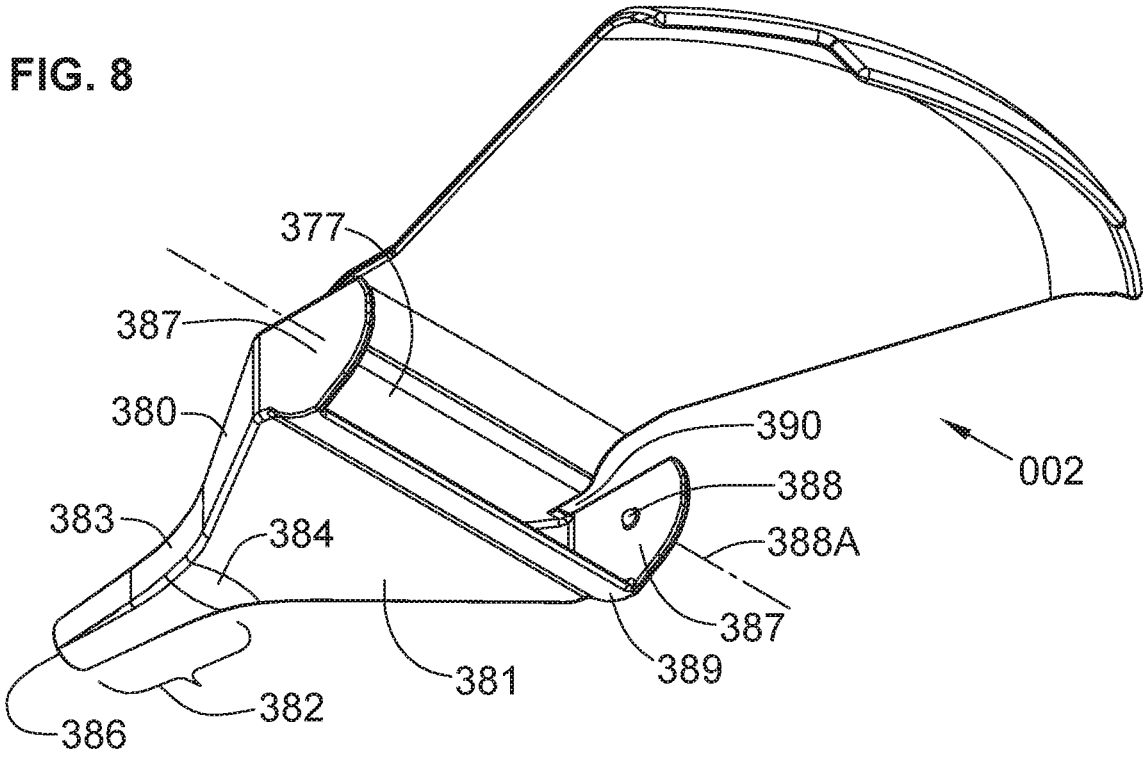
FIG. 8 is an additional perspective view of receptacle lid and funnel 002.
Figure 9:
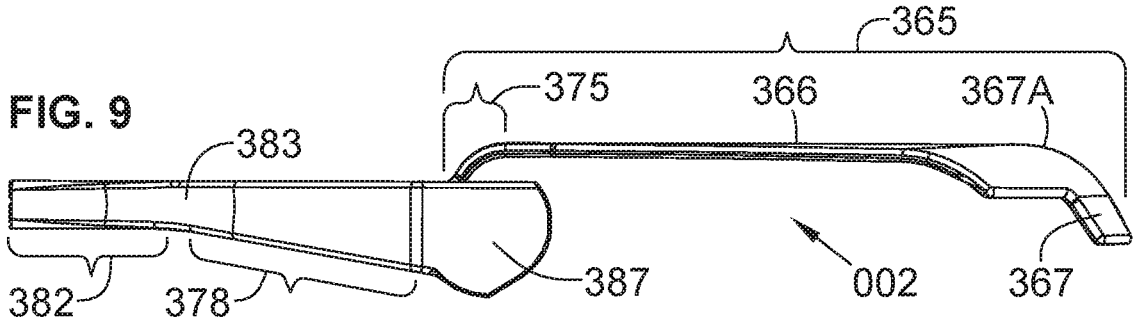
FIG. 9 is a side elevation view of receptacle lid and funnel 002.
Figure 76:
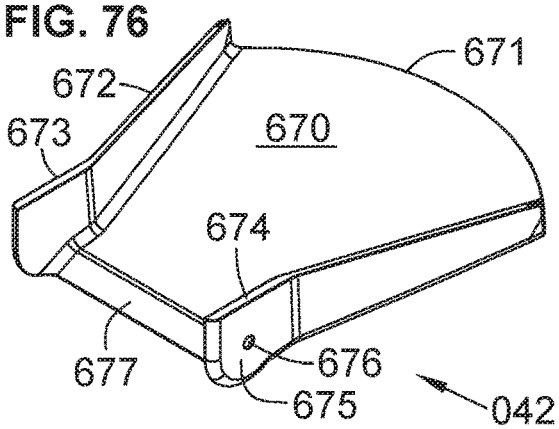
FIG. 76 is a perspective view of urine pan 042.

Referring to FIG. 8, the interior surfaces of these pivot tabs including small hemispherical pivot buttons 388, substantially aligned with the cylindrical profile of pivot tabs 387; the distance between the interior surfaces of pivot tabs 387 being substantially equivalent to the distance between the external surface of pivot tabs 675 of urine pan 042; pivot buttons 388 further being proportioned to mate with hemispherical divots 676 of urine pan 042 (Reference FIG. 76); a horizontal axis passing concentrically through pivot buttons 388, hereafter being identified as funnel pivot axis 388A; a thin floor member, being a forward radial extension of funnel floor member 381, constituting radial sweep 389; radial sweep 389 having an upper radial surface and a lower radial surface, both concentrically aligned with funnel pivot axis 388A, extending downward and forward for a short distance from the forward edge of funnel floor member 381; the lower radial surface having radius equal to that of pivot tabs 387; radial sweep 389 further substantially terminating at its forward edge in a vertical plane passing directly through the central axis of pivot tabs 387; radial sweep 389 further spanning laterally between pivot tabs 387; two vertical rectangular cavities 390, one occurring laterally between each pivot tab 387 and planar extension 377; rectangular cavities 390 being proportioned to receive pivot tabs 675 of urine pan 042 (Reference FIG. 76.). FIG. 9 clearly illustrates the side profiles of receptacle lid 365, step-down extension 375, converging funnel 378, and funnel spout 382 of receptacle lid and funnel 002.

Upper Cartridge Segment 102/202 Common Geometry—

Figure 10:
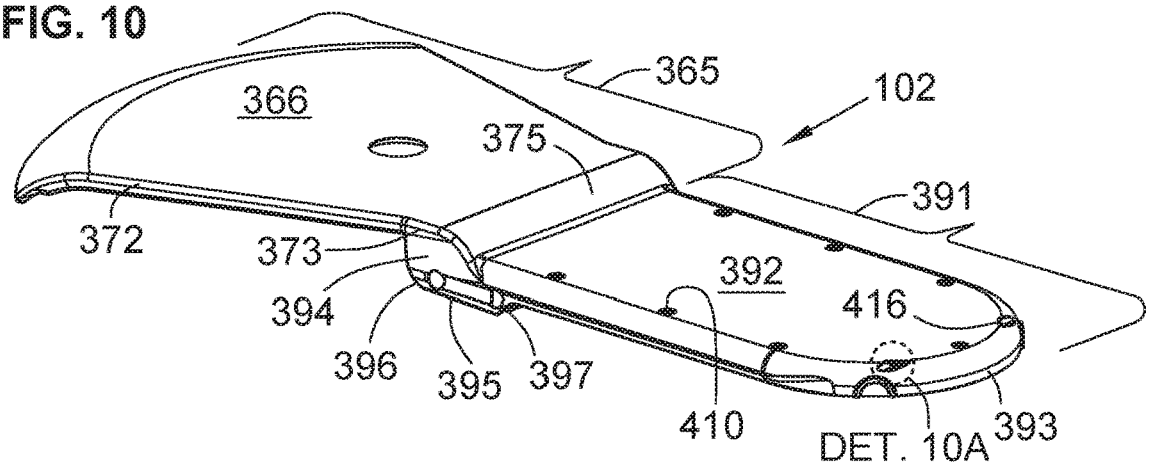
FIG. 10 is a perspective view of upper cartridge segment 102.

In addition to the common receptacle lid, these parts also include the following common features:

Rear Cartridge Cap:

Referring to FIG. 10, in addition to the common receptacle lid 365, upper cartridge segment 102/202 also shares a common rear cartridge cap 391, appended to receptacle lid 365. Rear cartridge cap 391 is described as follows: A thin planar horizontal ceiling member 392, originating at the rear edge of step-down extension 375 of receptacle lid 365, and further being a planar extension of step-down extension 375; ceiling member 392 continuing rearward for a length approximately equal in length to receptacle lid 365; ceiling member 392 further having a simple keyhole profile, as seen from above, comprised of a rectangle with a full radius on its rearmost end; the flat end of the simple keyhole profile being coincident with the rear edge of step-down extension 375 of receptacle lid 365; the width of the keyhole profile being substantially equivalent to the width of step-down extension 375; the perimeter of the ceiling member arching into a shallow downturned vertical perimeter wall 393; perimeter wall 393 terminating at its lower surface in a horizontal plane.

Figure 10A:
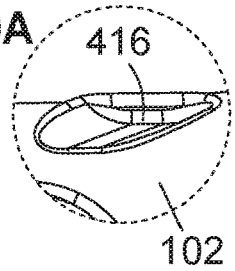
FIG. 10A is a detail view of upper cartridge segment 102, as indicated by the view window labeled DET. 10A in FIG. 10.
Figure 50:
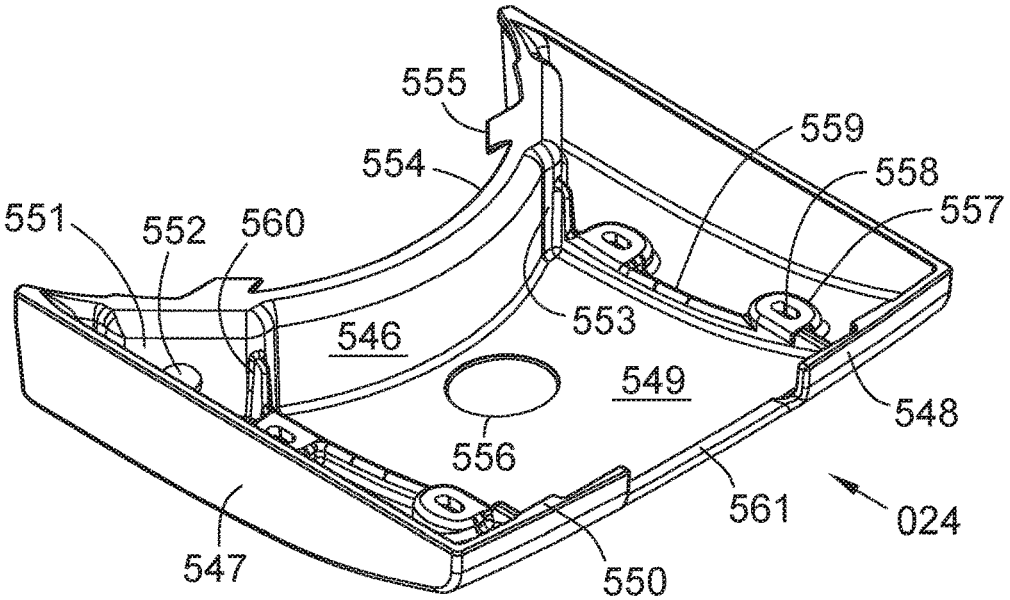
FIG. 50 is a perspective view of brake cover 024.

In addition to the common receptacle lid 365 and the common rear cartridge cap 391, these parts also include the following common features:

Guide Saddles:

Referring to FIG. 10 and FIG. 10A, two short horizontal collinear cylindrical cuts with common axis, oriented transversely to the longitudinal axis of the part, forming guide saddles 416; referring to FIG. 10, guide saddles 416 shallowly intersecting the top surface of rear cartridge cap 391 a short distance forward of its back edge; each guide saddle 416 further extending inward only a short distance from the corresponding side of rear cartridge cap 391, and terminating in an oblique vertical plane; guide saddles 416 further being proportioned to receive guide fingers 555 of brake cover 024/124 (Reference FIG. 50.).

Pivot Wings:

Referring to FIG. 10, forward extensions of perimeter wall 393 occurring on both sides of the part, constituting pivot wings 394; pivot wings 394 occurring from the forward edge of rear cartridge cap 391, to the plane of convergence between the rear parallel sides 373 and the converging angled sides 372 of receptacle lid 365; pivot wings 394 further spanning upward to meet step-down extension 375 and plate member 366 of receptacle lid 365.

Figure 11A:
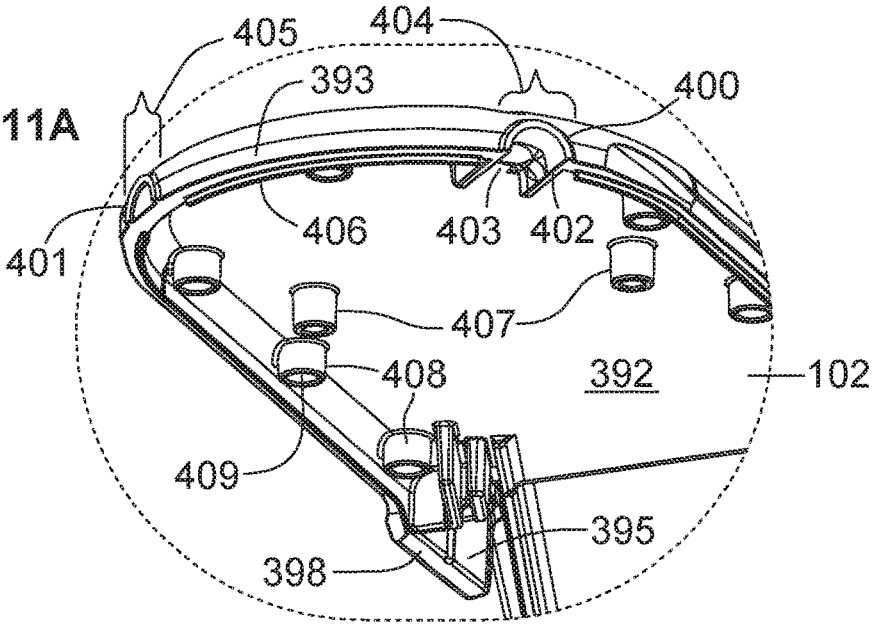
FIG. 11A is a detail view of upper cartridge segment 102, as indicated by the view window labeled DET. 11A in FIG. 11.

Wing Extensions:

Referring to FIG. 10, on each side of the part, a downward extension of perimeter wall 393 and pivot wings 394, constituting wing extensions 395; wing extensions 395 having length about one-half the width of rear cartridge cap 391; wing extensions 395 further beginning at the forward edge of pivot wings 394 and continuing rearward a short distance behind the rear edge of step-down extension 375; the forward edge of each wing extension 395 meeting the front edge of the corresponding pivot wing 394 in a radial arc 396; each wing extensions 395 further having an oblique rear transition 397 at its rear edge, sloping upward and rearward at approximately 45°; referring to FIG. 11, and then FIG. 11A, a front-to-rear linear chamfer 398 occurring along the inside bottom edge of each wing extension 395.

Latch Protrusion:

As illustrated in FIG. 11, a short linear latch protrusion 399 appended to the interior of the forward edge of perimeter lip 367 of receptacle lid 365, originating at the forward terminal surface 368, and extending upward a short distance; latch protrusion 399 being oriented transversely to the longitudinal axis of the part, and proportioned to fit the latch groove 345 of modified WC lid 101/201/301 (Reference FIG. 4B.).

Funnel Seal Protrusions:

Referring to FIG. 11A, two small toroidal ridges protruding slightly outward from the rear cylindrical surface of perimeter wall 393, creating symmetric seal protrusions, hereafter identified as left funnel seal protrusion 400 and right funnel seal protrusion 401; the outer radiuses of left funnel seal protrusion 400 and right funnel seal protrusion 401 being approximately five-eighths the height of perimeter wall 393; the inner radiuses of left funnel seal protrusion 400 and right funnel seal protrusion 401 being about three-fourths their respective outer radiuses; the center axis of left funnel seal protrusion 400 being positioned at −45° with respect to the center of the cylindrical surface of perimeter wall 393, as seen from above; the center axis of right funnel seal protrusion 401 being positioned at 45° with respect to the center of the cylindrical surface of perimeter wall 393, as seen from above; the center axes of left funnel seal protrusion 400 and right funnel seal protrusion 401 further being located in the bottom plane of perimeter wall 393.

Return Walls:

Referring to FIG. 11A, two short parallel vertical return walls 402 protruding downward from the bottom surface of rear ceiling member 392, and terminating in the bottom plane of perimeter wall 393; return walls 402 being further positioned with inner surfaces tangent to the interior of left funnel seal protrusion 400 at the bottom plane of perimeter wall 393.

Funnel Bore:

Referring to FIG. 11A, a cylindrical cut, comprising funnel bore 403, concentrically aligned to left funnel seal protrusion 400, with radius equal to the interior radius of left funnel seal protrusion 400; funnel bore 403 further extending through perimeter wall 393, blending upward to meet the bottom surface of ceiling member 392, and also blending outward to meet return walls 402.

Urine Spout and False Spout:

Referring to FIG. 11A, left funnel seal protrusion 400, and the opening within left funnel seal protrusion accomplished by funnel bore 403, comprising upper urine spout 404; right funnel seal protrusion 401, and the section of perimeter wall 393 encompassed by right funnel seal protrusion 401, comprising upper false spout 405.

Alignment Lip:

Referring to FIG. 11A, beginning at the bottom rear of wing extensions 395, perimeter wall 393 further having a very thin, short, downward extension, constituting alignment lip 406 (See also FIG. 13A); alignment lip 406 having thickness about one-third of perimeter wall 393, and further having coincident inner surfaces with perimeter wall 393; alignment lip 406 continuing around the interior of perimeter wall 393, having one break centered around, and extending a short distance about, left funnel seal protrusion 400; alignment lip 406 further having a second break centered around, and extending a short distance about, right funnel seal protrusion 401.

Cartridge Ballast Bosses:

Referring to FIG. 11A, two cylindrical screw bosses, hereafter identified as cartridge ballast bosses 407, extending downward from the bottom surface of ceiling member 392, each having exterior diameter and height proportioned to receive cartridge ballast 011/111; cartridge ballast bosses 407 further including internal threaded screw holes proportioned to receive ballast retainers 012; cartridge ballast bosses 407 further being positioned such that, within the respective master assembly, the mass of cartridge ballast 011 will affect a moment within removable dry cartridge 855 (Reference FIG. 29), promoting the self-opening function of removable dry cartridge 855.

Fastener Standoffs:

Referring to FIG. 11 and FIG. 11A, seven thin walled cylindrical protrusions located near the perimeter of the part, protruding downward from the bottom surface of ceiling member 392, comprising fastener standoffs 408; referring to FIG. 11A, penetrating the bottom surface of each fastener standoff 408, a blind-depth cylindrical bore, hereafter identified as screw boss ports 409; screw boss ports 409 being proportioned to receive screw bosses 491A of rear cartridge base 008/108 (Reference FIG. 23); referring to FIG. 10, seven screw ports 410, being co-aligned with fastener standoffs 408 (FIG. 11A), vertically piercing rear cartridge cap 391 and fastener standoffs 408 (FIG. 11A); each screw port 410 further being proportioned to receive cartridge fasteners 010; each screw port 410 further including a top-side countersink, shallowly intersecting the top surface of rear cartridge cap 391, allowing the heads of cartridge fasteners 010 to recess during assembly.

Figure 12:
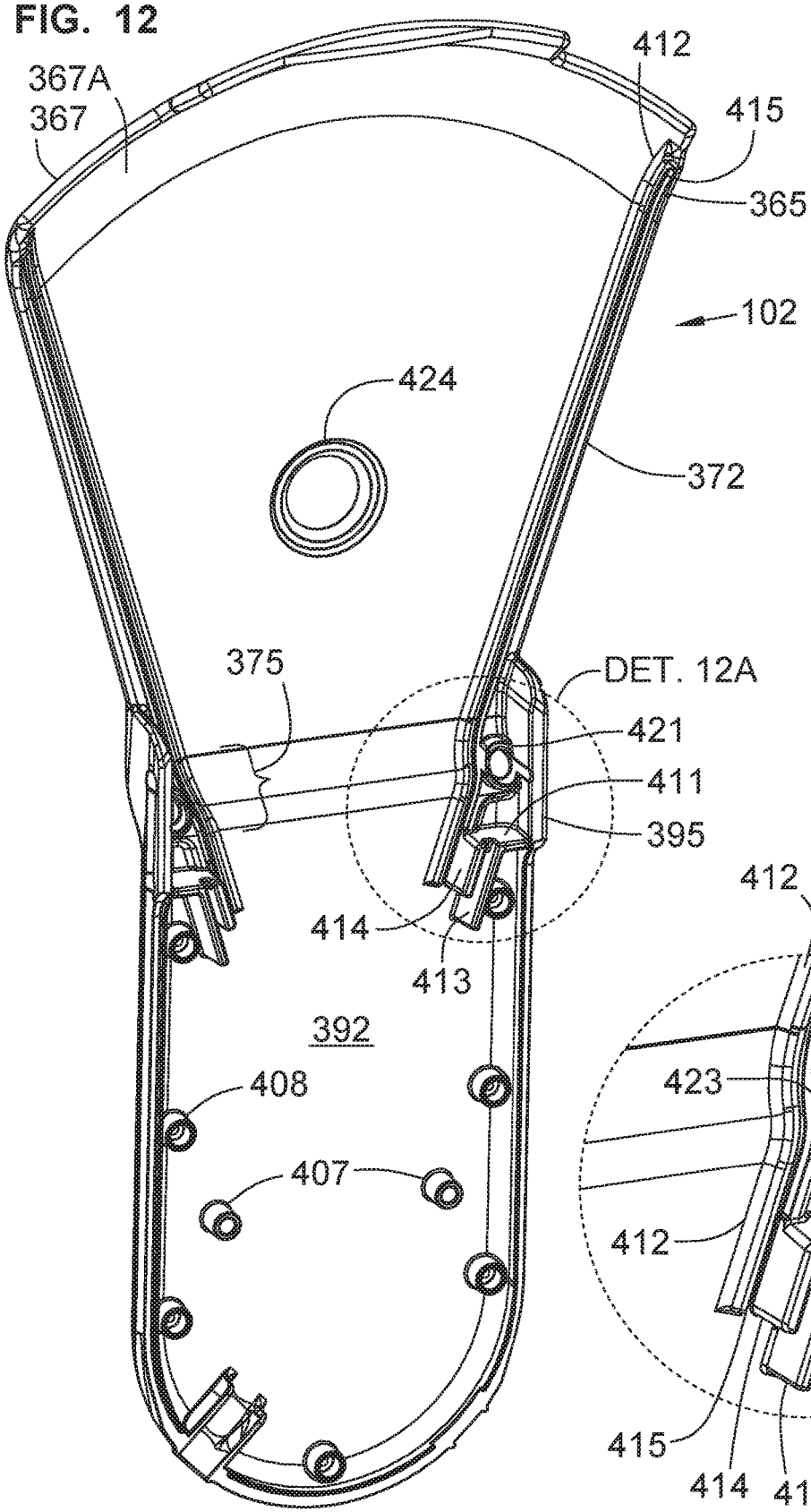
FIG. 12 is an additional perspective view of upper cartridge segment 102.
Figure 16:
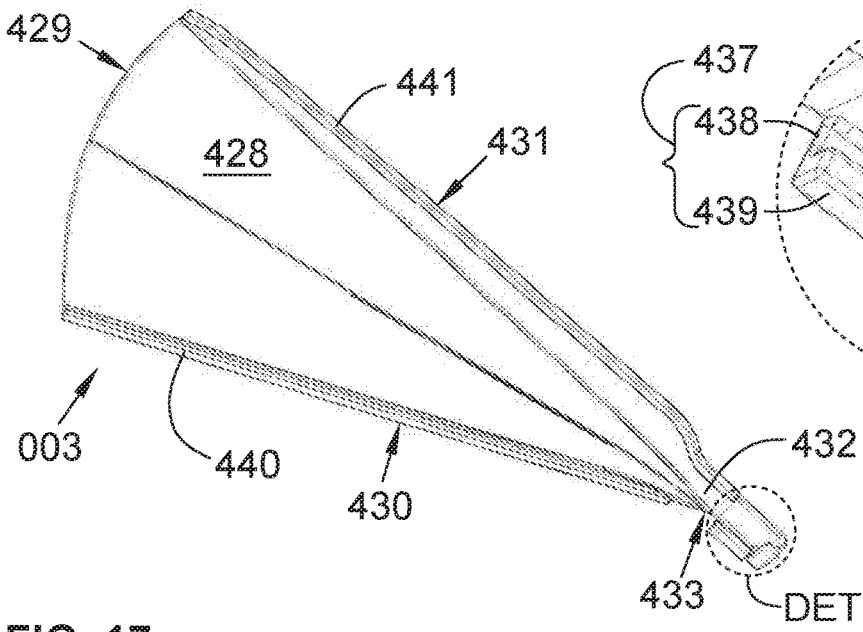
FIG. 16 is a perspective view of right side shield 003.
Figure 16A:
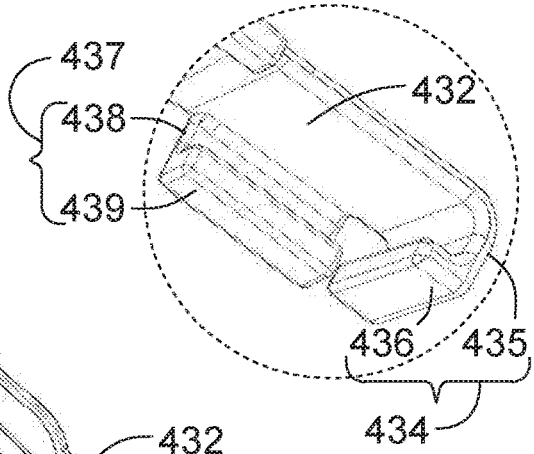
FIG. 16A is a detail view of right side shield 003, as indicated by the view window labeled DET. 16A in FIG. 16.

Concealment Walls:

Referring to FIG. 12, beginning near the rear of wing extensions 395, two vertical concealment walls 411 protruding downward from the bottom surface of ceiling member 392, and extending nearly to the bottom of wing extensions 395; concealment walls 411 being oriented transversely to the longitudinal axis of the part; each concealment wall 411 extending inward a short distance from the interior surface of the respective wing extension 395, and meeting the corresponding inner parallel wall 414; each concealment wall 411 being trimmed upward at its interior edge to match the lower terminus of the adjacent inner parallel wall 414; each concealment wall 411 further being trimmed a short distance upward between the adjacent outer parallel wall 413 and inner parallel wall 414, to a height proportioned to receive the bottom compression insert 439 of the respective right side shield 003/103 or left side shield 004/104 (Reference FIG. 16A.).

Linear Protrusions:

Referring to FIG. 12, protruding a very short distance below the bottom of receptacle lid 365, two linear protrusions 412; linear protrusions 412 further being adjacent to, and substantially parallel with, converging angled sides 372; these linear protrusions beginning near the mid-width of perimeter blend radius 367A; linear protrusions 412 further extending rearward, each maintaining constant height while following the elevation curvature of step-down extension 375; linear protrusions 412 further terminating a short distance behind concealment walls 411.

Parallel Walls:

Referring to FIG. 12, extending obliquely rearward from concealment walls 411, a thin outer parallel wall 413 and a thin inner parallel wall 414 occurring on each side of the part; inner parallel walls 414 and outer parallel walls 413 having common thickness; each outer parallel wall 413 being substantially parallel with the proximate inner parallel wall 414; inner parallel walls 414 and outer parallel walls 413 protruding downward from the bottom surface of ceiling member 392; each outer parallel wall 413 having a lower terminus coincident with the bottom of the adjacent concealment wall 411; each inner parallel wall 414 having a lower terminus slightly higher than the lower terminus of the proximate outer parallel wall 413; each of the outer parallel walls 413 having length about one and one-half times the length of concealment walls 411; each of the inner parallel walls 414 having length about equal to the length of concealment walls 411; the outer parallel walls 413 and inner parallel walls 414 being further oriented parallel to linear protrusions 412; the outer surface of each inner parallel wall 414 further being approximately coincident with the outside edge of the proximate linear protrusion 412; the interstitial space between each inner parallel wall 414 and the proximate outer parallel wall 413 being approximately equal to the thickness of each outer parallel wall 413.

Figure 12A:
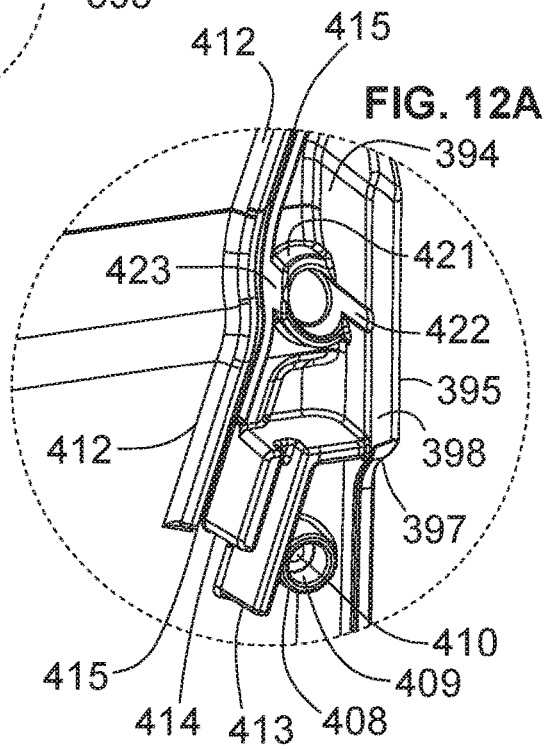
FIG. 12A is a detail view of upper cartridge segment 102, as indicated by the view window labeled DET. 12A in FIG. 12.

Side Shield Receptacles:

Referring to FIG. 12, and then FIG. 12A, two linear grooves, each with width approximately equal to one-third the width of linear protrusions 412, shallowly intersecting the bottom surface of linear protrusions 412, and forming side shield receptacles 415; the upper surface of each side shield receptacle 415 substantially being an upward offset of the lower surface of the intersected linear protrusion 412; each side shield receptacle 415 further having depth approximately equal to its width; each side shield receptacle 415 commencing a short distance behind the front edge of the corresponding linear protrusion 412, extending rearward the entire length of the corresponding linear protrusion 412, and further bisecting the rear end of the corresponding linear protrusion 412; the exterior surface of each side shield receptacle 415 further being substantially coplanar with the inside edge of the corresponding inner parallel wall 414.

Upper Cartridge Segment 102—

In addition to the common features of upper cartridge segment 102/202, upper cartridge segment 102 further includes the following features:

Lens Receptacle:

Referring to FIGS. 11 and 12, a circular cut having a revolved two-stage profile, the two-stage profile effecting a thick upper cavity of small diameter with inwardly sloped walls above a thin lower cavity of larger diameter and inwardly sloped walls adjoined at a horizontal plane; the circular cut, hereafter identified as lens receptacle 424, being proportioned to receive cartridge lens 009 from below; lens receptacle 424 passing through the longitudinal center plane of receptacle lid 365, slightly behind its mid-length; lens receptacle 424 further being centered about the longitudinal center plane of the part.

Spring Wells:

Referring to FIG. 12, two thin-walled cylindrical protrusions, extending downward a short distance from the bottom surface of step down extension 375, and comprising spring wells 421; the interior diameter of each spring well 421 being proportioned to receive cartridge springs 005; spring wells 421 further being positioned near the mid-length of wing extensions 395; referring to FIG. 12A, the interior surface of each spring well 421 being nearly tangent to the interior surface of the corresponding wing extension 395; the cylindrical walls of spring wells 421 terminating at the interior surface of pivot wings 394 and wing extensions 395; two cylindrical cuts, hereafter identified as spring trims 422, shallowly intersecting the interior surface of pivot wings 394 and wing extensions 395; the cylindrical surface of spring trims 422 being substantially coincident with the interior surfaces of spring wells 421; the innermost edge of spring wells 421 further being shallowly intersected by planar trim cuts, hereafter identified as side shield trims 423; each side shield trims 423 substantially terminating the cylindrical wall of the corresponding spring well 421 in the outer plane of the adjacent side shield receptacle 415.

Figure 13:
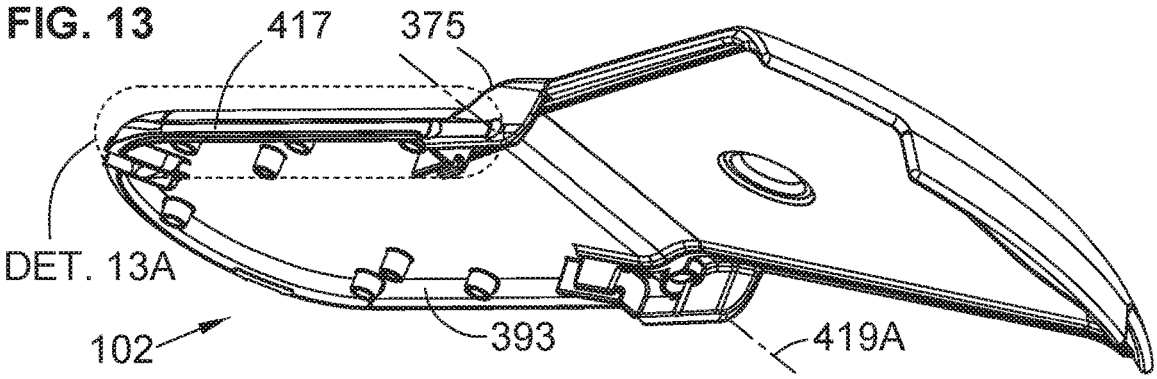
FIG. 13 is an additional perspective view of upper cartridge segment 102.
Figure 13A:
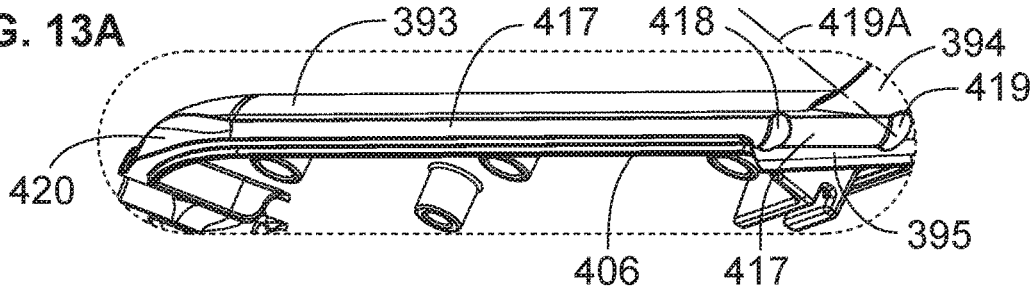
FIG. 13A is a detail view of upper cartridge segment 102, as indicated by the view window labeled DET. 13A in FIG. 13.

Slide Grooves:

Referring to FIG. 13, and then FIG. 13A, two linear groove cuts, each having a semi-circular linearly extruded profile of small diameter, forming slide grooves 417; slide grooves 417 being oriented parallel with one another; slide grooves 417 being substantially co-aligned with the corresponding lower outside linear edges of perimeter wall 393; referring to FIG. 13, the forward edges of slide grooves 417 beginning directly under the foremost edge of step-down extension 375; slide grooves 417 continuing rearward the full length of the part; referring to FIG. 13A, slide grooves 417 further revealing apparent quarter-cylinder grooves in the rear linear portions of perimeter wall 393; slide grooves 417 further revealing apparent half-cylinder grooves at the convergence of pivot wings 394 with wing extensions 395; two hemispherical divots occurring on each pivot wing 394, creating a rear detent divot 418 and a forward detent divot 419 within each slide groove 417; the rear detent divots 418 and forward detent divots 419 being vertically centered on slide grooves 417, having similar diameter to slide grooves 417, and penetrating the part slightly deeper than slide grooves 417; each forward detent divot 419 occurring at the foremost edge of the corresponding slide groove 417; each rear detent divot 418 occurring just forward of the rear edge of the corresponding wing extension 395; referring to a horizontal axis passing concentrically through forward detent divots 419, hereafter identified as pivot axis 419A (FIGS. 13 and 13A); two flare groove cuts, each occurring at the rearmost intersection of each slide groove with the part, constituting effective alignment guides 420 (FIG. 13A) to aid in reinstallation of removable dry cartridge 855.

Upper Cartridge Segment 202—

Figure 14:
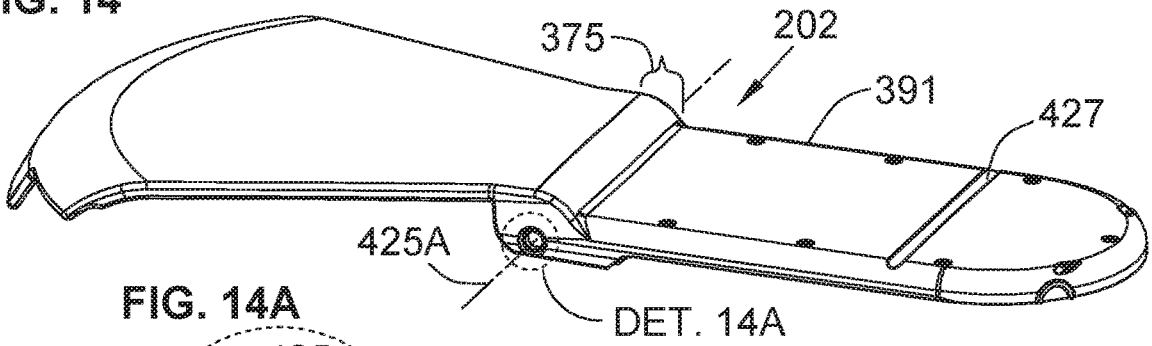
FIG. 14 is a perspective view of upper cartridge segment 202.
Figure 14A:
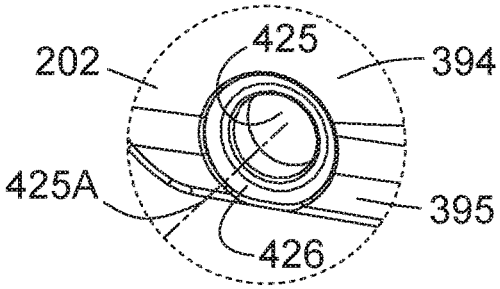
FIG. 14A is a detail view of upper cartridge segment 202, as indicated by the view window labeled DET. 14A in FIG. 14.
Figure 15:
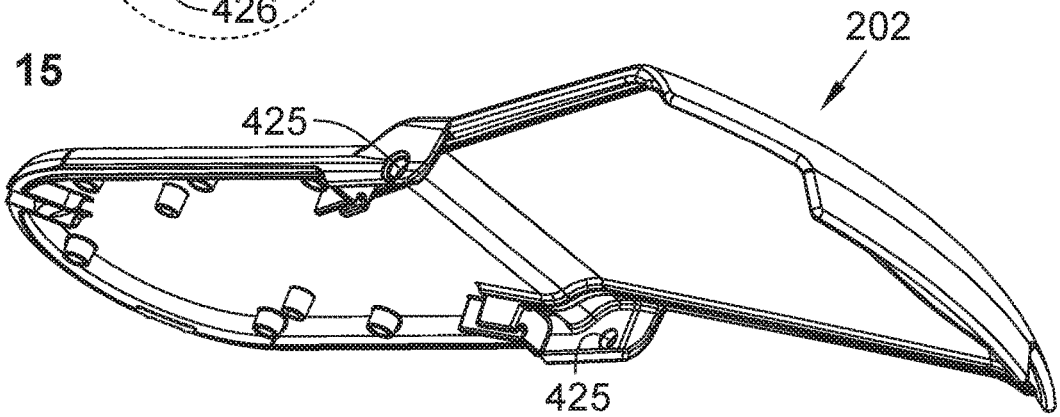
FIG. 15 is an additional perspective view of upper cartridge segment 202.
Figure 83:
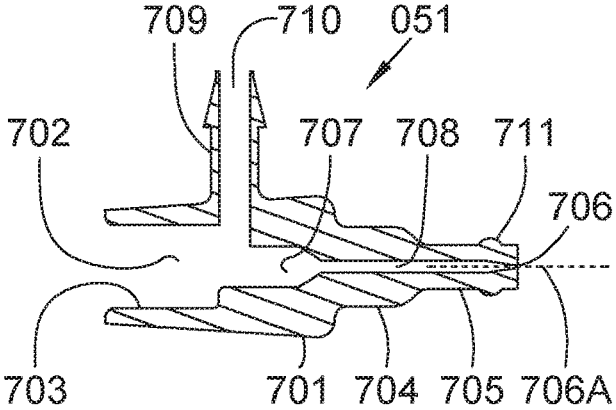
FIG. 83 is a section view of pivot jet 051, taken through section line 83 in FIG. 82.

In addition to the common features of upper cartridge segment 102/202, upper cartridge segment 202 further includes the following features: Referring to FIG. 14, and then FIG. 14A, two through-bores horizontally piercing the sides of the part; the through-bores, hereafter identified as pivot bores 425, being horizontally located directly under the foremost edge of the step-down extension 375 (FIG. 14); referring to FIG. 14A, pivot bores 425 further being located vertically at the horizontal convergence of pivot wings 394 with wing extensions 395; each pivot bore 425 further being proportioned to receive bearing shaft 704 of pivot jet 051 (Reference FIG. 83); a horizontal axis passing concentrically through pivot bores 425, constituting pivot axis 425A (FIGS. 14, 14A); again referring to FIG. 14A, a toroidal cut concentrically aligned with each pivot bore 425, shallowly intersecting the exterior surfaces of each pivot wing 394 and wing extension 395; the toroidal cuts, hereafter identified as seal wells 426, further being proportioned to receive O-ring seals 052; referring to FIG. 14, a small diameter cylindrical cut shallowly intersecting the top surface of rear cartridge cap 391, constituting tubing trim 427. FIG. 15 offers an additional perspective of upper cartridge segment 202. (Note that upper cartridge segment 202 does not include the slide grooves 417 (FIG. 13A), rear detent divots 418 (FIG. 13A), forward detent divots 419 (FIG. 13A), alignment guides 420 (FIG. 13A), spring wells 421 (FIG. 12A), spring trims 422 (FIG. 12A), side shield trims 423 (FIG. 12A), and lens receptacle 424 (FIG. 12) of upper cartridge segment 102)

Right Side Shield 003—

Referring to FIG. 16, this part, preferably formed of molded silicon rubber, includes the following features: A thin vertical wall member 428, originating from a forward circular curve 429 of large radius; within the respective master assembly, the wall member 428 further having a lower surface boundary 430 defined by the bottom surface of the corresponding side shield receptacle 458 of forward cartridge base 006 (Reference FIGS. 23, 23A), when forward cartridge base 006 is in its open position; within the respective master assembly, wall member 428 further having an upper surface boundary 431 defined by the upper surfaces of the rightmost side shield receptacle 415 of upper cartridge segment 102/202 (Reference FIG. 12), when upper cartridge segment 102/202 is in its opened position; a short extension continuing rearward from wall member 428, constituting rear extension 432; within the respective master assembly, rear extension 432 having a lower rear surface boundary 433 defined by the top surface of cartridge hinge 007 (Reference FIG. 23) and the top surface of floor member 473 of rear cartridge base 008/108 (Reference FIG. 23), with both parts in their open positions.

Retainers:

Referring to FIG. 16A, appended to the back edge of rear extension 432 a rear retainer 434 comprised of a short transverse rear wrap-around segment 435 oriented outward at 90° relative to rear extension 432, and a rear compression insert 436 oriented forward at 90° relative to rear wrap-around segment 435; similarly, appended to the bottom edge of rear extension 432, and centrally disposed lengthwise on rear extension 432, a bottom retainer 437 comprised of a short bottom wrap-around segment 438, oriented outward at 90° relative to rear extension 432, and a bottom compression insert 439 oriented upward at 90° relative to bottom wrap-around segment 438; rear retainer 434 being proportioned to wrap around the back surface of the corresponding inner parallel wall 414 of upper cartridge segment 102/202; bottom wrap-around segment 438 being proportioned to wrap around the bottom surface of the corresponding inner parallel wall 414 of upper cartridge segment 102/202 (Reference FIG. 12); rear compression insert 436 and bottom compression insert 439 further being proportioned such that when installed, they must compress slightly to fit between the corresponding outer parallel wall 413 and inner parallel wall 414 of upper cartridge segment 102/202 (Reference FIG. 12), effecting a substantial interference fit between these features.

Figure 18:
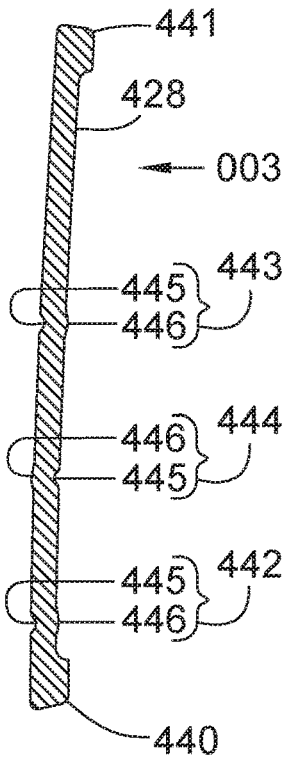
FIG. 18 is a section view of right side shield 003, taken through section line 18 in FIG. 17.

Compression Inserts:

Referring to FIG. 16, at the upper and lower extremities of the part two localized thickened protrusions extend a short distance outward from the outside surface of wall member 428, creating two receptacle inserts; lower receptacle insert 440 (FIGS. 16 and 18) being bound below by lower surface boundary 430 (FIG. 16); referring to FIG. 16, the upper surfaces of lower receptacle insert 440 being a shallow upward offset of lower surface boundary 430; the thickness of lower receptacle insert 440 being slightly greater than the width of the corresponding side shield receptacle 458 of forward cartridge base 006/106, allowing an effective interference-fit between these features; lower receptacle insert 440 further terminating at its rear edge slightly forward of rear extension 432, to fit the corresponding side shield receptacle 458 of forward cartridge base 006/106 (Reference FIGS. 23, 23A), within the respective master assembly; upper receptacle insert 441 (FIGS. 16 and 18) being bound above by upper surface boundary 431 (FIG. 16); referring to FIG. 16, the lower surfaces of upper receptacle insert 441 being a shallow downward offset of upper surface boundary 431; the thickness of upper receptacle insert 441 being slightly greater than the width of the corresponding side shield receptacle 415 of upper cartridge segment 102/202, allowing an effective interference-fit between these features; upper receptacle insert 441 further terminating at its rear edge a short distance behind the forward edge of rear extension 432, to fit the corresponding side shield receptacle 415 of upper cartridge segment 102/202 (Reference FIG. 12), within the respective master assembly.

Figure 17:
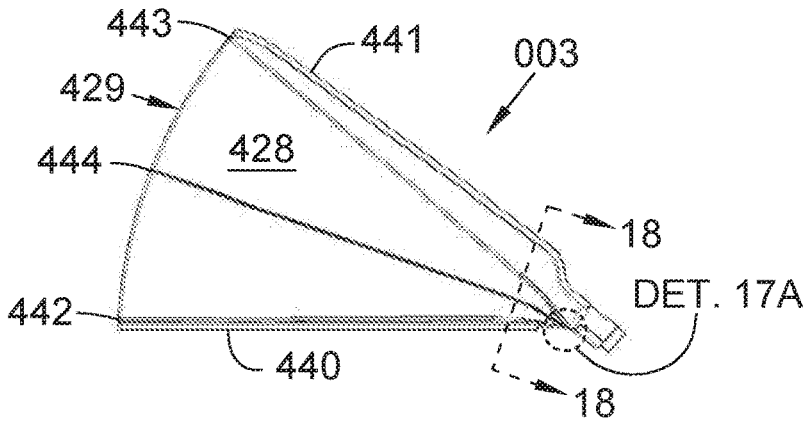
FIG. 17 is an additional perspective view of right side shield 003.
Figure 17A:
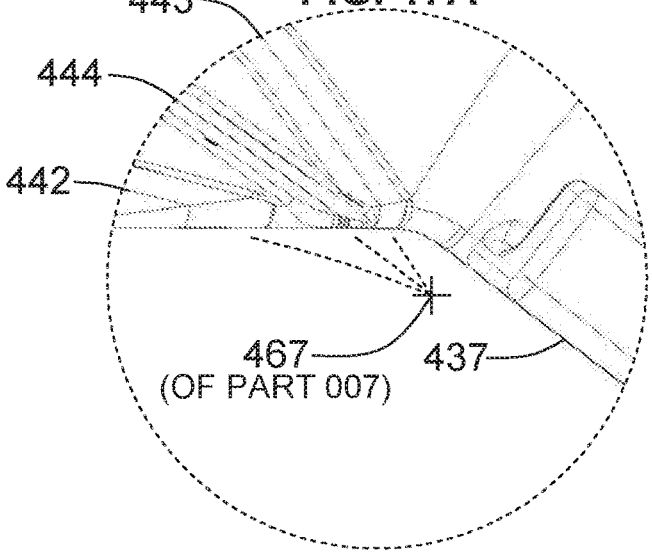
FIG. 17A is a detail view of right side shield 003, as indicated by the view window labeled DET. 17A in FIG. 17.

Flexion Control Curves:

Referring to FIG. 17, and then FIG. 17A, a radial pattern of three flexion control curves, the pattern positioned to radiate about virtual flexural axis 467 of cartridge hinge 007 (Superimposed in FIG. 17A for illustration; See also FIG. 24), within the respective master assembly; referring to FIG. 17, lower control curve 442 being oriented to intersect forward circular curve 429 just above the forward top edge of lower receptacle insert 440; upper control curve 443 being oriented to intersect forward circular curve 429 just below the forward bottom edge of upper receptacle insert 441; middle control curve 444 bisecting the angle between lower control curve 442 and upper control curve 443; lower control curve 442, upper control curve 443 and middle control curve 444 each having a linear forward sweep path tangentially connected to a rear downward curving radial sweep path; referring to FIG. 18, lower control curve 442 and upper control curve 443 each being comprised of a semi-circular flex groove 445 shallowly intersecting the interior surface of wall member 428, and an exterior circular swept protuberance, hereafter identified as flex protrusions 446, shallowly protruding from wall member 428; middle control curve 444 being comprised of an exterior flex groove 445 and an interior flex protrusion 446; flex protrusions 446 having diameter approximately four times the diameter of flex grooves 445; the combination of these flexion control features causing wall member 428 to fold inwardly as removable dry cartridge 855 articulates from an open state to a closed state, within the respective master assembly.

Although this part is shown as a separated component, it should be noted that this part could readily be over-molded onto upper cartridge segment 102/202, becoming a contiguous member of that part.

Right Side Shield 103—

Figure 20:
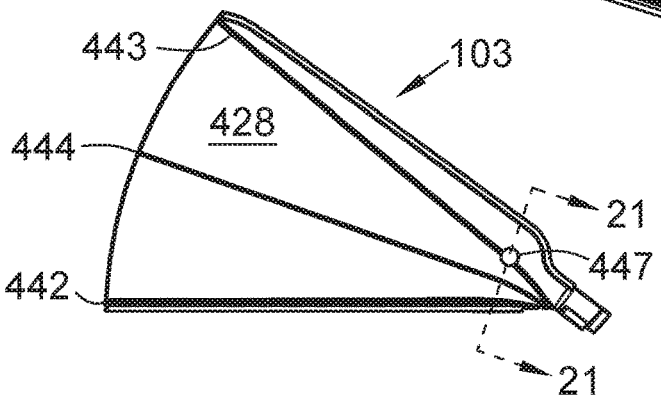
FIG. 20 is a perspective view of right side shield 103.
Figure 21:
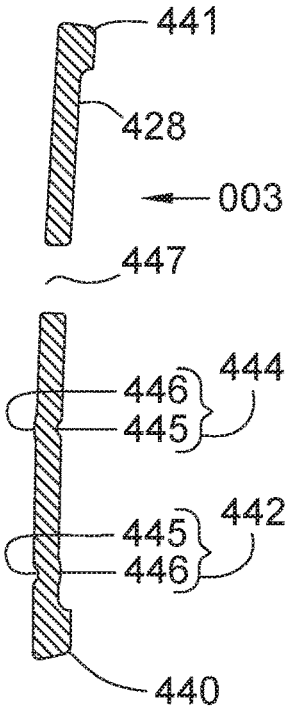
FIG. 21 is a section view of right side shield 103, taken through section line 21 in FIG. 20.

Right side shield 103, as illustrated in FIGS. 20 and 21, is substantially identical to right side shield 003, but having one additional feature: A small diameter aperture, hereafter identified as nozzle aperture 447, horizontally piercing wall member 428; nozzle aperture 447 further being positioned and proportioned to receive nozzle shaft 705 of pivot jet 051 (Reference FIG. 83), within the respective master assembly; nozzle aperture 447 further interrupting upper control curve 443 near the convergence of its linear forward sweep path and rear radial sweep path.

Left Side Shield 004—

Figure 19:
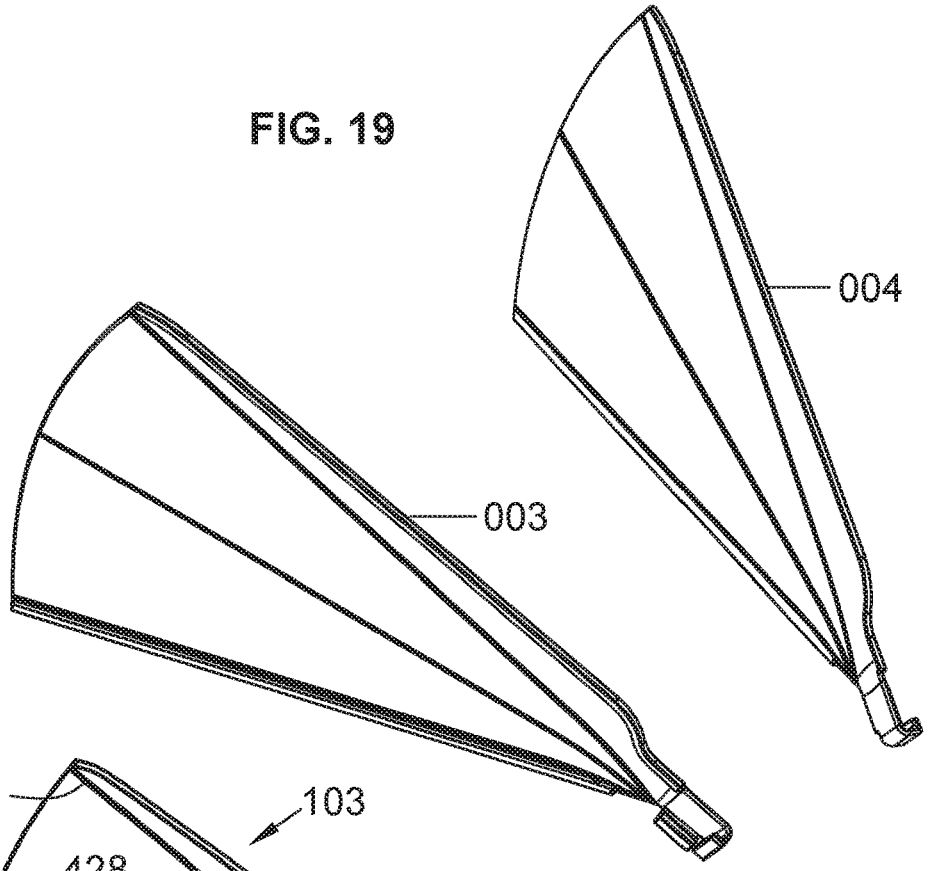
FIG. 19 is a perspective view of right side shield 003 and left side shield 004.

As illustrated in FIG. 19, left side shield 004 is a mirror image of right side shield 003 about a vertical plane; within the respective master assembly, the plane of symmetry being the longitudinal center plane of the respective master assembly.

Left Side Shield 104—

Figure 22:
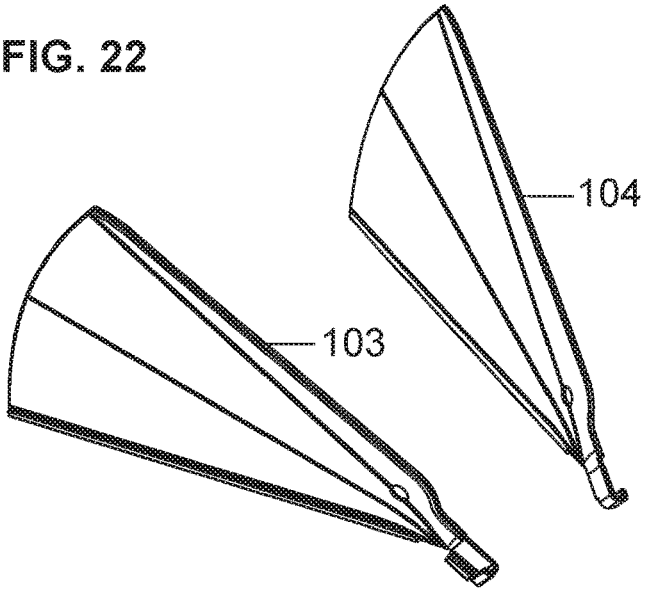
FIG. 22 is a perspective view of right side shield 103 and left side shield 104.

Referring to FIG. 22, left side shield 104 is a mirror image of right side shield 103 about a vertical plane; within the respective master assembly, the plane of symmetry being the longitudinal center plane of the respective master assembly.

Cartridge Springs 005—

Figure 29:
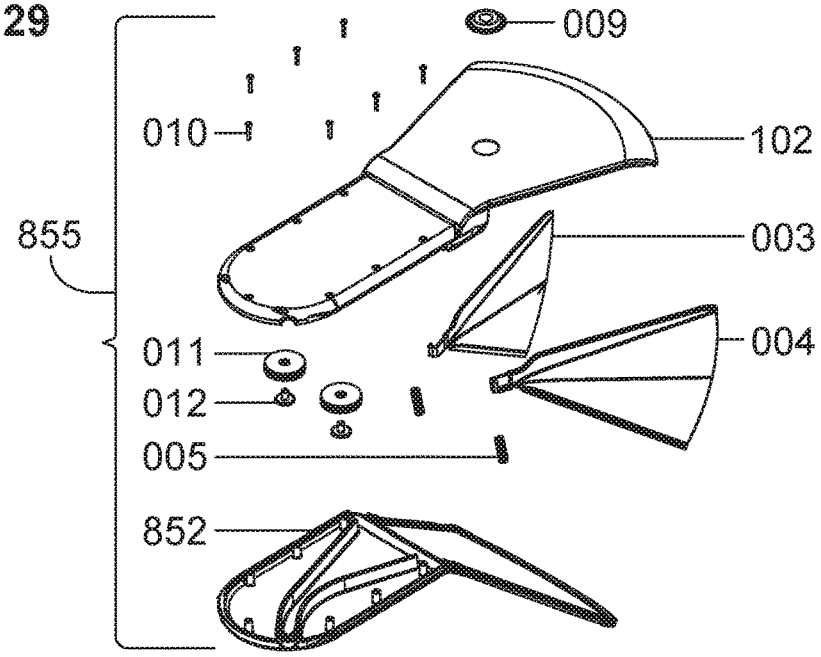
FIG. 29 is a perspective view of the components comprising removable dry cartridge 855, relatively positioned in an exploded state.

Referring to FIG. 29, these components are preferably standard off-the-shelf stainless steel compression springs.

Forward Cartridge Base 006—

Referring to FIG. 23, this part, preferably formed of molded plastic, has the following features: A thin floor member 448 having slight curvature similar to the top surface of radial bridge 334 of modified WC lid 001; this floor member 448 originating at a forward elliptical arc 449 having a substantially vertical axis; within the respective master assembly, forward elliptical arc 449 substantially being a slight forward offset from the rearward (interior) curvature of radial bridge 334 of modified WC lid 001/101/201/301 (Reference FIG. 1); floor member 448 extending rearward with a slight downward slope; floor member 448 further having side profiles, as seen from above, similar to receptacle opening 328 of modified WC lid 001, including short forward parallel sides 450 long converging angled sides 451 and short rear parallel sides 452; floor member 448 further terminating in a rear transverse plane 453; linear chamfer trims 454 occurring along the upper lateral edges of the short rear parallel sides 452; chamfer trims 454 terminating just forward of the convergence between converging angled sides 451 and rear parallel sides 452; chamfer trims 454 further being proportioned to receive chamfers 398 on wing extensions 395 of upper cartridge segment 102 (Reference FIG. 12A); a short radial protrusion extending upward from floor member 448, along the foremost elliptical edge of floor member 448, creating an effective drip lip 455; two short guide protrusions 456 extending horizontally outward a short distance from forward parallel sides 450 of floor member 448; guide protrusions 456 further having oval-shaped profiles, as seen from the side, with longitudinal axis oriented horizontally, and diameter slightly less than the thickness of floor member 448; guide protrusions 456 further substantially centered vertically on floor member 448.

Figure 23B:
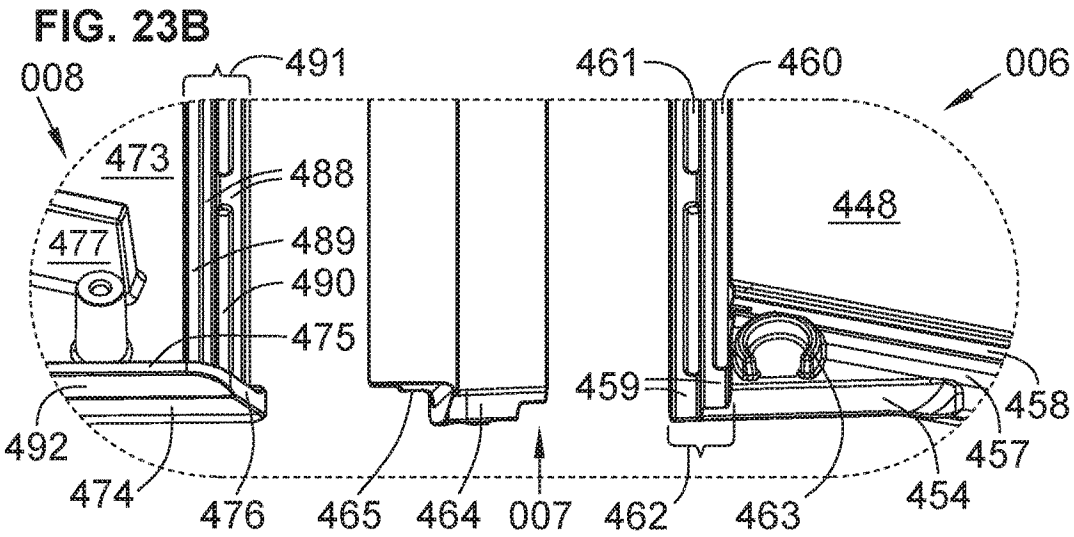
FIG. 23B is a detail view of forward cartridge base 006, cartridge hinge 007 and rear cartridge base 008, as indicated by the view window labeled DET. 23B in FIG. 23.

Still referring to FIG. 23, two linear protrusions 457 extending upward a short distance from floor member 448, substantially parallel with, and inset a short distance from, converging angled sides 451; each linear protrusion 457 originating at the rear edge of drip lip 455, having height approximately one-half that of drip lip 455, and spanning rearward, terminating at the foremost edge of interleave region 462 (FIG. 23B); referring to FIGS. 23 and 23B, two linear grooves, with width approximately equal to one-third the width of linear protrusions 457, forming side shield receptacles 458; side shield receptacles 458 shallowly penetrating the top surfaces of linear protrusions 457; side shield receptacles 458 commencing a short distance behind the front edges of linear protrusions 457 (FIG. 23), extending rearward the entire length of linear protrusions 457, and further bisecting the rear end of linear protrusions 457 (FIG. 23B); now referring to FIG. 23B, two downward stair-step cuts 459 penetrating the rear upper surface of floor member 448 across its entire width, effecting progressive layers of thinner material; the foremost stair-step cut 459 having a shallow continuous linear groove 460 adjacent to its foremost edge and centrally disposed about the longitudinal center plane of the part, extending nearly the full width of the part; the rearmost stair-step cut 459 having a shallow intermittent linear groove 461 adjacent to its foremost edge; intermittent linear groove 461 being interrupted by two short breaks in continuity, being central disposed about the longitudinal center plane of the part, and extending nearly the full width of the part; stair-step cuts 459, continuous linear groove 460 and intermittent linear groove 461 comprising interleave region 462; interleave region 462 further being proportioned to accept forward interleave region 471 of cartridge hinge 007 (Reference FIG. 24); two thin-walled cylindrical protrusions, extending vertically upward a short distance from the top of floor member 448, and comprising spring wells 463; each spring well 463 occurring just forward of interleave region 462, between each chamfer trim 454 and the proximate linear protrusion 457; the interior diameter of each spring well 463 being proportioned to receive one cartridge spring 005; each spring well 463 further including a short radial break for approximately one-fourth of its perimetral length, being aligned with the proximate chamfer trim 454.

Forward Cartridge Base 106—

Figure 26:
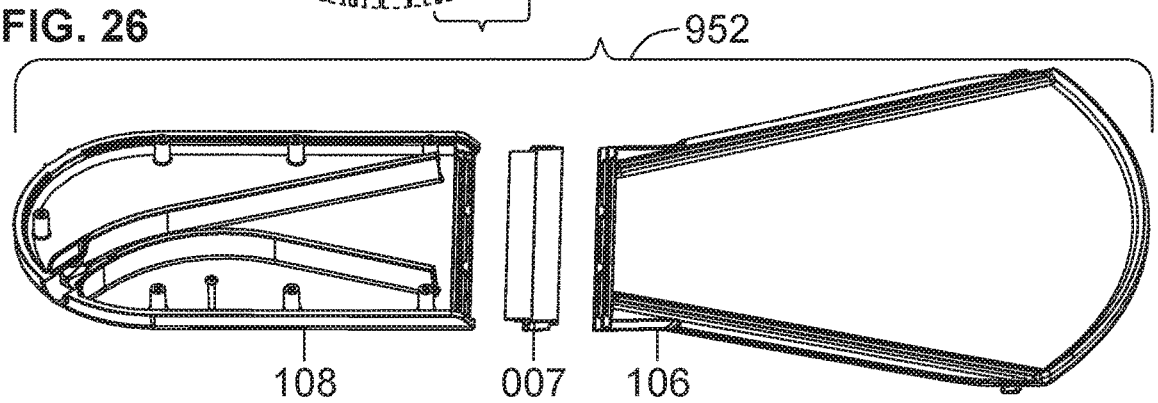
FIG. 26 is a perspective view of the components comprising hinged wet cartridge base 952, relatively positioned in an exploded state.

As illustrated in FIG. 26, forward cartridge base 106 is substantially identical to forward cartridge base 006, less the two spring wells 463.

Cartridge Hinge 007—

This part, preferably formed of molded silicon rubber, is describes as follows: Referring to FIG. 23 an elastomeric member, substantially equal in thickness to floor member 448 of forward cartridge base 006/106 and floor member 473 of rear cartridge base 008/108, having width equivalent to the overall width of rear cartridge base 008/108; referring to FIG. 23B, a front-to-rear linear chamfer trims 464 occurring on each upper lateral edge of the part; chamfer trims 464 further being proportioned to match chamfer trims 454 of forward cartridge base 006/106; two contoured trim cuts, hereafter identified as rear base trims 465 (FIGS. 23B, 24), having substantially rectangular profiles of narrow width, intersecting the left and right sides of the part shortly behind its mid-length; referring to FIG. 23B, rear base trims 465 cutting obliquely rearward and downward from the top surface of the part, being proportioned to receive the foremost edges of perimeter wall 474 of rear cartridge base 008; now referring to FIG. 24, a flex control groove 466 having an inverted V-shaped profile, penetrating the bottom surface of the part, at its mid-length; flex control groove 466 further leaving the part substantially thinned directly above flex control groove 466, effecting a controlled region for part flexion with an implied virtual flexural axis 467 extending laterally through cartridge hinge 007 at the mid-thickness of the part, directly above flex control groove 466.

Figure 24:
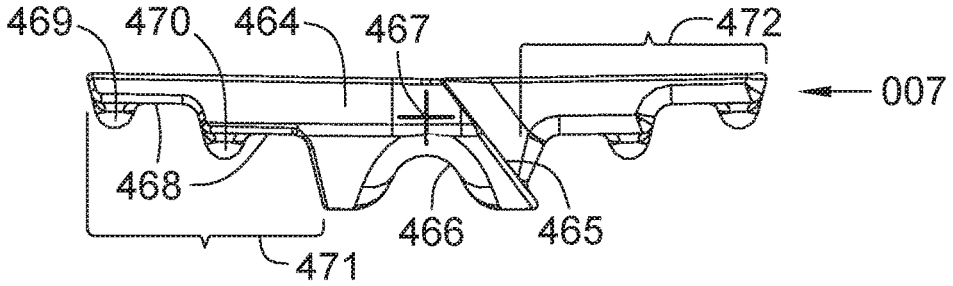
FIG. 24 is a side elevation view of cartridge hinge 007.
Figure 25:
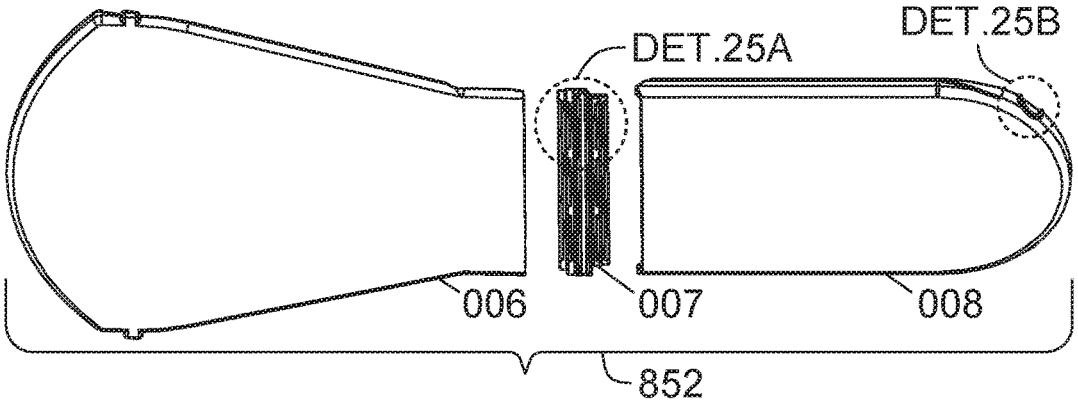
FIG. 25 is a perspective view of the components comprising hinged dry cartridge base 852, relatively positioned in an exploded state.
Figure 25A:
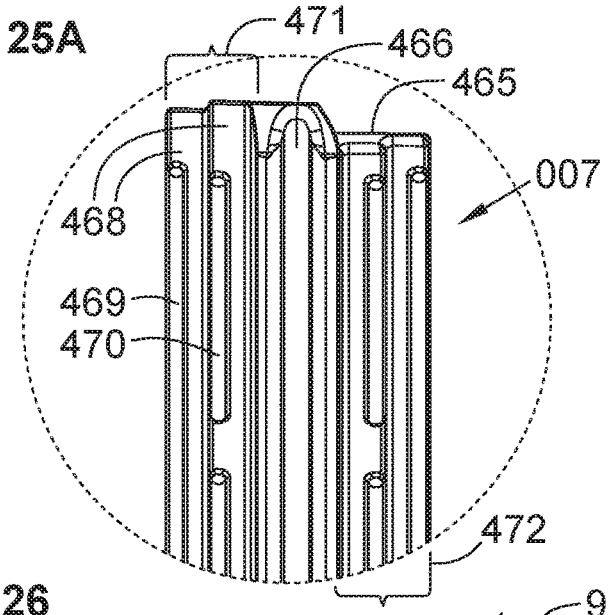
FIG. 25A is a detail view of cartridge hinge 007 as indicated by the view window labeled DET. 25A in FIG. 25.

Still referring to FIG. 24, slightly forward of flex control groove 466, two inverted stair-step cuts 468 penetrating the bottom of the part across its entire width, effecting progressive layers of thinner material; now referring to FIG. 25, and then 25A, the foremost stair-step cut 468 having a continuous linear protrusion 469 adjacent to its foremost edge and extending downward a short distance (see FIG. 24 also) for nearly the full width of the part; continuous linear protrusion 469 further being symmetrically positioned about the center plane of the part; the rearward stair-step cut 468 in comparison having an intermittent linear protrusion 470 adjacent to its foremost edge; intermittent linear protrusion 470 being interrupted by two short breaks in continuity, and further being symmetrically positioned about the center plane of the part; stair-step cuts 468, continuous linear protrusion 469, and intermittent linear protrusion 470 collectively comprising forward interleave region 471 (FIGS. 24, 25A); forward interleave region 471 further being proportioned to fit interleave region 462 of forward cartridge base 006/106 (Reference FIG. 23B); a rear interleave region 472 (FIGS. 24, 25A), similar to forward interleave region 471, extending laterally between rear base trims 465; rear interleave region 472 being comprised of two inverted stair-step cuts, a continuous linear protrusion and an intermittent linear protrusion; referring to FIG. 24, rear interleave region 472 practically being a mirror image of forward interleave region 471, with the plane of symmetry passing vertically through virtual flexural axis 467; rear interleave region 472 further being proportioned to fit interleave region 491 of rear cartridge base 008/108 (Reference FIG. 23B.).

Although this part is shown as a separated component, it should be noted that the function of cartridge hinge 007 could instead be accomplished by concurrently over-molding an elastomeric material onto forward cartridge base 006/106 and rear cartridge base 008/108, such that the hinging function of cartridge hinge 007 is accomplished by a contiguous member of a singular cartridge base. Alternatively, forward cartridge base 006/106 and rear cartridge base 008/108 could be combined into a singular component having an integral living hinge to accomplish the hinging function of cartridge hinge 007.

Rear Cartridge Base 008—

This part, preferably formed of molded plastic, is complimentary in size and shape to rear cartridge cap 391 of upper cartridge segment 102/202, and includes the following features: Referring to FIG. 23, a thin planar horizontal floor member 473 having length and width substantially equal to the length and width of ceiling member 392 of rear cartridge cap 391 of upper cartridge segment 102/202; floor member 473 further having a simple keyhole profile, as seen from above, comprised of a rectangle with a full radius at its rearmost end; said profile being substantially equivalent to the top-view profile of rear cartridge cap 391 of upper cartridge segment 102/202 (Reference FIG. 10); the contiguous perimeter of floor member 473, excluding only the forward edge, arching into a shallow upturned vertical perimeter wall 474; perimeter wall 474 terminating at its upper surface in a horizontal plane, hereafter identified as mating plane 475; the forward edges of perimeter wall 474 further sloping downward and forward from mating plane 475, to meet the front edge of the part in oblique forward transitions 476; oblique forward transitions 476 being proportioned to compliment oblique rear transitions 397 of upper cartridge segment 102/202 (Reference FIG. 10.).

Still referring to FIG. 23, two thin rearward converging vertical walls beginning shortly behind the front edge of the part, constituting funnel entry walls 477; within the respective master assembly, the forward surfaces of funnel entry walls 477 being offset a short distance behind the rear surfaces of inner parallel walls 414 of upper cartridge segment 102/202 (Reference FIG. 12); within the respective master assembly, funnel entry walls 477 further having interior and exterior surfaces substantially coplanar with the respective surfaces of inner parallel walls 414 of upper cartridge segment 102/202 (Reference FIG. 12); funnel entry walls 477 extending upward from the top of floor member 473 to a height approximately twice that of perimeter wall 474; within the respective master assembly, the upper terminal surface of funnel entry walls 477, hereafter identified as funnel wall terminus 478, being substantially coincident with the lower surface of ceiling member 392 of upper cartridge segment 102/202 (Reference FIG. 12.).

Figure 23A:
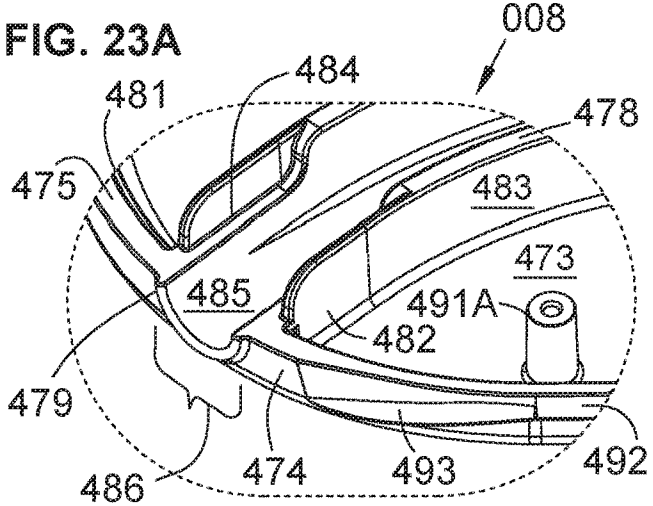
FIG. 23A is a detail view of rear cartridge base 008, as indicated by the view window labeled DET. 23A in FIG. 23.

Still referring to FIG. 23, two small toroidal ridges protruding slightly outward from the rear cylindrical surface of perimeter wall 474, creating symmetric protrusions hereafter identified as left funnel seal protrusion 479 (FIG. 23A), and right funnel seal protrusion 480 (FIG. 23); the center axis of left funnel seal protrusion 479 (FIG. 23A) being positioned at −45° with respect to the center of the cylindrical surface of perimeter wall 474, as seen from above; the horizontal center axis of right funnel seal protrusion 480 (FIG. 23) being positioned at 45° with respect to the center of the cylindrical surface of perimeter wall 474, as seen from above; referring to FIG. 23A, the horizontal center axis of left funnel seal protrusion 479 further being located within mating plane 475; referring to FIG. 23, the horizontal center axis of right funnel seal protrusion 480 similarly being located within mating plane 475; left funnel seal protrusion 479 (FIG. 23A) further being proportioned to compliment left funnel seal protrusion 400 of upper cartridge segment 102/202 (Reference FIG. 11A); similarly, right funnel seal protrusion 480 (FIG. 23) being proportioned to compliment right funnel seal protrusion 401 of upper cartridge segment 102/202 (Reference FIG. 11A); now referring to FIG. 23A, perimeter wall 474 further having an alignment groove 481 shallowly intersecting its interior edge and penetrating shallowly downward from mating plane 475; alignment groove 481 further having two breaks in continuity centered around left funnel seal protrusion 479 (FIG. 23A) and right funnel seal protrusion 480 (FIG. 23); alignment groove 481 further being proportioned to receive alignment lip 406 of upper cartridge segment 102 (Reference FIG. 11A); referring to FIG. 23A, two thin parallel vertical walls, hereafter identified as funnel exit walls 482, protruding upward from the top of floor member 473 and vertically concluding at the height of funnel wall terminus 478; funnel exit walls 482 being positioned with inner surfaces tangent to the interior of left funnel seal protrusion 479 at mating plane 475; the top surface of funnel exit walls 482 further curving downward near their exterior end to meet mating plane 475 perpendicularly, at the interior edge of perimeter wall 474.

Figure 25B:
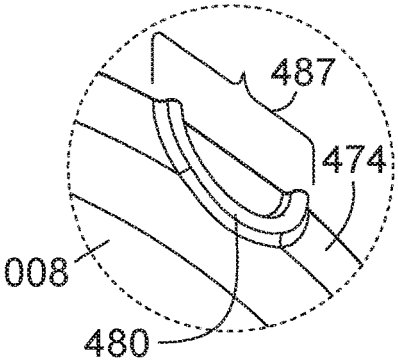
FIG. 25B is a detail view of rear cartridge base 008 as indicated by the view window labeled DET. 25B in FIG. 25.

Referring to FIG. 23, two radial walls 483, having upper terminus coincident to funnel wall terminus 478, tangentially blending each funnel entry wall 477 to the respective funnel exit wall 482 in a large-radius arc; radial walls 483 further radiating about a common vertical axis; referring to FIG. 23A, two trim cuts, hereafter identified as return wall trims 484, shallowly intersecting the inside of funnel exit walls 482; return wall trims 484 being proportioned to receive return walls 402 of upper cartridge segment 102/202 (Reference FIG. 11A); a cylindrical cut, concentrically aligned to left funnel seal protrusion 479, with radius equal to the interior radius of left funnel seal protrusion 479, comprising funnel bore 485; funnel bore 485 further extending through perimeter wall 474, blending downward to meet the top surface of floor member 473, while also blending outward to meet funnel exit walls 482; left funnel seal protrusion 479, and the opening within left funnel seal protrusion 479 accomplished by funnel bore 485, comprising lower urine spout 486; referring to FIG. 25, then FIG. 25B, right funnel seal protrusion 480, and the section of perimeter wall 474 encompassed by right funnel seal protrusion 480, comprising lower false spout 487.

Now referring to FIG. 23B, two downward stair-step cuts 488 penetrating the forward upper surface of floor member 473 between the lateral sides of perimeter wall 474, effecting progressive layers of thinner material; the rearmost stair-step cut 488 having a shallow continuous linear groove 489 adjacent to its rearmost edge and centrally disposed laterally within the rearmost stair-step cut 488; continuous linear groove 489 further extending nearly the full width of the rearmost stair-step cut 488; the forward stair-step cut 488 having a shallow intermittent linear groove 490 adjacent to its rearmost edge; intermittent linear groove 490 being interrupted by two short breaks in continuity, central disposed within the forward stair-step cut 488, and extending nearly the full width of the forward stair-step cut 488; stair-step cuts 488, continuous linear groove 489 and intermittent linear groove 490 comprising interleave region 491; interleave region 491 further being proportioned to accept rear interleave region 472 of cartridge hinge 007 (Reference FIG. 24.).

Referring again to FIG. 23, seven cylindrical protrusions extending upward a short distance from the top surface of floor member 473; each cylindrical protrusion having an internally threaded hole concentrically penetrating its top surface; the cylindrical protrusions and internally threaded holes comprising screw bosses 491A; screw bosses 491A further being proportioned and positioned to align with, and fit within screw boss ports 409 of upper cartridge segment 102/202 (Reference FIG. 11A.).

Referring to FIGS. 23A and 23B, two linear groove cuts, each having a semi-circular linearly extruded profile of small diameter, forming slide grooves 492; the axis of each slide groove 492 being nearly coincident with the line of convergence where the long linear sections of perimeter wall 474 meet mating plane 475; each slide groove 492 extending the entire length of the part; slide grooves 492 further being proportioned to compliment slide grooves 417 of upper cartridge segment 102 (Reference FIG. 13A); two flare groove cuts, each occurring at the rearmost intersection of each slide groove 492 with the part, constituting effective alignment guides 493 (FIG. 23A), to aid in reinstallation of removable dry cartridge 855; alignment guides 493 further being proportioned to compliment alignment guides 420 of upper cartridge segment 102 (Reference FIG. 13A.).

Rear Cartridge Base 108—

As illustrated in FIG. 26, rear cartridge base 108 is substantially identical to rear cartridge base 008, less the two slide grooves 492 and the two alignment guides 493.

Cartridge Lens 009—

Figure 27:
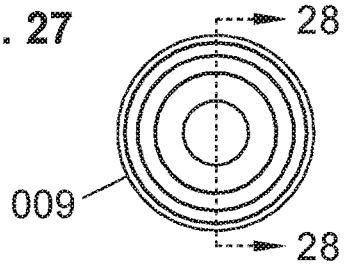
FIG. 27 is a top plan view of cartridge lens 009.
Figure 28:
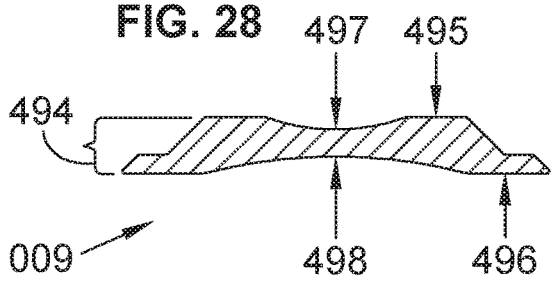
FIG. 28 is a section view of cartridge lens 009, taken through section line 28 in FIG. 27.

This part, preferably formed of translucent molded plastic, has the following features: Referring to FIG. 27 and then FIG. 28, a thin disk-shaped body having a vertical axis and a revolved two-stage profile 494; two-stage profile 494 effecting a moderately thick upper region of small diameter and inwardly sloped walls above a thinner lower region of larger diameter with inwardly sloped walls, adjoined at a horizontal plane; this part further being proportioned to fit lens receptacle 424 of upper cartridge segment 102 (Reference FIG. 12); an upper surface 495 that, when assembled, is substantially coincident with the upper surface of receptacle lid 365 of upper cartridge segment 102; a lower surface 496 that, when assembled, is substantially coincident with the lower surface of receptacle lid 365 of upper cartridge segment 102; a semi-spherical cut concentrically aligned with the axis of the part, creating a shallow upper concavity 497 in upper surface 495; a second semispherical cut concentrically aligned with the axis of the part, creating a larger diameter shallow lower concavity 498 in lower surface 496; this part further having good light transmission characteristics, such that any light entering upper concavity 497 is transmitted through the part and broadly dispersed from lower concavity 498. By this means, a light source emitting photons above cartridge lens 009 may illuminate the interior of removable dry cartridge 855.

Cartridge Fasteners 010—

Figure 30:
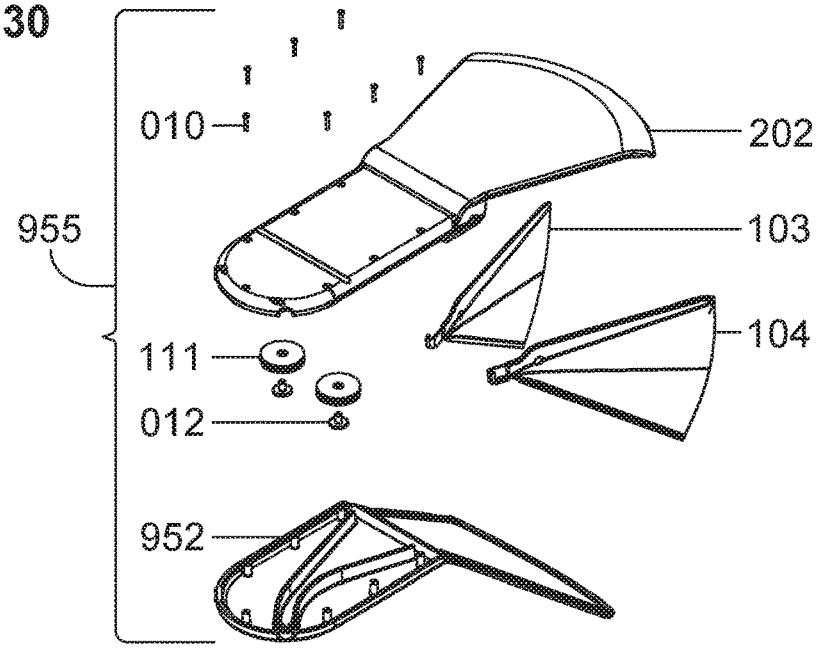
FIG. 30 is a perspective view of the components comprising fixed wet cartridge 955, relatively positioned in an exploded state.

These parts are preferably standard off-the-shelf stainless steel screws, as illustrated in FIGS. 29 and 30.

Cartridge Ballast 011—

Referring to FIG. 29, this component is preferably comprised of multiple standard off-the-shelf stainless steel fender washers, concentrically aligned and stacked together, and bearing the following attributes: Cartridge ballast 011 being proportioned to provide supplementary mass that will cause a rotational moment within removable dry cartridge 855; this rotational moment, supplemented by the expansion force provided by cartridge springs 005, will affect the self-opening function of removable dry cartridge 855, within the respective master assembly.

Cartridge Ballast 111—

Referring to FIG. 30, this component is preferably comprised of multiple standard off-the-shelf stainless steel fender washers, concentrically aligned and stacked together, and bearing the following attributes: Cartridge ballast 111 having marginally greater thickness, marginally greater diameter, and therefore greater mass, than cartridge ballast 011; cartridge ballast 111 further being proportioned to provide supplementary mass that will cause a rotational moment within fixed wet cartridge 955, to affect the self-opening function of fixed wet cartridge 955. (Note: Comparison of FIG. 29 to FIG. 30 illustrates that unlike removable dry cartridge 855, fixed wet cartridge 955 does not include cartridge springs 005.)

Ballast Retainers 012—

Referring to FIGS. 29 and 30, these parts are preferably standard off-the-shelf stainless steel screws, proportioned to retain cartridge ballasts 011/111.

Pivot Slide Springs 013—

Figure 31:
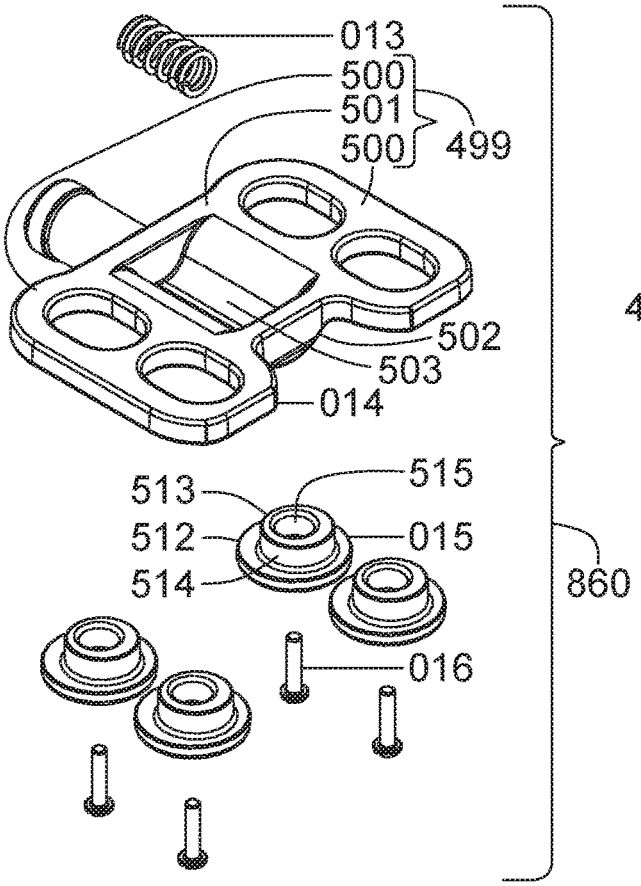
FIG. 31 is a perspective view of the components comprising sliding pivot plate assembly 860, relatively positioned in an exploded state.

This compression spring is preferably a standard off-the-shelf stainless steel component, as illustrated in FIG. 31.

Pivot Plate 014/114 Common Geometry—

Referring to FIG. 31, these parts, preferably formed of molded plastic, share the following features: A thin planar plate member 499, having a vertical profile formed by adjoining two oval-shaped segments 500 with a rectangular segment 501; oval-shaped segments 500 being oriented with their longitudinal axes parallel to the longitudinal axis of rectangular segment 501; oval-shaped segments 500 having length about twice their width; rectangular segment 501 having length approximately three-fourths that of oval-shaped segments 500 and width approximately equal to that of oval-shaped segments 500; the interior edge of rectangular segment 501 further being very slightly offset exterior to the common interior end of oval-shaped segments 500; within the respective master assembly, the upper surface of plate member 499 being coincident with the lower surface of coplanar pads 348 of modified WC lid 101/201/301 (Reference FIG. 3B.).

Figure 32:
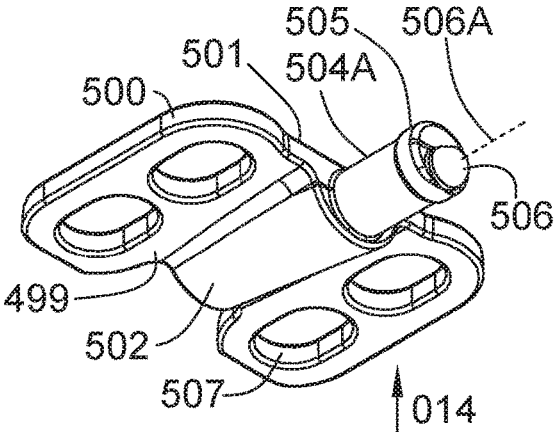
FIG. 32 is a perspective view of pivot plate 014.

Referring to FIG. 32, rectangular segment 501 further having a tapered cylindrical protrusion 502 appended to its bottom side; tapered cylindrical protrusion 502 being centrally disposed on the lower surface of rectangular segment 501, and having cylindrical diameter approximately three-fourths the width of rectangular segment 501; the interior and exterior end surfaces of tapered cylindrical protrusion 502 being substantially coincident with respective end surfaces of rectangular segment 501; tapered cylindrical protrusion 502 projecting a short distance below the exterior end of plate member 499; at its interior end, tapered cylindrical protrusion 502 projecting moderately below plate member 499, such that the vertical midpoint of tapered cylindrical protrusion 502 is slightly below the bottom surface of plate member 499; referring to FIG. 31, a horizontally oriented cylindrical cavity 503, penetrating the upper surfaces of tapered cylindrical protrusion 502 and plate member 499, practically coring tapered cylindrical protrusion 502; cylindrical cavity 503 extending upward in a full profile cut through plate member 499, and blending tangentially forward and rearward to meet the upper surface of plate member 499; cylindrical cavity 503 further being proportioned to receive reference protrusion 347 and spring saddle 347A of modified WC lid 101/201/301 (Reference FIG. 3B.).

Pivot Plate 014—

In addition to the common geometry of pivot plate 014/114, this part further includes the following features, as illustrated in FIG. 32: A circular protrusion of small diameter, hereafter identified as large pivot stud 504A, protruding horizontally outward from the interior end of tapered cylindrical protrusion 502; large pivot stud 504A further being centrally disposed on the interior end of tapered cylindrical protrusion 502; large pivot stud 504A having diameter approximately three-fourths that of the largest diameter of tapered cylindrical protrusion 502; large pivot stud 504A having length approximately twice its diameter; a narrow circular disk 505, appended concentrically to the interior end of large pivot stud 504A; circular disk 505 further having diameter slightly greater than large pivot stud 504A; a hemispherical protrusion, hereafter identified as pivot knob 506 appended to the interior end of circular disk 505; pivot knob 506 further having diameter about one-half that of circular disk 505; pivot knob 506 further being eccentrically aligned with circular disk 505, such that the bottom edge of pivot knob 506 is coincident with the bottom edge of circular disk 505; a horizontal axis passing concentrically through the center of pivot knob 506, being hereafter identified as pivot axis 506A; four oval-shaped slide apertures 507 vertically penetrating plate member 499; slide apertures 507 having diameter proportioned to receive slide surfaces 514 of four pivot plate retainers 015 (FIG. 31); the length of slide apertures 507 being approximately one and one-half times their diameter; two slide apertures 507, aligned lengthwise to each other, being centrally positioned and symmetrically spaced on each oval-shaped segment 500 of plate member 499.

Pivot Plate 114—

Figure 34:
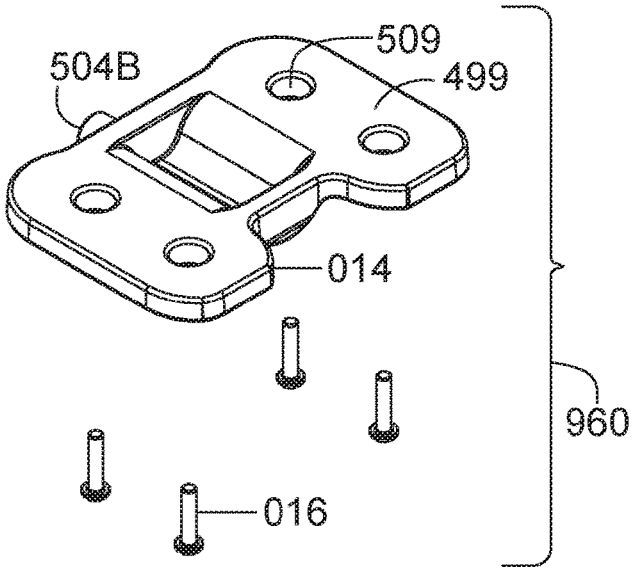
FIG. 34 is a perspective view of the components comprising fixed pivot plate assembly 960, relatively positioned in an exploded state.
Figure 35:
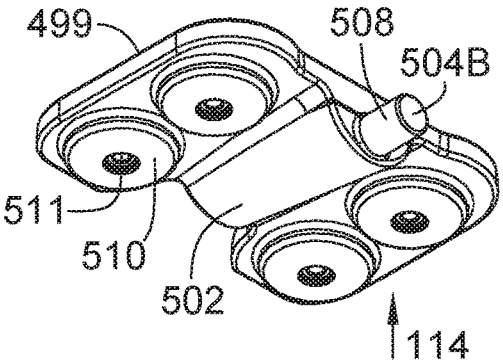
FIG. 35 is a perspective view of pivot plate 114.

In addition to the common geometry of pivot plate 014/114, this part further includes the following features, as illustrated in FIG. 35: A circular protrusion of small diameter, hereafter identified as small pivot stud 504B, protruding horizontally outward from the interior end of tapered cylindrical protrusion 502; small pivot stud 504B further being positioned near the lower edge of the interior end of tapered cylindrical protrusion 502; small pivot stud 504B, having diameter approximately three-eighths that of the largest diameter of tapered cylindrical protrusion 502; small pivot stud 504B having length approximately one and one-half times its diameter; small pivot stud 504B further having external straight threads 508, proportioned to receive internal straight threads 703 of pivot jet 051 (Reference FIG. 83); four blind-depth screw boss ports 509 (FIG. 34), intersecting the top surface of plate member 499, with diameter and depth proportioned to receive pivot mount bosses 349 of modified WC lid 101/201/301 (Reference FIG. 3B); four radial screw cap protrusions 510 (FIG. 35) being coaxially aligned with the four screw boss ports 509 (FIG. 34); referring to FIG. 35, screw cap protrusions 510 adding thin disk members to the lower surface of plate member 499; four screw ports 511 comprised of vertical through-bores and bottom-side countersinks proportioned to receive pivot plate fasteners 016.

Pivot Plate Retainers 015—

Figure 33:
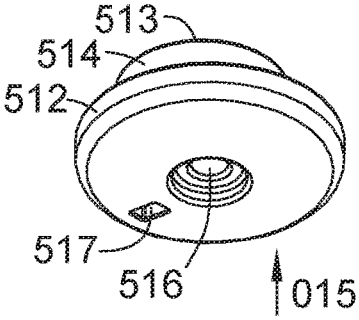
FIG. 33 is a perspective view of pivot plate retainer 015.

This part, preferably formed of molded plastic, bears the following features: Referring to FIG. 31, a round lower disk 512 having thickness approximately one-fifth of its diameter, with axis oriented vertically; a round upper disk 513 of smaller diameter, having thickness substantially equal to that of plate member 499 of pivot plate 014; upper disk 513 having diameter approximately three-fifths that of lower disk 512; upper disk 513 also having its axis oriented vertically; the lower planar face of upper disk 513 adjoined to the upper planar face of lower disk 512; the axes of lower disk 512 and upper disk 513 being parallel to each other, but slightly offset, effecting a minor eccentricity between lower disk 512 and upper disk 513; said eccentricity being proportioned to allow positional adjustment of pivot plate 014 (FIG. 31) within the respective master assembly; upper disk 513 being proportioned such that its upper surface will mate with the lower surface of coplanar pads 348 of modified WC lid 101/201/301 (Reference FIG. 3B), within the respective master assembly; the upper surface of lower disk 512 being proportioned to substantially mate with the lower surfaces of oval-shaped segments 500 of pivot plate 014 (Reference FIG. 31); upper disk 513 (FIG. 31) further having diameter slightly smaller than the width of slide apertures 507 of pivot plate 014 (FIG. 32); the cylindrical surface of upper disk 513 hereafter being identified as slide surface 514; a screw boss port 515, comprised of a vertical circular bore concentrically aligned with lower disk 512, penetrating the top surface of upper disk 513; screw boss port 515 further being proportioned to receive a pivot mount boss 349 of modified WC lid 101/201/301 (Reference FIG. 3B); referring to FIG. 33, a screw port 516 comprised of a vertical through-bore and a bottom-side countersink, concentrically aligned with lower disk 512, and proportioned to receive pivot plate fasteners 016; a short linear groove, shallowly intersecting the lower surface of lower disk 512, positioned radially with respect to the central axis of the part, constituting alignment indicator 517.

Pivot Plate Fasteners 016—

These parts are preferably standard off-the-shelf stainless steel screws, as illustrated in FIGS. 31 and 34.

Pivot Rod 017—

Figure 38:
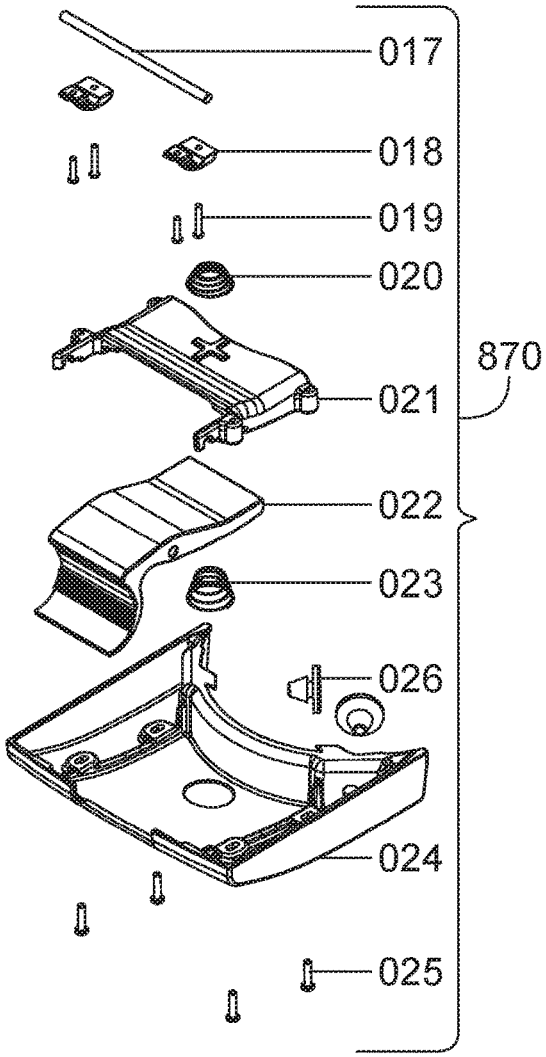
FIG. 38 is a perspective view of the components comprising incremental brake assembly 870, relatively positioned in an exploded state.
Figure 39:
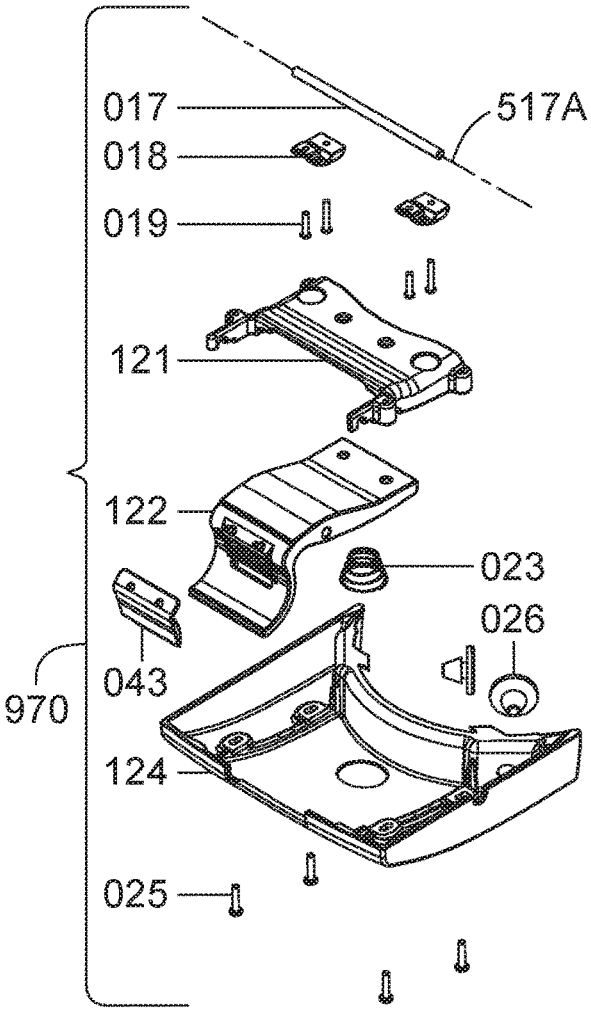
FIG. 39 is a perspective view of the components comprising analog brake assembly 970, relatively positioned in an exploded state.

This part is preferably a standard off-the-shelf stainless steel rod, as illustrated in FIGS. 38 and 39, having small diameter proportioned to fit pivot saddles 354 of modified WC lid 101/201/301 (Reference FIG. 3C.). Pivot rod 017 having length substantially equal to the overall width of brake sub-frame 021/121, and a horizontal axis passing concentrically through it, hereafter being identified as lever pivot axis 517A (FIG. 39).

Pivot Rod Retainers 018—

Figure 36:
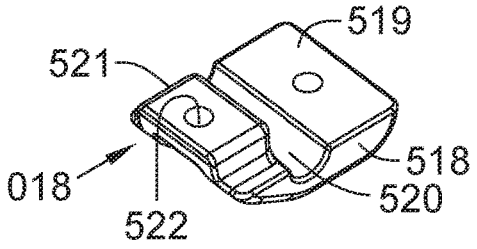
FIG. 36 is a perspective of pivot rod retainer 018.

These parts, preferably formed of molded plastic, bear the following features: Referring to FIG. 36, a short extruded body 518 having a curved lower profile, substantially being the lower half of a horizontal cylinder; extruded body 518 having an upper planar surface, hereafter identified as saddle plane 519; a small diameter cylindrical cut, with axis oriented parallel to the axis of extruded body 518, shallowly penetrating the top of extruded body 518, creating pivot saddle 520, a short distance behind the mid-length of extruded body 518; the axis of pivot saddle 520 further being in saddle plane 519; pivot saddle 520 further being proportioned to receive pivot rod 017; a rear rectangular protrusion, hereafter identified as recess land 521, projecting upward from saddle plane 519 behind pivot saddle 520; recess land 521 having width moderately narrower than that of extruded body 518; the forward edge of recess land 521 being tangent to pivot saddle 520 at saddle plane 519; recess land 521 extending rearward to the rear terminus of extruded body 518; recess land 521 further being laterally centered on extruded body 518; referring to FIG. 37, two screw ports 522, comprised of vertical through bores and bottom side recesses penetrating extruded body 518; referring to FIG. 36, one screw port 522 being centrally disposed on that portion of the planar top surface of extruded body 518 occurring forward of pivot saddle 520; one screw port 522 being centrally disposed on the top surface of recess land 521; screw ports 522 further being proportioned to receive retainer fasteners 019; this component further being proportioned to mate with pivot blocks 353 of modified WC lid 101/201/301 (Reference FIG. 3C.).

Retainer Fasteners 019—

These parts are preferably standard off-the-shelf stainless steel screws, as illustrated in FIGS. 38 and 39.

Upper Brake Spring 020—

As illustrated in FIG. 38, this conical compression spring is preferably a standard off-the-shelf stainless steel component, having a spring constant approximately one-half that of lower brake spring 023.

Brake Sub-Frame 021—

Figure 42:
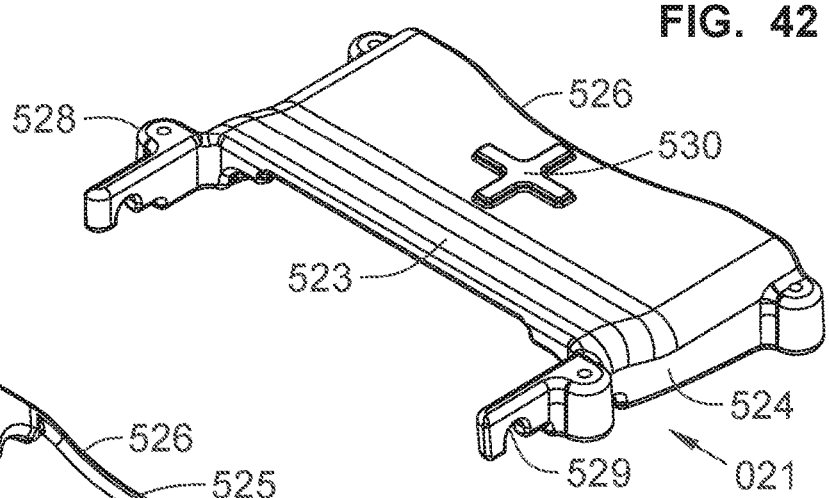
FIG. 42 is a perspective view of brake sub-frame 021.

This part, preferably formed of molded plastic, bears the following features: Referring to FIG. 42, a thin upper plate member 523, having minor front to rear curvature, curling downward along its lateral sides, and blending into two thin, short vertical sidewalls 524, substantially creating a downward opening shallow channel; vertical sidewalls 524 extending rearward, and terminating a moderate distance behind the rear edge of upper plate member 523; vertical sidewalls 524 having lower terminal surfaces proportioned to match the upper surfaces of stiffening ribs 559 of brake cover 024/124 (Reference FIG. 50); the interstitial space between the two vertical sidewalls 524 being proportioned to receive the two pivot blocks 353 of modified WC lid

101/201/301 (Reference FIG. 3); upper plate member 523 having length approximately two-thirds that of vertical sidewalls 524.

Figure 43:
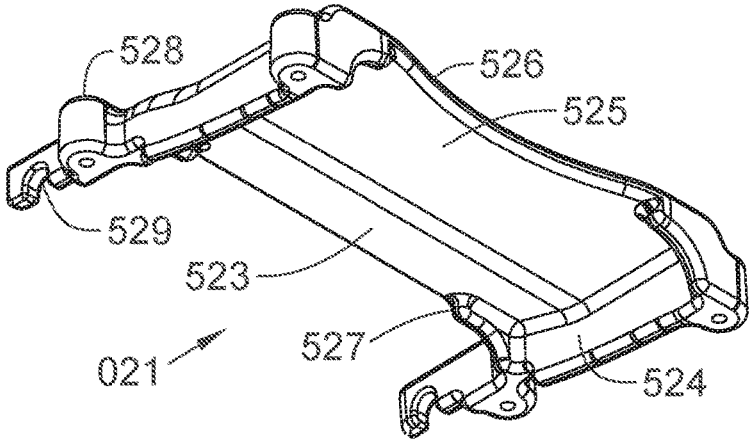
FIG. 43 is an additional perspective view of brake sub-frame 021.

Referring to FIG. 43, the bottom forward surface of upper plate member 523, hereafter identified as lever contact surface 525, being proportioned to mate with sub-frame contact surface 536 of brake lever 022/122 (Reference FIG. 46), within the respective stored master assembly; the forward edge of upper plate member 523 having a vertical radial cut 526; within the respective master assembly, vertical radial cut 526 being a rearward offset from radial wall 546 of brake cover 024/124 (Reference FIG. 50); four gussets 527, providing structural rigidity; two gussets 527 spanning between each of the vertical sidewalls 524 and upper plate member 523; one gusset 527 occurring at each forward lateral edge of upper plate member 523 and one gusset 527 occurring at each rear lateral edge of upper plate member 523; four screw ports 528 formed of vertical cylindrical protrusions appended to the exterior sides of vertical sidewalls 524, and spaced to align with screw wells 557 of brake cover 024/124; screw ports 528 further including concentrically aligned internally threaded screw holes, proportioned to receive brake cover fasteners 025; two pivot saddles 529, each having a simple keyhole profile comprised of a rectangle with a full radius on the top end, laterally penetrating vertical sidewalls 524 along their bottom edge; each pivot saddle 529 further intersecting the bottom of the respective vertical sidewall 524 just forward of its rear terminus; pivot saddles 529 further being proportioned to receive pivot rod 017; referring to FIG. 42, a spring positioning cross 530 having a top-view profile similar to the letter "X", protruding slightly upward from the top surface of upper plate member 523, proportioned to receive upper brake spring 020; this part further being proportioned to mate with brake cover 024/124.

Brake Sub-Frame 121—

Figure 44:
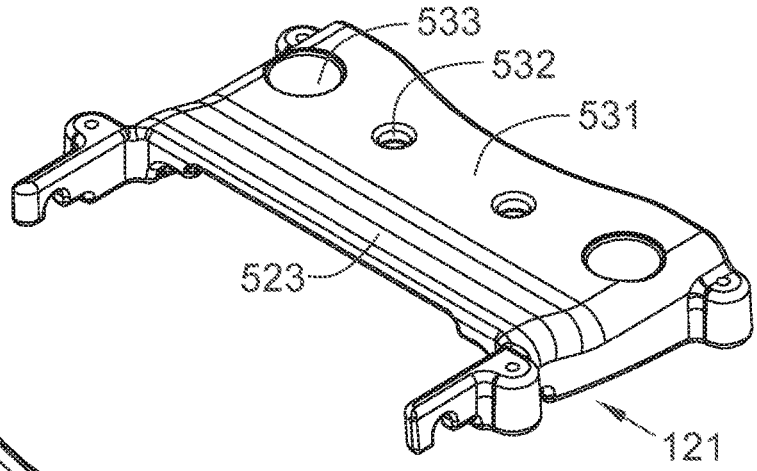
FIG. 44 is a perspective view of brake sub-frame 121.

As illustrated in FIG. 44, brake sub-frame 121 is substantially identical to brake sub-frame 021, notwithstanding the following differences: Brake sub-frame 121 does not include spring positioning cross 530 of brake sub-frame 021.

Figure 45:
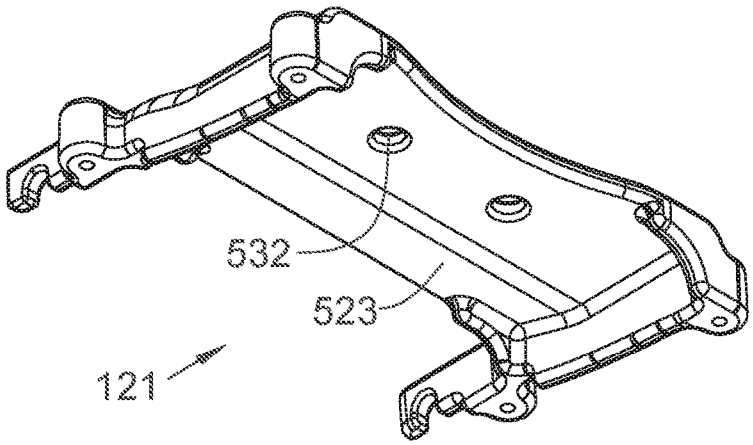
FIG. 45 is an additional perspective view of brake sub-frame 121.

In comparison to brake sub-frame 021, brake sub-frame 121 also includes the following additional features: Referring to FIG. 44, the top forward surface of upper plate member 523, hereafter being identified as actuator contact surface 531; two vertical circular through-ports, hereafter identified as vent apertures 532 (FIGS. 44 and 45), piercing upper plate member 523 a moderated distance forward of its mid-length; vent apertures 532 being symmetrically positioned about the center plane of the part; vent apertures 532 further being dimensionally positioned and proportioned to align with venting ports 795 of auto-flush diaphragm 078 (Reference FIG. 94), within the respective master assembly; referring to FIG. 44, two circular trim cuts, constituting positioning divots 533, shallowly intersecting the top surface of upper plate member 523; positioning divots 533 being symmetrically positioned about the center plane of the part; positioning divots 533 further being located laterally to either side of vent apertures 532 and near the lateral outside edges of the part; positioning divots 533 further being positioned and proportioned to receive positioning protrusions 793 of auto-flush diaphragm 078 (Reference FIG. 95), to ensure operational alignment of auto-flush diaphragm 078, within the respective master assembly.

Brake Lever 022/122 Common Geometry—

Figure 46:
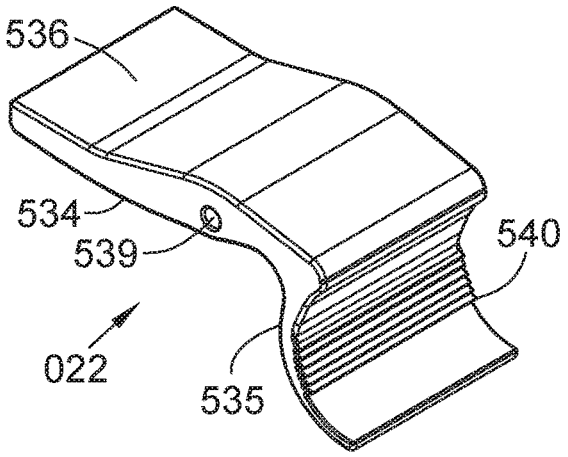
FIG. 46 is a perspective view of brake lever 022.
Figure 47:
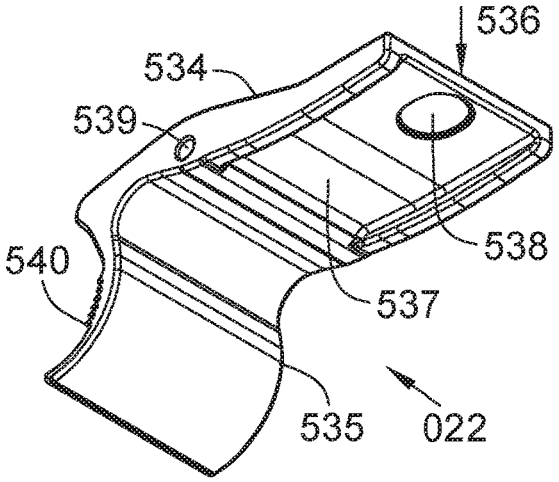
FIG. 47 is an additional perspective view of brake lever 022.

These parts, preferably formed of corrosion resistant metal or fiber reinforced plastic, share the following features: Referring to FIG. 46, a thin, horizontal lever arm 534, having minor upper and lower curvature when viewed from the side, with width about one-half its length; a radially swept member, being swept about a horizontal axis, hereafter identified as radial arm 535, adjoined to the rear of lever arm 534, having the same width as lever arm 534, and extending downward with a semicircular side-view profile; beginning at the rear of lever arm 534, radial arm 535 sweeping first downward and slightly forward, then vertically downward, then downward and rearward, terminating at the lower center of its circular profile; the top of lever arm 534 further having a forward planar surface, hereafter identified as sub-frame contact surface 536; sub-frame contact surface 536 being proportioned to mate with lever contact surface 525 of brake sub-frame 021/121 (Reference FIG. 43), within the respective stored master assembly; referring to FIG. 47, lever arm 534 further being shallowly penetrated by a forward lower cavity 537 with width marginally less than the width of lever arm 534, centrally disposed about the longitudinal axis of the part; centrally disposed side-to-side near the forward edge of lower cavity 537, a shallow circular spring positioning gland 538; spring positioning gland 538 further being proportioned to receive lower brake spring 023; oriented transversely to the longitudinal axis of lever arm 534, and intersecting lever arm 534 at its mid-height, a small diameter through bore piercing lateral through the part, constituting pivot bore 539; pivot bore 539 being proportioned to receive pivot rod 017; a minor disparity between the upper curvature and lower curvature of lever arm 534 affecting a slightly thickened region about pivot bore 539.

Brake Lever 022—

In addition to the common geometry of brake lever 022/122, this part further includes the following features: Referring to FIG. 46, a radial pattern of linear brake interlock ribs 540 occurring on the internal surface of radial arm 535; said radial pattern and radial arm 535 substantially sharing a common axis; interlock ribs 540 further occurring in the central third of the radial path of radial arm 535, and extending the full width of radial arm 535; interlock ribs 540 further having a gear-tooth shaped profile, proportioned to mesh tightly with interlock ribs 651 of brake shaft 037 (Reference FIG. 65.).

Brake Lever 122—

Figure 48:
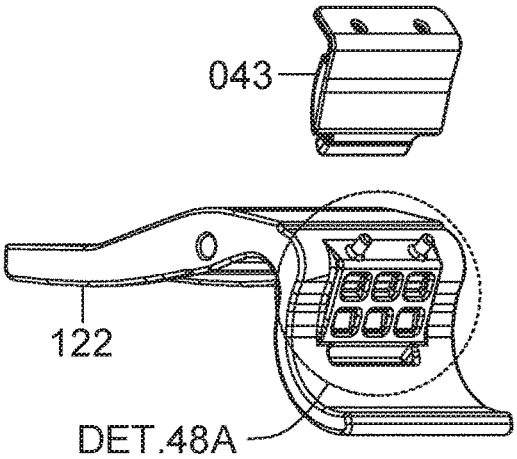
FIG. 48 is a perspective view of brake lever 122 and brake pad 043.

In addition to the common geometry of brake lever 022/122, this part further includes the following features: Referring first to FIG. 48, and then to FIG. 48A, a rectangular pad, hereafter identified as interleave pad 541 extending rearward from the upper half of the interior surface of radial arm 535, and culminating at a nearly vertical planar surface a short distance behind the interior surface of radial arm 535; interleave pad 541 having width about two-thirds that of radial arm 535, and having a planar upper terminus, hereafter identified as upper terminal plane 543; interleave pad 541 further being centrally positioned about the longitudinal center plane of the part; interleave pad 541 further containing a series of six square-profile shallow interleave wells 542, proportioned to receive the complimentary interleave blocks 682 of brake pad 043 (Reference FIG. 49A); upper terminal plane 543 of interleave pad 541 intersecting the inner surface of radial arm 535 slightly below the rearmost upper surface of lever arm 534; two small diameter circular pad retaining posts 544 extending upward a short distance above upper terminal plane 543; a rectangular through-hole piercing radial arm 535, constituting insert gland 545; insert gland 545 being positioned near the mid-arc of radial arm 535, immediately below interleave pad 541; insert gland 545 further having width slightly narrower than interleave pad 541, and height about one-fourth of its width; referring to FIG. 49, two small diameter circular cuts vertically piercing lever arm 534, constituting vent apertures 545A; vent apertures 545A being located near the forward edge, and near the lateral sides, of lever arm 534; vent apertures 545A further being dimensionally positioned and proportioned to align with vent apertures 532 of brake sub-frame 121 (Reference FIG. 45), within the respective stored master assembly.

Lower Brake Spring 023—

As illustrated in FIGS. 38 and 39, this conical compression spring is preferably a standard off-the-shelf stainless steel component, having a spring constant approximately twice that of upper brake spring 020.

Brake Cover 024—

This part, preferably formed of molded plastic, bears the following features: Referring to FIG. 50, a forward radial wall 546, substantially vertical, proportioned to compliment the profile of the radial section of perimeter wall 393 of upper cartridge segment 102/202 (Reference FIG. 11A); two vertical sidewalls 547; within the respective stored master assembly, vertical sidewalls 547 being parallel to, and substantially aligned with, the forward parallel portions of perimeter wall 393 of upper cartridge segment 102/202 (Reference FIGS. 13, 13A); a swept wall segment, hereafter identified as rear wall 548, spanning between the two vertical sidewalls 547; the bottom edge of rear wall 548 blending forward into floor member 549; the swept profile of rear wall 548 further having complimentary curvature to that of exterior perimeter wall 569 of left facade 027/127; a lower lofted and curved floor plate, hereafter identified as floor member 549, having complimentary curvature to floor member 572 of left facade 027/127; radial wall 546, vertical sidewalls 547, and rear wall 548 sharing a common upper terminal surface 550, substantially proportioned to mate with the lower surface of plate member 325 of modified WC lid 101/201/301 (Reference FIG. 3), within the respective stored master assembly; radial wall 546, further being broken at two locations to reveal two short planer offset walls 551 occurring at 45° and −45° relative to the vertical axis of radial wall 546, as seen from above; two seal apertures 552 piercing horizontally through offset walls 551; seal apertures 552 being positioned to concentrically align with upper urine spout 404 and upper false spout 405 of upper cartridge segment 102/202 (Reference FIG. 11A), within the respective stored master assembly; seal apertures 552 further being proportioned to receive cartridge spout seals 026; referring to FIG. 51, four vertical blend walls 553 adjoining the lateral ends of offset walls 551 to radial wall 546.

Figure 51:
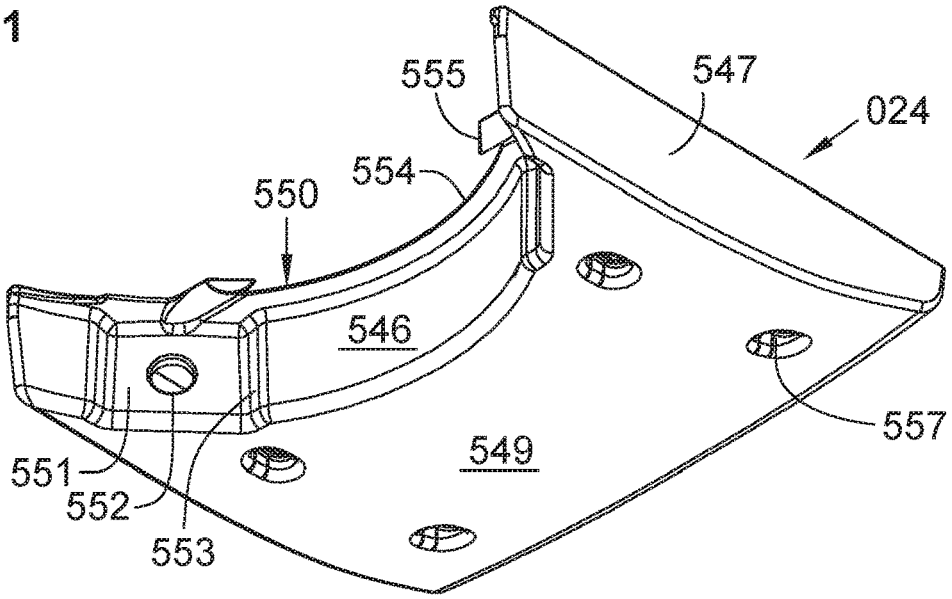
FIG. 51 is an additional perspective view of brake cover 024.

Referring to FIG. 51, a short horizontal radial lip, hereafter identified as lip protrusion 554 commencing at the top edge of radial wall 546 and extending a short distance inward from radial wall 546; two short opposing guide fingers 555 attached to lip protrusion 554; guide fingers 555 substantially being the lower half of cylindrical protrusions, proportioned to fit in guide saddles 416 of upper cartridge segment 102/202 (Reference FIGS. 10, 11); referring to FIG. 50, a shallow spring positioning gland 556 shallowly intersecting the top surface of floor member 549, positioned and proportioned to receive lower brake spring 023; referring to FIG. 51 four screw wells 557 inset upwardly into the bottom surface of floor member 549; referring to FIG. 50, four circular screw holes 558, piercing vertically through screw wells 557; screw wells 557 and screw holes 558 further being spaced to align with screw ports 528 of brake sub-frame 021/121; screw wells 557 and screw holes 558 further being proportioned to receive brake cover fasteners 025.

Referring to FIG. 50, two front-to-rear horizontal stiffening ribs 559 adjoined to the interior sides of screw wells 557, and protruding a short distance upward from the upper surface of floor member 549; the upper surface of stiffening ribs 559 being proportioned to mate with the bottom edges of vertical sidewalls 524 of brake sub-frame 021/121 (Reference FIG. 43); two vertical ribs 560 protruding upward from the forward edge of stiffening ribs 559, and intersecting vertical blend walls 553; vertical ribs 560 having height approximately five-eighths that of radial wall 546; a rectangular profiled trim cut, intersecting the top surface of rear wall 548, and effecting lever opening 561 in the back of the part; lever opening 561 being proportioned to allow operational movement of brake lever 022/122 (Reference FIG. 38), within the respective master assembly.

Brake Cover 124—

Figure 52:
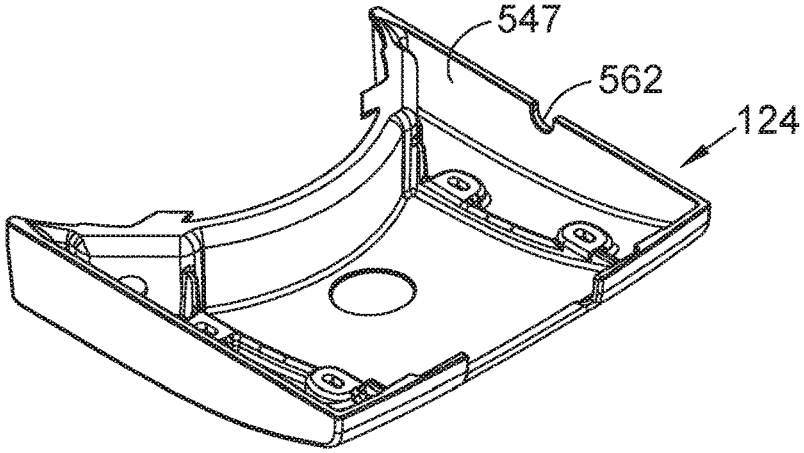
FIG. 52 is a perspective view of brake cover 124.

This part is substantially identical to brake cover 024, but having one additional feature, as illustrated in FIG. 52: A singular transverse tubing trim 562 shallowly intersecting the top of the leftmost vertical sidewall 547, near its midpoint; tubing trim 562 further being proportioned and positioned to affect an operational passage for pneumatic tube 079.

Brake Cover Fasteners 025—

These parts are preferably standard off-the-shelf stainless steel screws, as illustrated in FIGS. 38 and 39.

Cartridge Spout Seal 026—

Figure 40:
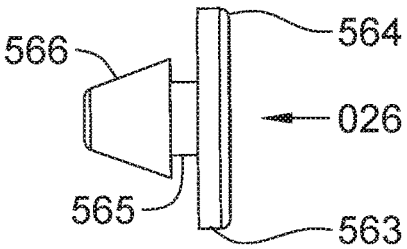
FIG. 40 is a side elevation view of cartridge spout seal 026.
Figure 41:
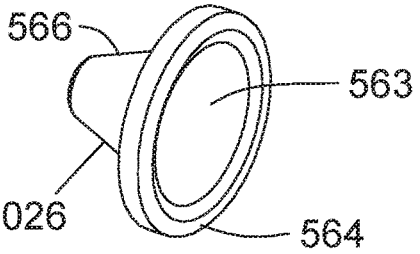
FIG. 41 is a perspective view of cartridge spout seal 026.

This part, preferably formed from a molded elastomer, has the following features: Referring to FIG. 40 and FIG. 41, a flexible, thin circular disk 563; a toroidal protrusion 564, concentrically aligned with circular disk 563, projecting forward from circular disk 563 by a distance approximately one-half the thickness of circular disk 563; toroidal protrusion 564 further having inner diameter substantial equivalent to the outer diameter of left funnel seal protrusion 400 of upper cartridge segment 102/202; circular disk 563 and toroidal protrusion 564 both having outer diameters approximately one and one-third the inner diameter of toroidal protrusion 564; a short cylindrical protrusion comprising insert stem 565 (FIG. 40), concentrically aligned with circular disk 563; insert stem 565 extending rearward from the back surface of circular disk 563, by a distance substantially equal to the thickness of offset walls 551 of brake cover 024/124; insert stem 565 further having diameter proportioned to fit seal apertures 552 of brake cover 024/124 (Reference FIG. 51); a conical protrusion concentrically appended to the rear of insert stem 565, comprising retaining bulb 566; the large end of retaining bulb 566 further having a maximum diameter somewhat larger than seal apertures 552 of brake cover 024; the rear of retaining bulb 566 terminating in a planar surface, effectively trimming the point of its conical protrusion; the small end of retaining bulb 566 further having diameter slightly smaller than seal apertures 552 of brake cover 024/124, to aid in installation; the material properties of this component further allowing it to be slightly compressed by left funnel seal protrusion 400 of upper cartridge segment 102/202 and left funnel seal protrusion 479 of rear cartridge base 008/108 (Reference FIG. 147B), to affect a substantial seal within the respective stored master assembly.

Left Facade 027—

Figure 53:
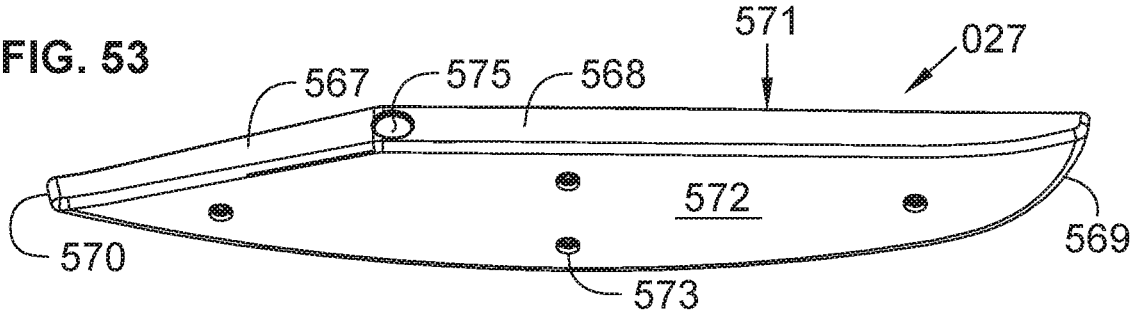
FIG. 53 is a perspective view of left façade 027.

This part, preferably formed of molded plastic, bears the following features: Referring to FIG. 53, a vertical forward interior sidewall 567 blending into a vertical rear interior sidewall 568; within the respective master assembly, forward interior sidewall 567 being offset slightly outward from the converging angled sides 330 of receptacle opening 328 of modified WC lid 001/101/201/301 (Reference FIG. 1); within the respective master assembly, rear interior sidewall 568 being slightly offset outward from the rear parallel sides 331 of receptacle opening 328 of modified WC lid 001/101/201/301; rear interior sidewall 568 converging at its rearmost edge at a right angle with a swept exterior wall member, hereafter identified as perimeter wall 569; exterior perimeter wall 569 sweeping in a broad arc first directly outward, then forward and outward, then forward, then forward and inward; exterior perimeter wall 569 further converging at its forward terminus, hereafter identified as foremost edge 570, with forward interior sidewall 567, in an acute angle; the rear portion of exterior perimeter wall 569 further having complimentary curvature and complimentary sweep path to those of rear wall 548 of brake cover 024/124; the top surfaces of forward interior sidewall 567, rear interior sidewall 568, and exterior perimeter wall 569 sharing a common upper terminal surface 571; within the respective stored master assembly, upper terminal surface 571 being coincident with upper terminal surface 550 of brake cover 024/124 (Reference FIG. 50), and having complimentary curvature to the lower surface of plate member 325 of modified WC lid 101/201/301; the bottom of exterior perimeter wall 569 blending into a lower floor member 572; floor member 572 further having a lofted aesthetic curvature, sweeping slightly upward near the front, rear, and exterior sides of the part; within the respective stored master assembly, the lower surface of floor member 572 substantially being a lateral continuation of the lower surfaces of [(i) floor member 549 of brake cover 024/124 (Reference FIG. 51), (ii) floor member 473 of rear cartridge base 008/108 (Reference FIG. 23), and (iii) floor member 448 of forward cartridge base 006/106 (Reference FIG. 23)]; four screw wells 573 inset upward into the bottom surface of floor member 572.

Figure 54:
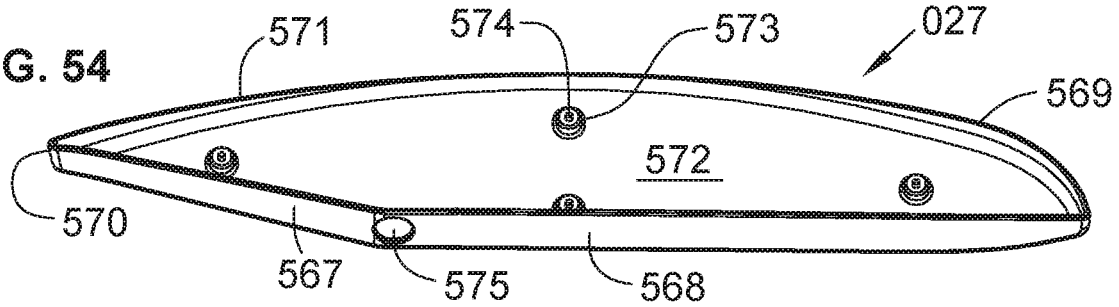
FIG. 54 is a perspective view of left facade 027 and right façade 028.
Figure 54:
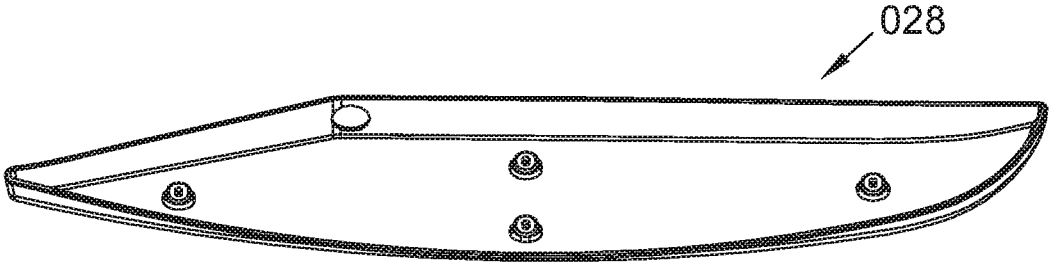

Referring to FIG. 54, four circular through-holes, hereafter identified as screw holes 574, piercing vertically through screw wells 573; screw wells 573 and screw holes 574 further being spaced to align with left facade bosses 351 of modified WC lid 101/201/301; screw wells 573 and screw holes 574 further being proportioned to receive facade fasteners 029; a circular cut piercing rear interior sidewall 568 at its foremost edge, comprising circular pivot port 575; circular pivot port 575 having diameter slightly larger than circular disk 505 of pivot plate 014, allowing pivot plate 014 to translate laterally in the respective master assembly without operational interference with left facade 027.

Left Facade 127—

Figure 55:
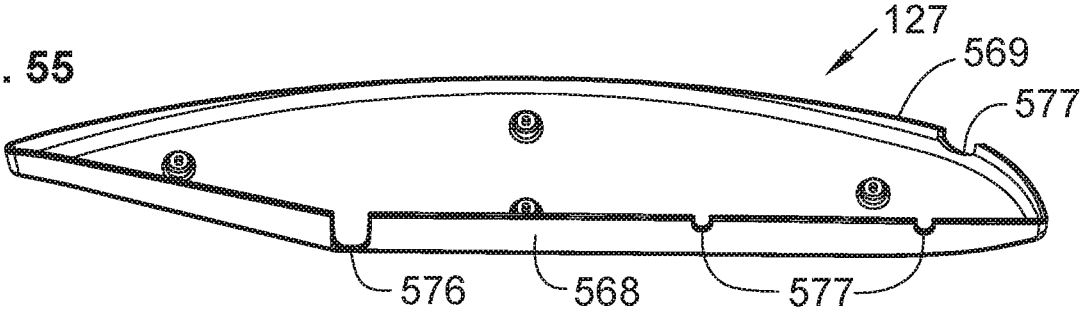
FIG. 55 is a perspective view of left facade 127 and right façade 128.
Figure 55:
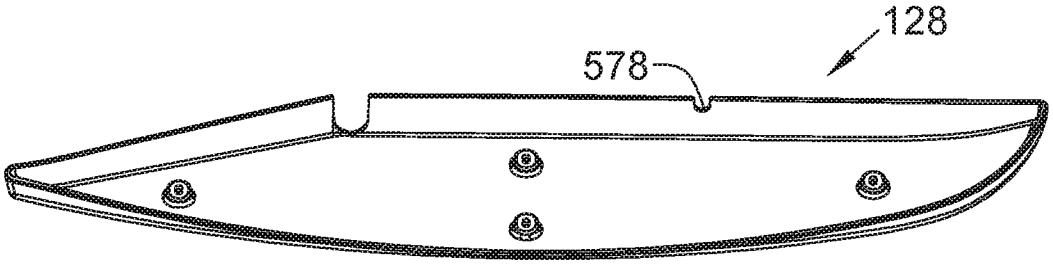

This part, preferably formed of molded plastic, is substantially identical to left facade 027, notwithstanding the following differences, as illustrated in FIG. 55: Compared to the circular pivot port 575 of left facade 027 (FIG. 54), for left facade 127 the comparable feature intersects the top of rear interior sidewall 568 in a full width cut, constituting open-top pivot port 576; left facade 127 further includes three small tubing trims 577; two tubing trims 577 shallowly intersecting the top surface of rear interior sidewall 568, and one tubing trim 577 shallowly intersecting the top surface of exterior perimeter wall 569, with similarly shaped profiles to open-top pivot port 576; tubing trims 577 further being proportioned and positioned to effect operational passages for right supply tube 067, valve supply tube 068, and pneumatic tube 079, within the respective master assembly.

Right Facade 028—

This part, preferably formed of molded plastic, is a mirror image of left facade 027, as illustrated in FIG. 54. Within the respective master assembly, the components are symmetrically mirrored about the vertical center plane of the respective master assembly.

Right Facade 128—

This part, preferably formed of molded plastic, is substantially a mirror image of left facade 127, notwithstanding one difference, as illustrated in FIG. 55: The three tubing trims 577 of left facade 127 are replaced by a single tubing trim 578 for right façade 128; tubing trim 578 being proportioned and positioned to symmetrically mirror the foremost tubing trim 577 of left façade 127; tubing trim 578 further being proportioned and positioned to effect an operational passage for right supply tube 067, within the respective master assembly.

Façade Fasteners 029—

Referring to FIG. 108, these parts are preferably standard off-the-shelf stainless steel screws.

Water Closet (WC)—

Figure 56:
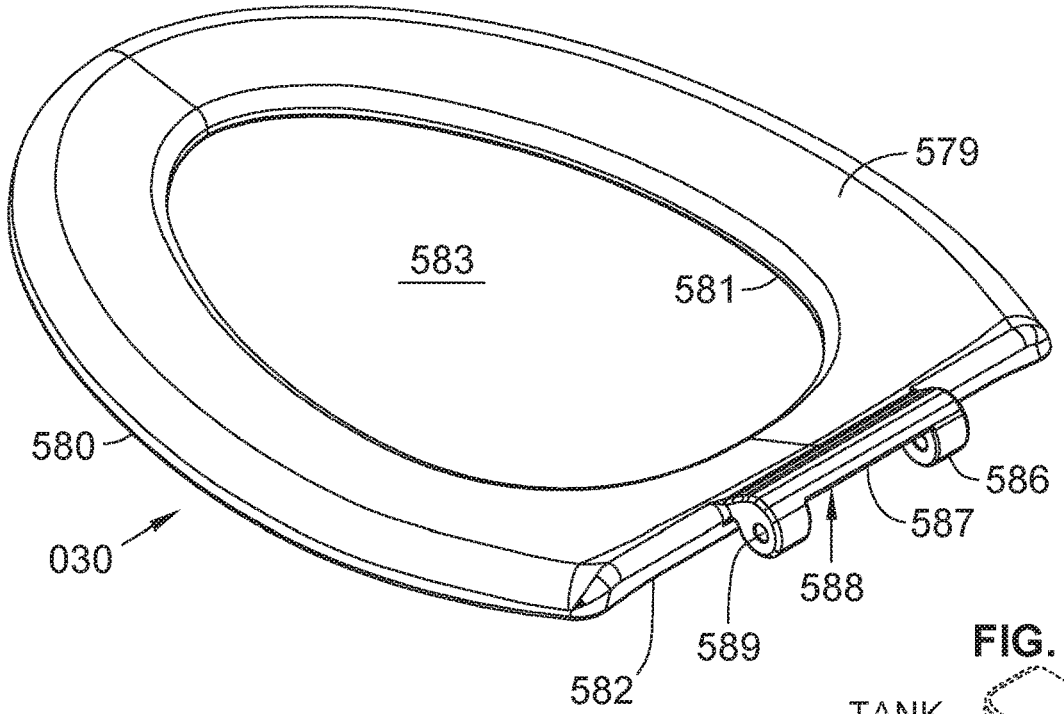
FIG. 56 is a perspective view of modified WC seat 030.
Figure 56A:
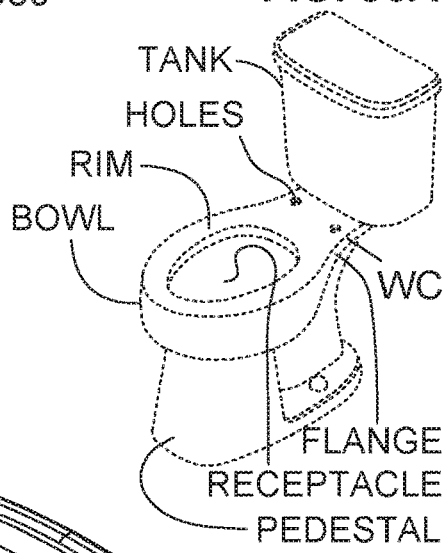
FIG. 56A is a perspective view of a traditional western style residential water closet (WC).

Though outside of the claims of the current invention, a residential western style flush toilet, or water closet (WC), is illustrated in FIG. 56A, to identify its following features for reference: The rim (RIM) of the water closet (WC) refers to the top surface of the bowl (BOWL), situated above the pedestal (PEDESTAL); The waste receptacle (RECEPTACLE), intended to receive human excrement, refers to the interior opening of the bowl (BOWL); The seat assembly mounting holes (HOLES) refer to the mounting holes in the mounting flange (FLANGE), positioned and proportioned to receive assembly mounting bolts 039; The water tank (TANK), common to most residential water closets, refers to the water reservoir, typically located above the rim (RIM), and behind the bowl (BOWL), near the rear of the water closet (WC).

Modified WC Seat 030/130 Common Geometry—

These parts, preferably formed of molded plastic, share the following common features: Referring to FIG. 56, an inwardly sloped arching profile of moderate width, being lofted about a closed horizontal elliptical loop forming seat loop 579; seat loop 579 having overall width approximately two-thirds of its overall length; the overall length and overall width of seat loop 579 further being proportioned to complement the rim (RIM, FIG. 56A) of the water closet (WC, FIG. 56A) this component is intended to cover; seat loop 579 further curling downward around its exterior elliptical boundary into a shallow exterior perimeter lip 580; seat loop 579 further curling downward around its interior elliptical boundary into a shallow interior perimeter lip 581; seat loop 579 further being trimmed at its rear terminus in a substantially linear edge, interrupting the exterior elliptical top-view profile; seat loop 579 further curling downward at its rear edge, forming rear lip 582; rear lip 582 further tangentially blending into exterior perimeter lip 580 at its lateral ends; the interior elliptical area enclosed by seat loop 579 effecting a receptacle opening 583; receptacle opening 583 further having length and width slightly less than the corresponding dimensions of the waste receptacle (RECEPTACLE, FIG. 56A) of the water closet (WC, FIG. 56A) this component is intended for use with.

Figure 57:
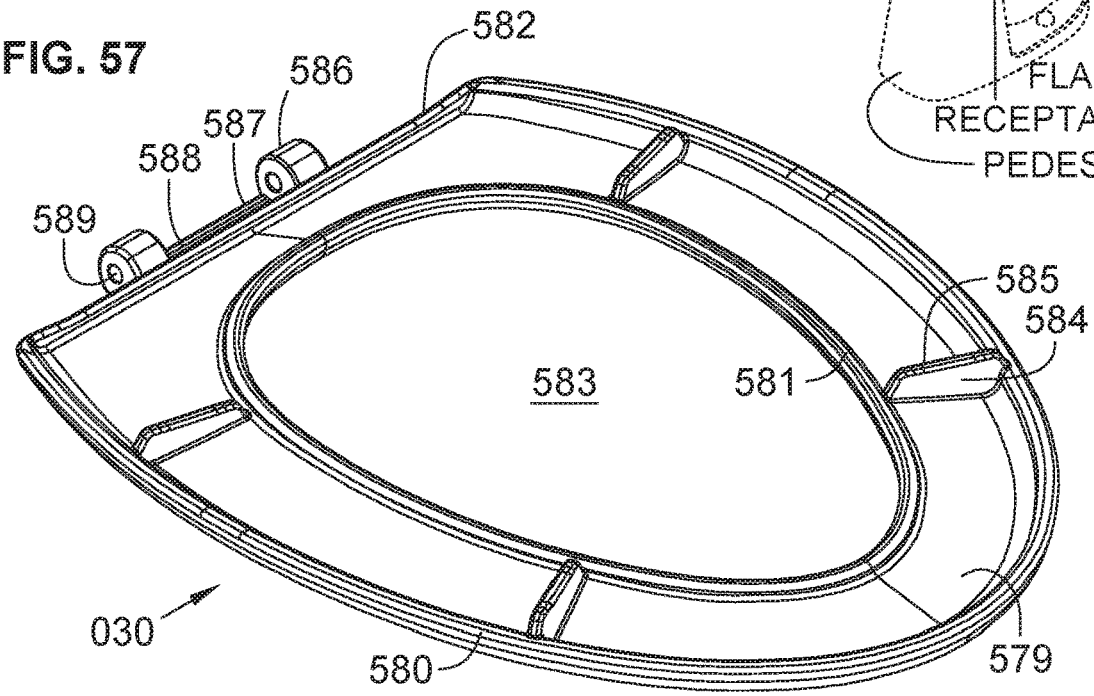
FIG. 57 is an additional perspective view of modified WC seat 030.

Referring to FIG. 57, four thin support chairs 584 comprised of narrow rectangular protrusions extending vertically downward from the bottom surface of seat loop 579; support chairs 584 being oriented substantially perpendicular to the interior perimeter lip 581; two support chairs 584 occurring near the front of seat loop 579; two support chairs 584 occurring near the rear of seat loop 579; support chairs 584 further being symmetrically spaced about the longitudinal center plane of the part; support chairs 584 further terminating in a common plane, hereafter identified as WC rim plane 585, occurring a short distance below seat loop 579; within the respective stored master assembly, WC rim plane 585 being coincident with the bottom surface of hinge block 040/140 (Reference FIG. 71), such that support chairs 584 will rest on the rim (RIM, FIG. 56A) of the employed water closet (WC, FIG. 56A), to support modified WC seat 030/130, for seated use.

Modified WC Seat 030—

In addition to the common geometry of modified WC seat 030/130, this part further includes the following features: Referring to FIG. 56, two short cylindrical hinge protrusions 586 sharing a common horizontal axis, being appended to the rear of seat loop 579 by a semi-cylindrical shaped hinge bridge 587, having external diameter equal to that of hinge protrusions 586; hinge bridge 587, substantially being the upper one-third segment of a horizontal cylinder, being terminated at its lower edge in an arched profile effecting a lower concave surface 588; hinge protrusions 586 further being equally spaced about the longitudinal center plane of the part; the common axis of hinge protrusions 586 further being located slightly upward and slightly rearward with respect to the upper edge of rear lip 582; hinge bridge 587 further sweeping upward and rearward from the convergence of rear lip 582 with the upper surface of seat loop 579; hinge bridge 587 further spanning the lateral space between hinge protrusions 586; the outside-to-outside dimension of hinge protrusions 586 being proportioned to fit the interstitial space between two hinge pivot blocks 040/140 (Reference FIG. 104), within the respective master assembly; two small diameter through-holes horizontally piercing hinge protrusions 586, creating hinge bearing ports 589; hinge bearing ports 589 substantially being concentrically aligned with the cylindrical profile of hinge protrusions 586; each hinge bearing port 589 being proportioned to receive hinge pin 044. FIG. 57 offers an additional perspective of modified WC seat 030, and the features addressed here.

Modified WC Seat 130—

Figure 58:
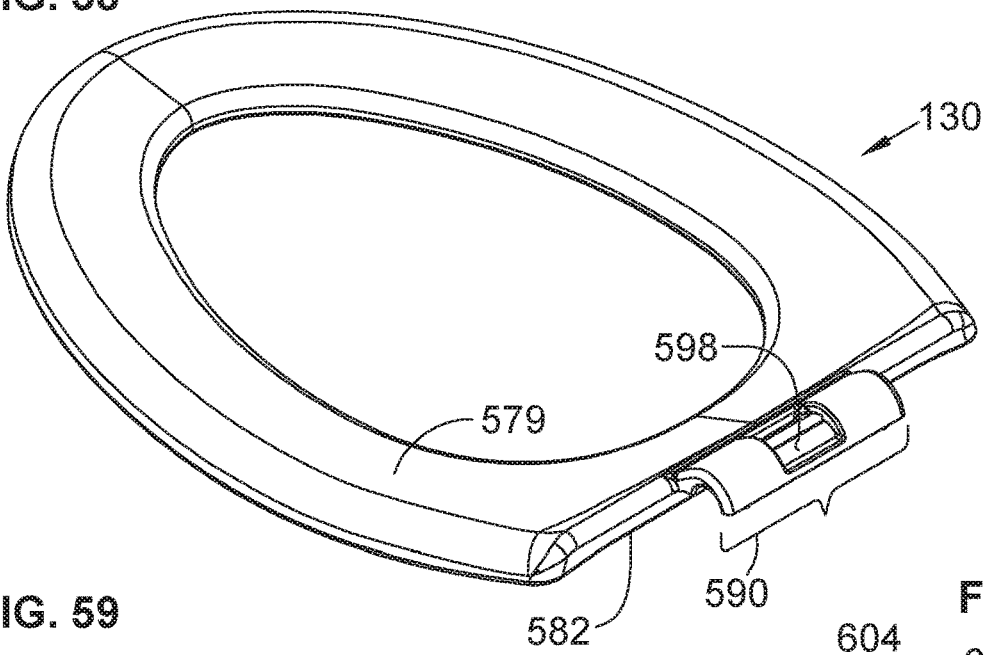
FIG. 58 is a perspective view of modified WC seat 130.

Referring to FIG. 58, in addition to the common geometry of modified WC seat 030/130, this component also includes a brake shaft housing, sweeping first upward and rearward from the convergence of rear lip 582 with the upper surface of seat loop 579, then sweeping directly rearward, then sweeping rearward and downward, substantially forming the upper half of a horizontal cylinder, at the rear of part, hereafter identified as upper shaft housing 590; upper shaft housing 590 further having its central axis located slightly upward and slightly rearward with respect to the rear terminus of seat loop 579; shaft housing 590 further having length substantially equivalent to the outside to outside dimension of hinge protrusions 586 of modified WC seat 030 (Reference FIG. 56.).

Figure 59:
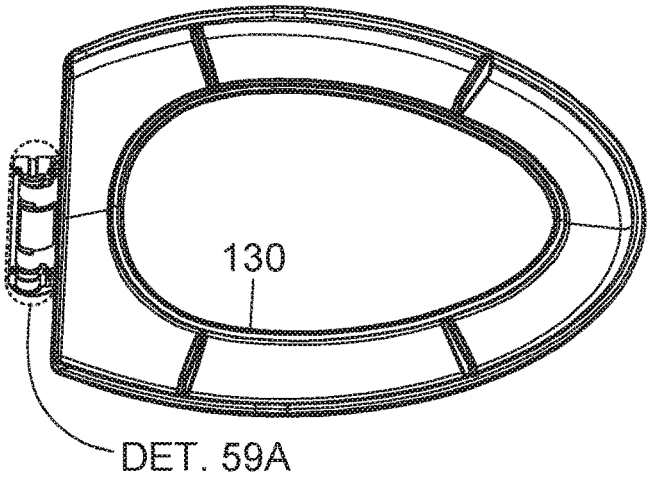
FIG. 59 is an additional perspective view of modified WC seat 130.

Upper shaft housing 590 of modified WC seat 130 further including the following features: Referring to FIG. 59, and then FIG. 59A, a central cavity 591 within upper shaft housing 590, also having half-cylinder shape, concentrically aligned with upper shaft housing 590; the central cavity 591 effectively coring the central interior of upper shaft housing 590, leaving a thin radial shell 592, a thick right end wall 593, and a thick left end wall 594; right end wall 593 being further trimmed by a cylindrical cut, intersecting its bottom surface for the full width of the wall; the cylindrical cut, being concentrically aligned with upper shaft housing 590, further having diameter substantially equivalent to solid shaft 647 of brake shaft 037/137, and constituting right bearing surface 595; the interior one-fourth of left end wall 594 also being trimmed by a cylindrical cut, concentrically aligned with right bearing surface 595, and having diameter substantially equivalent to solid shaft 647 of brake shaft 037/137, creating left bearing surface 596; a half-toroid alignment feature 597 being concentrically aligned with, and protruding downward from, right bearing surface 595; alignment feature 597 further being proportioned to fit alignment groove 648 of brake shaft 037/137 (Reference FIG. 65); a vertical rectangular-shaped hole piercing the top of upper shaft housing 590, proportioned to receive brake lever 022/122, and constituting brake lever opening 598.

Figure 59A:
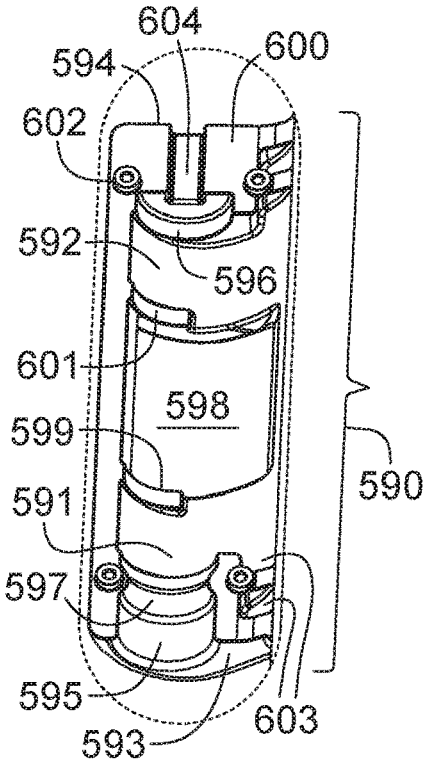
FIG. 59A is a detail view of modified WC seat 130, as indicated by the view window labeled DET. 59A in FIG. 59.
Figure 64:
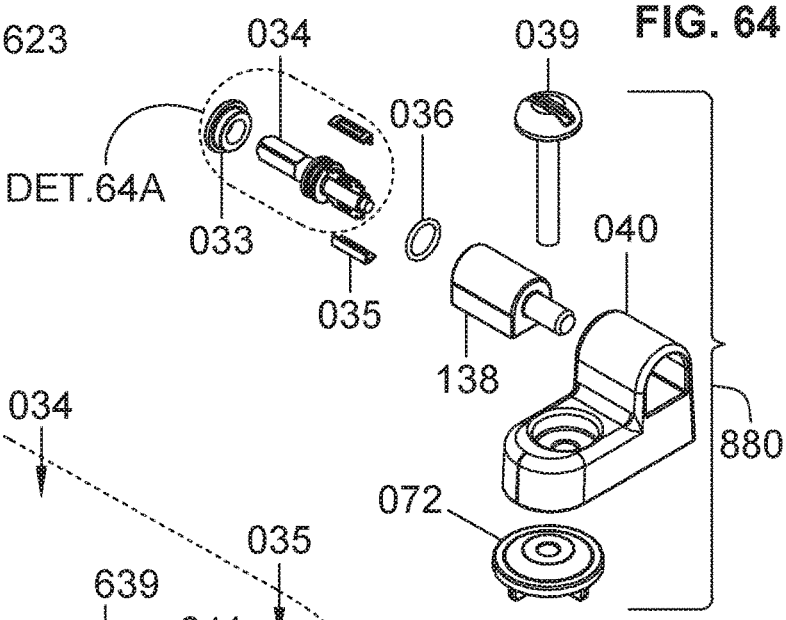
FIG. 64 is a perspective view of the components that comprise dry left hinge assembly 880, relatively positioned in an exploded state.
Figure 64A:
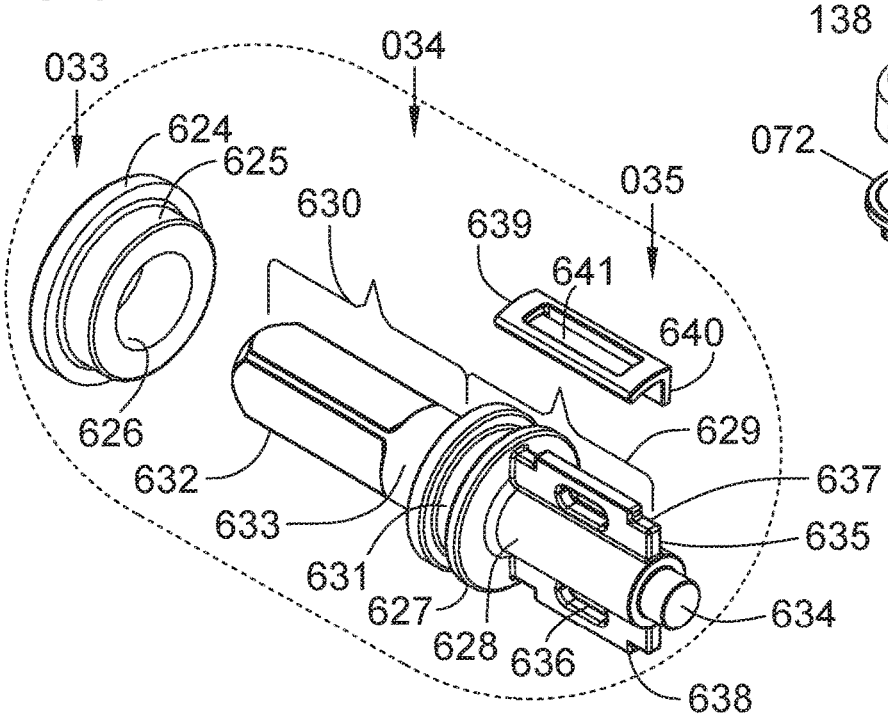
FIG. 64A is a detail view of hinge cylinder cap 033, hinge shaft 034 and wiper seals 035, as indicated by the view window labeled DET. 64A in FIG. 64.

Still referring to FIG. 59A, two thin vertical shaft support walls 599 positioned immediately to either side of brake lever opening 598; shaft support walls 599 extending vertically downward from the interior surface of thin radial shell 592, and terminating at the bottom plane of upper shaft housing 590; the bottom plane of upper shaft housing 590 hereafter being identified as housing mating plane 600; shaft support walls 599 further extending forward from the rear interior edge of thin radial shell 592, approximately to the mid-length of upper shaft housing 590; each shaft support wall 599 being trimmed by a cylindrical cut with diameter substantially equivalent to solid shaft 647 of brake shaft 037/137, forming supplementary bearing surfaces 601; supplementary bearing surfaces 601 further being concentrically aligned with right bearing surface 595; four vertical screw bosses 602 positioned symmetrical within upper shaft housing 590, and occurring near the lateral ends of upper shaft housing 590; two screw bosses 602 occurring near the front of upper shaft housing 590; two screw bosses 602 occurring near the extreme rear edge of upper shaft housing 590; screw bosses 602 including cylindrical screw holes with internal threads proportioned to receive shaft housing fasteners 032; four coring cuts 603 substantially thinning unnecessary material in localized areas of right end wall 593 and left end wall 594, to aid in fabrication; left end wall 594 further being penetrated by a linear cut having a small square profile, forming keyway 604; the central axis of keyway 604 being concentrically aligned with the central axis of upper shaft housing 590; keyway 604 penetrating the bottom surface of left end wall 594 across its full width in a rectangular channel, proportioned to receive the upper half of key shank 632 of hinge shaft 034 (Reference FIG. 64A.).

Modified WC Seat 230—

Figure 60:
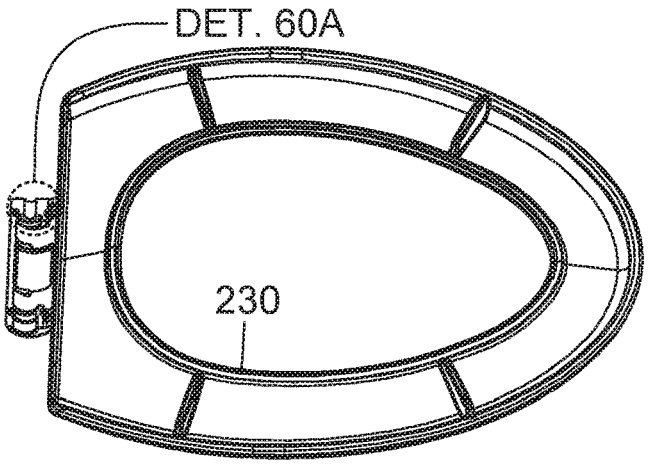
FIG. 60A is a detail view of modified WC seat 230.
Figure 60A:
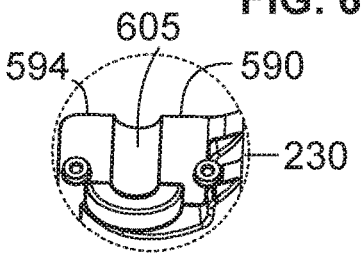

This part is substantially identical to modified WC seat 130, notwithstanding one difference: Referring to FIG. 60, and then FIG. 60A, instead of the keyway 604 of modified WC seat 130 (as illustrated in FIG. 59A) modified WC seat 230 bears a slightly larger cylindrical cut, constituting bearing port 605 (FIG. 60A); the central axis of bearing port 605 being concentrically aligned with the central axis of upper shaft housing 590; bearing port 605 further intersecting the bottom surface of left end wall 594 across its full width, creating a half-cylinder channel proportioned to receive seat insert 769 of wet pivot shaft 069 (Reference FIG. 92.).

Lower Shaft Housing 031—

Figure 61:
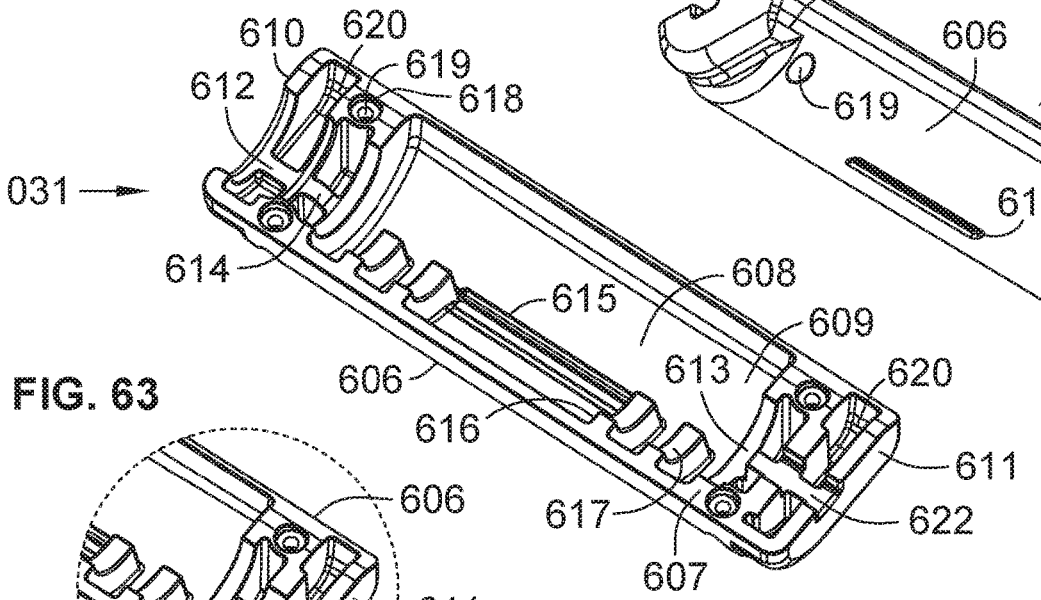
FIG. 61 is a perspective view of lower shaft housing 031.

This part, preferably formed of molded plastic, being complimentary in size and shape to upper shaft housing 590 of modified WC seat 130, is described as follows: Referring to FIG. 61, a half-cylinder protrusion, comprising housing body 606 of lower shaft housing 031, substantially being the lower half of a horizontal cylinder, and having diameter and length equal to the diameter and length of upper shaft housing 590 of modified WC seat 130/230; the upper terminal surface of housing body 606 constituting housing mating plane 607; a central cavity 608, also having half-cylinder shape, concentrically aligned with housing body 606; central cavity 608 effectively coring the interior of the part, leaving a thin radial shell 609, a thick right end wall 610, and a thick left end wall 611; right end wall 610 being further trimmed by a cylindrical cut, intersecting its top surface for the full width of right end wall 610; the cylindrical cut, being concentrically aligned with housing body 606, further having diameter substantially equivalent to solid shaft 647 of brake shaft 037/137, creating right bearing surface 612; the interior one-fourth of left end wall 611 also being trimmed by a cylindrical cut, concentrically aligned with right bearing surface 612, with diameter substantially equivalent to solid shaft 647 of brake shaft 037/137, creating left bearing surface 613; a half-toroid shaped alignment feature 614 being concentrically aligned with, and protruding upward from, right bearing surface 612; alignment feature 614 further being proportioned to fit alignment groove 648 of brake shaft 037/137 (Reference FIG. 65.). Note that the majority of alignment feature 614 is removed by two coring cuts 620); a thin vertical rectangular cut, hereafter identified as collateral drainage slot 615 (FIGS. 61 and 62), piercing through the bottom of the part; collateral drainage slot 615 being symmetrically positioned about the center plane of the part; four thin vertical shaft support walls 616, two positioned immediately to either side of collateral drainage slot 615, and two positioned a short distance exterior to those; shaft support walls 616 extending vertically upward from the interior surface of thin radial shell 609, and terminating at housing mating plane 607; shaft support walls 616 spanning forward from the rear interior edge of thin radial shell 609, approximately to the mid-length of housing body 606; each shaft support wall 616 being trimmed by a cylindrical cut having diameter substantially equivalent to solid shaft 647 of brake shaft 037/137, forming supplementary bearing surfaces 617; supplementary bearing surfaces 617 further being concentrically aligned with right bearing surface 612.

Figure 62:
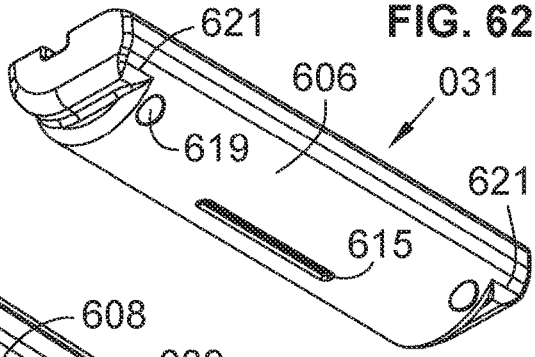
FIG. 62 is an additional perspective view of lower shaft housing 031.

Still referring to FIG. 61, four cylindrical apertures intersecting the top of the part, constituting screw wells 618; screw wells 618 being positioned near the extremities of housing body 606, proportioned and aligned to receive screw bosses 602 of modified WC seat 130/230 (Reference FIG. 59A); four screw ports 619 (FIGS. 61 and 62), vertically piercing the part, each comprised of a through-hole and a bottom-side counter bore; screw ports 619 being concentrically aligned with the central axes of screw wells 618; screw ports 619 further being proportioned to receive shaft housing fasteners 032; referring to FIG. 61, multiple coring cuts 620, vertically penetrating the top surface of the part, and substantially thinning unnecessary material in localized areas to aid in fabrication; coring cuts 620 further penetrating right end wall 610 and left end wall 611 in multiple places; referring to FIG. 62, two contoured pivot block interference cuts 621, one intersecting each lower exterior end of housing body 606; pivot block interference cuts 621 being positioned and proportioned to prevent interference of this part with hinge pivot blocks 040/140 during operation of the respective master assembly; referring to FIG. 61, left end wall 611 further being penetrated by a linear cut having a small square profile, constituting keyway 622; the central axis of keyway 622 being concentrically aligned with the axis of housing body 606; keyway 622 intersecting the top surface of left end wall 611 across its full width, resulting in a rectangular channel; keyway 622 being proportioned to receive the lower half of key shank 632 of hinge shaft 034 (Reference FIG. 64A); lower shaft housing 031 further being proportioned to mate with upper shaft housing 590 of modified WC seat 130/230 (Reference FIG. 59A.).

Lower Shaft Housing 131—

Figure 63:
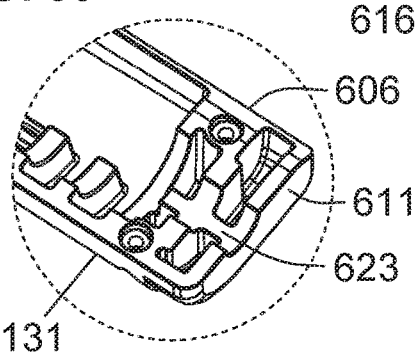
FIG. 63 is a detail perspective view of lower shaft housing 131, centered about the disparate feature that differentiates lower shaft housing 131 from lower shaft housing 031.

This part is substantially identical to lower shaft housing 031, notwithstanding one difference, as illustrated in FIG. 63: Keyway 622 of lower shaft housing 031 (as illustrated in FIG. 61) is replaced with a slightly larger cylindrical cut in lower shaft housing 131, comprising bearing port 623; the central axis of bearing port 623 being concentrically aligned with the axis of housing body 606; bearing port 623 further intersecting the top surface of left end wall 611 across its full width, creating a half-cylinder channel, proportioned to receive seat insert 769 of wet pivot shaft 069 (Reference FIG. 92.).

Shaft Housing Fasteners 032—

Figure 97:
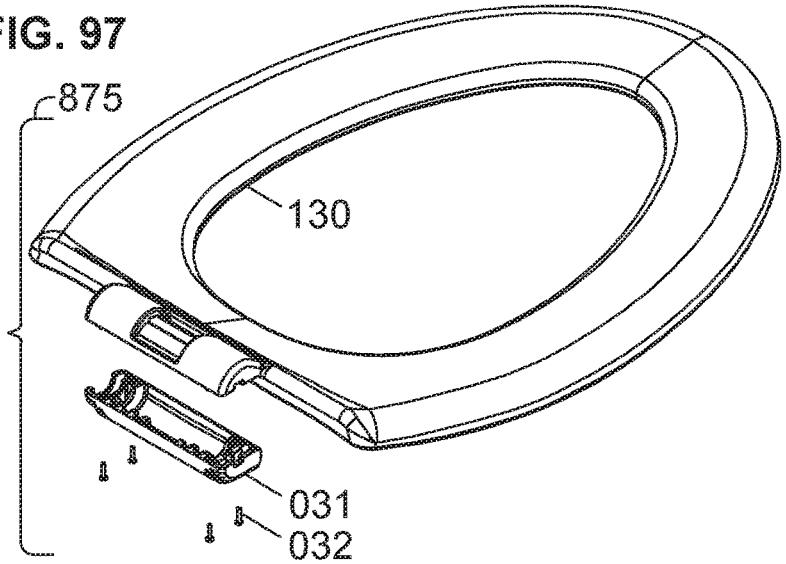
Figure 98:
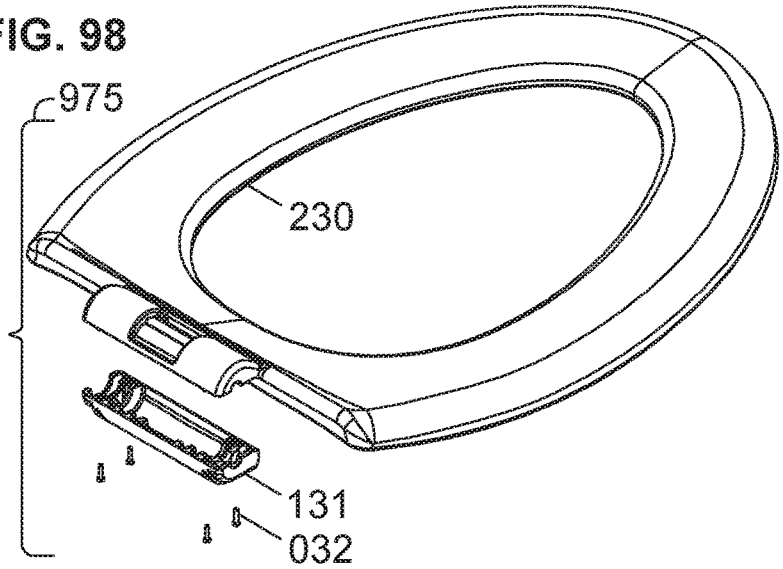

These parts are preferably standard off-the-shelf stainless steel screws, as shown in FIGS. 97 and 98.

Hinge Cylinder Cap 033—

This part, preferably formed of molded plastic, bears the following features: Referring to FIG. 64, and then 64A, a thin, round disk member, hereafter identified as cap disk 624, having a horizontal axis; appended to cap disk 624, a second round disk, hereafter identified as insert disk 625, coaxially aligned with cap disk 624, and having diameter about three-quarters that of cap disk 624; cap disk 624 and insert disk 625 being pierced horizontally by a small diameter circular through-bore, hereafter identified as shaft bore 626, concentrically aligned with cap disk 624; the diameter of shaft bore 626 being about one-half the outer diameter of cap disk 624; shaft bore 626 further being proportioned to receive bearing shank 633 of hinge shaft 034 (Reference FIG. 64A); the outer diameter of insert disk 625 being proportioned to snugly fit hydraulic chamber 644 of brake shaft 037 (Reference FIG. 66); the material properties of this part further being such that hinge cylinder cap 033 can be solvent welded or adhesively bonded to brake shaft 037/137 or hinge cylinder 138.

Hinge Shaft 034—

This part, preferably formed of molded plastic, is described as follows: Referring to FIG. 64A, a small horizontal cylindrical shaft having length about six times its mean diameter; the shaft further having a short cylindrical region of greater diameter near the mid-length of the part, creating outer bearing protrusion 627; outer bearing protrusion 627 further being proportioned to bear in hydraulic chamber 644 of brake shaft 037 (Reference FIG. 66); the exterior end of the cylindrical shaft, hereafter identified as wiper shaft 628, having diameter about two-fifths that of outer bearing protrusion 627; the interior end of the cylindrical shaft having diameter about three fifths that of outer bearing protrusion 627; outer bearing protrusion 627 and the exterior end of hinge shaft 034 together comprising wet stem 629; the interior end of the cylindrical shaft comprising dry stem 630; a shallow radial groove, hereafter identified as seal groove 631, bisecting the cylindrical surface of outer bearing protrusion 627; seal groove 631 being proportioned to receive O-ring seal 036; dry stem 630 further being trimmed by four flat cuts; the flat cuts, occurring at the interior end of dry stem 630 and having length about one-third that of hinge shaft 034; the flat cuts further being positioned about the cylindrical shaft with polar symmetry, revealing a key shank 632 of substantially square profile.

Still referring to FIG. 64A, that portion of dry stem 630 occurring between key shank 632 and outer bearing protrusion 627 being hereafter identified as bearing shank 633; a short inner bearing protrusion 634 appended concentrically to the exterior end of wet stem 629; inner bearing protrusion 634 having diameter about two-thirds that of wet stem 629 and length slightly smaller than its diameter; inner bearing protrusion 634 being proportioned to bear in inner bearing bore 645 of brake shaft 037 (Reference FIG. 66); two thin wiper arms 635 protruding outward from the center of wet stem 629, one upward, and one downward; wiper arms 635 beginning at the bearing protrusion and extending the full length of wet stem 629; wiper arms 635 terminating in a cylindrical surface substantially common to that of outer bearing protrusion 627; wiper arms 635 each further being pierced horizontally by a small oval-shaped hydraulic port 636; each hydraulic port 636, centrally disposed on the corresponding wiper arm 635, having length and height about one-half those of wiper arms 635; wiper arms 635 each further having a very small rectangular trim cut at each end of their respective upper and lower extremities, creating wiper seal saddles 637; the regions of wiper arms 635 occurring between the respective wiper seal saddles 637 being hereafter identified as wiper seal posts 638; wiper arms 635, wiper seal saddles 637, and wiper seal posts 638 further proportioned to receive wiper seals 035.

Wiper Seal 035—

This part, preferably formed of molded plastic, is described as follows: Referring to FIG. 64A, a curved member 639, substantially a small segment of a thin-walled cylinder, adjoined to a short rectangular thin-walled planar member 640 of equal length; planar member 640 being oriented substantially perpendicular to a tangent of curved member 639; curved member 639 having outer diameter substantially equal to the inner diameter of hydraulic chamber 644 of brake shaft 037; curved member 639 and planar member 640 both having length substantially equivalent to wiper arms 635 of hinge shaft 034; the height of planar member 640 further being slightly less than the height of wiper arms 635 of hinge shaft 034; planar member 640 further having sufficient height to fully cover hydraulic port 636 of hinge shaft 034, within the respective master assembly; a vertical rectangular cut, centrally disposed on, and passing completely through, curved member 639, creating a slide window 641; slide window 641 further having length proportioned to receive wiper seal posts 638 of hinge shaft 034; slide window 641 further having width about twice that of wiper seal posts 638 of hinge shaft 034, allowing a small degree of radial translation to occur between each wiper seal 035 and the corresponding wiper arm 635 of hinge shaft 034 during operational rotation of the assembled components.

O-Ring Seal 036—

As illustrated in FIG. 64, this part is preferably a standard off-the-shelf elastomeric O-ring.

Brake Shaft 037/137 and Hinge Cylinder 138 Common Geometry—

Figure 65:
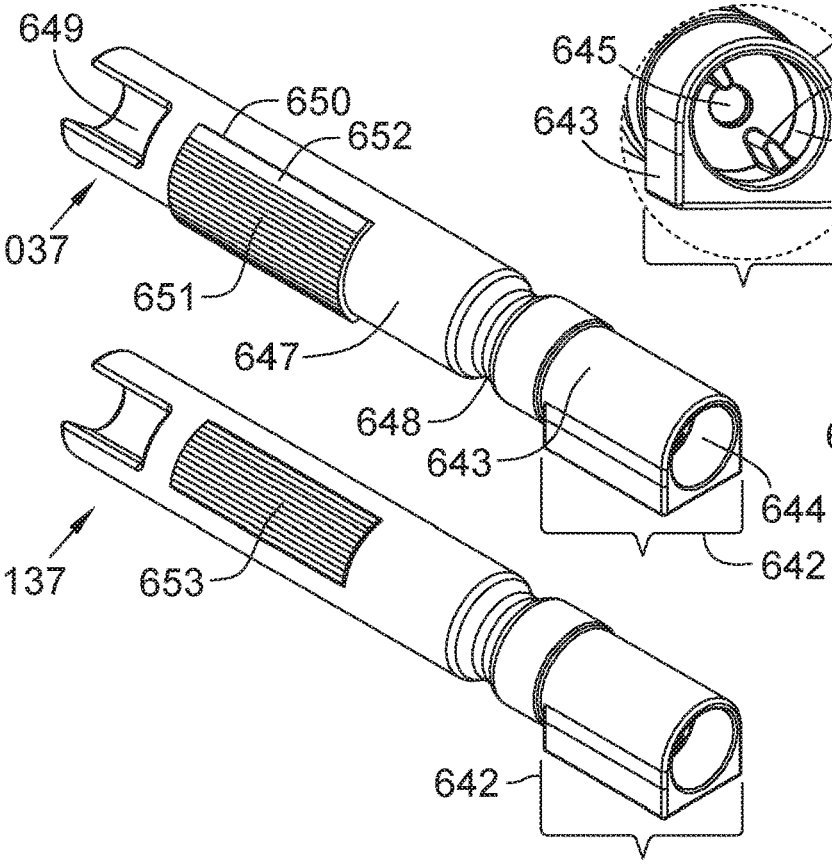
FIG. 65 is a perspective view of brake shaft 037 and brake shaft 137.
Figure 66:
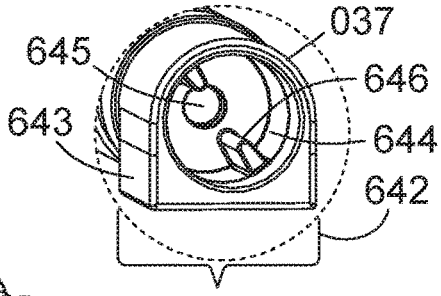
FIG. 66 is a detail perspective view of brake shaft 037, centered about slow-close cylinder 642.

These parts share a common slow-close cylinder 642 (FIG. 65), bearing the following features: referring to FIG. 65, a horizontally extruded body member 643; body member 643 having a profile of extrusion being a simple keyhole shape, comprised of a rectangle with a full radius on its top edge; body member 643 further being proportioned to fit snugly within hinge cylinder port 660 of hinge pivot block 040 (Reference FIG. 70); a blind-bottom circular bore concentrically aligned with the radial surface of body member 643, and further having diameter about fourth-fifths that of body member 643; the circular bore penetrating body member 643 to a depth approximately four-fifths of the length of body member 643, forming hydraulic chamber 644; referring to FIG. 66, a small diameter shallow circular bore, concentrically aligned within hydraulic chamber 644, penetrating a short distance into the rear wall of hydraulic chamber 644, creating inner bearing bore 645; inner bearing bore 645 being proportioned to receive inner bearing protrusion 634 of hinge shaft 034 (Reference FIG. 64A); two linear hydraulic walls protruding inward from the cylindrical wall of the hydraulic chamber 644, creating shear fins 646; shear fins 646 beginning at the rear wall of hydraulic chamber 644, and extending outward, having length slightly less than the depth of hydraulic chamber 644; shear fins 646 further having length approximately equal to that of wiper arms 635 of hinge shaft 034; shear fins 646 being oriented at approximately the 5 o'clock and 11 o'clock positions as seen from the open end of hydraulic chamber 644; shear fins 646 further having a slightly wedge shaped profile with rounded vertices, when viewed from the open end of hydraulic chamber 644; shear fins 646 further being proportioned to receive wiper shaft 628 of hinge shaft 034 (Reference FIG. 64A), within the central opening between the two shear fins 646.

Brake Shaft 037—

This component, preferably formed of corrosion resistant metal or fiber reinforced plastic, includes the previously described slow-close cylinder 642 common to brake shaft 137 and hinge cylinder 138. This part further bears the following features: Referring to FIG. 65, a cylindrical extension, having radius slightly greater than that of the radial surface of slow-close cylinder 642, and length about four times that of slow-close cylinder 642, comprising solid shaft 647; solid shaft 647 being concentrically aligned with the cylindrical surface of body member 643, and extending outward from the enclosed end of slow-close cylinder 642; positioned a short distance from slow-close cylinder 642, a toroidal alignment groove 648 intersecting the outside surface of solid shaft 647 concentrically; alignment groove 648 being proportioned to receive alignment feature 597 of modified WC seat 130/230 (Reference FIG. 59A) and alignment feature 614 of lower shaft housing 031/131 (Reference FIG. 61); an installation trim 649 intersecting the end of solid shaft 647; installation trim 649 including a flat-bottom circular bore concentrically centered on the end of solid shaft 647, with diameter approximately three-fifths that of solid shaft 647; installation trim 649 further passing from the circular bore through the side of solid shaft 647 in full profile, following an oblique path oriented at approximately the 10 o'clock position, as seen from the open end of hydraulic chamber 644.

Figure 67:
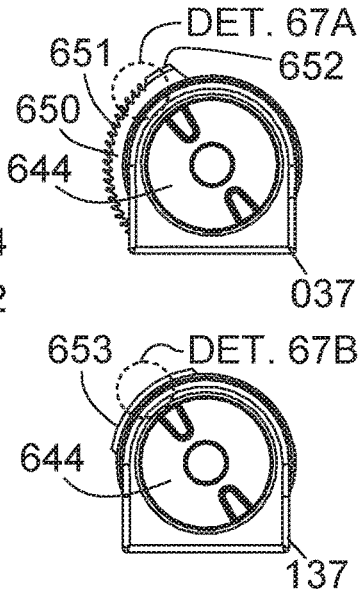
FIG. 67 is a side elevation view of brake shaft 037 and brake shaft 137.
Figure 67A:
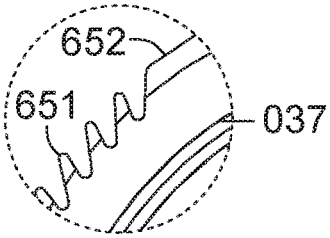
FIG. 67A is a detail view of brake shaft 037, as indicated by the view window labeled DET. 67A in FIG. 67.

Still referring to FIG. 65, a raised cylindrical surface, hereafter identified as contact pad 650, having radius slightly greater than that of solid shaft 647; contact pad 650 having length approximately two-fifths that of solid shaft 647, and approximately equal to the width of radial arm 535 of brake lever 022/122; the center of contact pad 650 being offset a short distance from the mid-length of solid shaft 647 toward installation trim 649, such that contact pad 650 is symmetrically positioned about the center plane of the respective master assembly; the outer surface of contact pad 650 further being interrupted by a radial pattern of linear grooves revealing brake interlock ribs 651 (FIGS. 65, 67, and 67A); referring to FIG. 67A, interlock ribs 651 further having a gear-tooth shaped profile; interlock ribs 651 further being proportioned to mesh tightly with complimentary interlock ribs 540 of brake lever 022 (Reference FIG. 46); referring to FIG. 67, interlock ribs 651 occurring radially between the approximate angles of 8 o'clock and 10:30, as seen from the open end of hydraulic chamber 644; contact pad 650 further having a narrow non-ribbed region 652 (FIGS. 65, 67, and 67A) along its upper edge, being uninterrupted by interlock ribs 651, to prevent engagement of the brake components outside of the intended operational range; non-ribbed region 652 further occurring between the approximate angles of 10:30 and 11 o'clock, as seen from the open end of hydraulic chamber 644.

Brake Shaft 137—

Figure 67B:
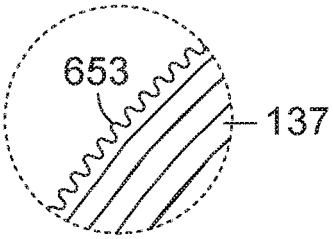
FIG. 67B is a detail view of brake shaft 137, as indicated by the view window labeled DET. 67B in FIG. 67.

This part, preferably formed of corrosion resistant metal or fiber reinforced plastic, is very similar to brake shaft 037, notwithstanding the following differences: Referring to FIG. 65, interlock ribs 651 of brake shaft 037 (FIG. 65) are replaced by pad engagement ribs 653 (FIGS. 65, 67, and 67B) having a significantly smaller gear-tooth profile than interlock ribs 651 of brake shaft 037; pad engagement ribs 653 of brake shaft 137 further being proportioned to deform, and substantially engage with, friction pad 678 of brake pad 043 (Reference FIG. 49A); referring to FIG. 67, in contrast to interlock ribs 651 of brake shaft 037, pad engagement ribs 653 of brake shaft 137 occur between the approximate angles of 9 o'clock and 11:30, as seen from the open end of hydraulic chamber 644; non-ribbed region 652 of brake shaft 037 does not occur in brake shaft 137.

Hinge Cylinder 038—

Figure 68:
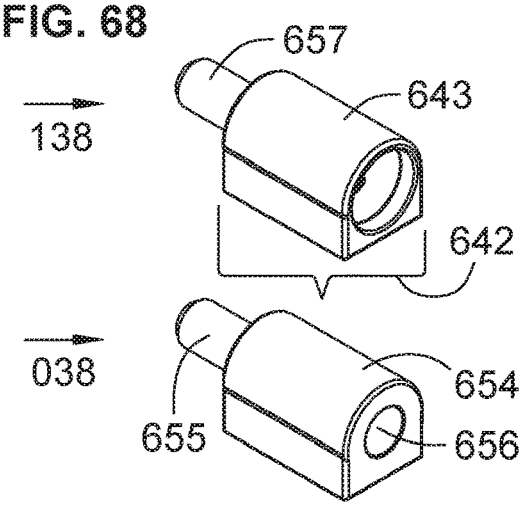
FIG. 68 is a perspective view of hinge cylinder 038 and hinge cylinder 138.
Figure 69:
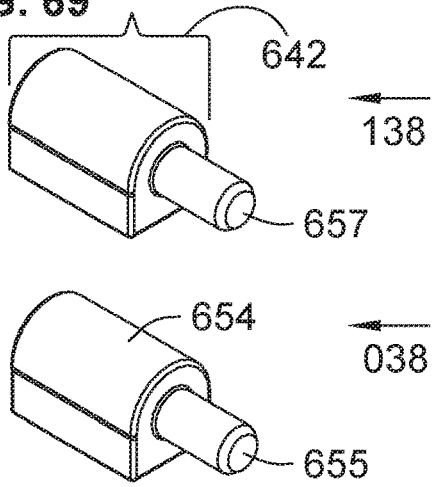
FIG. 69 is an additional perspective view of hinge cylinder 038 and hinge cylinder 138.

This part, preferably formed of molded plastic, bears the following features: Referring to FIG. 68, a horizontally extrusion, hereafter identified as body member 654; body member 654 having a profile of extrusion with a simple keyhole shape, comprised of a rectangle with a full radius on the top; body member 654 further being proportioned to fit snugly within hinge cylinder port 660 of hinge pivot block 040 (Reference FIG. 70); body member 654, further being substantially equivalent in profile and length to body member 643 of slow-close cylinder 642; a cylindrical shaft, concentrically aligned with the arc of the keyhole profile, protruding from the left end of the part, constituting bearing stem 655; bearing stem 655 having a diameter approximately one-half the diameter of body member 654, and length about one-half as long as body member 654; bearing stem 655 further being proportioned for insertion in hinge bearing ports 341 of modified WC lid 001 (Reference FIG. 2) and hinge bearing port 589 of modified WC seat 030 (Reference FIG. 56); a cylindrical blind-bottom bore, concentrically aligned with the arc of the keyhole profile, piercing the right end of the part, and having diameter substantially equal to bearing stem 655, creating hinge pin receptacle 656; hinge pin receptacle 656, having depth about one-half the length of body member 654; hinge pin receptacle 656 further having diameter proportioned to snugly receive hinge pin 044. FIG. 69 provides an additional perspective of hinge cylinder 038.

Hinge Cylinder 138—

This part, preferably formed of molded plastic, includes the previously described slow-close cylinder 642 common to brake shaft 037/137. This part further bears the following features: Referring to FIG. 68, a small diameter cylindrical protrusion, concentrically aligned with the cylindrical surface of body member 643, extending outward from the closed end of slow-close cylinder 642, and forming bearing stem 657; bearing stem 657 further being proportioned to fit hinge bearing port 342 of modified WC lid 101 (Reference FIG. 3.). FIG. 69 provides an additional perspective of hinge cylinder 138.

Assembly Mounting Bolt, 039—

As illustrated in FIG. 64, this part is very similar to a bolt that would typically be included with a conventional water closet seat and lid assembly, and is preferably a standard off-the-shelf stainless-steel or plastic bolt proportioned for the application, and having sufficient tensile strength to withstand the user applied forces.

Hinge Pivot Block 040/140 Common Geometry—

Figure 70:
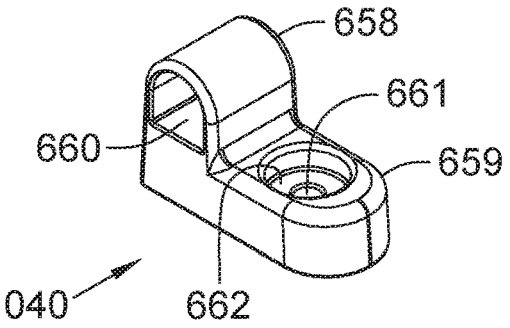
FIG. 70 is a perspective view of hinge pivot block 040.

These parts, preferably formed of molded plastic, bear the following common features: Referring to FIG. 70, a solid horizontal extrusion of short length, having a simple keyhole side profile, comprised of a tall rectangle with a full radius on the top end; said extrusion forming hinge tower 658; the length of hinge tower 658 being slightly greater that the diameter of the extruded profile; a short solid protrusion forming anchoring base 659, having a vertical profile shaped like a simple keyhole; anchoring base 659 having a profile proportioned slightly larger than that of hinge tower 658; anchoring base 659 oriented with the radial axis vertical, the flat of its profile adjoined to the long side of hinge tower 658, and the bottom surface of anchoring base 659 being coplanar with the bottom surface of hinge tower 658; the width of anchoring base 659 further being substantially equal to the length of hinge tower 658.

Hinge Pivot Block 040—

Figure 71:
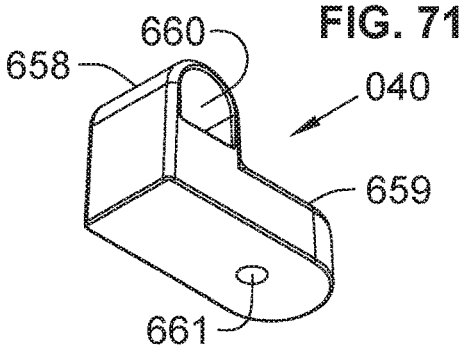
FIG. 71 is an additional perspective view of hinge pivot block 040.

In addition to the common geometry of hinge pivot block 040/140, this part further includes the following features: Referring to FIG. 70, a through-hole piercing hinge tower 658, comprising hinge cylinder port 660; hinge cylinder port 660 also having a simple keyhole profile, both smaller and shorter than that of hinge tower 658; the profile of hinge cylinder port 660 being proportioned to receive body member 654 of hinge cylinder 038 (Reference FIG. 68) or slow-close cylinder 642 of hinge cylinder 138 (Reference FIG. 68); the profiles of hinge tower 658 and hinge cylinder port 660 being commonly oriented, with radial surfaces coaxially aligned; a cylindrical through-bore, centrally positioned on anchoring base 659 near its mid-length, vertically piercing anchoring base 659, and constituting bolt hole 661; bolt hole 661 having diameter slightly larger than that of assembly mounting bolt 039; a top-side countersink 662, concentrically aligned with bolt hole 661 and intersecting the top surface of anchoring base 659; bolt hole 661 and countersink 662 being proportioned to receive assembly mounting bolt 039. FIG. 71 offers an additional perspective of hinge pivot block 040.

Hinge Pivot Block 140—

Figure 72:
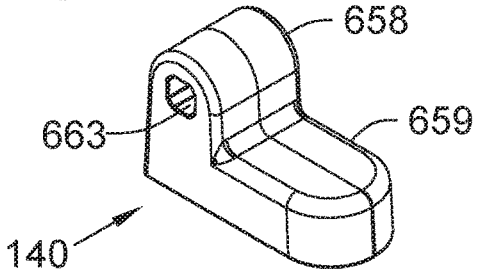
FIG. 72 is a perspective view of hinge pivot block 140.

In addition to the common geometry of hinge pivot block 040/140, this part further includes the following features: Referring to FIG. 72, a three-stage penetration 663 passing through hinge tower 658; three-stage penetration 663 including [(i) a large key region comprised of a square profile with boldly rounded corners, adjacently connected to (ii) a central radial bore, adjacently connected to (iii) a small key region also comprised of a square profile with boldly rounded corners]; three-stage penetration 663 further being proportioned to receive hinge block insert 768 of wet pivot shaft 069, and two cup seals 070; referring to FIG. 73, a blind-depth cylindrical bore intersecting the bottom of anchoring base 659, forming inlet receptacle 664; inlet receptacle 664 further being centrally positioned on anchoring base 659 near its mid-length; referring to FIG. 74, and then FIG. 75, inlet receptacle 664 further having internal tapered threads 665, proportioned to receive outlet threads 772 of hollow mounting stud 071 (Reference FIG. 90); a hydraulic cavity 666 (FIGS. 73, 75) penetrating the bottom of the part and substantially coring the lower interior of hinge tower 658 and the forward section of anchoring base 659, leaving the part thinly shelled around hydraulic cavity 666; referring to FIG. 75, an internal horizontal connecting port 667 linking inlet receptacle 664 to hydraulic cavity 666; a vertical bore connecting hydraulic cavity 666 to the central radial bore of three-stage penetration 663, comprising outlet port 668; referring now to FIG. 73, a shallow rectangular cut, intersecting the bottom of the part, symmetrically positioned below hydraulic cavity 666, comprising floor plate receptacle 669 (See also FIG. 75); floor plate receptacle 669 having length and width slightly greater than the bottom intersecting length and width of hydraulic cavity 666; floor plate receptacle 669 further being proportioned to receive hinge block floor plate 041; a single coring cut 669A, having a crescent-moon shaped top-view profile, intersecting the bottom of anchoring base 659 behind inlet receptacle 664, and substantially removing unnecessary material to aid in fabrication; this part further having material properties allowing solvent welding of hinge pivot block 140 to hinge block floor plate 041.

Hinge Block Floor Plate 041—

Figure 73:
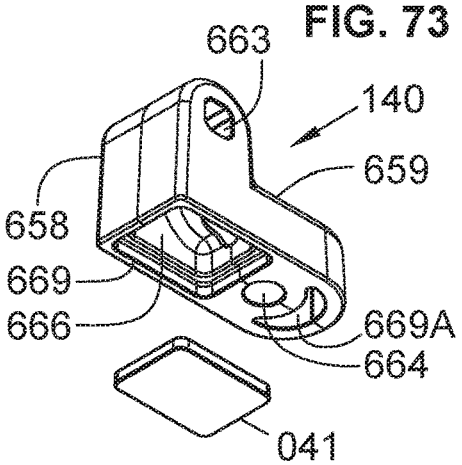
FIG. 73 is a perspective view of hinge pivot block 140 and hinge block floor plate 041.
Figure 74:
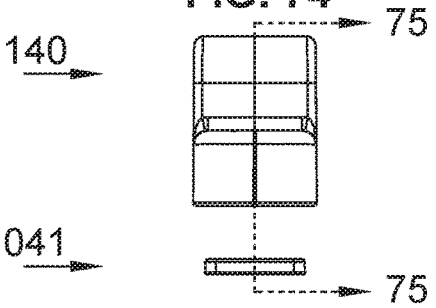
FIG. 74 is a rear elevation view of hinge pivot block 140 and hinge block floor plate 041.
Figure 75:
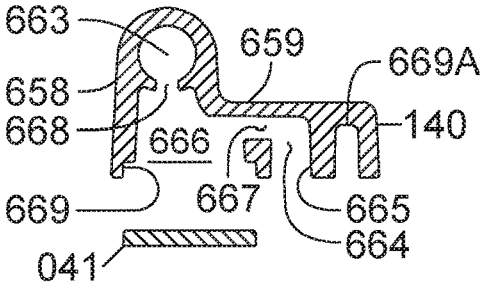
FIG. 75 is a section view of hinge pivot block 140 and hinge block floor plate 041, taken through section line 75 in FIG. 74.

This part, preferably formed of molded plastic, is described as follows: Referring to FIGS. 73 and 75, a thin horizontal plate having a rectangular profile as seen from above, proportioned to fit floor plate receptacle 669 of hinge pivot block 140; this part further having material properties allowing solvent welding of hinge pivot block 140 to hinge block floor plate 041.

Urine Pan 042—

Figure 77:
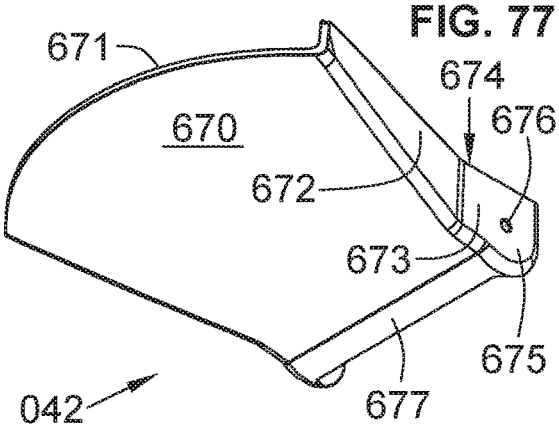
FIG. 77 is an additional perspective view of urine pan 042.

This part, preferably formed of molded plastic, bears the following features: Referring to FIG. 76, a substantially planar thin floor member 670, nearly horizontal, originating from a forward elliptical arc 671, and sloping moderately downward toward the rear of the part; the curvature of forward elliptical arc 671 being complimentary to the inner curvature of radial bridge 334 of modified WC lid 001; floor member 670 further spanning between two sidewalls; said sidewalls originating at forward elliptical arc 671, and being symmetrically positioned about the longitudinal axis of the part; said sidewalls further complimenting the top-view profile of receptacle opening 328 of modified WC lid 001, being comprised of converging angled segments 672 with rearward convergence, tangentially blending into rear parallel segments 673; converging angled segments 672 and rear parallel segments 673 extending upward to a common surface, hereafter identified as upper terminal surface 674; upper terminal surface 674 having complimentary curvature to the lower surface of plate member 325 of modified WC lid 001; the foremost edge of converging angled segments 672 further terminating in vertical surfaces proportioned to mate with the rear surfaces of drop walls 333 of modified WC lid 001 (Reference FIG. 1); rear parallel segments 673 further having lower rear profiles curving first downward and rearward, then upward and rearward, then vertically upward, creating semi-cylindrical pivot tabs 675; the exterior surfaces of each pivot tab 675 being interrupted by a small hemispherical divot 676; hemispherical divots 676 being coaxially aligned with the cylindrical profiles of pivot tabs 675; a short rearward radial extension of floor member 670, hereafter identified as sweep lip 677; sweep lip 677 having a lower radial surface with a side view profile coincident with the radial profile of pivot tabs 675; sweep lip 677 further having an upper planar surface with moderate downward slope, meeting the upper surface of floor member 670 slightly forward of hemispherical divots 676; the lower radial surface and upper planar surface of sweep lip 677 further converging directly below the axis of pivot tabs 675, effecting the rear terminus of sweep lip 677; this part further having material properties allowing solvent welding of urine pan 042 to modified WC lid 001. FIG. 77 illustrates and alternate perspective of urine pan 042.

Brake Pad 043—

Figure 49:
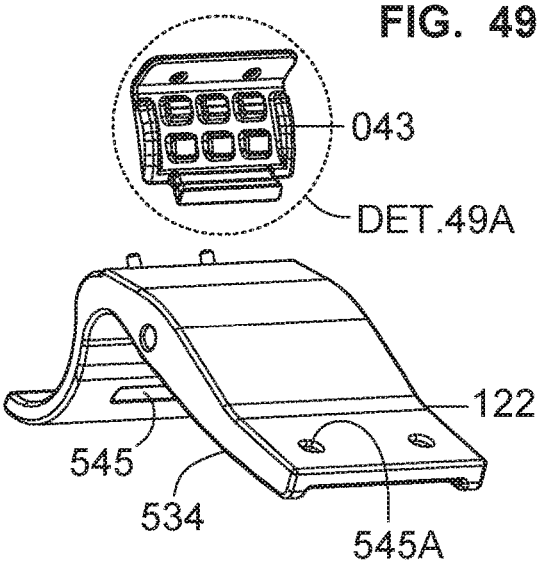
FIG. 49 is an additional perspective view of brake lever 122 and brake pad 043.
Figure 48A:
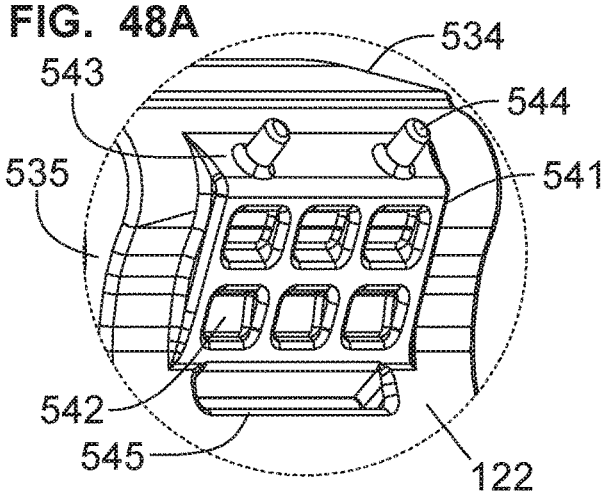
FIG. 48A is a detail view of brake lever 122 as indicated by the view window labeled DET. 48A in FIG. 48.
Figure 49A:
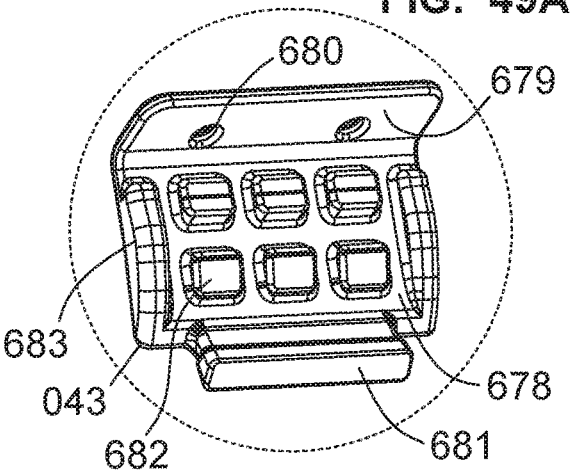
FIG. 49A is a detail view of brake pad 043 as indicated by the view window labeled DET. 49A in FIG. 49.

This part is preferably formed of molded silicon rubber, having a high durometer value, and bearing the following description: Referring to FIG. 49, and then FIG. 49A, a thin semi-flexible rectangular plate member, hereafter identified as friction pad 678; the height of friction pad 678 being proportioned to match the height of interleave pad 541 of brake lever 122 (Reference FIG. 48A); the width of friction pad 678 being proportioned slightly greater than the width of interleave pad 541 of brake lever 122 (FIG. 48A); a thin retaining tab 679 extending forward from the top of friction pad 678, with an interior angle between friction pad 678 and retaining tab 679 of approximately 120 degrees; retaining tab 679 extending forward with length proportioned to match upper terminal plane 543 of brake lever 122 (FIG. 48A); two cylindrical retaining holes 680 piercing vertically through retaining tab 679; retaining holes 680 being spaced and proportioned to receive retaining posts 544 of brake lever 122 (FIG. 48A); a thin rectangular protrusion extending inward and downward from the lower surface of friction pad 678, comprising compression insert 681; the interior angle between friction pad 678 and compression insert 681 being approximately 150 degrees; compression insert 681 further having a slightly tapered profile, with larger cross-section at its lower extremity; compression insert 681 further having cross section, profile, and length proportioned to snugly fit insert gland 545 of brake lever 122 (FIG. 48A), in a slightly compressed state; a series of six square-profile shallow protrusions, hereafter identified as interleave blocks 682, protruding from the inner surface of friction pad 678; interleave blocks 682 further being proportioned and spaced to fill interleave wells 542 of brake lever 122 (FIG. 48A); two additional rectangular protrusions extending inward from the inner surface of friction pad 678, along its extreme sides, constituting support wings 683; support wings 683 being proportioned to mate with the outside walls of interleave pad 541 of brake lever 122; the forward edge of support wings 683 terminating in a common cylindrical surface, proportioned to mate with the interior surface of radial arm 535 of brake lever 122 (FIG. 48A).

Hinge Pin 044—

Figure 99:
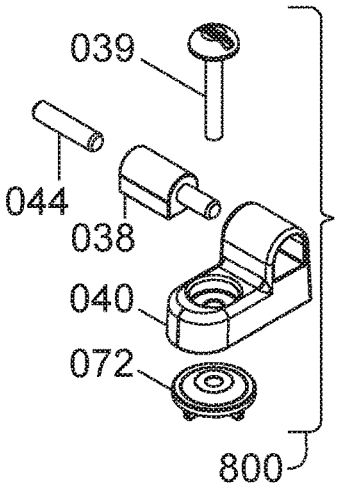

This part, preferably formed of molded plastic, bears the following features, as illustrated in FIG. 99: A cylindrical shaft, substantially identical in diameter to bearing stem 655 and hinge pin receptacle 656 of hinge cylinder 038; the cylindrical shaft having length about twice the depth of hinge pin receptacle 656 of hinge cylinder 038; the cylindrical shaft further being proportioned to fit hinge bearing ports 341 of modified WC lid 001 (Reference FIG. 2.).

Flush Button Cap 045—

Figure 78:
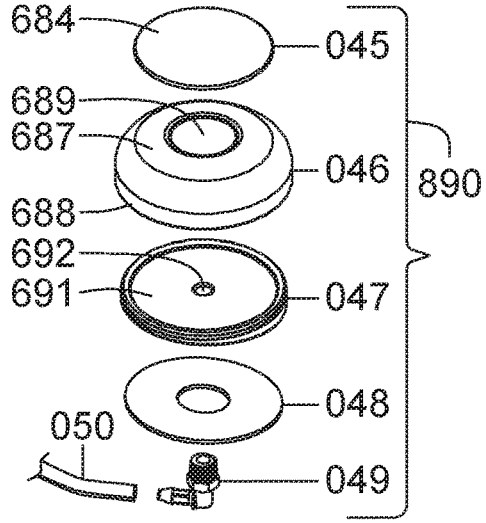
FIG. 78 is a perspective view of the components comprising manual actuator 890, relatively positioned in an exploded state.

This part, preferably formed of molded plastic, is described as follows: Referring to FIG. 78, a thin circular disk member having overall diameter approximately three-fourths that of flush button diaphragm 046; the circular disk member having an upwardly domed top surface 684; referring to FIG. 79, the circular disk member further having a bottom concave surface 685; bottom concave surface 685 of the circular disk member further having a circular protrusion, extending downward, with diameter approximately one-half that of the circular disk member; the circular protrusion hereafter being identified as reference disk 686; reference disk 686 further being proportioned to fit reference gland 689 of flush button diaphragm 046; bottom concave surface 685 of this part further being proportioned to match the upper surface of dome cap 687 of flush button diaphragm 046; the material properties of this component further being such that reference disk 686 may be adhesively bonded into reference gland 689 of flush button diaphragm 046.

Flush Button Diaphragm 046—

This part, preferably formed from a low-durometer molded elastomer, is described as follows: Referring to FIG. 78, a flexible, thin-walled circular dome-shaped member, having an upper gently sloping region, hereafter identified as dome cap 687, dome cap 687 further blending downward into a thin vertical cylindrical wall 688; cylindrical wall 688 having internal diameter substantially equivalent to the exterior diameter of flush button housing 047; the bottom edge of cylindrical wall 688 further terminating in a horizontal plane; dome cap 687 further being proportioned to match the curvature of flush button cap 045; the top convex center of dome cap 687 having a circular region offset slightly downward, creating reference gland 689; reference gland 689 further being proportioned to receive reference disk 686 of flush button cap 045 (Reference FIG. 79); referring to FIG. 79, a toroidal reference ring 690, protruding inward from the lower surface of cylindrical wall 688, being located a short distance above the bottom of the part; reference ring 690 further being proportioned to fit reference gland 700 of flush button housing 047 (Reference FIG. 80); this part further having material properties that will allow the diaphragm to flex downwardly when flush button cap 045 is depressed by the user; this part further having material properties that will prevent pressurized air from passing through the part; the material properties of this component further being such that reference disk 686 of flush button cap 045 may be adhesively bonded into reference gland 689 of flush button diaphragm 046; the material properties of this component further being such that reference ring 690 of flush button diaphragm 046 may be adhesively bonded into reference gland 700 of flush button housing 047.

Flush Button Housing 047—

Figure 80:
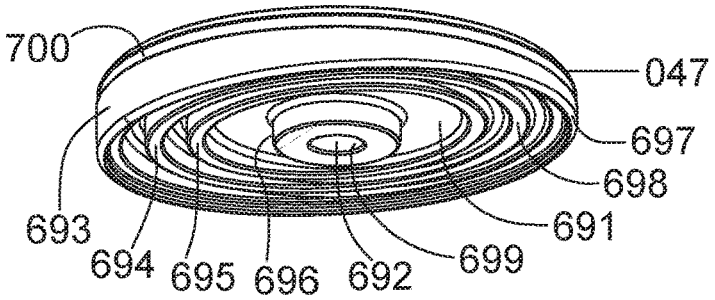
FIG. 80 is a perspective view of flush button housing 047.

Referring to FIGS. 78 and 80, this part, preferably formed of molded plastic, is described as follows: A thin circular disk member 691 having a vertical axis; within the respective master assembly, the axis being concentrically aligned with manual actuator signal port 364 of modified WC lid 201 (Reference FIG. 5A); a small diameter circular through-bore piercing vertical through the center of disk member 691, comprising outlet port 692.

Referring to FIG. 80, four radial walls of different diameters extending downward a short distance from the bottom surface of disk member 691; the first radial wall, hereafter identified as radial wall A 693, having outer diameter equal to the internal diameter of cylindrical wall 688 of flush button diaphragm 046; radial wall A 693 substantially bounding the perimeter of disk member 691, and having thickness approximately equal to that of disk member 691; radial wall A 693 further extending upward a short distance above the top surface of disk member 691; the second radial wall, hereafter identified as radial wall B 694, having thickness approximately equal to that of disk member 691 and diameter approximately four-fifths that of radial wall A 693; the third radial wall, hereafter identified as radial wall C 695, having thickness approximately equal to that of disk member 691 and diameter approximately three-fifths that of radial wall A 693; the fourth radial wall, hereafter identified as radial wall D 696, having thickness about twice that of disk member 691 and internal diameter equivalent to that of outlet port 692; radial wall A 693, radial wall B 694, and radial wall C 695 projecting downward to a common lower terminal surface 697; the common lower terminal surface 697 complimenting the top surface of plate member 325 of modified WC lid 201; radial wall A 693, radial wall B 694, and radial wall C 695 further being trimmed by a circular disk cut shallowly intersecting their bottom surfaces, and proportioned to receive adhesive pad 048; said circular disk cut, having external diameter approximately equal to the mean diameter of radial wall A 693; the upper surface revealed by said circular disk cut being hereafter identified as trim surface 698 being offset slightly upward from lower terminal surface 697; radial wall D 696 extending downward a short distance below disk member 691 and terminating in a horizontal plane; internal tapered threads 699 occurring in the bottom interior surface of radial wall D 696, being proportioned to receive threaded elbow 049; a shallow toroidal groove intersecting the upper extension of radial wall A 693, slightly above the mid-height of disk member 691, comprising reference gland 700; the material properties of this component further being such that reference ring 690 of flush button diaphragm 046 may be adhesively bonded into reference gland 700 of flush button housing 047.

Adhesive Pad 048—

Figure 79:
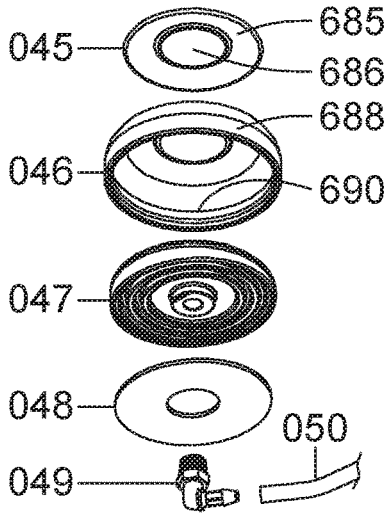
FIG. 79 is an additional perspective view of the components comprising manual actuator 890, relatively positioned in an exploded state.

This part, preferably formed from standard off-the-shelf two-sided adhesive tape sheet stock, is described as follows, as illustrated in FIGS. 78 and 79: A very thin flexible annular disk, having a vertical axis, being proportioned to adhere flush button housing 047 to modified WC lid 201; the annular disk having external diameter approximately equal to the mean diameter of radial wall A 693 of flush button housing 047; the annular disk further having inner diameter slightly greater than the outer diameter of radial wall D 696 of flush button housing 047; the annular disk further having adhesive on its top and bottom surfaces, appropriate to affix flush button housing 047 to modified WC lid 201.

Threaded Elbow 049—

This part is preferably a standard off-the-shelf plastic component having the following features: A barb stem connected to a threaded base at a right angle, and an internal passage passing entirely through the part, as illustrated in FIGS. 78 and 79.

Pneumatic Tube 050—

Referring to FIGS. 78 and 79, this part is preferably standard off-the-shelf pneumatic tubing, cut to length.

Pivot Jet 051—

This part, preferably formed of stainless steel, bears the following features: Referring to FIG. 82 and then FIG. 83, a small diameter cylindrical body member 701 (FIGS. 82 and 83) having a horizontal axis and a blind-depth internal cylindrical cavity 702; cylindrical cavity 702 within body member 701 further having internal straight threads 703, being proportioned to receive small pivot stud 504B of pivot plate 114 (Reference FIG. 35); cylindrical cavity 702 further being proportioned to internally receive disk seal 054 (Reference FIG. 81); the exterior of body member 701 having a slight taper with larger diameter near the interior end of the part; appended to the interior end of body member 701, a lesser diameter cylindrical shaft, hereafter identified as bearing shaft 704, having external diameter about half that of the largest diameter of body member 701; bearing shaft 704 having length about one-third that of body member 701; bearing shaft 704 further being proportioned to externally receive O-ring seal 052; bearing shaft 704 further being proportioned to fit either pivot bore 425 of upper cartridge segment 202 (Reference FIG. 14A); appended to the interior end of bearing shaft 704, a lesser diameter cylindrical shaft, hereafter identified as nozzle shaft 705; nozzle shaft 705 having external diameter about one-half that of bearing shaft 704 and length about one and one-third times that of bearing shaft 704; nozzle shaft 705 further terminating at its interior end in a vertical plane.

Figure 82:
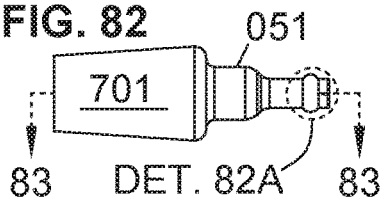
FIG. 82 is a front elevation view of pivot jet 051.
Figure 82A:
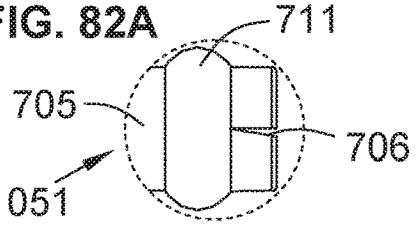
FIG. 82A is a detail view of pivot jet 051, as indicated by the view window labeled DET. 82A in FIG. 82.

Referring to FIG. 82, and then FIG. 82A, a linear horizontal groove, constituting v-groove 706, cutting shallowly into the vertical face of nozzle shaft 705; v-groove 706 further being formed by the convergence of a horizontal plane with an oblique plane of very shallow angle; again referring to FIG. 83, a horizontal axis passing concentrically through nozzle shaft 705, hereafter being identified as pivot axis 706A; a horizontal tapered-point circular bore, hereafter identified as bearing bore 707, having diameter approximately one-half that of cylindrical cavity 702, being concentrically aligned with the axis of body member 701; bearing bore 707 penetrating body member 701 from its open end, and boring nearly through body member 701; a second tapered-point circular bore, hereafter identified as nozzle bore 708, having diameter about one-third that of bearing bore 707; nozzle bore 708 being concentrically aligned with bearing bore 707, penetrating the center of bearing shaft 704 and nozzle shaft 705; the tip of nozzle bore 708 shallowly piercing the vertical terminal face of nozzle shaft 705 at the midpoint of v-groove 706; a hose barb, comprising barbed stem 709, with horizontal axis oriented transversely to the central axis of body member 701, being adjoined to body member 701 at its mid-height, and near its mid-length; a fluid port, constituting water inlet port 710, having diameter about three-fourths the minor diameter of barbed stem 709, concentrically piercing barbed stem 709 and intersecting bearing bore 707; a toroidal protrusion having an exterior diameter slightly greater than the diameter of nozzle shaft 705, forming locating band 711 (FIGS. 82A and 83) on nozzle shaft 705, near the interior edge of v-groove 706; locating band 711 further being proportioned to retain right side shield 103 in position as it flexes during operation of the respective master assembly.

O-Ring Seals 052—

Figure 81:
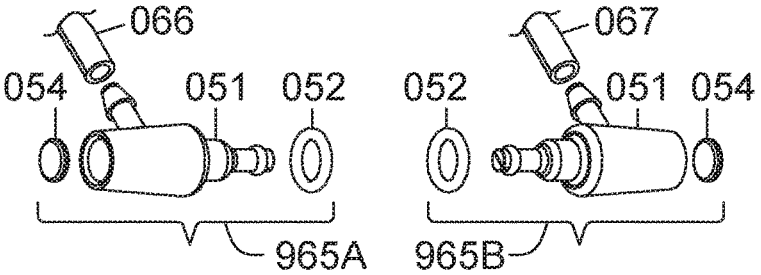
FIG. 81 is a perspective view of the components comprising left spray nozzle assembly 965A and right spray nozzle assembly 965B, positioned in exploded states.

These parts are preferably standard off-the-shelf elastomeric O-rings, as illustrated in FIG. 81.

Slow-Close Fluid 053—

This fluid, required to accomplish the slow-close rotational dampening functionality, is preferably a highly viscous non-vulcanizing liquid silicon rubber. (Reference FIG. 137A, illustrating slow-close fluid 053 filling the interstitial spaces of hydraulic chamber 644 of brake shaft 037)

Disk Seal 054—

This part, illustrated in FIG. 81, is preferably a standard off-the-shelf elastomeric disk seal. Alternatively it may be cut from off-the-shelf elastomeric sheet stock. This part further having diameter approximately equivalent to the diameter of small pivot stud 504B of pivot plate 114, and being proportioned to fit cylindrical cavity 702 of pivot jet 051 (Reference FIG. 83.).

Valve Body Fasteners 055—

Figure 84:
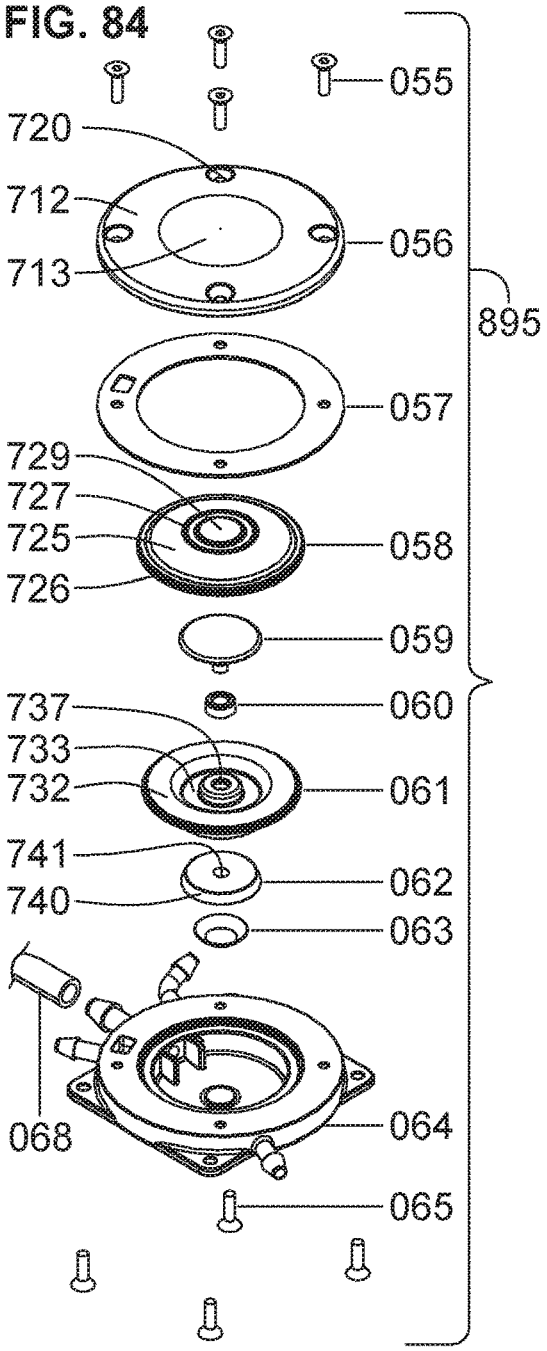
FIG. 84 is a perspective view of the components comprising manual flush valve 895, relatively positioned in an exploded state.
Figure 85:
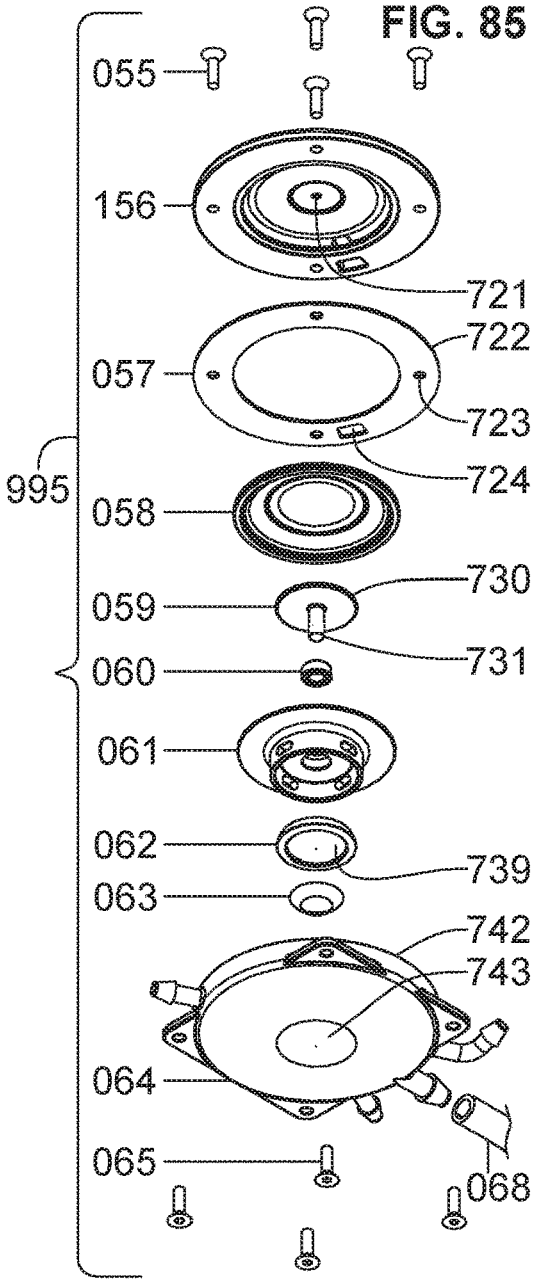
FIG. 85 is a perspective view of the components comprising automatic flush valve 995, relatively positioned in an exploded state.

These parts are preferably standard off-the-shelf stainless steel screws, as illustrated in FIGS. 84 and 85.

Valve Cap 056—

Figure 86:
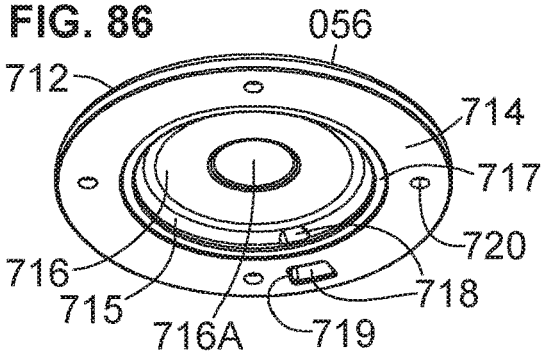
FIG. 86 is a perspective view of valve cap 056.

This part, preferably formed of molded plastic, is described as follows: Referring to FIG. 84, a circular disk member 712, having a vertical axis; disk member 712 having a domed top surface 713 and a lower planar surface 714 (FIG. 86); referring to FIG. 86, disk member 712 further containing a lower radial cavity, hereafter identified as pneumatic cavity 715, intersecting the bottom side of disk member 712; pneumatic cavity 715 having an overall diameter about two-thirds that of disk member 712; pneumatic cavity 715 substantially thinning the interior of disk member 712, revealing top shell 716 above; a small diameter circular cut shallowly intersecting the bottom surface of thin top shell 716, comprising vent seal gland 716A; vent seal gland 716A further being proportioned to receive vent seal surface 729 of valve diaphragm 058 (Reference FIG. 84); a circular shaped recessed groove 717 occurring at the convergence of pneumatic cavity 715 and lower planar surface 714; recessed groove 717 being further dimensioned to receive valve diaphragm 058; a through port extending upward and inward from lower planar surface 714, constituting pneumatic port 718; pneumatic port 718 penetrating through disk member 712 and piercing horizontally through the interior cylindrical wall of pneumatic cavity 715; pneumatic port 718 further penetrating lower planar surface 714 in a rectangular profile 719; four screw ports 720 (FIGS. 84, 86) comprised of vertical through-holes with top-side countersinks; screw ports 720 being symmetrically positioned near the perimeter of disk member 712, exterior to pneumatic cavity 715 and recessed groove 717; screw ports 720 further being proportioned to receive valve body fasteners 055.

Valve Cap 156—

This part, preferably formed of molded plastic, is substantially identical to valve cap 056, notwithstanding one additional feature, as illustrated in FIG. 85: Valve cap 156 also includes a very small diameter venting port 721 piercing vertically through the center of the part.

Valve Gasket 057—

This part, preferably formed of PTFE or paper gasket material, is described as follows: Referring to FIG. 85, a very thin circular disk member 722 having a vertical axis; disk member 722 further having planar top and bottom surfaces; disk member 722 further having outer diameter substantially equivalent to the outer diameter of valve cap 056/156; this part further having a centrally disposed circular vertical through-hole with diameter substantially equal to the outer diameter of recessed groove 717 of valve cap 056/156; four vertical screw holes 723 being positioned and proportioned to match screw ports 720 of valve cap 056/156 (Reference FIG. 84); a vertical cut passing through the part, constituting pneumatic port 724; pneumatic port 724 vertically piercing the part in a rectangular top-view profile; pneumatic port 724 being positioned and proportioned to compliment rectangular profile 719 of valve cap 056/156 (Reference FIG. 86); this part further having material properties that will allow it to compress slightly within the respective master assembly, and prevent air and water from passing through it.

Valve Diaphragm 058—

Figure 87:
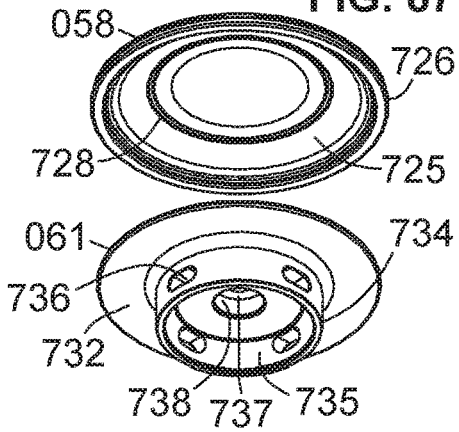
FIG. 87 is a perspective view of valve diaphragm 058 and valve seat insert 061.

This part, preferably formed from a low-durometer molded elastomer, is described as follows: Referring to FIG. 84, a thin, flexible, circular upwardly domed disk 725, having a vertical axis; domed disk 725 further having a circular protrusion extending downward around its perimeter, hereafter identified as sealing flange 726 (See also FIG. 87); sealing flange 726 having outer diameter substantially equal to that of recessed groove 717 of valve cap 056/156; sealing flange 726 having thickness about twice that of domed disk 725; sealing flange 726 further having width approximately equal to its thickness; a circular V-groove shallowly intersecting the top of the part, effecting an upper flexural control 727; upper flexural control 727 having a mean diameter approximately one-half that of sealing flange 726; referring to FIG. 87, a circular V-groove shallowly intersecting the bottom of domed disk 725, effecting lower flexural control 728; lower flexural control 728 having a mean diameter approximately two-thirds that of sealing flange 726; referring again to FIG. 84, a small diameter protrusion extending upward from the top surface of the part, hereafter identified as vent seal surface 729; vent seal surface 729 being proportioned to fit vent seal gland 716A of valve cap 056/156 (Reference FIG. 86); this part further having material properties that will allow the valve diaphragm 058 to flex downwardly when subjected to pressurized air within the respective master assembly; this part further having material properties that will prevent pressurized water and pressurized air from passing through it.

Valve Piston 059—

This part, preferably formed from molded plastic, bears the following features, as illustrated in FIG. 85: A thin, circular disk member, hereafter identified as diaphragm mating disk 730, having a vertical axis; diaphragm mating disk 730 having planar top and bottom surfaces; diaphragm mating disk 730 further having diameter approximately one-half that of pneumatic cavity 715 of valve cap 056/156; a cylindrical shaft, hereafter identified as piston shaft 731 extending downward from the center of diaphragm mating disk 730, with diameter about one-fifth that of diaphragm mating disk 730; piston shaft 731 extending downward approximately seven times the thickness of diaphragm mating disk 730; the diameter of piston shaft 731 being proportioned to receive valve cup seal 060.

Valve Cup Seal 060—

Referring to FIGS. 84 and 85, this part, also known as a "Lip Seal" is preferably a standard off-the-shelf elastomeric seal, rated for use with water and air.

Valve Seat Insert 061—

This part, preferably formed from molded plastic, is described as follows: Referring to FIG. 84, a thin-walled revolved protrusion having a vertical axis comprising top plate 732; commencing at the extremity of the part, the profile of revolution of top plate 732 projecting horizontally inward, then curving vertically downward, then projecting horizontally inward, then projecting vertically upward, then projecting horizontally inward, and terminating at the axis of revolution; the revolved profile effecting a planar disk with a circular trough 733 near its mid-radius; the outer diameter of top plate 732 being slightly less the outer diameter of valve diaphragm 058; referring to FIG. 87, a thin-walled cylindrical protrusion, hereafter identified as disk housing 734 extending downward a short distance from the bottom of top plate 732, directly below the outer cylindrical wall of circular trough 733 (Reference FIG. 84); the interior surface of disk housing 734, hereafter identified as disk seat 735, having inwardly sloped walls, proportioned to receive valve disk 062; four horizontal oval-shaped fluid passages 736 penetrating the sidewall of disk housing 734 at its mid-height; a vertical through bore penetrating the center of top plate 732, constituting piston bore 737 (FIGS. 84 and 87); piston bore 737 having diameter proportioned to receive piston shaft 731 of valve piston 059 (Reference FIG. 85); the internal vertical wall of circular trough 733 (Reference FIG. 84) constituting seal gland 738 (FIG. 87); seal gland 738 being proportioned to receive valve cup seal 060; the material of this part further being suitable for solvent welding to valve base 064.

Valve Disk 062—

This part, preferably formed from a molded elastomer, is described as follows: Referring to FIG. 84, a circular disk member, having a vertical axis; the disk member having a planar top surface; referring to FIG. 85, the disk member further having a convexly curved bottom surface, proportioned to compliment the upper surfaces of hydraulic cavity 745 of valve base 064 (Reference FIG. 88); the bottom surface further being intersected by a shallow circular cut creating a lower cavity, hereafter identified as disk spring gland 739; disk spring gland 739 further being proportioned to receive disk spring 063; referring again to FIG. 84, the external wall of the disk member, hereafter identified as seal surface 740, having sloped walls proportioned to mate with disk seat 735 of valve seat insert 061 (Reference FIG. 87); a flat-bottom blind-depth vertical circular bore concentrically intersecting the top of the part, and penetrating approximately two-thirds of the way through the part, constituting piston shaft gland 741; piston shaft gland 741 further being proportioned to snugly receive piston shaft 731 of valve piston 059 (FIG. 85).

Disk Spring 063—

Referring to FIGS. 84 and 85, this part is preferably a standard off-the-shelf stainless steel disk spring, having a spring constant proportioned such that this part will compress vertically under the applied pneumatic loading conditions, and return when the load is removed.

Valve Base 064—

This part, preferably formed of molded plastic, is described as follows: Referring to FIG. 85, a circular disk member 742, having a vertical axis, and overall diameter equal to that of valve cap 056/156; disk member 742 having a downwardly domed bottom surface 743.

Figure 88:
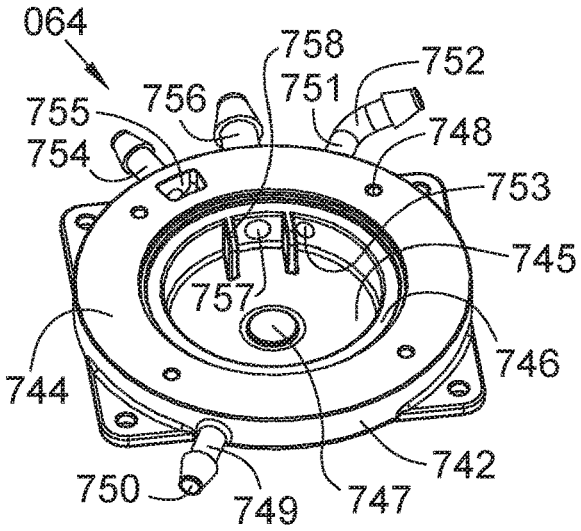
FIG. 88 is a perspective view of valve base 064.

Referring to FIG. 88, disk member 742 having an upper planar surface 744; disk member 742 further containing a radial hydraulic cavity 745, penetrating the top of disk member 742, having an overall diameter slightly smaller than that of pneumatic cavity 715 of valve cap 056/156; hydraulic cavity 745 substantially thinning the interior of disk member 742, leaving a thin bottom shell beneath; a circular two-stage groove 746 occurring at the convergence of hydraulic cavity 745 and upper planar surface 744; two-stage groove 746 being comprised of a shallow circular groove, occurring adjacently below a second shallower circular groove of slightly greater diameter; two-stage groove 746 being proportioned to receive sealing flange 726 of valve diaphragm 058 (Reference FIG. 84) immediately above top plate 732 of valve seat insert 061 (FIG. 84); a circular central protrusion of small diameter extending slightly upward from the interior lower surface of hydraulic cavity 745, creating spring positioning feature 747; spring positioning feature 747 being proportioned to receive disk spring 063; four vertical blind-bottom holes comprising screw ports 748 penetrating upper planar surface 744; screw ports 748 further being internally threaded and spaced to align with screw ports 720 of valve cap 056/156; screw ports 748 further being dimensioned to receive valve body fasteners 055.

Still referring to FIG. 88, one barbed stem, hereafter identified as left-side outlet nozzle 749, horizontally intersecting disk member 742 slightly below its mid-height, being oriented near the 7:30 position, as seen from above; left-side outlet nozzle 749 being proportioned to receive left supply tube 066; a hydraulic port, hereafter identified as left-side outlet port 750, concentrically penetrating the shaft of left-side outlet nozzle 749 and further penetrating the interior wall of hydraulic cavity 745; one barbed stem, hereafter identified as right-side outlet nozzle 751 being proportioned to receive right supply tube 067; the shaft base of right-side outlet nozzle 751 horizontally intersecting disk member 742 slightly below its mid-height, being oriented near the 1:30 position, as seen from above; the shaft of right-side outlet nozzle 751 further including an elbow 752; elbow 752 being proportioned and oriented such that the barbed end of the stem points upward at approximately 25° from horizontal, and away from the longitudinal center plane of the part; elbow 752 further being oriented such that the central axis of the barbed end of its stem occurs within a vertical plane being perpendicular to the longitudinal center plane of the part; a hydraulic port, hereafter identified as right-side outlet port 753, concentrically penetrating the shaft of right-side outlet nozzle 751 and further penetrating the interior wall of hydraulic cavity 745; one barbed stem, hereafter identified as pneumatic nozzle 754, horizontally intersecting disk member 742 slightly below its mid-height, being oriented near the 10:30 position, as seen from above; pneumatic nozzle 754 being proportioned to receive pneumatic tube 050; a connecting port, hereafter identified as pneumatic signal port 755 (See also FIG. 89), concentrically penetrating the shaft of pneumatic nozzle 754; pneumatic signal port 755 further penetrating inward and upward through disk member 742 and intersecting upper planar surface 744 in a rectangular top-view profile positioned and proportioned to compliment rectangular profile 719 of valve cap 056/156 (Reference FIG. 86); one barbed stem, hereafter identified as water inlet nozzle 756, horizontally intersecting disk member 742 slightly below its mid-height, being oriented at the 12 O'clock position, as seen from above; water inlet nozzle 756 being proportioned to receive valve supply tube 068; the central axis of water inlet nozzle 756 further occurring in the longitudinal center plane of the part; a hydraulic port, hereafter identified as water inlet port 757, concentrically penetrating the shaft of water inlet nozzle 756 and further penetrating the interior wall of hydraulic cavity 745; water inlet nozzle 756 further having diameter approximately one and one-half times those of the left-side outlet nozzle 749, right-side outlet nozzle 751, and pneumatic nozzle 754; water inlet port 757 further having diameter approximately one and one-half times those of left-side outlet port 750, right-side outlet port 753, and pneumatic signal port 755.

Still referring to FIG. 88, two short vertical parallel walls, hereafter identified as inlet isolation walls 758, extending inward from the sidewall of hydraulic cavity 745 and upward from the floor of hydraulic cavity 745; the top terminal surfaces of inlet isolation walls 758 being proportioned to mate with the bottom surface of top plate 732 of valve seat insert 061 (FIG. 87); the interior surfaces of inlet isolation walls 758 being proportioned to mate with the exterior cylindrical wall of disk housing 734 of valve seat insert 061 (FIG. 87); inlet isolation walls 758 further being positioned immediately to either side of water inlet port 757.

Figure 89:
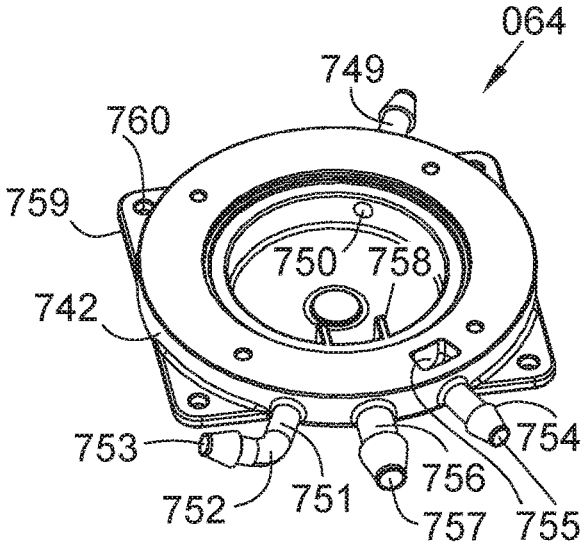
FIG. 89 is an additional perspective view of valve base 064.

Referring to FIG. 89: four thin planar triangular shaped valve mounting tabs 759, each having a centrally disposed vertical through hole, hereafter identified as mounting holes 760; valve mounting tabs 759 being symmetrically positioned exterior to the part, and intersecting disk member 742 near its bottom surface; mounting holes 760 being spaced to align with valve mounting bosses 361 of modified WC lid 201/301; mounting holes 760 further being proportioned to receive valve mounting fasteners 065.

Valve Mounting Fastener 065—

Referring to FIGS. 84 and 85, this part is preferably a standard off-the-shelf stainless steel screw.

Left Supply Tube 066—

Referring to FIG. 81, this part is preferably standard off-the-shelf water supply tubing, cut to length.

Right Supply Tube 067—

Referring to FIG. 81, this part is preferably standard off-the-shelf water supply tubing, cut to length.

Valve Supply Tube 068—

Referring to FIGS. 84 and 85, this part is preferably standard off-the-shelf water supply tubing, cut to length, having material properties that allow it to be sealant bonded into outlet port 359 of modified WC lid 201/301. Alternatively, this part may be a molded component, with elbows and curves formed into the part, to precisely fit the application.

Wet Pivot Shaft 069—

Figure 91:
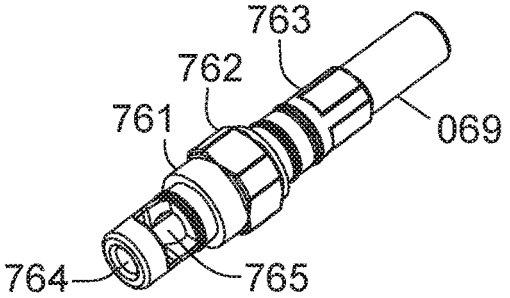
FIG. 91 is a perspective view of wet pivot shaft 069.

This part, preferably formed of stainless steel, is described as follows: Referring to FIG. 91, a small horizontal cylindrical shaft having length about six times its mean diameter; the cylindrical shaft further having a short cylindrical region of greater diameter near the exterior end of the part, creating a lid bearing stem 761; lid bearing stem 761 being further proportioned to bear within wet hinge port 358 of modified WC lid 201/301 (Reference FIG. 5B); immediately adjacent to lid bearing stem 761, toward the interior end of the cylindrical shaft, a short region having a square profile with boldly rounded corners, creating a large key feature 762; a short distance farther towards the interior end of the cylindrical shaft, and slightly interior from the mid-length of the cylindrical shaft, a second region having a smaller square profile with boldly rounded corners, creating a small key feature 763; a circular blind bottom connecting port 764 penetrating the exterior end of the cylindrical shaft with diameter approximately one-half that of the cylindrical shaft; connecting port 764 further having length about one-half the length of the cylindrical shaft; between the exterior end of the cylindrical shaft and lid bearing stem 761, a vertical oval-shaped outlet port 765 penetrating the top of the cylindrical shaft and extending downward to intersect connecting port 764.

Figure 92:
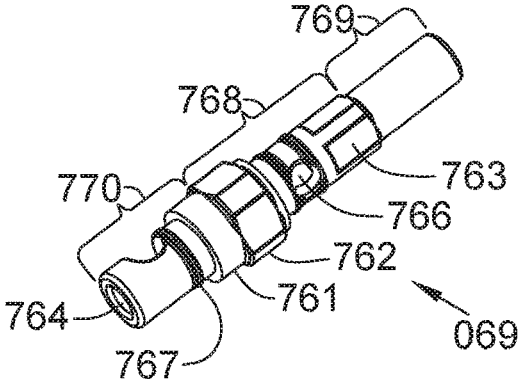

Referring to FIG. 92, between large key feature 762 and small key feature 763, a cylindrical shaped inlet port 766 penetrating the bottom of the cylindrical shaft and intersecting connecting port 764; three positioning bands 767 located on the cylindrical surfaces of the part, proportioned to retain cup seals 070; the region of the cylindrical shaft spanning between, and including, large key feature 762 and small key feature 763 comprising hinge block insert 768; hinge block insert 768 being proportioned to fit three-stage penetration 663 of hinge pivot block 140 (Reference FIG. 72); the interior end of the cylindrical shaft comprising seat insert 769, being proportioned to fit bearing port 605 of modified WC seat 230 (Reference FIG. 60A); the exterior end of the cylindrical shaft, beginning at, and including, lid bearing stem 761, comprising lid insert 770; lid insert 770 being proportioned to fit within wet hinge port 358 of modified WC lid 201/301 (Reference FIG. 5B.).

Cup Seals 070—

Figure 90:
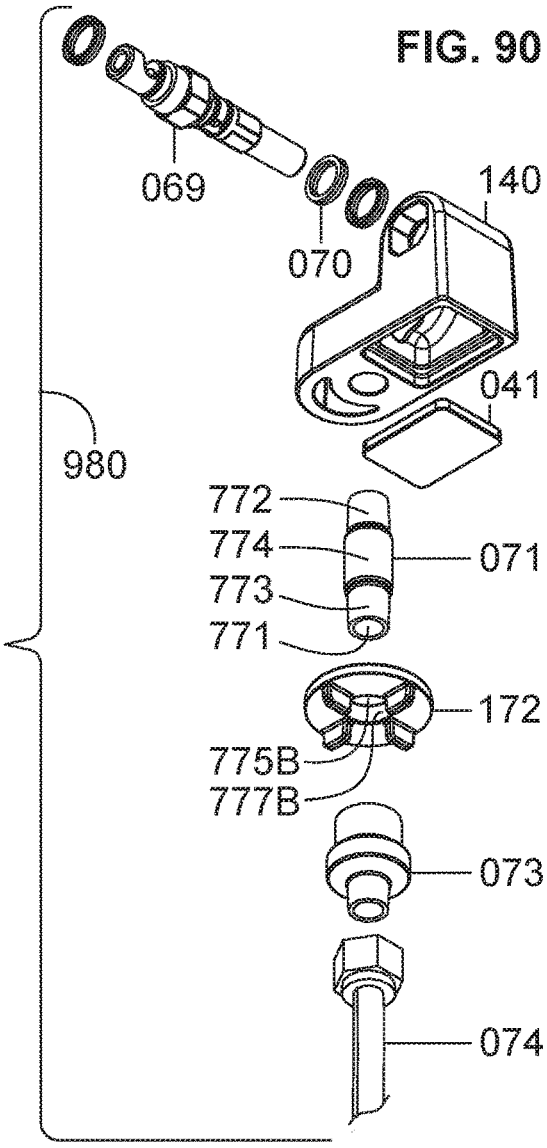
FIG. 90 is a perspective view of the components comprising wet left hinge assembly 980, relatively positioned in an exploded state.

Referring to FIG. 90, these parts, also commonly known as a "Lip Seals", are preferably standard off-the-shelf elastomeric seals, rated for use with water.

Hollow Mounting Stud 071—

This part, very similar to a common pipe nipple, is preferably formed from stainless steel, and has the following features, as illustrated in FIG. 90: A small diameter cylindrical component with vertical axis, and length substantially larger that its diameter, forming the stud body; a fluid port 771 passing completely through the part, concentrically aligned with the stud body; the upper end of the stud body having external tapered threads, hereafter identified as outlet threads 772, proportioned to fit internal tapered threads 665 of hinge pivot block 140 (Reference FIG. 75); the lower end of the stud body having external tapered threads, hereafter identified as inlet threads 773, proportioned to fit pressure reducer 073; the midsection of the stud having a thickened region with slightly greater diameter; the thickened region further having external straight threads, hereafter identified as mounting threads 774 proportioned to receive internal straight threads 777B of thumb-nut 172 (Reference FIG. 90); this component further being proportioned to span through the mounting flange (FLANGE, FIG. 56A) of the water closet (WC, FIG. 56A) this part is intended for use with.

Thumb-Nut 072—

Figure 93:
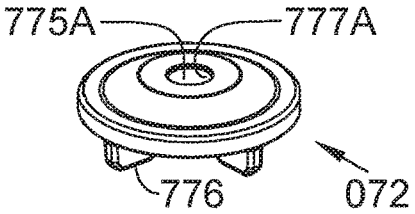

This part is very similar to a thumb-nut that would often be included with a conventional water closet seat and lid assembly. It is preferably formed of molded plastic, and has the following features, as illustrated in FIG. 93: A horizontal circular disk body having a planar bottom surface, and a domed top surface; a vertical through-bore 775A piercing the part, concentrically aligned with the circular disk body; four short thin-wall thumb tabs 776 extending vertically downward from the bottom surface of the circular disk body; thumb tabs 776 being aligned such that their center planes pass through the axis of the circular disk body; thumb tabs 776 further being positioned with radial symmetrically about the axis of the circular disk body; thumb tabs 776 further being proportioned for hand tightening of this part; internal straight threads 777A occurring in through-bore 775A, and being proportioned to receive assembly mounting bolt 039.

Thumb-Nut 172—

This part, preferably formed of molded plastic, is substantially identical to thumb-nut 072, notwithstanding the following differences, as illustrated in FIG. 90: Through-bore 775A and internal straight threads 777A of thumb-nut 072 (Reference FIG. 93) are replaced by a larger diameter through-bore 775B with internal straight threads 777B proportioned to receive mounting threads 774 of hollow mounting stud 071 (Reference FIG. 90.).

Pressure Reducer 073—

Referring to FIG. 90, this part is preferably a standard off-the-shelf inline "street" pressure reducer, having external tapered threads on its inlet shaft, and internal tapered threads in its outlet shaft. Pressure reducer 073 reduces the working pressure of the incoming water supply to the required operational pressure.

System Supply Hose 074—

Referring to FIG. 90, this part is preferably a standard off-the-shelf water closet supply hose, as would typically be used to supply water to any residential water closet.

Auto-Flush Actuator Body 075—

Figure 94:
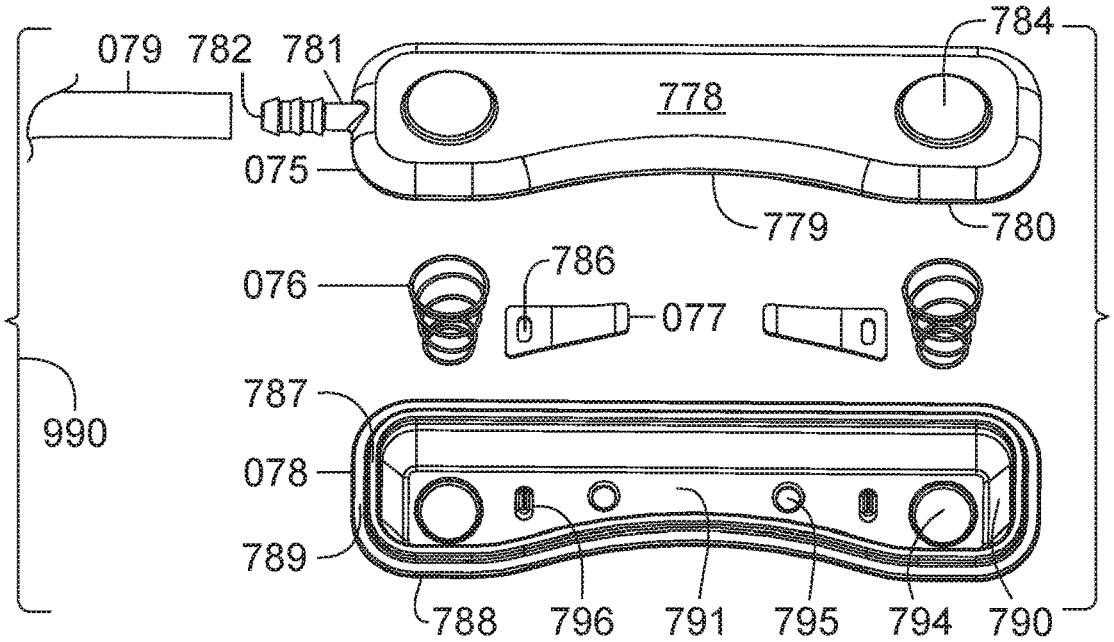

This part, preferably formed of molded plastic, is described as follows: Referring to FIG. 94, a thin horizontal rectangular shaped plate member 778, having rounded corners; within the respective master assembly, the top surface of plate member 778 being positioned and proportioned to mate with with the bottom surface of plate member 325 of modified WC lid 101/201/301 (Reference FIG. 3); plate member 778 having length about five times its width; the forward edge of the rectangular profile further being intersected by a large-radius radial trim 779 with vertical axis, proportioned to compliment radial wall 546 of brake cover 024/124 (Reference FIG. 50); the edges of plate member 778 blending downward into a shallow perimeter wall 780; perimeter wall 780 terminating a short distance below plate member 778 in a common plane, substantially parallel to the top surface of plate member 778; centrally positioned on one end of the part, a barbed stem 781 proportioned to receive pneumatic tube 079; a circular pneumatic outlet port 782 piercing concentrically through barbed stem 781 and continuing through perimeter wall 780.

Figure 95:
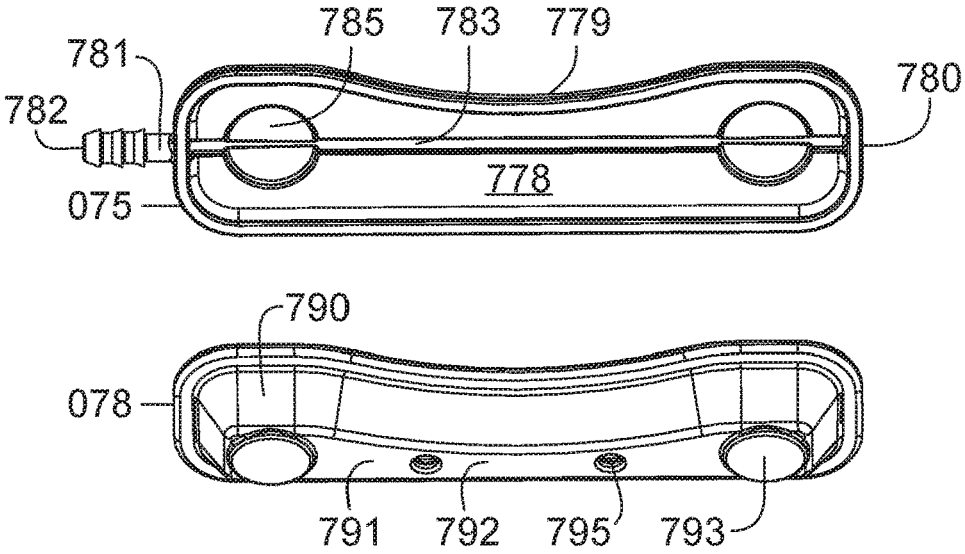

Referring to FIG. 95, a circular groove of very small diameter shallowly intersecting the bottom surface of plate member 778, concentrically aligned with the outlet port, and extending the full length of the part bounded by perimeter wall 780; the circular groove, hereafter identified as outlet port extension groove 783, further being a linear extension of pneumatic outlet port 782; two small diameter cylindrical disks, hereafter identified as positioning protrusions 784 (FIG. 94) extending slightly upward from the top surface of the plate member 778, spaced and proportioned to fit in actuator positioning divots 360 of modified WC lid 201/301 (Reference FIG. 5); two cylindrical spring positioning divots 785 (FIG. 95) shallowly penetrating the bottom surface of plate member 778; spring positioning divots 785 being concentrically aligned with positioning protrusions 784 (FIG. 94) and proportioned to receive conical springs 076.

Conical Springs 076—

As illustrated in FIG. 94, these components are preferably standard off-the-shelf stainless steel conical compression springs, having spring constants approximately two-thirds that of upper brake spring 020.

Auto-Flush Reed 077—

Referring to FIG. 94, this part, preferably cut from thin flexible plastic sheet stock, is described as follows: A very thin, flexible horizontal member, with a top-view profile formed by adjoining a short end segment to a longer end segment through two converging side segments; the side segments being oriented to compliment the proximate curvature of sidewalls 790 of auto-flush diaphragm 078, within the respective master assembly; an aperture, having an oval shape as seen from above, piercing vertically through the part near its wide end, constituting retainer hole 786; retainer hole 786 further being centrally disposed near the wide end of the part; retainer hole 786 further being oriented parallel to the wide end of the part; retainer hole 786 further being proportioned to receive a single reed retainer 796 of auto-flush diaphragm 078; this part further having material properties that will allow the part to flex in response to minor pressure differentials; this part further having material properties that will allow it to seal against the upper surface of floor member 791 of auto-flush diaphragm 078; this part further having material properties that will prevent pressurized air from passing through the part.

Auto-Flush Diaphragm 078—

This part, preferably formed from a low-durometer molded elastomer, is described as follows: Referring to FIG. 94, a thin, very flexible member having an upper mating surface 787 with a top-view profile substantially identical to the lowermost profile of perimeter wall 780 of auto-flush actuator body 075; a thickened ring around the upper perimeter of the part, having a similar top-view profile to upper mating surface 787, substantially creating a mating flange 788 at the top of the part; a receiving groove 789, comprised of a square profile cut being swept around the upper exterior perimeter of mating flange 788; receiving groove 789 being proportioned to receive perimeter wall 780 of auto-flush actuator body 075; inwardly sloped sidewalls 790 extending downward from mating flange 788 in a converging loft of similar top-view profile to upper mating surface 787; sidewalls 790 terminating in a lower thin floor member 791.

Referring to FIG. 95, the bottom surface of floor member 791, hereafter being identified as sub-frame contact surface 792; sub-frame contact surface 792 being positioned and proportioned to mate with actuator contact surface 531 of brake sub-frame 121 (Reference FIG. 44), within the respective open master assembly, with brake sub-frame 121 in the "brake engageable" position (Reference Analog Braking System, Section 5.9); two small circular shaped positioning protrusions 793 extending slightly downward from the bottom surface of floor member 791, spaced and proportioned to fit in positioning divots 533 of brake sub-frame 121 (Reference FIG. 44.).

Referring again to FIG. 94, two shallow cylindrical spring positioning divots 794 intersecting the top surface of floor member 791; spring positioning divots 794 being concentrically aligned with positioning protrusions 793 (FIG. 95) and proportioned to receive conical springs 076; two small-diameter venting ports 795 (FIGS. 94 and 95) vertically piercing floor member 791, and symmetrically spaced about the mid-length of the part; two reed retainers 796 protruding upward a short distance from floor member 791; each reed retainer 796 being positioned approximately midway between a spring positioning divot 794 and the corresponding venting port 795.

Figure 96:
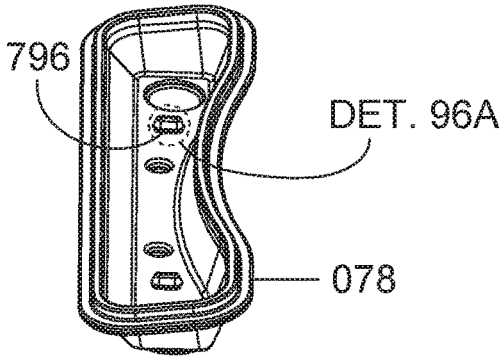
Figure 96A:
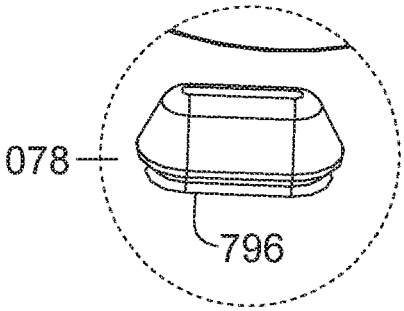

Referring to FIG. 96, and then FIG. 96A, each reed retainer 796 being comprised of a lower stem and an upper tapered retaining bulb; the lower stem having height and top-view profile proportioned to fit retainer hole 786 of auto-flush reed 077 (Reference FIG. 94); the upper tapered retaining bulb having a similar top-view profile to that of the lower stem; compared to the lower stem, the upper tapered retaining bulb having a larger cross section at its lower terminus and a smaller cross section at its upper terminus; referring to FIG. 94, reed retainers 796 further being proportioned to retain auto-flush reeds 077, within the respective master assembly.

This part further being formed of a highly flexible material that will allow auto-flush diaphragm 078 to collapse upwardly when brake sub-frame 121 is rotated into its stored (brake disengaged) position; this part further having material properties that will prevent pressurized air from passing through it; this part further being formed of a material that can be adhesively bonded to auto-flush actuator body 075.

Pneumatic Tube 079—

Referring to FIG. 94, this part is preferably standard off-the-shelf pneumatic tubing, cut to length.

Debris Screen and Bead Rack 080—

Referring to FIG. 183A, this part, preferably formed of molded plastic, is an optional accessory, and includes the following features: Two short vertical sidewalls 796A, symmetrically positioned about the center plane of the part; vertical sidewalls 796A being obliquely oriented to each other, and converging towards the rear of the part; each vertical sidewall 796A having length approximately four times its height; each sidewall further having a radial trim curve 796B at its forward terminus; radial trim curves 796B radially blending between the upper surface and lower surface of each vertical sidewall 796A; within the respective master assembly, the exterior surfaces of vertical sidewalls 796A being parallel to, and offset slightly inward from funnel entry walls 477 of rear cartridge base 008/108 (Reference FIG. 23); within the respective master assembly, the top surfaces of vertical sidewalls 796A being offset slightly downward from the lower surface of ceiling member 392 of upper cartridge segment 102/202 (Reference FIG. 11); within the respective master assembly, the lower surfaces of vertical sidewalls 796A being offset slightly upward from the upper surface of floor member 473 of rear cartridge base 008/108 (Reference FIG. 23); spanning transversely between vertical sidewalls 796A, four small diameter linear horizontal rods, hereafter identified as bead capture rods 796C; bead capture rods 796C being positioned in a rectangular pattern, as viewed from the side of the part, such that the two uppermost bead capture rods 796C intersect vertical sidewalls 796A near their top edge and the two lowermost bead capture rods 796C intersect vertical sidewalls 796A near their bottom edge; bead capture rods 796C further being positioned such that small chemical beads residing within the interstitially space between bead capture rods 796C will be retained by bead capture rods 796C (Reference BEADS, FIG. 183B); the rearmost two bead capture rods 796C occurring near the mid-length of vertical sidewalls 796A; the foremost two bead capture rods 796C occurring near the forward edge of vertical sidewalls 796A; the uppermost rear bead capture rod 796C further being interrupted at its center by a lofted arc 796D, laterally centered on the part; lofted arc 796D sweeping horizontally rearward, and then returning horizontally forward, and meeting the uppermost rear bead capture rod 796C tangentially at both ends; lofted arc 796D further being proportioned such that a single small chemical bead may pass vertically between the two uppermost bead capture rods 796C; this part further being proportioned to fit within the interior of removable dry cartridge 855 (Reference FIGS. 183C, 183D), with removable dry cartridge 855 in any state.

4. Description of the Assemblies

Preface—

Similar to the numbering scheme applied to the previously described parts, the assemblies are each assigned a three-digit numeric identifier of the format, "AXX", where "A" represents a progression indicator. Thus, removable dry cartridge 855 will be similar in form and function to fixed wet cartridge 955.

The five master assemblies presented here, each representing a unique embodiment of the present invention, are respectively assigned consecutive numeric identifiers from 1001 through 1005.

Simple Hinge Assembly 800—

As illustrated in FIG. 99, this assembly is comprised of the following components: one Hinge Cylinder 038; one assembly mounting bolt 039; one hinge pivot block 040; one hinge pin 044; one thumb-nut 072.

Hinged Dry Cartridge Base 852—

As illustrated in FIG. 25, this assembly is comprised of the following components: one forward cartridge base 006; one cartridge hinge 007; one rear cartridge base 008.

Hinged Wet Cartridge Base 952—

As illustrated in FIG. 26, this assembly is comprised of the following components: one forward cartridge base 106; one cartridge hinge 007; one rear cartridge base 108.

Removable Dry Cartridge 855—

As illustrated in FIG. 29, this assembly is comprised of the following assemblies and components: one upper cartridge segment 102; one right side shield 003; one left side shield 004; two cartridge springs 005; one cartridge lens 009; seven cartridge fasteners 010; two cartridge ballasts 011; two ballast retainers 012; one hinged dry cartridge base 852. (Note: All exterior components of removable dry cartridge 855 must be dishwasher safe, such that after assembly, removable dry cartridge 855 may be cleansed in a standard residential dishwasher, without damage to any component.)

Fixed Wet Cartridge 955—

As illustrated in FIG. 30, this assembly is comprised of the following assemblies and components: one upper cartridge segment 202; one right side shield 103; one left side shield 104; seven cartridge fasteners 010; two cartridge ballasts 111; two ballast retainers 012; one hinged wet cartridge base 952.

Sliding Pivot Plate Assembly 860—

As illustrated in FIG. 31, this assembly is comprised of the following components: one pivot slide spring 013; one pivot plate 014; four pivot plate retainers 015; four pivot plate fasteners 016.

Fixed Pivot Plate Assembly 960—

As illustrated in FIG. 34, this assembly is comprised of the following components: one pivot plate 114; four pivot plate fasteners 016.

Left Spray Nozzle Assembly 965A—

As illustrated in FIG. 81, this assembly is comprised of the following components: one pivot jet 051; one O-ring seal 052; one disk seal 054; one left supply tube 066.

Right Spray Nozzle Assembly 965B—

As illustrated in FIG. 81, this assembly is comprised of the following components: one pivot jet 051; one O-ring seal 052; one disk seal 054; one right supply tube 067.

Incremental Brake Assembly 870—

As illustrated in FIG. 38, this assembly is comprised of the following components: one pivot rod 017; two pivot rod retainers 018; four retainer fasteners 019; one upper brake spring 020; one brake sub-frame 021; one brake lever 022; one lower brake spring 023; one brake cover 024; four brake cover fasteners 025; two cartridge spout seals 026.

Analog Brake Assembly 970—

As illustrated in FIG. 39, this assembly is comprised of the following components: one pivot rod 017; two pivot rod retainers 018; four retainer fasteners 019; one brake sub-frame 121; one brake lever 122; one lower brake spring 023; one brake cover 124; four brake cover fasteners 025; two cartridge spout seals 026; one brake pad 043.

Dry Seat Assembly 875—

As illustrated in FIG. 97, this assembly is comprised of the following components: one modified WC seat 130; one lower shaft housing 031; four shaft housing fasteners 032.

Wet Seat Assembly 975—

As illustrated in FIG. 98, this assembly is comprised of the following components: one modified WC seat 230; one lower shaft housing 131; four shaft housing fasteners 032.

Dry Left Hinge Assembly 880—

As illustrated in FIG. 64, this assembly is comprised of the following components: one hinge cylinder cap 033; one hinge shaft 034; two wiper seals 035; one O-ring seal 036; one hinge cylinder 138; one assembly mounting bolt 039; one hinge pivot block 040; one thumb-nut 072; slow-close fluid 053 (not illustrated in FIG. 64).

Wet Left Hinge Assembly 980—

As illustrated in FIG. 90, this assembly is comprised of the following components: one hinge pivot block 140; one hinge block floor plate 041; one wet pivot shaft 069; three cup seals 070; one hollow mounting stud 071; one thumb-nut 172; one pressure reducer 073; one system supply hose 074.

Incremental Right Hinge Assembly 885—

Figure 100:
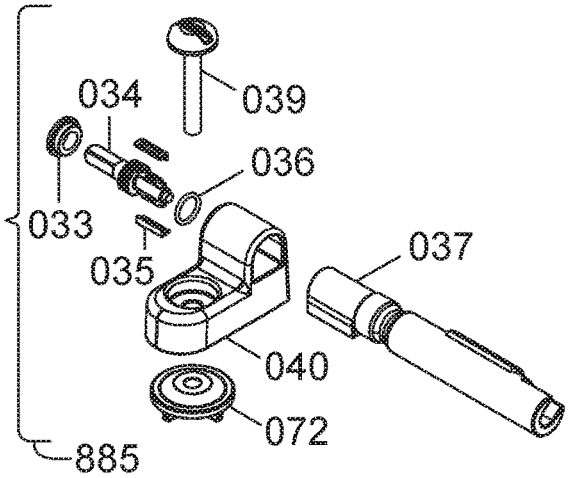

As illustrated in FIG. 100, this assembly is comprised of the following components: one hinge cylinder cap 033; one hinge shaft 034; two wiper seals 035; one O-ring seal 036; one brake shaft 037; one assembly mounting bolt 039; one hinge pivot block 040; one thumb-nut 072; slow-close fluid 053 (not illustrated in FIG. 100).

Analog Right Hinge Assembly 985—

Figure 101:
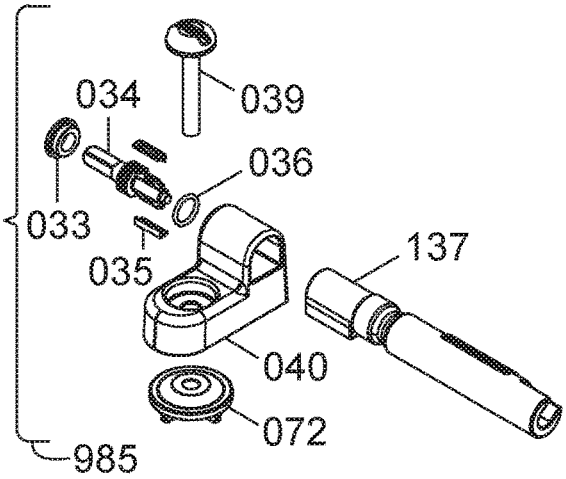

As illustrated in FIG. 101, this assembly is comprised of the following components: one hinge cylinder cap 033; one hinge shaft 034; two wiper seals 035; one O-ring seal 036; one brake shaft 137; one assembly mounting bolt 039; one hinge pivot block 040; one thumb-nut 072; slow-close fluid 053 (not illustrated in FIG. 101).

Manual Actuator 890—

As illustrated in FIG. 78, this assembly is comprised of the following components: one flush button cap 045; one flush button diaphragm 046; one flush button housing 047; one adhesive pad 048; one threaded elbow 049; one pneumatic tube 050.

Automatic Actuator 990—

As illustrated in FIG. 94, this assembly is comprised of the following components: one auto-flush actuator body 075; two conical springs 076; two auto-flush reeds 077; one auto-flush diaphragm 078; one pneumatic tube 079.

Manual Flush Valve 895—

As illustrated in FIG. 84, this assembly is comprised of the following components: four valve body fasteners 055; one valve cap 056; one valve gasket 057; one valve diaphragm 058; one valve piston 059; one valve cup seal 060; one valve seat insert 061; one valve disk 062; one disk spring 063; one valve base 064; four valve mounting fasteners 065; one valve supply tube 068.

Automatic Flush Valve 995—

As illustrated in FIG. 85, this assembly is comprised of the following components: four valve body fasteners 055; one valve cap 156; one valve gasket 057; one valve diaphragm 058; one valve piston 059; one valve cup seal 060; one valve seat insert 061; one valve disk 062; one disk spring 063; one valve base 064; four valve mounting fasteners 065; one valve supply tube 068.

Embodiment 1

Figure 102:
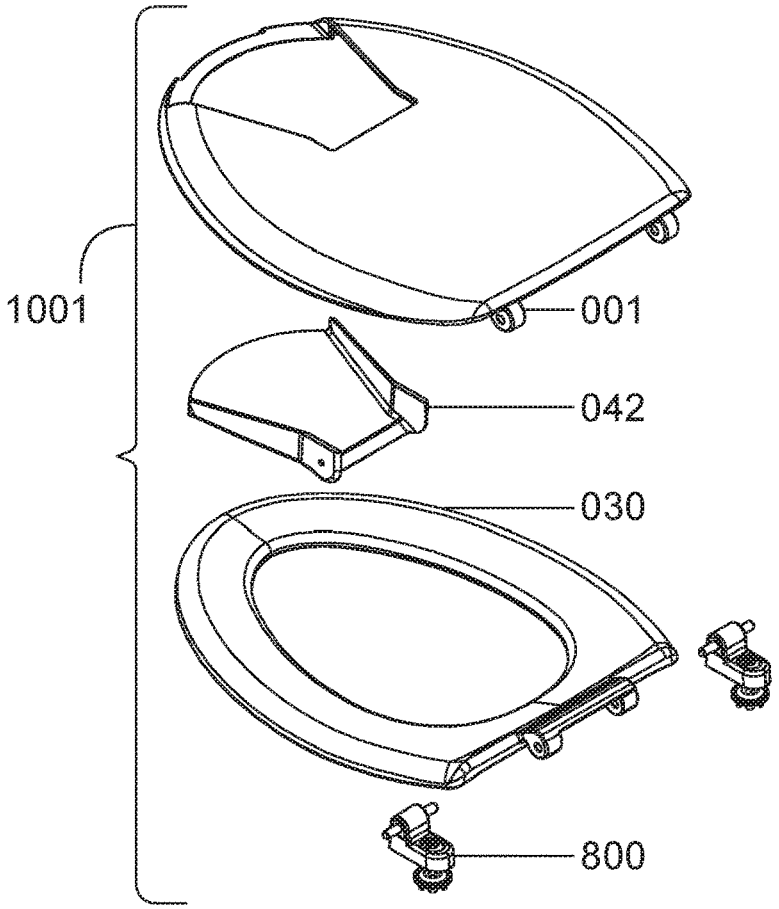

As illustrated in FIG. 102, Embodiment 1, hereafter identified as master assembly 1001, is comprised of the following assemblies and components: one modified WC lid 001; one urine pan 042; one modified WC seat 030; two simple hinge assemblies 800. FIGS. 103 and 104 further illustrate master assembly 1001 in its assembled and stored state.

Embodiment 2

As illustrated in FIG. 105, Embodiment 2, hereafter identified as master assembly 1002, is comprised of the following assemblies and components: one receptacle lid and funnel 002; one modified WC lid 001; one urine pan 042; one modified WC seat 030; two simple hinge assemblies 800. FIGS. 106 and 107 further illustrate master assembly 1002 in its assembled state with receptacle lid and funnel 002 open.

Embodiment 3

As illustrated in FIG. 108, Embodiment 3, hereafter identified as master assembly 1003, is comprised of the following assemblies and components: one removable dry cartridge 855; one modified WC lid 101; two sliding pivot plate assemblies 860; one left façade 027; one right façade 028; eight façade fasteners 029; one incremental brake assembly 870; one dry seat assembly 875; one dry left hinge assembly 880; one incremental right hinge assembly 885. FIGS. 109 and 110 further illustrate master assembly 1003 in its assembled state with removable dry cartridge 855 open.

Embodiment 4

As illustrated in FIG. 111, Embodiment 4, hereafter identified as master assembly 1004, is comprised of the following assemblies and components: one fixed wet cartridge 955; one manual actuator 890; one modified WC lid 201; two fixed pivot plate assemblies 960; one manual flush valve 895; one left spray nozzle assembly 965A; one right spray nozzle assembly 965B; one left façade 127; one right façade 128; eight façade fasteners 029; one incremental brake assembly 870; one wet seat assembly 975; one wet left hinge assembly 980; one incremental right hinge assembly 885. FIGS. 112 and 113 further illustrate master assembly 1004 in its assembled state with fixed wet cartridge 955 open. FIG. 112A illustrates pivot jet 051 penetrating nozzle aperture 447 of right side shield 103 of fixed wet cartridge 955, affecting the mechanism for spray rinse of fixed wet cartridge 955. Locating band 711 of pivot jet 051 constrains right side shield 103 in relative position when right side shield 103 flexes as fixed wet cartridge 955 is opened and closed.

Embodiment 5

As illustrated in FIG. 114, Embodiment 5, hereafter identified as master assembly 1005, is comprised of the following assemblies and components: one fixed wet cartridge 955; one modified WC lid 301; two fixed pivot plate assemblies 960; one automatic flush valve 995; one left spray nozzle assembly 965A; one right spray nozzle assembly 965B; one automatic actuator 990; one left façade 127; one right façade 128; eight façade fasteners 029; one analog brake assembly 970; one wet seat assembly 975; one wet left hinge assembly 980; one analog right hinge assembly 985. FIGS. 115 and 116 further illustrate master assembly 1005 in its assembled state with fixed wet cartridge 955 open. Similar to FIG. 112A, FIG. 115A again illustrates pivot jet 051 penetrating nozzle aperture 447 of right side shield 103 of fixed wet cartridge 955. Again, locating band 711 of pivot jet 051 constrains right side shield 103 in relative position when right side shield 103 flexes as fixed wet cartridge 955 is opened and closed.

5. Description of the Functional Systems and Usage

For each of the embodiments (master assemblies) of the current invention presented in this specification, the functional systems are described below, followed by a description of usage, as best contemplated by the inventor.

5.1 Functional Systems of Master Assembly 1001—

Master Assembly 1001, as previously illustrated in FIGS. 102, 103, and 104, features the following functional systems:

Assembly Hinge Pivot System—

FIG. 117 illustrates components of master assembly 1001 associated with the right side (as identified from the user's perspective) of the assembly hinge pivot system, in a partially exploded state, to clearly depict the relationship between components affecting this system. Similarly, FIG. 118 illustrates components of master assembly 1001 associated with the left side of the assembly hinge pivot system, in a partially exploded state, distinctly opposed to the exploded state of FIG. 117.

Referring to both FIGS. 117 and 118, the hinge cylinder ports 660 of hinge pivot blocks 040 snugly receive body members 654 of hinge cylinders 038; when assembled, each body member 654 of each hinge cylinder 038 is constrained from lateral or rotational movement, with respect to the respective hinge pivot block 040. During assembly, the interior end of each hinge pin 044 will be solvent welded into the respective hinge pin receptacle 656 (FIG. 117) of hinge cylinders 038; these solvent welds will constrain hinge pins 044 with respect to hinge cylinders 038, and thus with respect to hinge pivot blocks 040. The exterior ends of hinge pins 044 insert loosely into hinge bearing ports 341 of Modified WC lid 001, allowing modified WC lid 001 to pivot freely about hinge pins 044. Bearing stems 655 of hinge cylinders 038 insert into hinge bearing ports 589 of modified WC seat 030, allowing modified WC seat 030 to pivot freely about the Bearing stems 655 of hinge cylinders 038.

FIG. 119 illustrates master assembly 1001 installed on a fixed water closet (WC) for use. FIG. 120 represents a localized section view passing through the lateral center of the right hinge pivot block 040 of FIG. 119, to illustrate the relationship between assembly hinge pivot system components. (Note: A similar section taken through the lateral center of the left hinge pivot block 040 would be substantially identical in illustration to FIG. 120.) An assembly mounting bolt 039 and thumb-nut 072 clamps each hinge pivot block 040 into the respective seat assembly mounting hole (HOLE) of the water closet (WC), substantially constraining hinge pivot blocks 040 from movement, and thus hinge cylinder 038.

FIG. 121 illustrates master assembly 1001 mounted to a water closet (WC) for use. Receptacle opening 328 of modified WC lid 101 exposes urine pan 042, immediately below. Contact post 336 and finger openings 339 of modified WC lid 101 are easily accessed for operation. Referring to FIG. 122, with hinge pivot blocks 040 fully constrained (as depicted in FIG. 120), modified WC lid 101 can be freely rotated about hinge pivot axis 340A, as illustrated by arrows A1. Likewise, with hinge pivot blocks 040 fully constrained, modified WC seat 030 can be freely rotated about hinge pivot axis 340A, as illustrated by arrows A2.

Urinal System—

FIG. 123 depicts a cross section of the mounted master assembly 1001 of FIG. 119. The section, being taken through the longitudinal mid-plane of the assembly, does not intersect the previously described assembly hinge pivot system, but the intersected hinge pivot axis 340A of modified WC lid 001 indicates the rotational center for the assembly. Urine pan 042, solvent welded to modified WC lid 001, occurs directly below the receptacle opening 328 of modified WC lid 001, substantially filling the void caused by receptacle opening 328. Floor member 670 of urine pan 042 bridges over, and substantially shields the seat loop 579 of modified WC seat 030. Urine deposited into receptacle opening 328 will initially contact floor member 670 of urine pan 042. The urine will then flow inward and downward over floor member 670, over the sweep lip 677 of urine pan 042, through the receptacle opening 583 of modified WC seat 030, and into the waste receptacle (RECEPTACLE) of the water closet (WC) as indicated by arrows A3 (FIG. 123).

5.2 Usage of Master Assembly 1001

Urinal Use for Short Users—

With master assembly 1001 securely mounted on a water closet (WC), as illustrated in FIG. 124A, short users may urinate directly into the receptacle opening 328 of modified WC lid 001 in its closed position.

Urinal Use for Tall Users—

Referring to FIG. 124B, taller users may employ master assembly 1001 by first rotating modified WC lid 001 open, as illustrated by arrow A4. To do so, the operator should use his fingers to lift upward on contact post 336 of modified WC lid 001, while modified WC seat 030 remains closed. The taller operator should then rotate modified WC lid 001 to an angle appropriate to his height, such that receptacle opening 328 of modified WC lid 001 is in close proximity to, and slightly below, the operator's groin, as illustrated in FIG. 124C. Referring to FIG. 124C, with one hand (right hand illustrated), the operator should constrain modified WC lid 001 at the selected rotational angle. The operator may utilize his other hand (left hand illustrated), to aid while urinating into the receptacle opening 328 of modified WC lid 001. After urination, the operator should lower the modified WC lid 001: with his fingers still touching contact post 336 of modified WC lid 001, the user should control the downward rotation of modified WC lid 001 in the direction of arrow A5 (FIG. 124B), until modified WC lid 001 comes to rest on modified WC seat 030, as illustrated in FIG. 124B.

Urinal Use for Pets—

Referring to FIG. 125, pets may employ master assembly 1001 with modified WC lid 001 in the closed position. The pet should stand on the plate member 325 of modified WC lid 001, facing away from the receptacle opening 328 of modified WC lid 001 as illustrated. The pet should urinate into the receptacle opening 328 of modified WC lid 001.

Seated Use—

Seated use of master assembly 1001 is substantially identical to that for a standard water closet seat and lid assembly: Referring to FIG. 126A, the operator should first rotate modified WC lid 001 open, as illustrated by arrow A6. To do so, the operator should use his (her) fingers to lift upward on contact post 336 of modified WC lid 001, while modified WC seat 030 remains closed. The operator should rotate modified WC lid 001 to its extreme open position, such that modified WC lid 001 rests on the water tank (TANK) of the water closet (WC), as illustrated in FIG. 126B. The operator may then sit on modified WC seat 030, for seated use of master assembly 1001, as illustrated in FIG. 126C.

Toilet Cleaning Access—

Modified WC seat 030 may also be raised, for cleaning of the water closet (WC), or for other purposes. Beginning with modified WC lid 001 in its extreme open position, as depicted in FIG. 126B, the operator may rotate modified WC seat 030 open, as illustrated by arrow A7, in FIG. 126D. To do so, the operator should use his fingers to lift upward on the forward edge of the seat loop 579, of modified WC seat 030, as shown in FIG. 126D, and rotate modified WC seat 030 upward to its extreme open position, at which modified WC seat 030 will rest on modified WC lid 001, as illustrated in FIG. 126F.

Alternatively, with modified WC lid 001 in the closed position, as illustrated in FIG. 126E, the operator may rotate modified WC lid 001 and modified WC seat 030 open together, in the direction of arrow A8. To do so, the operator should use his fingers to lift upward on the forward edge of the seat loop 579, of modified WC seat 030, as shown in FIG. 126E, and rotate both modified WC lid 001 and modified WC seat 030 open, to their extreme open positions, as previously described and as illustrated in FIG. 126F.

5.3 Functional Systems of Master Assembly 1002—

Master assembly 1002, as previously illustrated in FIGS. 105, 106, and 107, features the following functional systems.

Assembly Hinge Pivot System—

The assembly hinge pivot system of master assembly 1002 is identical in components and function to that for master assembly 1001, as described in Assembly Hinge Pivot System, Section 5.1.

Urinal System—

The urinal system of master assembly 1002 is similar to the urinal system of master assembly 1001 (as described in Urinal System, Section 5.1), notwithstanding the addition of receptacle lid and funnel 002. FIG. 127 illustrates master assembly 1002 mounted to a water closet (WC), with receptacle lid and funnel 002 in the open position. Urine pan 042 can be seen directly below the receptacle opening 328 of modified WC lid 001. Contact post 336 and finger openings 339 of modified WC lid 001 are easily accessed for operation. FIG. 128 represents a top view of the master assembly 1002 mounted to a water closet (WC), with receptacle lid and funnel 002 in the closed position.

FIG. 129 represents a section view of FIG. 128, through section plane 129, which passes directly through funnel pivot axis 388A of receptacle lid and funnel 002. FIG. 129A, a detail view from FIG. 129, illustrates a pivot button 388 of receptacle lid and funnel 002, nesting within a hemispherical divot 676 of urine pan 042, affecting the pivot joint for receptacle lid and funnel 002 to rotate with respect to urine pan 042.

FIG. 130 illustrates a cross section of the mounted master assembly 1002, through section plane 130 of FIG. 128, the longitudinal mid-plane of the assembly. Modified WC lid 001, modified WC seat 030, and urine pan 042 are situated identically to their positions as illustrated in FIG. 123 (a comparable section through master assembly 1001). Receptacle lid and funnel 002 is shown in its closed position.

Referring to FIG. 130A, with receptacle lid and funnel 002 in the closed position, the step down extension 375 of receptacle lid and funnel 002 is in close proximity to contoured rear surface 332 (the rear boundary of receptacle opening 328) of modified WC lid 001. The rearmost lower surface of sweep lip 677 of urine pan 042 contacts the upper surface of radial sweep 389 of receptacle lid and funnel 002.

FIG. 131, similar to FIG. 130, illustrates a cross section of the mounted master assembly 1002, through the same section plane as FIG. 130, the longitudinal mid-plane of the assembly. Comparing to FIG. 130, receptacle lid and funnel 002 in FIG. 131 has been rotated clockwise about funnel pivot axis 388A to its extreme open position, uncovering receptacle opening 328 of modified WC lid 001, and urine pan 042 immediately below. Referring to FIG. 131, urine deposited into receptacle opening 328 will initially contact the floor member 670 of urine pan 042. As indicated by arrows A9, the urine will then flow inward and downward over floor member 670 and sweep lip 677 of urine pan 042, into pivoting urine funnel 376 of receptacle lid and funnel 002. The urine will exit master assembly 1002 through funnel exit 386 of receptacle lid and funnel 002, as it enters the waste receptacle (RECEPTACLE) of the water closet (WC), as indicated by arrow A10 (FIG. 131).

Referring to FIG. 131A, with receptacle lid and funnel 002 in the open position, the foremost edge of step down extension 375 of receptacle lid and funnel 002 is illustrated in very close proximity to contoured rear surface 332 of modified WC lid 001. In this regard, contoured rear surface 332 effectively acts as a rotational hard stop limiting the rotational travel of receptacle lid and funnel 002. Similar to FIG. 130A, the lower surface of sweep lip 677 of urine pan 042 contacts the upper surface of radial sweep 389 of receptacle lid and funnel 002, substantially sealing the previously described urine flow path.

5.4 Usage of Master Assembly 1002

Urinal Use for Short Users—

Referring to FIG. 132A, with master assembly 1002 securely mounted on a water closet (WC), the operator should begin by rotating receptacle lid and funnel 002 open, as indicated by arrow A11. To do so, the operator should use his fingers to lift upward on the lower edge of perimeter lip 367 of receptacle lid and funnel 002, while modified WC lid 001 and modified WC seat 030 remain closed. The operator should rotate receptacle lid and funnel 002 to its extreme open position. Frictional forces will hold receptacle lid and funnel 002 in its open position, as illustrated in FIG. 132B.

With receptacle lid and funnel 002 in its open position, short users may urinate directly into the receptacle opening 328 of modified WC lid 001 in its closed position, as illustrated in FIG. 132B. The user should then rotate receptacle lid and funnel 002 closed, as indicated by arrow A12 in FIG. 132C. To do so, the operator should use his fingers to press lightly downward on receptacle lid and funnel 002, on or near perimeter blend radius 367A, as illustrated in FIG. 132C, until receptacle lid and funnel 002 comes to rest in its closed position.

Urinal Use for Tall Users—

Tall users should begin by rotating receptacle lid and funnel 002 to the open position, as described above for short users, and as illustrated in FIG. 132A. Frictional forces will hold receptacle lid and funnel 002 in its open position. Next, the tall user should rotate modified WC lid 001 open, as indicated by arrow A13 in FIG. 132D. To do so, the operator should use his fingers to lift upward on contact post 336 of modified WC lid 001, while modified WC seat 030 remains closed. The taller operator should then rotate modified WC lid 001 to an angle appropriate to his height, such that receptacle opening 328 of modified WC lid 001 is in close proximity to, and slightly below, the operator's groin, as illustrated in FIG. 132E. Referring to FIG. 132E, with one hand (right hand illustrated), the operator should constrain modified WC lid 001 at the selected rotational angle. The operator may utilize his other hand (left hand illustrated), to aid while urinating into the receptacle opening 328 of modified WC lid 001. After urination, the operator should lower modified WC lid 001: with his fingers still touching contact post 336 of modified WC lid 001, the user should control the downward rotation of modified WC lid 001 in the direction of arrow A14 (FIG. 132D), until modified WC lid 001 comes to rest on modified WC seat 030, as illustrated in FIG. 132D.

Seated Use—

Seated use of master assembly 1002 is substantially identical to that for master assembly 1001, (Reference Seated Use, Section 5.2.) Referring to FIG. 133A, the operator should first rotate modified WC lid 001 open, as illustrated by arrow A15. To do so, the operator should use her (his) fingers to lift upward on contact post 336 of modified WC lid 001, while modified WC seat 030 remains closed. The operator should rotate modified WC lid 001 to its extreme open position, such that modified WC lid 001 rests on the water tank (TANK) of the water closet (WC), as illustrated in FIG. 133B. The operator may then sit on modified WC seat 030, for seated use of master assembly 1002, as illustrated in FIG. 133C.

Toilet Cleaning Access—

Modified WC seat 030 may also be raised, for cleaning of the water closet (WC), or for other purposes. Beginning with modified WC lid 001 in its extreme open position, as depicted in FIG. 133B, the operator may rotate modified WC seat 030 open, as illustrated by arrow A16, in FIG. 133D. To do so, the operator should use his fingers to lift upward on the forward edge of the seat loop 579, of modified WC seat 030, as shown in FIG. 133D, and rotate modified WC seat 030 upward to its extreme open position, at which modified WC seat 030 will rest on modified WC lid 001, as illustrated in FIG. 133F.

Alternatively, with modified WC lid 001 in the closed position, as illustrated in FIG. 133E, the operator may rotate modified WC lid 001 and modified WC seat 030 open together, in the direction of arrow A17. To do so, the operator should use his fingers to lift upward on the forward edge of seat loop 579, of modified WC seat 030, as shown in FIG. 133E, and rotate both modified WC lid 001 and modified WC seat 030 open, to their extreme open positions, as illustrated in FIG. 133F.

5.5 Functional Systems of Master Assembly 1003—

Master assembly 1003, as previously illustrated in FIGS. 108, 109, and 110, features the following functional systems:

Assembly Hinge Pivot System—

FIG. 134 illustrates components of master assembly 1003 associated with the right side (as identified from the user's perspective) of the assembly hinge pivot system, in a partially exploded state, to clearly depict the relationship between components affecting this system. Similarly, FIG. 135 illustrates components of master assembly 1003 associated with the left side of the assembly hinge pivot system, in a partially exploded state, distinctly opposed to the exploded state of FIG. 134.

Referring to FIG. 134, hinge cylinder port 660 of the right side hinge pivot block 040 snugly receives slow-close cylinder 642 of brake shaft 037; when assembled, slow-close cylinder 642 of brake shaft 037 is constrained from lateral or rotational movement, with respect to the right side hinge pivot block 040. Referring to FIG. 135, the hinge cylinder port 660 of the left side hinge pivot block 040 snugly receives slow-close cylinder 642 of hinge cylinder 138; when assembled, slow-close cylinder 642 of hinge cylinder 138 is constrained from lateral or rotational movement, with respect to the left side hinge pivot block 040.

Referring to FIG. 135, hinge bearing port 342 of modified WC lid 101 loosely receives the cylindrical shaped bearing stem 657 of hinge cylinder 138, allowing modified WC lid 101 to pivot freely about bearing stem 657 of hinge cylinder 138. Referring to FIG. 134, the keyed bearing port 343 of modified WC lid 101 snugly receives the key shank 632 of the right side hinge shaft 034, effectively constraining the rotation of modified WC lid 101, with respect to the right side hinge shaft 034; in its assembled state, the rotation of right side hinge shaft 034 being dampened within slow-close cylinder 642 of brake shaft 037 by the slow-close rotational dampening system, as described below.

Referring to FIG. 134, the cylindrical shaped solid shaft 647 of brake shaft 037 loosely fits right bearing surface 595 of modified WC seat 130 and right bearing surface 612 of lower shaft housing 031, allowing modified WC seat 130 and lower shaft housing 031 (and thus, dry seat assembly 875) to pivot freely about solid shaft 647 of brake shaft 037. Referring to FIG. 135, key shank 632 of the left side hinge shaft 034 snugly fits keyway 604 of modified WC seat 130 and keyway 622 of lower shaft housing 031, effectively constraining the rotation of modified WC seat 130 and lower shaft housing 031 (and thus, dry seat assembly 875) with respect to the left side hinge shaft 034; in its assembled state, the rotation of the left side hinge shaft 034 being dampened within slow-close cylinder 642 of hinge cylinder 138, by the slow-close rotational dampening system, as described below.

Slow-Close Rotational Dampening System—

FIG. 136 illustrates a cutaway of master assembly 1003 installed on a fixed water closet (WC) for use, with modified WC lid 101 and dry seat assembly 875 both in the closed position.

FIG. 137 represents a jogged section view passing through right hinge pivot block 040 of FIG. 136, to illustrate the relationship between the right side assembly hinge pivot system components. As illustrated in FIG. 137, an assembly mounting bolt 039 and thumb-nut 072 clamps the right side hinge pivot block 040 into the respective seat assembly mounting hole (HOLE) of the water closet (WC), substantially constraining the right side hinge pivot block 040 from movement, and thus brake shaft 037. The components within hydraulic chamber 644 of brake shaft 037 affect the slow-close rotational dampening function for modified WC lid 101, as described below.

Similar to FIG. 137, FIG. 138 represents a jogged section view passing through left hinge pivot block 040 of FIG. 136, to illustrate the relationship between the left side assembly hinge pivot system components. As illustrated in FIG. 138, an assembly mounting bolt 039 and thumb-nut 072 clamps the left side hinge pivot block 040 into the respective seat assembly mounting hole (HOLE) of the water closet (WC), substantially constraining the left side hinge pivot block 040 from movement, and thus hinge cylinder 138. Note that FIGS. 137 and 138 appear virtually identical in illustration, since brake shaft 037 and hinge cylinder 138 share a common slow-close cylinder 642. The components within hydraulic chamber 644 of hinge cylinder 138 affect the slow-close rotational dampening function for dry seat assembly 875.

FIG. 137A represents a detail view from FIG. 137, focusing on the right side assembly hinge pivot system components associated with the slow-close rotational dampening of modified WC lid 101. Within the hydraulic chamber 644 of brake shaft 037, hinge shaft 034 is positioned in its extreme counterclockwise rotational position where it resides when modified WC lid 101 is closed, as illustrated in FIG. 136. Wiper seal posts 638 of hinge shaft 034 are situated within the slide windows 641 of wiper seals 035. Wiper seals 035 are rotationally positioned at their extreme clockwise rotational position, with respect to hinge shaft 034, such that planar members 640 of wiper seals 035 are in contact with wiper arms 635 and wiper seal posts 638 of hinge shaft 034, substantially sealing hydraulic ports 636 of hinge shaft 034. The planar members 640 of wiper seals 035 are rotationally positioned directly between shear fins 646 of brake shaft 037, and wiper seal posts 638 of hinge shaft 034. Slow-close fluid 053 substantially fills the interstitial space between the components, within hydraulic chamber 644 of brake shaft 037.

FIG. 137B represents a detail progression from FIG. 137A, after modified WC lid 101 has been rotated to a slightly open position (Clockwise, as indicated by arrow A18, FIG. 137), resulting in the slight clockwise rotation of hinge shaft 034, as illustrated by comparison of FIGS. 137A and 137B. Comparison of FIGS. 137A and 137B further illustrates that wiper seals 035 do not rotate during this progression. Referring to FIG. 137B, hinge shaft 034 is rotationally positioned such that wiper seal posts 638 of hinge shaft 034 occur at the clockwise extremity of slide windows 641 of wiper seals 035. With the components in these relative positions, planar members 640 of wiper seals 035 no longer seal hydraulic ports 636 of hinge shaft 034.

Referring to FIG. 137B, as modified WC lid 101 is rotated open further (Clockwise, as indicated by arrow A18, FIG. 137), it will result in the clockwise rotation of hinge shaft 034 and wiper seals 035, as depicted by arrow A20 (FIG. 137B); the slow-close fluid 053 that fills the interstitial spaces of hydraulic chamber 644 of brake shaft 037 will remain relatively static during this rotation, being practically constrained by shear fins 646 of brake shaft 037; during the rotation, the slow-close fluid 053 will transfer through hydraulic ports 636 of hinge shaft 034, and between the narrow cavity occurring between shear fins 646 of brake shaft 037 and wiper shaft 628 of hinge shaft 034, as illustrated by arrows A21 (FIG. 137B), presenting very little rotational dampening. The user may notice no resistance when opening modified WC lid 101.

FIG. 137C represents a progression from FIG. 137B, with modified WC lid 101 rotated to its extreme open position (Clockwise, as indicated by arrow A18, FIG. 137), resulting in the clockwise rotation of hinge shaft 034 and wiper seals 035, as illustrated by the comparison of FIGS. 137B and 137C. As illustrated in FIG. 137C, wiper seals 035 remain rotationally positioned at their counterclockwise extremity, relative to hinge shaft 034, with hydraulic ports 636 of hinge shaft 034 not blocked by planar members 640 of wipers seals 035.

FIG. 137D represents a detail progression from FIG. 137C, after the user has rotated modified WC lid 101 slightly closed (Counterclockwise, as indicated by arrow A19, FIG. 137), relative to its represented position in FIG. 137C, resulting in a slight counterclockwise rotation of hinge shaft 034, as illustrated by comparison of FIGS. 137C and 137D. Further comparison of FIGS. 137C and 137D illustrates that wiper seals 035 did not rotate during this progression. In the relative position of the components illustrated in FIG. 137D, wiper seal posts 638 of hinge shaft 034 occur at the counterclockwise extremity of slide windows 641 of wiper seals 035; hydraulic ports 636 of hinge shaft 034 are substantially blocked by planar members 640 of wipers seals 035. As modified WC lid 101 rotates further closed (Counterclockwise, as indicated by arrow A19, FIG. 137), it will result in the counterclockwise rotation of hinge shaft 034 and wiper seals 035, as depicted by arrow A22 (FIG. 137D). The substantial blockage of hydraulic ports 636 of hinge shaft 034 prevents hinge shaft 034 and wiper seals 035 (and thus modified WC lid 101) from freely rotating within the surrounding slow-close fluid 053. Rather, the counterclockwise rotation of hinge shaft 034 and wiper seals 035 will force slow-close fluid 053 to pass through the narrow cavity occurring between shear fins 646 of brake shaft 037 and wiper shaft 628 of hinge shaft 034, as illustrated by arrows A23 (FIG. 137D), presenting a significant rotational dampening effect. If the user attempts to force modified WC lid 101 closed, he or she will encounter significant rotational resistance. Instead, this rotational dampening system is intended to allow modified WC lid 101 to slowly rotate closed (Counterclockwise, as indicated by arrow A19, FIG. 137), due to its own weight, after closure is initiated by the user.

FIG. 137E represents a detail progression from FIG. 137D, after modified WC lid 101 has rotated to its fully closed position (Counterclockwise, as indicated by arrow A19, FIG. 137), resulting in the counterclockwise rotation of hinge shaft 034 and wiper seals 035, as illustrated by comparison of FIGS. 137D and 137E. Note that FIG. 137E represents the same position of modified WC lid 101, hinge shaft 034, and wiper seals 035, as illustrated in FIG. 137A, the first Figure in this progression.

FIG. 139 illustrates master assembly 1003 installed on a fixed water closet (WC) for use, with modified WC lid 101 and modified WC seat 130 both in their extreme open positions. Referring to FIG. 141, after dry seat assembly 875 is closed, and the user initiates closure of modified WC lid 101, modified WC lid 101 will rotate slowly closed, due to its own weight, as indicated by arrow A25.

The slow-close rotational dampening system of dry seat assembly 875, is substantially identical to the slow-close rotational dampening system of modified WC lid 101, notwithstanding two distinctions as previously described and as illustrated in FIGS. 134 through 138: (i) Rotational dampening of modified WC lid 101 occurs within the right side assembly hinge pivot components of master assembly 1003, as illustrated in FIGS. 134 and 137. In comparison, rotational dampening of dry seat assembly 875 is effected by the left side assembly hinge pivot components of master assembly 1003, as illustrated in FIGS. 135 and 138. (ii) Rotational dampening of modified WC lid 101 occurs in the hydraulic chamber 644 of brake shaft 037 (FIG. 137). In comparison, the rotational dampening of dry seat assembly 875 occurs in the hydraulic chamber 644 of hinge cylinder 138 (FIG. 138).

The rotational dampening system of dry seat assembly 875 functions in the same manner as the rotational dampening system of modified WC lid 101: When the user rotates dry seat assembly 875 open, he or she will encounter no resistance. After opening dry seat assembly 875, if the user attempts to force dry seat assembly 875 closed, he or she will encounter significant rotational resistance. Instead, this rotational dampening system is intended to allow dry seat assembly 875 to slowly rotate closed, due to its own weight, after closure is initiated by the user.

FIG. 139 illustrates master assembly 1003 installed on a fixed water closet (WC) for use, with modified WC lid 101 and dry seat assembly 875 both in their extreme open positions. Referring to FIG. 140, after the user initiates closure of dry seat assembly 875, dry seat assembly 875 will rotate slowly closed, due to its own weight, as indicated by arrow A24.

Collapsible Cartridge System—

FIG. 142 illustrates removable dry cartridge 855 in its expanded state, similar to the states illustrated in FIGS. 109 and 110, but without the remainder of master assembly 1003. Upper cartridge segment 102 is tilted downward toward its rear. Cartridge hinge 007 is in its extreme operational flexed position, adjoining forward cartridge base 006 and rear cartridge base 008. Right side shield 003 and left side shield 004 are both in taught and fully erect positions. The region surrounded by upper cartridge segment 102, forward cartridge base 006, right side shield 003, and left side shield 004, forming a substantial cavity, hereafter identified as urine receptacle 797.

Referring to FIG. 143, as removable dry cartridge 855 begins to close, upper cartridge segment 102 rotates toward forward cartridge base 006, as indicated by arrow A26, and cartridge hinge 007 relaxes partially in response. Wall member 428 of right side shield 003 flexes inward toward the longitudinal center plane of the assembly, creasing inwardly about lower control curve 442 and upper control curve 443, and creasing outwardly about middle control curve 444. Likewise, left side shield 004 flexes inward, in the same fashion. Urine receptacle 797 reduces in size.

Referring to FIG. 144, removable dry cartridge 855 is shown in its closed or "collapsed" position, from an opposing perspective relative to FIGS. 142 and 143. Right side shield 003 (not visible in FIG. 144) and left side shield 004 are in their respective folded states, between forward cartridge base 006 and upper cartridge segment 102. Forward cartridge base 006 practically fits within upper cartridge segment 102, with left side shield 004 barely visible between. Cartridge hinge 007 is fully relaxed, as the lower surfaces of forward cartridge base 006 and rear cartridge base 008 are substantially coplanar. Upper urine spout 404 of upper cartridge segment 102 is complimented by lower urine spout 486 of rear cartridge base 008; the two features collectively forming urine spout 798 of removable dry cartridge 855. Alignment guide 420 of upper cartridge segment 102 is complimented by alignment guide 493 of rear cartridge base 008; the two features collectively forming alignment guide 799, within removable dry cartridge 855.

FIG. 145 illustrates removable dry cartridge 855 in its closed position with other critical components of master assembly 1003 necessary to illustrate the various sub-functions of the collapsible cartridge system. For clarity, the majority of modified WC lid 101 is cut away, and some components unrelated to the functions being illustrated have been removed. Various section lines illustrate where the components have been dissected to illustrate the cartridge functionality.

FIG. 146 represents a cross section through the components of FIG. 145, as indicated by the jogged section line 146. Similarly FIGS. 147, 147A and 147B represent cross sections through the components of FIG. 145, as indicated by section lines 147, 147A and 147B respectively.

Referring to FIG. 146, reflecting removable dry cartridge 855 in the closed position, the major components and features of removable dry cartridge 855 are illustrated, as well as brake cover 024, pivot rod 017, pivot rod retainer 018, and critical cutaway sections of modified WC lid 101. Drip lip 455 of forward cartridge base 006 resides laterally near the horizontal center of contact post 336 of modified WC lid 101. Referring to FIG. 146A, latch protrusion 399 of upper cartridge segment 102 fits within latch groove 345 at the forward edge of contact post 336 of modified WC lid 101, substantially constraining upper cartridge segment 102 in the closed position. The forward edge of forward cartridge base 006 rests on the radial bridge 334 of modified WC lid 101. Referring to FIG. 146B, cartridge spring 005 is in a compressed state, held in position by spring well 421 of upper cartridge segment 102 and spring well 463 of forward cartridge base 006. Cartridge hinge 007, in its un-flexed state, bridges between forward cartridge base 006 and rear cartridge base 008. Referring again to FIG. 146, note that forward cartridge base 006 slopes slightly downward towards the center of removable dry cartridge 855, ensuring that any small amounts of residual fluid within removable dry cartridge 855 will flow toward the rear cavity of removable dry cartridge 855, even in this closed and stored state.

Referring to FIG. 147, guide protrusion 456 of forward cartridge base 006 resides at its rearmost operational position within slide channel 344B of modified WC lid 101; slide guide 344A and slide channel 344B of modified WC lid 101 constrain guide protrusion 456 of forward cartridge base 006, to prevent vertical movement of the forward end of forward cartridge base 006. Referring to FIG. 147A, guide finger 555 of brake cover 024 rests in guide saddle 416 of upper cartridge segment 102. Referring to FIG. 147B, left funnel seal protrusion 400 of upper cartridge segment 102 and left funnel seal protrusion 479 of rear cartridge base 008 fit within toroidal protrusion 564 of cartridge spout seal 026, slightly compressing circular disk 563 of cartridge spout seal 026, and substantially sealing urine spout 798 of removable dry cartridge 855.

FIG. 148 represents a progression from FIG. 146, as the user unlatches removable dry cartridge 855. FIG. 148A illustrates how the user, placing his or her index finger within the finger opening 339 of modified WC lid 101 (See FIG. 182) and behind perimeter lip 367 of upper cartridge segment 102, (FIG. 148A) pulls softly outward and upward on perimeter lip 367 of upper cartridge segment 102, as depicted by arrow A30, causing a minor deformation of upper cartridge segment 102, such that perimeter lip 367 of upper cartridge segment 102 flexes outward. Still referring to FIG. 148A, this flexion allows latch protrusion 399 of upper cartridge segment 102 to unseat from latch groove 345 of modified WC lid 101, and circumvent contact post 336 of modified WC lid 101.

Referring again to FIG. 148, the weight of cartridge ballast 011 provides a downward force, as illustrated by arrow A27, affecting a clockwise "ballast moment" through removable dry cartridge 855, represented by arrow A28, and acting about pivot axis 419A with a moment arm indicated by arrow A29. With guide protrusions 456 of forward cartridge base 006 still being constrained from vertical movement by slide guide 344A and slide channel 344B of modified WC lid 101, as previously illustrated in FIG. 147, the ballast moment represented by arrow A28 (FIG. 148) affects the self-opening function of removable dry cartridge 855; after latch protrusion 399 of upper cartridge segment 102 is unseated from latch groove 345 of modified WC lid 101 (FIG. 148A), the self-opening function will cause removable dry cartridge 855 to rotate open. Referring to FIG. 148B, cartridge spring 005, seated within spring well 421 of upper cartridge segment 102 and spring well 463 of forward cartridge base 006, applies an expansion force, as indicated by arrows A31, forcing upper cartridge segment 102 away from forward cartridge base 006. This expansion force, as indicated by arrows A31, assists the self-opening function of removable dry cartridge 855, after latch protrusion 399 (FIG. 148A) of upper cartridge segment 102 is unseated from latch groove 345 (FIG. 148A) of modified WC lid 101.

FIG. 149 represents a progression from FIG. 148, after the self-opening function of removable dry cartridge 855 has caused it to rotate open. Similarly FIGS. 150 and 150B represent progressions of FIGS. 147 and 147B, with removable dry cartridge 855 in this fully-open state, as illustrated in FIG. 149. Note that the localized view window represented in FIG. 149 does not encompass the corresponding sections of pivot rod 017, pivot rod retainer 018, brake cover 024, or the rear cutaway segment of modified WC lid 101 that were fully visible in the view window of FIG. 146 and partially visible in the view window of FIG. 148. Similarly, the localized view window represented in FIG. 150B does not encompass the corresponding sections of brake cover 024 and cartridge spout seal 026 that were visible in the view window of FIG. 147B. However, these components that occur outside of the visible view windows are not pertinent to the current illustrations.

Referring to FIG. 149, urine receptacle 797 is apparent within the open removable dry cartridge 855. Drip lip 455 of forward cartridge base 006 is now laterally positioned to the left side of contact post 336 of modified WC lid 101. Comparison of FIGS. 146 and 149 illustrates the forward (leftward) translation of drip lip 455 of forward cartridge base 006 that occurs when removable dry cartridge 855 is opened (indicated by arrow A36, FIG. 149), substantially repositioning the foremost edge of removable dry cartridge 855, closer to the user. Referring again to FIG. 149, the weight of cartridge ballast 011 still provides a downward force, as illustrated by arrow A32, affecting a clockwise ballast moment through removable dry cartridge 855, represented by arrow A33, and acting about pivot axis 419A with a moment arm indicated by arrows A34. Comparison of FIGS. 148 and 149 illustrates that the moment arm indicated by arrow A34 of FIG. 149 is reduced from the previous moment arm indicated by arrow A29 of FIG. 148, due to the progressed position of cartridge ballast 011 within open removable dry cartridge 855 (FIG. 149). Referring to FIG. 149B, cartridge spring 005, seated within spring well 421 of upper cartridge segment 102 and spring well 463 of forward cartridge base 006, applies expansion force, as indicated by arrows A37, forcing upper cartridge segment 102 away from forward cartridge base 006; this expansion force, coupled with the ballast moment indicated by arrow A33 (FIG. 149), acts to hold removable dry cartridge 855 in the open position illustrated in FIG. 149, until the user closes it.

Referring to FIG. 150, guide protrusion 456 of forward cartridge base 006 is positioned at the forward extremity of its operating range. Comparison of FIGS. 147 and 150 illustrates the forward linear translation of guide protrusion 456 of forward cartridge base 006 within slide channel 344B of modified WC lid 101, as illustrated by arrow A38, when removable dry cartridge 855 opened.

Referring to FIG. 149, urine deposited into urine receptacle 797 will initially contact floor member 448 of forward cartridge base 006. In these positions, floor member 448 of forward cartridge base 006, as well as the rear cavity of removable dry cartridge 855, both demonstrate appreciable drain slope. (Note: Typical plastics used for this type of application require ~8.0% slope, or greater, to properly shed deposited urine. "Appreciable drain slope" indicates a slope of 8.0% or greater.) Thus, the urine will flow rearward and downward over floor member 448 of forward cartridge base 006, and into the rear cavity of removable dry cartridge 855, as illustrated by arrows A35. Referring to FIG. 150B, the urine will continue through the rear cavity of removable dry cartridge 855, and exit through urine spout 798 of removable dry cartridge 855, as illustrated by arrows A39 (FIG. 150B). Similar to that shown for master assembly 1002 in FIG. 131, the exiting urine (represented by arrow A10 in FIG. 131) will fall into the waste receptacle (RECEPTACLE) of the water closet (WC) (FIG. 131).

FIG. 151 represents a progression from FIG. 149, as the user is closing removable dry cartridge 855 after use, with removable dry cartridge 855 in a nearly-closed state. FIG. 152 represents a progression from FIGS. 147 and 150, with removable dry cartridge 855 in the nearly-closed state illustrated in FIG. 151. FIG. 152A represents a progression from FIG. 147A, with removable dry cartridge 855 in a nearly-closed state (as illustrated in FIG. 151). Similarly, FIG. 152B represents a progression from FIGS. 147B and 150B, with removable dry cartridge 855 in a nearly-closed state (as illustrated in FIG. 151).

Referring to FIG. 151, using his or her fingers to contact upper cartridge segment 102, on (or near) perimeter blend radius 367A, the user presses gently downward to rotate upper cartridge segment 102 closed about pivot axis 419A, as indicated by arrow A40. As illustrated in FIG. 151, drip lip 455 of forward cartridge base 006 is again laterally positioned near the horizontal center of contact post 336 of modified WC lid 101; comparison of FIGS. 149 and 151 illustrates the rearward translation of drip lip 455 of forward cartridge base 006, as indicated by arrow A41 (FIG. 151), that occurs during the closure of removable dry cartridge 855.

Referring to FIG. 152, guide protrusion 456 of forward cartridge base 006 is near its rear operating extremity within slide channels 344B of modified WC lid 101. Comparison of FIGS. 150 and 152 demonstrates the rearward translation of guide protrusion 456 of forward cartridge base 006 that occurs within slide channels 344B of modified WC lid 101, as illustrated by arrow A42, when the user rotates upper cartridge segment 102 closed. Referring to FIG. 152A, as the user rotates upper cartridge segment 102 closed, about pivot axis 419A (as illustrated in FIG. 151), the rear ends of upper cartridge segment 102 and rear cartridge base 008 rotate upward, as indicated by arrow A43; as upper cartridge segment 102 nears complete closure, guide saddle 416 of upper cartridge segment 102 receives guide finger 555 of brake cover 024, effectively causing brake cover 024 to rotate clockwise about lever pivot axis 517A (FIG. 151) of pivot rod 017, as illustrated by arrow A44 (FIG. 152A), in response to the closing rotation of removable dry cartridge 855. Referring to FIG. 152B, as upper cartridge segment 102 and rear cartridge base 008 rotate counterclockwise (indicated by arrow A45) and brake cover 024 and cartridge spout seal 026 rotate clockwise (indicated by arrow A46), left funnel seal protrusion 400 of upper cartridge segment 102 meets circular disk 563 of cartridge spout seal 026, meeting the interior edge of toroidal protrusion 564 of cartridge spout seal 026; cartridge spout seal 026 compresses slightly where contacted by left funnel seal protrusion 400 of upper cartridge segment 102.

Referring to FIG. 153, as the user continues to push downward on upper cartridge segment 102, as indicated by arrow A47, latch protrusion 399 of upper cartridge segment 102 meets contact post 336 of modified WC lid 101, causing upper cartridge segment 102 to deform outward slightly, as indicated by arrow A48. With continued closure, latch protrusion 399 of upper cartridge segment 102 will enter latch groove 345 of modified WC lid 101, substantially latching upper cartridge segment 102 in the closed position, and allowing upper cartridge segment 102 to relax from the deformation. When upper cartridge segment 102 is latched closed, the components of removable dry cartridge 855 will return to the state of FIG. 146; similarly, the components of FIGS. 152, 152A, and 152B will return to the respective states of FIGS. 147, 147A and 147B.

Removable Cartridge System—

FIG. 154 illustrates a cutaway of master assembly 1003, with removable dry cartridge 855 in its closed position. FIG. 155 represents a cross section of the components illustrated in FIG. 154, passing through the center of the forward pivot plate fasteners 016, as indicated by section line 155. FIG. 156 represents a cross section of the components illustrated in FIG. 154, passing through the center of pivot plate 014, as indicated by section line 156.

Referring to FIG. 155, screw boss ports 515 of pivot plate retainers 015 receive pivot mount bosses 349 of modified WC lid 101; pivot plate retainers 015 being fastened in place by pivot plate fasteners 016; slide apertures 507 of pivot plate 014 receive upper disks 513 of pivot plate retainers 015; coplanar pads 348 of modified WC lid 101 and lower disks 512 of pivot plate retainers 015 constrain pivot plate 014 vertically, while allowing pivot plate 014 to translate laterally side to side, as indicated by arrow A49.

Referring concurrently to FIGS. 31 and 155, note that when assembled, pivot plate retainers 015 may be uniformly rotated, or "clocked", to any rotational position with respect to screw boss ports 515 of pivot plate retainers 015 and thus with respect to pivot mount bosses 349 of modified WC lid 101 (FIG. 155); alignment indicators 517 of pivot plate retainers 015 (FIGS. 33 and 155) will provide a visual indicator allowing the assembler to ensure that pivot plate retainers 015 are uniformly rotated, or uniformly "clocked", during assembly; by uniformly varying the rotational position of pivot plate retainers 015, the eccentric relationship between lower disk 512 and upper disk 513 of pivot plate retainers 015 (most visible in FIG. 31) will affect a means by which the relative position of pivot plate 014 (FIG. 155) may be finely adjusted with respect to modified WC lid 101; referring again to FIG. 155, with pivot plate retainers 015 uniformly "clocked" to any rotational position, pivot plate 014 will be allowed to translate laterally side to side, as indicated by arrow A49; referring to FIGS. 145 and 146, this adjustment mechanism will very slightly affect the relative position between removable dry cartridge 855 and modified WC lid 101, allowing the assembler to make fine adjustments during assembly, to ensure that the latch mechanism of master assembly 1003, described above in Collapsible Cartridge System (Section 5.5), will operate consistently, with minimal operational force required from the user.

Referring to FIG. 156, pivot slide springs 013, within the cylindrical cavities 503 of pivot plates 014, bear against reference protrusions 347 of modified WC lid 101, and press pivot plates 014 inward against removable dry cartridge 855, as illustrated by arrows A50; pivot knobs 506 of pivot plates 014 bear in forward detent divots 419 of upper cartridge segment 102, allowing upper cartridge segment 102 to rotate about pivot axis 419A of upper cartridge segment 102. Because forward detent divots 419 penetrate upper cartridge segment 102 deeper than do the adjacent slide grooves 417 (As illustrated in FIGS. 13 and 13A), the inward forces provided by pivot slide springs 013 (indicated by arrows A50, FIG. 156), substantially constrain removable dry cartridge 855 in the position represented by FIGS. 154 and 156, until a deliberate extraction force is provided by the user.

FIG. 157 represents a progression from FIG. 154, illustrating removable dry cartridge 855 partially extracted from master assembly 1003, after a deliberate extraction force has been provided by the user, as indicated by arrow A51, to begin the extraction process. Referring to FIG. 158, pivot slide spring 013 continues to bear against reference protrusion 347 of modified WC lid 101, and presses pivot plate 014 inward against removable dry cartridge 855, as illustrated by arrow A52; pivot knob 506 of pivot plate 014 bears in slide groove 417 of upper cartridge segment 102.

FIG. 159 represents a progression from FIG. 157. During the extraction, removable dry cartridge 855 will come to a stop in the position illustrated in FIG. 159. Referring to FIG. 160, pivot slide spring 013 continues to bear against reference protrusion 347 of modified WC lid 101, and presses pivot plate 014 inward against removable dry cartridge 855, as illustrated by arrow A54; pivot knob 506 of pivot plate 014 bears in rear detent divot 418 of upper cartridge segment 102. Close comparison of FIGS. 158 and 160 illustrates the lateral translation that occurs to pivot plate 014 (in the direction of arrow A54, FIG. 160). Since rear detent divot 418 penetrates upper cartridge segment 102 deeper than does the adjacent slide groove 417 (See FIG. 13A), the inward force provided by pivot slide spring 013, as illustrated by arrow A54 (FIG. 160), substantially constrains removable dry cartridge 855 in the position represented by FIGS. 159 and 160, until increased extraction force is provided by the user, in the direction of arrow A53 (FIG. 159).

FIG. 161 represents a progression from FIG. 159, as the user applies continued extraction force to removable dry cartridge 855 from master assembly 1003, in the direction indicated by arrow A55. Referring to FIG. 162, pivot slide spring 013 continues to bear against reference protrusion 347 of modified WC lid 101, and presses pivot plate 014 inward against removable dry cartridge 855, as illustrated by arrow A56; pivot knob 506 of pivot plate 014 bears in alignment guide 799 of removable dry cartridge 855.

Continued extraction force in the direction indicated by arrow A55 (FIG. 161) will result in the complete extraction of removable dry cartridge 855 from master assembly 1003, as illustrated in FIG. 181. Referring again to FIG. 162, when removable dry cartridge 855 is fully removed from master assembly 1003, pivot slide spring 013, bearing against reference protrusion 347 of modified WC lid 101, will press pivot plate 014 inward, as indicated by arrow A56, until the exterior lateral gap (GAP) between reference protrusion 347 of modified WC lid 101 and cylindrical cavity 503 of pivot plate 014 dissipates. In such position, pivot plate 014 will remain until removable dry cartridge 855 is reinstalled.

Cartridge Illumination System—

FIG. 163 illustrates removable dry cartridge 855 in its open position, with a night-light (NL) presented for illustration purposes only. FIG. 164 is a localized section of FIG. 163 through the common section plane 164, 165. FIG. 165 illustrates a full section of FIG. 163, through the common section plane 164, 165.

Referring to FIG. 164, cartridge lens 009, being solvent welded in lens receptacle 424 of upper cartridge segment 102, provides a conduit through which light rays (photons) may be transmitted. Arrows A57 represents transmission paths through which light rays may pass through cartridge lens 009. Due to the distinct shape and optical properties of cartridge lens 009, vertical light rays originating from above will be slightly refracted laterally outward as they are intercepted by upper concavity 497 of cartridge lens 009; the light rays will transmit through the component and will be slightly refracted laterally outward again as they exit cartridge lens 009 through lower concavity 498, as illustrated by arrows A57 of FIG. 164. Upward projections from the twice refracted exiting rays converge a short distance above cartridge lens 009, indicating the focal point (FP) of cartridge lens 009.

Referring to FIG. 165, in a dark environment, when an energized night-light (NL) is placed in close proximity to the focal point (FP) of cartridge lens 009 (as illustrated in FIGS. 163 and 165) a portion of the emitted light (photons), indicated by arrows A58, will be intercepted by cartridge lens 009. The light rays intercepted by cartridge lens 009, indicated by arrows A59, will pass through the lens, consistent with the light paths indicated by arrows A57 in FIG. 164; the light rays will broadcast through the interior of removable dry cartridge 855, striking, and effectively illuminating, the interior surfaces of right side shield 003, left side shield 004, and forward cartridge segment 006, such that urine receptacle 797 may be easily identified by the user, in a dark environment.

Incremental Braking System—

FIG. 166 illustrates a cutaway section of the master assembly 1003 in a closed state, with components strategically dissected for illustration of the incremental braking system. FIG. 167 represents a cross section taken through the components of FIG. 166, through section plane 167.

In FIG. 167, the sectioned components of master assembly 1003 are illustrated in a stored position. Removable dry cartridge 855, being fully closed, holds brake cover 024 in its closed position. (Note: The interaction between removable dry cartridge 855 and brake cover 024 was previously described in Collapsible Cartridge System, Section 5.5.) The expansion force applied by upper brake spring 020, as indicated by arrow A60 is opposed by the expansion force applied by lower brake spring 023, illustrated by arrow A61. With these opposing forces being equal, they hold brake lever 022 in equilibrium, in the disengaged state of FIG. 167. FIG. 167A illustrates that in this disengaged state, brake lever 022 does not contact brake shaft 037.

FIG. 168, a progression from FIG. 167, illustrates the same component sections shown in FIG. 167, reflecting removable dry cartridge 855 in a partially open state. As removable dry cartridge 855 rotates toward its open position, as illustrated by arrow A62, brake cover 024, no longer constrained by removable dry cartridge 855, becomes free to rotate counterclockwise about lever pivot axis 517A, of pivot rod 017. In response to the expansion force applied by upper brake spring 020, illustrated by arrow A63, brake cover 024, brake sub-frame 021, brake lever 022 and lower brake spring 023, rotate counterclockwise, as indicated by arrow A64, to the "brake engageable" state illustrated in FIG. 168, with brake lever 022 contacting brake shaft 037, preventing further counterclockwise rotation of these components. As illustrated in FIG. 168A, interlock ribs 540 of brake lever 022 contact interlock ribs 651 of brake shaft 037. The expansion force applied by upper brake spring 020, illustrated by arrow A63 (FIG. 168), holds brake lever 022 against brake shaft 037, as indicated by arrow A65 in FIG. 168A.

FIG. 169, a progression from FIG. 168, illustrates the same component sections shown in FIG. 168 (notwithstanding removable dry cartridge 855), after removable dry cartridge 855 has been fully opened, and the user rotates modified WC lid 101 open. Note that removable dry cartridge 855, in its fully opened state, resides outside of the localized view window of FIG. 169. During the rotation of modified WC lid 101 upward, as indicated by arrow A66, the expansion force applied by upper brake spring 020, illustrated by arrow A67, holds brake sub-frame 021 (and thus brake cover 024, brake lever 022 and lower brake spring 023) in counterclockwise rotation about lever pivot axis 517A, of pivot rod 017, as illustrated by arrow A68 in FIG. 169; referring to FIG. 169A, as illustrated by arrow A69, brake lever 022 is held in constant contact with brake shaft 037, maintaining the "brake engageable" system state. As further illustrated in FIG. 169A, though misaligned, the interlock ribs 540 of brake lever 022 ride against interlock ribs 651 of brake shaft 037.

FIG. 170, a progression from FIG. 169, illustrates the same component sections shown in FIG. 169. After the user has rotated modified WC lid 101 to the selected position, a slight distance clockwise of the preferred usage position, the user should release modified WC lid 101, allowing it to rotate counterclockwise about hinge pivot axis 340A, under its own weight, as indicated by arrow A70. As modified WC lid 101 rotates counterclockwise (indicated by arrow A70), the expansion force applied by upper brake spring 020, illustrated by arrow A71, continues to hold brake sub-frame 021 (and thus brake cover 024, brake lever 022 and lower brake spring 023) in counterclockwise rotation (illustrated by arrow A72 in FIG. 170A), such that interlock ribs 540 of brake lever 022 ride against interlock ribs 651 of brake shaft 037 maintaining the "brake engageable" system state. As modified WC lid 101 rotates further counterclockwise (as indicated by arrow A70, FIG. 170), the interlock ribs 540 of brake lever 022, as illustrated in FIG. 170A, will effectively seek alignment with interlock ribs 651 of brake shaft 037. Note that the alignment of interlock ribs 540 of brake lever 022 with interlock ribs 651 of brake shaft 037 is subject to the increment (pitch) of the individual ribs.

FIG. 171, a progression from FIG. 170, illustrates the same component sections shown in FIG. 170, with the incremental braking system fully engaged, and modified WC lid 101 at rest. FIG. 171A depicts the interlock ribs 540 of brake lever 022 interleaved and fully engaged with the interlock ribs 651 of brake shaft 037. As illustrated in FIG. 171, brake lever 022 effectively binds between brake shaft 037 and pivot rod 017, to stop the downward rotation of modified WC lid 101. In this way, the incremental braking system effectively self-engages during normal use of master assembly 1003. Note that lower brake spring 023, in the semi-relaxed state illustrated in FIG. 171, exerts a minor expansion force, indicated by arrow A73, forcing brake cover 024 downward, away from brake lever 022.

FIG. 172, a progression from FIG. 171, illustrates the same component sections shown in FIG. 171, after removable dry cartridge 855 has been rotated closed, as illustrated by arrow A74, and is again visible within the localized view frame. Brake cover 024 is constrained in its closed position by removable dry cartridge 855, and thus brake sub-frame 021 is also constrained in its closed position. FIG. 172A illustrates that interlock ribs 540 of brake lever 022 remain interleaved and fully engaged with interlock ribs 651 of brake shaft 037; the shape of interlock ribs 540 of brake lever 022 and interlock ribs 651 of brake shaft 037 substantially constrain the components in this interleaved relationship. Referring again to FIG. 172, lower brake spring 023 is compressed between brake lever 022 and brake cover 024, with an increased expansion force, indicated by arrow A75, relative to the expansion force it exerted in the semi-relaxed state of FIG. 171 (indicated by arrow A73, FIG. 171).

FIG. 173, a progression from FIG. 172, illustrates the same component sections shown in FIG. 172. Referring to FIG. 173, as the user rotates modified WC lid 101 upwards, in the direction indicated by arrow A76, the expansion force of lower brake spring 023, indicated by arrow A77, presses brake lever 022 upward away from brake cover 024. Referring to FIG. 173A, the upward rotation of modified WC lid 101 (indicated by arrow A76, FIG. 173) allows interlock ribs 540 of brake lever 022 to gradually disengage from interlock ribs 651 of brake shaft 037, in the direction indicated by arrow A78. When modified WC lid 101 (FIG. 173) achieves a rotation angle such that interlock ribs 540 of brake lever 022 can fully retract from interlock ribs 651 of brake shaft 037, brake lever 022 will suddenly rotate clockwise, as illustrated by arrow A78. The user may hear a slight "thump" as brake lever 022 makes contact with brake sub-frame 021 (FIG. 173), indicating the brake system has disengaged.

FIG. 174, a progression from FIG. 173, illustrates the same component sections shown in FIG. 173, with removable dry cartridge 855 closed and the incremental braking system disengaged. FIG. 174A illustrates that brake lever 022 is no longer in contact with brake shaft 037. Referring again to FIG. 174, when the user releases modified WC lid 101, no longer constrained by the incremental braking system, under its own weight it will rotate counterclockwise about hinge pivot axis 340A, as indicated by arrow A79, until it achieves its closed position. The closure speed will be dampened by the slow-close rotational dampening system. (See Slow-Close Rotational Dampening System above, Section 5.5.)

Referring to FIG. 174A, non-ribbed region 652 of brake shaft 037 is provided to prevent the incremental braking system from engaging, when modified WC lid 101 (FIG. 174) is at excessively high angles of rotation. When modified WC lid 101 is positioned above the intended operational range of the incremental braking system, interlock ribs 540 of brake lever 022 (as illustrated in FIG. 173A), cannot interleave with the non-ribbed region 652 of brake shaft 037 (FIG. 174A), substantially preventing engagement of the incremental braking system, until modified WC lid 101 (FIG. 174) is repositioned within the operational range of the incremental braking system.

FIG. 182 illustrates master assembly 1003 mounted on a water closet (WC) for use, with removable dry cartridge 855 open, and modified WC lid 101 in its closed position; contact post 336 and finger openings 339 of modified WC lid 101 are clearly visible for user access.

FIG. 183 similarly illustrates master assembly 1003 mounted on a water closet (WC) for use. Removable dry cartridge 855 is open, and modified WC lid 101 is held in a partially open state by the incremental braking system; the rear end of removable dry cartridge 855 spans through receptacle opening 583 of modified WC seat 130, and into the waste receptacle (RECEPTACLE) of the water closet (WC) below.

Debris Screening System—

Referring to FIG. 183C, and then FIG. 183D: To prevent loose debris from clogging the interior passages of removable dry cartridge 855, debris screen and bead rack 080 may optionally be used with master assembly 1003 (FIG. 183C). When debris screen and bead rack 080 is placed within removable dry cartridge 855, as illustrated by FIGS. 183C and 183D, with or without chemical beads (BEADS), any large debris occurring within urine receptacle 797 of removable dry cartridge 855 will not pass through debris screen and bead rack 080; debris small enough to pass through debris screen and bead rack 080 will be small enough to pass through removable dry cartridge 855 without clogging its interior passages.

Odor Control System—

Referring to FIG. 183C, and then FIG. 183D: To help prevent the occurrence of unpleasant orders, chemical beads, such as waterless urinal beads or chlorine beads, may optionally be used with debris screen and bead rack 080, in master assembly 1003 (FIG. 183C). As illustrated by FIGS. 183C and 183D, small chemical beads (BEADS), constrained in debris screen and bead rack 080, within urine receptacle 797 of removable dry cartridge 855, will be retained in the urine flow path, as described above in Collapsible Cartridge System, Section 5.5. As urine contacts the chemical beads (BEADS), it will interact with the chemical beads to eliminate odor causing bacteria, release odor masking ions, and substantially affect comprehensive odor control. Note that debris screen and bead rack 080 may also be used in conjunction with other urinal odor control products, such as a urinal mat (MAT), as illustrated in FIG. 183D.

5.6 Usage of Master Assembly 1003

Urinal Use for Short Users—

Referring to FIG. 175A, with master assembly 1003 securely mounted on a water closet (WC), the operator should begin by unlatching upper cartridge segment 102 of removable dry cartridge 855. To do so, the user should place his index finger within the finger opening 339 of modified WC lid 101 (Not visible in FIG. 175A. Reference FIG. 182), and pull outward on perimeter lip 367 of upper cartridge segment 102, as indicate by arrow A80. Referring to FIG. 175B, the self-opening function of removable dry cartridge 855 will cause upper cartridge segment 102 to rotate open, as indicated by arrow A81, revealing urine receptacle 797 of removable dry cartridge 855. Referring to FIG. 175C, the user should urinate directly into urine receptacle 797 of removable dry cartridge 855. Referring to FIG. 175D, after urination, the user should close removable dry cartridge 855, by using his hand to press downward on perimeter blend radius 367A of upper cartridge segment 102 to rotate it closed, as indicated by arrow A82. Referring to FIG. 175E, after rotating upper cartridge segment 102 to the closed position, the user should press downward, on (or near) perimeter blend radius 367A of upper cartridge segment 102, as illustrated by arrow A83, with slightly increased force, to latch removable dry cartridge 855 in the closed position.

Urinal Use for Tall Users—

Tall users should begin by unlatching upper cartridge segment 102, as described above for short users, and as illustrated in FIG. 175A. Referring to FIG. 175B, the self-opening function of removable dry cartridge 855 will cause upper cartridge segment 102 to rotate open, in the direction indicated by arrow A81, revealing urine receptacle 797 of removable dry cartridge 855. Referring to FIG. 176A, the tall user should then rotate modified WC lid 101 open, in the direction indicated by arrow A84. To do so, the operator should use his fingers to lift upward on contact post 336 of modified WC lid 101, while modified WC seat 130 remains closed. Referring to FIG. 176B, after selecting a usage position, the user should release modified WC lid 101; modified WC lid 101 will rotate closed a small angle, in the direction indicated by arrow A85, and then stop rotating as the brake system engages. If urine receptacle 797 of removable dry cartridge 855 is at the appropriate height for the user (i.e., if urine receptacle 797 is in close proximity to, and slightly below the user's groin), as illustrated in FIG. 176D, the user may urinate into urine receptacle 797, as illustrated in FIG. 176D. If, rather, urine receptacle 797 of removable dry cartridge 855 is too low, as illustrated in FIG. 176B, the user may raise modified WC lid 101 further, to increase the height of urine receptacle 797 of removable dry cartridge 855. Referring to FIG. 176C, to do so, the operator should use his fingers to lift upward on contact post 336 of modified WC lid 101, and rotate modified WC lid 101 open, in the direction of arrow A86. After selecting a rotation angle a short distance beyond the desired use position, the user should release modified WC lid 101; referring to FIG. 176D, modified WC lid 101 will rotate closed a small angle, in the direction indicated by arrow A87, and then stop rotating as the brake system engages. With urine receptacle 797 of removable dry cartridge 855 in an appropriate position for the user (in close proximity to, and slightly below the user's groin), the user should urinate into urine receptacle 797. Referring to FIG. 176E, tall females may also use master assembly 1003, for standing urination; after selecting the appropriate usage position, the female should position herself such that urine receptacle 797 of removable dry cartridge 855 is in close proximity to, and slightly below her groin, as illustrated in FIG. 176E. Depending on the female user's particular physique, she may choose to slightly straddle the water closet (WC), such as illustrated in FIG. 176E; alternatively, she may find it more comfortable to lean forward, to have urine receptacle 797 in close proximity to her groin. Referring to FIG. 176F, after urination, the user should close removable dry cartridge 855, by using his or her hand to press downward on perimeter blend radius 367A of upper cartridge segment 102 to rotate it closed, as indicated by arrow A88. Referring to FIG. 176G, after rotating upper cartridge segment 102 to the closed position, the user should press downward, on (or near) perimeter blend radius 367A of upper cartridge segment 102, as illustrated by arrow A89, with slightly increased force, to latch removable dry cartridge 855 in the closed position. Referring to FIG. 176H, the user should next rotate modified WC lid 101 slightly upward, as indicated by arrow A90, to disengage the brake system; to do so, the operator should use his or her fingers to lift upward on contact post 336 of modified WC lid 101, and rotate modified WC lid 101 slightly open. As the brake system releases, the user may hear a slight "thump" indicating that the brake system has disengaged. Referring to FIG. 176J, after the brake system is disengaged, the user should release modified WC lid 101, and allow it to rotate closed under its own weight, as indicated by arrow A91. The closure speed will be dampened by the slow-close rotational dampening system. (See Slow-Close Rotational Dampening System, Section 5.5.) Modified WC lid 101 will come to rest on modified WC seat 130.

Height Adjustment Range—

Referring to FIG. 177, four master assemblies 1003 are mounted on four different water closets for use; the four water closets (water closet A, water closet B, water closet C and water closet D) are labeled WCA, WCB, WCC and WCD respectively, for distinction. Four male users of different heights are illustrated urinating into the respective urine receptacles 797 of removable dry cartridges 855, to illustrate the vast range of heights that master assembly 1003 will comfortably accommodate. The shortest user, using master assembly 1003 on water closet A (WCA), is well suited to use master assembly 1003, with modified WC lid 101 in the closed position. The taller boy or teenager, using master assembly 1003 on water closet B (WCB), prefers to have modified WC lid 101 open a shallow angle, such that urine receptacle 797 of removable dry cartridge 855 is in close proximity to, and slightly below, his groin. The shorter adult, using master assembly 1003 on water closet C (WCC), prefers to have modified WC lid 101 open further, such that urine receptacle 797 of removable dry cartridge 855 is similarly at an appropriate height for him. The taller adult, using master assembly 1003 on water closet D (WCD), prefers to have modified WC lid 101 open further, near the highest adjustment of the braking mechanism, such that urine receptacle 797 of removable dry cartridge 855 is similarly at an appropriate height for him. In this regard, master assembly 1003 practically and easily adapts with each use to accommodate users of various heights, requiring no tools or special provisions. Note that the two tallest users, using master assemblies 1003 on water closet C (WCC) and water closet D (WCD), are illustrated slightly, and comfortably, straddling their respecting water closets. Depending on each user's particular physique, he may choose to slightly straddle the water closet, such as illustrated for the two tallest users in in FIG. 177; alternatively, he may find it more comfortable to lean forward, to have urine receptacle 797 in close proximity to his groin.

Referring to FIG. 178, four cutaway views of master assemblies 1003 are mounted on four different water closets for use; the four water closets, water closet A (WCA), water closet B (WCB), water closet C (WCC) and water closet D (WCD) correspond to the identically labeled water closets illustrated in FIG. 177. And, in each instance, the respective master assembly 1003 is adjusted to the same position illustrated in FIG. 177. Referring to master assembly 1003 mounted on water closet A (WCA), urine exits urine spout 798 of removable dry cartridge 855, within the waste receptacle (RECEPTACLE) of water closet A (WCA). Similarly, referring to master assembly 1003 mounted on water closet B (WCB), urine exits urine spout 798 of removable dry cartridge 855, within the waste receptacle (RECEPTACLE) of water closet B (WCB). In contrast, referring to master assembly 1003 mounted on water closet C (WCC), urine exits urine spout 798 of removable dry cartridge 855, above modified WC seat 130; the urine flows through receptacle opening 583 of modified WC seat 130, and enters the waste receptacle (RECEPTACLE) of water closet C (WCC). Similarly, referring to master assembly 1003 mounted on water closet D (WCD), urine exits urine spout 798 of removable dry cartridge 855, above modified WC seat 130; the urine flows through receptacle opening 583 of modified WC seat 130, and enters the waste receptacle (RECEPTACLE) of water closet D (WCD). In each and every instance, urine impacts the respective water closet above the standing water (WATER), substantially eliminating splash and potentially embarrassing noise.

Referring to FIG. 179, similar to FIG. 177, four master assemblies 1003 are mounted on four different water closets for use; the four water closets (water closet E, water closet F, water closet G and water closet H) are labeled WCE, WCF, WCG and WCH respectively, for distinction. Four female users of different heights are illustrated urinating into urine receptacles 797 of removable dry cartridges 855, to illustrate the range of female user heights that master assembly 1003 will comfortably accommodate. The shortest user, using master assembly 1003 on water closet E (WCE), prefers to have modified WC lid 101 open a shallow angle, such that urine receptacle 797 of removable dry cartridge 855 is in close proximity to, and slightly below, her groin. The slightly taller user, using master assembly 1003 on water closet F (WCF), prefers to have modified WC lid 101 open further, such that urine receptacle 797 of removable dry cartridge 855 is similarly at an appropriate height for her. The next user, using master assembly 1003 on water closet G (WCG), prefers to have modified WC lid 101 open further yet, such that urine receptacle 797 of removable dry cartridge 855 is similarly at an appropriate height for her. The tallest user, using master assembly 1003 on water closet H (WCH), prefers to have modified WC lid 101 open further, approaching the highest adjustment of the braking mechanism, such that urine receptacle 797 of removable dry cartridge 855 is similarly at an appropriate height for her. In this regard, master assembly 1003 practically and easily adapts with each use to accommodate female users of various heights, requiring no tools or special provisions. In FIG. 179, all four female users are illustrated slightly straddling their respective water closets. Depending on each female user's particular physique, she may choose to slightly straddle her water closet, such as illustrated in FIG. 179; alternatively, she may find it more comfortable to lean forward, to have urine receptacle 797 in close proximity to her groin.

Depending on the female user's particular physique, she may choose to slightly straddle the water closet (WC), such as illustrated in FIG. 176E. Alternatively, she may find it more comfortable to lean forward, to have urine receptacle 797 in close proximity to her groin.

Seated Use—

Seated use of master assembly 1003 is substantially identical to that described and illustrated for Master Assembly 1002. (Reference Seated Use, Section 5.4)

Toilet Cleaning Access—

Toilet cleaning access for master assembly 1003 is substantially identical to that described and illustrated for master assemblies 1001 and 1002. (Reference Toilet Cleaning Access, Section 5.4)

Extraction of the Removable Cartridge—

Referring to FIG. 180A, to extract removable dry cartridge 855 from master assembly 1003, the user should begin by unlatching removable dry cartridge 855, as described in Urinal Use for Short Users, Section 5.6. With upper cartridge segment 102 slightly open, the user should firmly grasp upper cartridge segment 102 with both hands, with his or her thumbs near the exterior edges of perimeter blend radius 367A, as illustrated in FIG. 180A. Referring to FIG. 180B, the user should pull outward on removable dry cartridge 855, in the direction indicated by arrow A92, with a deliberate extraction force, to begin the extraction process, while allowing removable dry cartridge 855 to rest on radial bridge 334 of modified WC lid 101 (Reference FIG. 180C.). After the cartridge initially begins to move, less force will be required to continue the extraction. When removable dry cartridge 855 achieves the position illustrated in FIG. 180B, removable dry cartridge 855 will come to a stop as pivot knobs 506 of pivot plates 014 bear in rear detent divots 418 of upper cartridge segment 102 (Reference FIG. 180D), as described in Removable Cartridge System, Section 5.5. Still referring to FIG. 180B, the user must provide increased extraction force, in the direction of arrow A92, to resume the extraction of removable dry cartridge 855. Referring to FIG. 180C, with the user providing constant and gentle extraction force, depicted by arrow A94, removable dry cartridge 855 will disengage from pivot knobs 506 of pivot plates 014 (slightly visible in FIG. 180C); after this occurs, removable dry cartridge 855 will be essentially separate from master assembly 1003. The user may now carry removable dry cartridge 855 to a preferred location for cleaning.

FIG. 181 illustrates master assembly 1003 mounted on a water closet (WC) with removable dry cartridge 855 in the fully extracted position. Receptacle opening 328 of modified WC lid 101 opens to receptacle opening 583 of modified WC seat 130, with the waste receptacle (RECEPTACLE) of the water closet (WC) visible immediately below.

Dishwasher Cleansing of the Removable Cartridge—

After removable dry cartridge 855 has been fully extracted from master assembly 1003, it may be cleansed in a standard residential dishwasher. To do so, the user should place removable dry cartridge 855 within the dishwasher, in an open state, to ensure cleansing of the interior surfaces. After the wash cycle is complete, removable dry cartridge 855 may be removed from the dishwasher and reinstalled within master assembly 1003.

Replacement of the Removable Cartridge—

Referring to FIG. 180C, to reinstall removable dry cartridge 855, the user should firmly grasp the closed removable dry cartridge 855 with both hands, with his or her thumbs near the exterior edges of perimeter blend radius 367A of upper cartridge segment 102, as illustrated in FIG. 180C. Referring to FIG. 180D, the user should next position removable dry cartridge 855 within receptacle opening 328 of modified WC lid 101; while resting removable dry cartridge 855 on radial bridge 334 of modified WC lid 101 the user should visually align the alignment guides 799 of removable dry cartridge 855 with pivot knobs 506 of pivot plates 014. Referring to FIG. 180E, the user should gently push removable dry cartridge 855 rearward, directly toward modified WC lid 101, as indicated by arrow A95. With continued force, removable dry cartridge 855 will translate rearward. Referring again to FIG. 180B, removable dry cartridge 855 will come to a stop as pivot knobs 506 of pivot plates 014 bear in rear detent divots 418 of upper cartridge segment 102 (Reference FIG. 180D; Removable Cartridge System, Section 5.5.). At this point, the user should visually align removable dry cartridge 855 to ensure that guide protrusions 456 of forward cartridge base 006 will insert below slide guides 344A of modified WC lid 101. The user must provide increased installation force, in the direction of arrow A93, to resume the installation of removable dry cartridge 855. With continued installation force, in the direction of arrow A93 (FIG. 180B), removable dry cartridge 855 will return to the original installed state, as illustrated in FIG. 180A; its rearward travel will stop when pivot knobs 506 of pivot plates 014 bear in forward detent divots 419 of upper cartridge segment 102 (Reference FIG. 180D), and substantially constrain removable dry cartridge 855 in its functional position, until a deliberate extraction force is provided by the user (Reference Removable Cartridge System, Section 5.5.). The user may now latch upper cartridge segment 102, as described in Urinal Use for Short Users, Section 5.6.

Use of Debris Screen and Chemical Beads—

Referring to FIG. 183B, to employ the debris screening system, the user may insert debris screen and bead rack 080 into urine receptacle 797 of removable dry cartridge 855, oriented as shown in FIG. 183B. Debris screen and bead rack 080 may be used with or without chemical beads (BEADS); the debris screening system will function in either case.

Referring again to FIG. 183B, to employ chemical beads, the user should place chemical beads (BEADS) in debris screen and bead rack 080. The user may then insert debris screen and bead rack 080 into urine receptacle 797 of removable dry cartridge 855, with debris screen and bead rack 080 oriented as shown in FIG. 183B. When installed, debris screen and bead rack 080 will reside within removable dry cartridge 855, as illustrated by FIGS. 183C and 183D. Master assembly 1003 may then be used as normal. As the chemical beads (BEADS) affect odor control, they will reduce in size with continued use. When the chemical beads (BEADS) become small enough to exit debris screen and bead rack 080, they will be small enough to pass through removable dry cartridge 855 without clogging its interior passages; urine will carry the chemical beads through removable dry cartridge 855 and into the water closet (WC, FIG. 183C).

5.7 Functional Systems of Master Assembly 1004—

Master Assembly 1004, as previously illustrated in FIGS. 111, 112, and 113, features the following functional systems:

Assembly Hinge Pivot System—

FIG. 184 illustrates components of master assembly 1004 associated with the right side (as identified from the user's perspective) of the assembly hinge pivot system, in a partially exploded state, to clearly depict the relationship between components affecting this system. Similarly, FIGS. 185 and 186 illustrate components of master assembly 1004 associated with the left side of the assembly hinge pivot system, in distinctly opposed partially exploded states.

Referring to FIG. 184, hinge cylinder port 660 of hinge pivot block 040 snugly receives slow-close cylinder 642 of brake shaft 037; when assembled, slow-close cylinder 642 of brake shaft 037 is constrained from lateral or rotational movement, with respect to hinge pivot block 040. Referring to FIG. 185, three-stage penetration 663 of hinge pivot block 140 snugly receives hinge block insert 768 of wet pivot shaft 069 and two cup seals 070; when assembled, wet pivot shaft 069 is constrained from lateral or rotational movement, with respect to hinge pivot block 140.

Referring to FIG. 185, wet hinge port 358 of modified WC lid 201 loosely receives lid bearing stem 761 of wet pivot shaft 069, allowing modified WC lid 201 to pivot freely about lid bearing stem 761 of wet pivot shaft 069. Referring to FIG. 184, keyed bearing port 343 of modified WC lid 201 snugly receives key shank 632 of hinge shaft 034, effectively constraining the rotation of modified WC lid 201, with respect to hinge shaft 034; in its assembled state, the rotation of hinge shaft 034 being dampened within slow-close cylinder 642 of brake shaft 037 by the slow-close rotational dampening system, as previously described for master assembly 1003. (See Slow-Close Rotational Dampening System, Section 5.5.)

Referring to FIG. 184, the cylindrical shaped solid shaft 647 of brake shaft 037 loosely fits right bearing surface 595 of modified WC seat 230 and right bearing surface 612 of lower shaft housing 131, allowing modified WC seat 230 and lower shaft housing 131 (and thus, wet seat assembly 975) to pivot freely about solid shaft 647 of brake shaft 037. Referring to FIG. 186, seat insert 769 of wet pivot shaft 069 loosely fits bearing port 605 of modified WC seat 230 and bearing port 623 of lower shaft housing 131, allowing modified WC seat 230 and lower shaft housing 131 (and thus, wet seat assembly 975) to pivot freely about seat insert 769 of wet pivot shaft 069. Note that the rotation of wet seat assembly 975 is not dampened by the slow-close rotational dampening system.

FIG. 187 illustrates a cutaway of master assembly 1004 installed on a fixed water closet (WC) for use, with modified WC lid 201 and wet seat assembly 975 both in their closed positions. FIG. 188 represents a jogged section view passing through hinge pivot block 040 of FIG. 187, to illustrate the relationship between the right side assembly hinge pivot system components. As illustrated in FIG. 188, an assembly mounting bolt 039 and thumb-nut 072 clamps hinge pivot block 040 into the respective seat assembly mounting hole (HOLE) of the water closet (WC), substantially constraining hinge pivot block 040 from movement, and thus brake shaft 037. The components within hydraulic chamber 644 of brake shaft 037 affect the slow-close rotational dampening function for modified WC lid 201 (Reference FIG. 187.).

Similar to FIG. 188, FIG. 189 represents a jogged section view passing through hinge pivot block 140 of FIG. 187, to illustrate the relationship between the left side assembly hinge pivot system components. As illustrated in FIG. 189, outlet threads 772 of hollow mounting stud 071 mate with internal tapered threads 665 within the inlet receptacle 664 of hinge pivot block 140. Similarly, internal straight threads 777B of thumb-nut 172 mate with mounting threads 774 of hollow mounting stud 071. Hollow mounting stud 071 spans the respective seat assembly mounting hole (HOLE) of the water closet (WC); together, hollow mounting stud 071 and thumb-nut 172 secure hinge pivot block 140 to the water closet (WC), substantially constraining hinge pivot block 140 from movement, and thus wet pivot shaft 069.

FIG. 190 illustrates master assembly 1004 mounted to a water closet (WC) for use. Modified WC lid 201 rests against the water tank (TANK) of the water closet (WC), in its fully open position. With hinge pivot block 040 fully constrained (as illustrated in FIG. 188) and with hinge pivot block 140 fully constrained (as illustrated in FIG. 189), modified WC seat 230 can be freely rotated about hinge pivot axis 340A, as illustrated by arrows A96. Referring to FIG. 191, modified WC lid 201 can be freely rotated open about hinge pivot axis 340A, as indicated by arrow A97. The closing rotation of modified WC lid 201, indicated by arrow A98, will be dampened by the slow-close rotational dampening system, as previously described for master assembly 1003. (See Slow-Close Rotational Dampening System, Section 5.5)

Slow-Close Rotational Dampening System—

The slow-close rotational dampening system of master assembly 1004 is substantially identical to the slow-close rotational dampening system of master assembly 1003, as described in Slow-Close Rotational Dampening System, Section 5.5, notwithstanding one significant difference: Master assembly 1004 does not accommodate rotational dampening of wet seat assembly 975, whereas master assembly 1003 does accommodate rotational dampening of dry seat assembly 875.

Collapsible Cartridge System—

FIG. 192 illustrates fixed wet cartridge 955 in its closed position with other critical components of master assembly 1004 necessary to illustrate the various sub-functions of the collapsible cartridge system. For clarity, the majority of modified WC lid 201 is cut away, and some components unrelated to the functions being illustrated have been removed. Jogged section line 193 illustrates where the components have been dissected to illustrate the functions of the collapsible cartridge system.

FIG. 193 represents a cross section through the components of FIG. 192, as indicated by the jogged section line 193. Referring to FIG. 193, reflecting fixed wet cartridge 955 in the closed position, the major components and features of fixed wet cartridge 955 are illustrated, as well as brake cover 024, pivot rod 017, pivot rod retainer 018, and critical cutaway sections of modified WC lid 201. Comparison of FIG. 193 to FIG. 146 illustrates that fixed wet cartridge 955 is very similar to removable dry cartridge 855 in form, notwithstanding one significant difference: fixed wet cartridge 955 does not include the cartridge springs 005 of removable dry cartridge 855, nor the accommodations to retain cartridge springs 005.

In fact, the collapsible cartridge system of fixed wet cartridge 955 is substantially identical to the collapsible cartridge system of removable dry cartridge 855, as described in Collapsible Cartridge System, Section 5.5, notwithstanding one difference: For removable dry cartridge 855, the "ballast moment" affected by cartridge ballast 011 (indicated by arrow A28, FIG. 148; arrow A33, FIG. 149) is supplemented by the expansion force of cartridge springs 005 (indicated by arrows A31, FIG. 148B), to affect the self-opening function in removable dry cartridge 855. In comparison, as illustrated in FIG. 193, fixed wet cartridge 955 uses cartridge ballast 111, somewhat larger and heavier than cartridge ballast 011, to affect a greater "ballast moment", not supplemented by spring force, to affect the self-opening function of fixed wet cartridge 955.

Referring again to FIG. 193, comparable to that described for removable dry cartridge 855 of master assembly 1003 (Reference Collapsible Cartridge System, Section 5.5), with fixed wet cartridge 955 in this closed and stored state, forward cartridge base 106 slopes slightly downward towards the center of fixed wet cartridge 955. This ensures that any small amounts of residual fluid within fixed wet cartridge 955 will flow toward the rear cavity of fixed wet cartridge 955, even in this closed and stored state. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1004.

Cartridge Illumination System—

Master assembly 1004 does not include the cartridge illumination system of master assembly 1003

Incremental Braking System—

The incremental braking system of master assembly 1004 is substantially identical in components and function to that described for master assembly 1003 in Incremental Braking System, Section 5.5.

Removable Cartridge System—

Master assembly 1004 does not include the removable cartridge system of master assembly 1003. Instead, master assembly 1004 employs a fixed cartridge pivot system, as described below.

Fixed Cartridge Pivot System—

FIG. 194 illustrates a cutaway of master assembly 1004, with fixed wet cartridge 955 in its closed position. FIG. 195 represents a cross section of the components illustrated in FIG. 194, as indicated by section line 195, and passing through the center of the forward pivot plate fasteners 016. FIG. 196 represents a cross section of the components illustrated in FIG. 194, passing through the center of pivot plate 114, as indicated by section line 196.

Referring to FIG. 195, screw boss ports 509 of pivot plate 114 receive pivot mount bosses 349 of modified WC lid 201; pivot plate 114 is fastened in place by pivot plate fasteners 016. Comparison of FIG. 195 to FIG. 155 (a comparable dissection of master assembly 1003) illustrates that pivot plate 114, unlike pivot plate 014, does not translate laterally side-to-side. Rather, once assembled, pivot plate 114 is fixed in position.

Referring to FIG. 196, reference protrusions 347 of modified WC lid 201 fit within the cylindrical cavities 503 of pivot plates 114. Internal straight threads 703 within cylindrical cavities 702 of pivot jets 051 mate with external straight threads 508 on small pivot studs 504B of pivot plates 114, essentially fixing pivot jets 051 to pivot plates 114. Bearing shafts 704 of pivot jets 051, insert through pivot bores 425 of upper cartridge segment 202, affecting a robust means for rotation of fixed wet cartridge 955 about pivot axis 425A of upper cartridge segment 202. Nozzle shafts 705 of pivot jets 051 penetrate nozzle apertures 447 of right side shield 103 and left side shield 104; locating bands 711 of pivot jets 051 retain right side shield 103 and left side shield 104 on the respective nozzle shafts 705 of pivot jets 051. Disk seals 054 fit within cylindrical cavities 702 of pivot jets 051, and seal against small pivot studs 504B of pivot plates 114. O-ring seals 052 fit within seal wells 426 of upper cartridge segment 202, and bear against body members 701 of pivot jets 051.

Cartridge Rinse System—

FIG. 197 illustrates a cutaway view of master assembly 1004. For clarity, the majority of modified WC lid 201 is cut away, and several components unrelated to the cartridge rinse system have been removed. Various section lines indicate where the components have been sectioned to illustrate the cartridge rinse system. FIG. 198 illustrates left spray nozzle assembly 965A mounted to fixed pivot plate assembly 960. FIG. 199 illustrates manual flush valve 895. Section lines, in FIGS. 198 and 199, indicate where the components have been sectioned to illustrate the cartridge rinse system.

Referring to FIG. 200A, pressurized water (WATER) enters fluid port 771 of hollow mounting stud 071; as indicated by arrows A99, the water flows into inlet receptacle 664, through connecting port 667, through hydraulic cavity 666, and outward through outlet port 668 of hinge pivot block 140; the hydraulic cavity 666 of hinge pivot block 140 being substantially sealed by hinge block floor plate 041.

As illustrated in FIG. 200B, the water exiting hinge pivot block 140, indicated by arrows A100, flows into inlet port 766, and through connecting port 764 of wet pivot shaft 069. Two cup seals 070 seal against wet pivot shaft 069 within three-stage penetration 663 of hinge pivot block 140 (one on each side of inlet port 766 of wet pivot shaft 069), effectively sealing the fluid path between wet pivot shaft 069 and hinge pivot block 140. One cup seal 070 seals against wet pivot shaft 069 within wet hinge port 358 of modified WC lid 201, effectively sealing the fluid path between wet pivot shaft 069 and modified WC lid 201.

As illustrated in FIG. 200C, the water exiting outlet port 765 of wet pivot shaft 069 flows through outlet port 359 of modified WC lid 201, and enters valve supply tube 068

(valve supply tube 068 being sealant bonded within outlet port 359 of modified WC lid 201), as indicated by arrows A101.

As illustrated by section line 200D in FIG. 197, FIG. 200D represents a bi-planar section view passing through the radial center of manual flush valve 895, with intersecting planes converging at the radial center of manual flush valve 895, and passing respectively through water inlet port 757 and left-side outlet port 750 of valve base 064. FIG. 200D illustrates manual flush valve 895 in a closed state: the expansion force of disk spring 063, indicated by arrows A102, holds valve disk 062, valve piston 059 and valve diaphragm 058 in their upward operational positions; seal surface 740 of valve disk 062 seats against disk seat 735 of valve seat insert 061, effectively sealing closed fluid passages 736 of valve seat insert 061. Water flowing through valve supply tube 068, indicated by arrows A103, passes through water inlet port 757 and into hydraulic cavity 745 of valve base 064. With fluid passages 736 of valve seat insert 061 sealed closed by valve disk 062, the pressurized water can travel no further.

FIG. 201A represents a progression from FIG. 200D, after a pneumatic force, indicated by arrow A104 has displaced valve diaphragm 058, valve piston 059, and valve disk 062 downward, effectively opening the previously sealed fluid passages 736 of valve seat insert 061. The incoming pressurized water, indicated by arrows A105, flows through fluid passages 736 of valve seat insert 061; as indicated by arrows A106, the water then re-enters hydraulic cavity 745 and passes through left-side outlet port 750 and into left supply tube 066.

Referring to FIG. 201B, the pressurize water flowing through left supply tube 066, indicated by arrow A107, enters water inlet port 710 of pivot jet 051. As indicated by arrow A108, the water flows through bearing bore 707 (sealed by disk seal 054), and into nozzle bore 708 of pivot jet 051, through which it will enter the interior chamber of fixed wet cartridge 955. (See FIG. 204.)

Compared to FIG. 201A, FIG. 202 represents a distinctly disparate cross section taken through manual flush valve 895, in its open state. Referring to FIG. 202, pressurized water entering water inlet port 757 of valve base 064 from valve supply tube 068 is indicated by arrow A109. As the water initially passes through hydraulic cavity 745, as indicated by arrow A110, inlet isolation walls 758 of valve base 064 prevent the water from flowing radially through hydraulic cavity 745 of valve base 064; with valve seat insert 061 being solvent welded to valve base 064, substantially sealing the mating surfaces together, the water may only pass through fluid passages 736 of valve seat insert 061. Referring to FIG. 200D, when seal surface 740 of valve disk 062 seats against disk seat 735 of valve seat insert 061 (i.e., with manual flush valve 895 in its closed state, as illustrated in FIG. 200D), the water will be contained within that portion of hydraulic cavity 745 (FIG. 202) occurring between inlet isolation walls 758 of valve base 064 (FIG. 202). Referring again to FIG. 202, with manual flush valve 895 in its open state, pressurized water passes freely through the interior of disk housing 734 of valve seat insert 061, and passes outward through fluid passages 736 of valve seat insert 061, as indicated by arrows A111. As indicated by arrow A112, the pressurized water will then exit valve base 064 through left-side outlet port 750 (also previously illustrated in FIG. 201A by arrow A106). Similarly, the pressurized water will exit valve base 064 through right-side outlet port 753, as indicated by arrow A113. Through this means, pressurized water may be distributed to both left spray nozzle assembly 965A and right spray nozzle assembly 965B (Reference FIG. 197) simultaneously.

FIG. 203 illustrates a cutaway view of master assembly 1004. For clarity, the majority of modified WC lid 201 is cut away, and several components unrelated to the cartridge rinse and pneumatic systems have been removed. Various section lines indicate where the components have been sectioned to illustrate these systems.

FIG. 204, sharing a common section plane with FIG. 196, represents a section view taken through section line 204 of FIG. 203. In contrast to FIG. 196, FIG. 204 represents assembly 1004 with manual flush valve 895 in its open state, such that the cartridge rinse system is active. Referring to FIG. 204, pressurized water flowing through bearing bore 707 of the leftmost pivot jet 051, as indicated by arrow A114 (comparable to arrow A108 in FIG. 201B) flows through the adjacent nozzle bore 708 and exits pivot jet 051 within the interior of fixed wet cartridge 955, affecting a left water spray (L. SPRAY) to emerge from the leftmost pivot jet 051. Similarly, water flowing through the rightmost pivot jet 051, as indicated by arrow A115, exits pivot jet 051 within the interior of fixed wet cartridge 955, affecting a right water spray (R. SPRAY). FIG. 204A represents a detail view of the leftmost pivot jet 051 of FIG. 204; referring to FIG. 204A, v-groove 706 of pivot jet 051 aims slightly downward (Reference FIG. 82A), and reflects the incoming pressurized water (indicated by arrow A116) slightly downward, such that the left water spray (L. SPRAY) will complement the opposing right water spray (R. SPRAY, FIG. 204) without interference. Similar to FIG. 204A, FIG. 204B represents a detail view of the rightmost pivot jet 051 of FIG. 204; referring to FIG. 204B, v-groove 706 of pivot jet 051 aims slightly upward, and reflects the incoming pressurized water (indicated by arrow A117) slightly upward, such that the right water spray (R. SPRAY) will complement the opposing left water spray (L. SPRAY, FIG. 204) without interference.

FIG. 209 illustrates master assembly 1004 installed on a water closet (WC) for use, with fixed wet cartridge 955 open, and modified WC lid 201 in a partially open state, held in position by the incremental braking system; Manual actuator 890 is in the compressed position, and the cartridge rinse system is active. FIG. 209A illustrates the active left water spray (L. SPRAY) and right water spray (R. SPRAY). As these sprays impinge on the interior surfaces of right side shield 103, left side shield 104, forward cartridge base 106 and upper cartridge segment 202, the spray is reflected at various angles within fixed wet cartridge 955, causing finer secondary spray, or mist (MIST) to impact other surfaces that are not directly impacted by the left water spray or the right water spray. The combination of the left water spray (L. SPRAY), the right water spray (R. SPRAY) and the mist (MIST) affects a thorough interior rinse (RINSE) of fixed wet cartridge 955. Furthermore, when the cartridge rinse system is active, the rinse waste will cleanse the interior passages of fixed wet cartridge 955, as it passes through.

Manual Pneumatic Actuation System—

FIG. 205 illustrates a section view through manual actuator 890, in its expanded state. FIG. 206 illustrates a section view through manual flush valve 895, in its closed stated; the section plane of FIG. 206, indicated by section line 206 in FIG. 203, passes through pneumatic signal port 755 of valve base 064. FIG. 206, similar in illustration to FIG. 200D, represents a different section plane than that represented by FIG. 200D.

Referring to FIG. 205, flush button housing 047 is affixed to modified WC lid 201 by adhesive pad 048. Reference ring 690 of flush button diaphragm 046 is adhesively bonded into reference gland 700 of flush button housing 047, substantially sealing these components together, with the interior cavity being filled with atmospheric air (AIR). Reference disk 686 of flush button cap 045 is adhesively bonded into reference gland 689 of flush button diaphragm 046, substantially bonding these components together. Threaded elbow 049, threaded into outlet port 692 of flush button housing 047, spans through manual actuator signal port 364 of modified WC lid 201, and receives pneumatic tube 050. In this closed system, the atmospheric air (AIR), substantially filling the interior volume of manual actuator 890, holds flush button diaphragm 046 in its expanded state, as illustrated by arrows A118 in FIG. 205.

Referring to FIG. 206, the expansion force of disk spring 063, indicated by arrows A119, holds valve disk 062, valve piston 059 and valve diaphragm 058 in their upward operational positions, with valve disk 062 effectively sealing closed the fluid passages 736 of valve seat insert 061 (Reference FIG. 200D), as described above in Cartridge Rinse System, Section 5.7.

FIG. 207 represents a progression from FIG. 205, after the user has pressed downward on flush button cap 045, as indicated by arrow A121 to "actuate" the cartridge rinse system via manual actuator 890. Similarly, FIG. 208 represents a progression from FIG. 206, after the same event. Referring to FIG. 207, in response to the user applied downward force, indicated by arrow A121, the atmospheric air (AIR, FIG. 205), now somewhat pressurized, is forced through outlet port 692 of Flush button housing 047, through the interior of threaded elbow 049, and into pneumatic tube 050, as indicated by arrows A122. Referring to FIG. 208, the incoming pressurized air, represented by arrows A123, passes through pneumatic signal port 755 of valve base 064, through pneumatic port 724 of valve gasket 057, through pneumatic port 718 of valve cap 056, and then floods pneumatic cavity 715 of valve cap 056, forcing valve diaphragm 058 to flex downward, as illustrated by arrow A124; the downward flexion of valve diaphragm 058 forces valve piston 059 and valve disk 062 to translate downward, in the direction of arrow A124, compressing disk spring 063, and increasing its expansion force, indicated by arrows A125. As described in Cartridge Rinse System, Section 5.7, the downward translation of valve disk 062 will open the previously sealed fluid passages 736 of valve seat insert 061 (Reference FIG. 201A) and initiate operation of the cartridge rinse system.

When the user releases the force applied to flush button cap 045 (indicated by arrow A121, FIG. 207), the expansion force of disk spring 063, indicated by arrows A125, FIG. 208, will press valve disk 062, and valve piston 059 upward, in the direction indicated by arrows A125, causing valve diaphragm 058 to flex upward, and return to its previous state, as illustrated in FIG. 206. As valve disk 062 translates upward, returning to the position illustrated in FIG. 206, it will again seal fluid passages 736 of valve seat insert 061 (Reference FIG. 200D) and terminate operation of the cartridge rinse system. Referring to FIG. 206, the upward flexion of valve diaphragm 058 will cause the somewhat pressurized air to flow out of manual flush valve 895, as indicated by arrow A120 (FIG. 206). Referring to FIG. 205, the somewhat pressurized air (AIR) will return into the internal cavity of manual actuator 890, as illustrated by arrows A118; the air (AIR) will expand to its original volume, such that it is no longer pressurized, and force flush button diaphragm 046 back to its original expanded state as shown in FIG. 205.

By these means, the manual pneumatic actuation system allows the user to easily activate the cartridge rinse system of master assembly 1004, at their discretion: it allows the user to choose when to activate the rinse system, and it allows the user to control the rinse duration.

Debris Screening System—

The debris screening system of master assembly 1004 is substantially identical to that described for master assembly 1003 in Debris Screening System, Section 5.5.

Odor Control System—

The odor control system of master assembly 1004 is substantially identical to that described for master assembly 1003 in Odor Control System, Section 5.5, notwithstanding the fact that waterless urinal beads are not recommended for use with a water rinse urinal such as master assembly 1004. However, chlorine beads, or other odor control beads intended for use with a water rinse urinal, may be used with master assembly 1004, to effectively control odor.

5.8 Usage of Master Assembly 1004

Seated Use—

Seated use of master assembly 1004 is substantially identical to that for master assemblies 1001, 1002, and 1003. Referring to FIG. 210A, the operator should first rotate modified WC lid 201 open, as illustrated by arrow A126. To do so, the operator should use his or her fingers to lift upward on contact post 336 of modified WC lid 201, while modified WC seat 230 remains closed. The operator should rotate modified WC lid 201 to its extreme open position, such that modified WC lid 201 rests on the water tank (TANK) of the water closet (WC), as illustrated in FIG. 210B. Note that with most water closets, manual actuator 890 will reside above the water tank (TANK) of the water closet (WC), when modified WC lid 201 is open, as illustrated in FIG. 210B. With modified WC lid 201 in its open position, as illustrated in FIG. 210B, the user may then sit on modified WC seat 230, for seated use of master assembly 1004, similar to that shown in FIG. 133C, illustrating seated use for master assembly 1002.

Urinal Use for Short Users—

Urinal use of master assembly 1004 for short users is practically identical to that for master assembly 1003 (as described in Urinal Use for Short Users, Section 5.6), notwithstanding the user's option to activate the cartridge rinse system after use.

After a short user urinates into fixed wet cartridge 955, as illustrated in FIG. 211A, the user may choose to activate the cartridge rinse system before closing fixed wet cartridge 955. To do so, the operator should press downward on flush button cap 045 of manual actuator 890 with his fingers, as illustrated by arrow A127 in FIG. 211B. The user should hold flush button cap 045 of manual actuator 890 downward for several seconds before releasing it. The rinse water will exit fixed wet cartridge 955 and flow into the waste receptacle of the water closet (WC). The user should then close and latch fixed wet cartridge 955, in substantially the same manner as described for removable dry cartridge 855 of master assembly 1003, in Urinal Use for Short Users, Section 5.6.

Alternatively, a short user may choose to activate the cartridge rinse system after closing fixed wet cartridge 955. Referring to FIG. 211C, to do so, the operator should again press downward on flush button cap 045 of manual actuator 890 with his fingers, as illustrated by arrow A128 in FIG. 211C. The user should hold flush button cap 045 of manual actuator 890 downward for no more than 5 seconds, before releasing it. A small amount of rinse water will accumulate in the closed fixed wet cartridge 955. As previously demonstrated in Collapsible Cartridge System, Section 5.7, the residual rinse water within fixed wet cartridge 955 will flow toward the rear cavity of fixed wet cartridge 955, even in this closed and stored state. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1004. By these means, the residual rinse water will continue to wet the rearward interior surfaces of fixed wet cartridge 955, until fixed wet cartridge 955 is opened again, substantially preventing the deposition and buildup of residual urine within fixed wet cartridge 955. Master assembly 1004 may be used normally (including seated use, toilet cleaning, and all other normal uses). When fixed wet cartridge 955 is opened again, the rinse water will drain.

Urinal Use for Tall Users—

Urinal use of master assembly 1004 for tall users is practically identical to that for master assembly 1003 (as described in Urinal Use for Tall Users, Section 5.6), notwithstanding the user's option to activate the cartridge rinse system after use.

After a tall user urinates into fixed wet cartridge 955, as illustrated in FIG. 211D, the user may choose to activate the cartridge rinse system before closing fixed wet cartridge 955, and before releasing the incremental braking system. To do so, the operator should press downward on flush button cap 045 of manual actuator 890 with his fingers, as illustrated by arrow A129 in FIG. 211E. The user should hold flush button cap 045 of manual actuator 890 downward for several seconds before releasing it. The rinse water will exit fixed wet cartridge 955 and flow into the waste receptacle of the water closet (WC). The user should then close and latch fixed wet cartridge 955, in substantially the same manner as described for removable dry cartridge 855 of master assembly 1003, in Urinal Use for Tall Users, Section 5.6.

Alternatively, a tall user may choose to activate the cartridge rinse system after closing fixed wet cartridge 955, but before releasing the incremental braking system. Referring to FIG. 211F, to do so, the operator should again press downward on flush button cap 045 of manual actuator 890 with his fingers, as illustrated by arrow A130 in FIG. 211F. The user should hold flush button cap 045 of manual actuator 890 downward for no more than 5 seconds, before releasing it. During the rinse, a small amount of rinse water will accumulate in the closed fixed wet cartridge 955, and flow toward the rear cavity of fixed wet cartridge 955. As demonstrated in Collapsible Cartridge System, Section 5.7, the residual rinse water within fixed wet cartridge 955 will remain in the rear cavity of fixed wet cartridge 955, even when master assembly 1004 is closed and stored. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1004. By these means, the residual rinse water will continue to wet the rearward interior surfaces of fixed wet cartridge 955, until fixed wet cartridge 955 is opened again, substantially preventing the deposition and buildup of residual urine within fixed wet cartridge 955. Master assembly 1004 may be used normally (including seated use, toilet cleaning, and all other normal uses). When fixed wet cartridge 955 is opened again, the rinse water will drain.

As a third option, the tall user may choose to activate the cartridge rinse system after closing fixed wet cartridge 955, and after releasing the incremental braking system and allowing modified WC lid 201 to close. In this case, the user would activate the cartridge rinse system as described above in Urinal Use for Short Users (Section 5.8), and as illustrated in FIG. 211C.

Height Adjustment Range—

The height adjustment range for master assembly 1004 is identical to that for master assembly 1003, as described in Height Adjustment Range, Section 5.6.

Toilet Cleaning Access—

Toilet cleaning access for master assembly 1004 is substantially identical to that described and illustrated for master assemblies 1001, 1002 and 1003. (Reference Toilet Cleaning Access, Section 5.4)

Use of Debris Screen and Chemical Beads—

Use of debris screen and chemical beads for master assembly 1004 is substantially identical to that for master assembly 1003, as described in Use of Debris Screen and Chemical Beads, Section 5.6. Note that waterless urinal beads are not recommended for use with a water rinse urinal such as master assembly 1004. However, chlorine beads, or other odor control beads intended for use with a water rinse urinal, may be used with master assembly 1004, to effectively control odor.

5.9 Functional Systems of Master Assembly 1005—

Master Assembly 1005, as previously illustrated in FIGS. 114, 115, and 116, features the following functional systems:

Assembly Hinge Pivot System—

The assembly hinge pivot system of Master Assembly 1005 is functionally identical to that described for master assembly 1004. (Reference Assembly Hinge Pivot System, Section 5.7)

Slow-Close Rotational Dampening System—

The slow-close rotational dampening system of Master Assembly 1005 is functionally identical to that described for master assembly 1004. (Reference Slow-Close Rotational Dampening System, Section 5.7)

Collapsible Cartridge System—

The collapsible cartridge system of Master Assembly 1005 are identical to those described for master assembly 1004. (Reference Collapsible Cartridge System, Section 5.7)

Removable Cartridge System—

Master assembly 1005 does not include the removable cartridge system of master assembly 1003. Instead, master assembly 1004 employs a fixed cartridge pivot system, as described below.

Fixed Cartridge Pivot System—

The fixed cartridge pivot system of Master Assembly 1005 functions identically to that described for master assembly 1004. (Reference Fixed Cartridge Pivot System, Section 5.7)

Cartridge Illumination System—

Master assembly 1005 does not include the cartridge illumination system of master assembly 1003.

Incremental Braking System—

Master assembly 1005 does not include the incremental braking system of master assemblies 1003 and 1004. Rather, master assembly 1005 employs an analog braking system, as described below.

Analog Braking System—

FIG. 212 illustrates a section of master assembly 1005 in a closed state, with components strategically dissected for illustration of the analog (non-incremental) braking system. FIG. 213 represents a cross section taken through the components of FIG. 212, through section plane 213.

In FIG. 213, the sectioned components of master assembly 1005 are illustrated in a stored position. Fixed wet cartridge 955, being fully closed, holds brake cover 124 in its closed position; the interaction between fixed wet cartridge 955 and brake cover 124 being substantially identical to the previously illustrated relationship between removable dry cartridge 855 and brake cover 024 of master assembly 1003 (See Collapsible Cartridge System, Section 5.5.). The expansion force applied by automatic actuator 990 (affected by conical springs 076 as shown in FIG. 94) as illustrated by arrow A131, are opposed by the expansion force applied by lower brake spring 023 (illustrated by arrow A132). With these opposing forces being equal, they hold brake lever 122 in equilibrium in a "disengaged" state. In this disengaged state, brake pad 043 is not in contact with brake shaft 137, as illustrated by FIG. 213A.

FIG. 214, a progression from FIG. 213, illustrates the same component sections shown in FIG. 213, reflecting fixed wet cartridge 955 in a partially open state. As fixed wet cartridge 955 rotates toward its open position, as illustrated by arrow A133, brake cover 124, no longer constrained by fixed wet cartridge 955, becomes free to rotate about lever pivot axis 517A, of pivot rod 017. In response to the expansion force applied by automatic actuator 990, illustrated by arrow A134, brake cover 124, brake sub-frame 121, brake lever 122 and lower brake spring 023, rotate counterclockwise, as indicated by arrow A135, to the "brake engageable" state illustrated in FIG. 214, with brake pad 043 contacting brake shaft 137, preventing further counterclockwise rotation of these components. As illustrated in FIG. 214A, friction pad 678 of brake pad 043 initially contacts pad engagement ribs 653 of brake shaft 137.

FIG. 215, a progression from FIG. 214, illustrates the same component sections shown in FIG. 214 (notwithstanding fixed wet cartridge 955), after fixed wet cartridge 955 has been fully opened, and the user has rotated modified WC lid 301 upward, or clockwise, as illustrated by arrow A136. Note that fixed wet cartridge 955, in its fully opened state, resides outside of the localized view window of FIG. 215. During the rotation of modified WC lid 301 upward, as indicated by arrow A136, the expansion force applied by automatic actuator 990, illustrated by arrow A137, holds brake sub-frame 121 (and thus brake cover 124, brake lever 122 and lower brake spring 023) in counterclockwise rotation about lever pivot axis 517A, of pivot rod 017, as illustrated by arrow A138. Referring to FIG. 215A, as modified WC lid 301 is rotated open (as illustrated by arrow A136, FIG. 215), brake pad 043 is held in constant contact with brake shaft 137, maintaining a "brake engageable" system state.

Again referring to FIG. 215, after the user has rotated modified WC lid 301 to the selected position, a slight distance clockwise of the preferred usage position, the user should release modified WC lid 301, allowing it to rotate counterclockwise about hinge pivot axis 340A, under its own weight, as indicated by arrow A139. Referring to FIG. 215A, during this counterclockwise rotation, the frictional force between friction pad 678 of brake pad 043 and pad engagement ribs 653 of brake shaft 137, indicated by arrow A140 (FIG. 215A), affects a counterclockwise "engaging moment" through brake lever 122, indicated by arrow A141 in FIG. 215A. Referring to FIG. 215A, this engaging moment (indicated by arrow A141) will increase with further downward rotation of modified WC lid 301 (in the direction of arrow A139, FIG. 215), causing friction pad 678 of brake pad 043 to substantially engage with pad engagement ribs 653 of brake shaft 137, and deform slightly in response to the applied forces and moments; referring again to FIG. 215, the engaging moment will increase until such point that brake lever 122 and brake pad 043 substantially bind between brake shaft 137 and lever pivot rod 017 and stop the downward rotation of modified WC lid 301. In this way, the analog braking system effectively self-engages during normal use of master assembly 1005.

FIG. 216, a progression from FIG. 215, illustrates the same component sections shown in FIG. 215, with the analog braking system fully engaged and modified WC lid 301 at rest. Comparison of FIGS. 215A and 216A illustrate the deformation that occurs to friction pad 678 of brake pad 043, as it substantially engages with pad engagement ribs 653 of brake shaft 137, in response to the previously illustrated engaging moment (arrow A141, FIG. 215A). Referring to FIG. 216, the mass of modified WC lid 301 acting about hinge pivot axis 340A affects a moment, indicated by arrow A142; similar to the downward rotation of modified WC lid 301, as illustrated by arrow A139 in FIG. 215. In this configuration, the moment indicated by arrow A142 (FIG. 216) will maintain the engaging moment through brake lever 122, as illustrated by arrow A144 in FIG. 216A. Referring again to FIG. 216, note that lower brake spring 023, in the semi-relaxed state illustrated here, exerts a minor expansion force, indicated by arrow A143, forcing brake cover 124 downward, away from brake lever 122.

FIG. 217, a progression from FIG. 216, illustrates the same component sections shown in FIG. 216, after fixed wet cartridge 955 has been closed, and is again visible within the local view frame. Brake cover 124 is constrained in its closed position by fixed wet cartridge 955, and thus brake sub-frame 121 is also constrained in its closed position; brake lever 122 and brake pad 043 remain in their engaged positions; lower brake spring 023 is compressed between brake lever 122 and brake cover 124, with an increased expansion force, indicated by arrow A145, relative to the expansion force it exerted in the semi-relaxed state of FIG. 216 (indicated by arrow A143). Still referring to FIG. 217, as the user rotates modified WC lid 301 upwards, in the direction indicated by arrow A146, the previously described engaging moment (further indicated by arrow A147, FIG. 217A) through brake lever 122 will reduce in response to the rotation. Concurrently, the expansion force of lower brake spring 023, illustrated by arrow A145 will affect a clockwise "disengaging moment" through brake lever 122 (indicated by arrow A148, FIG. 217A). Referring to FIG. 217, when modified WC lid 301 achieves such an angle that the "disengaging moment" (arrow A148, FIG. 217A) exceeds the engaging moment (arrow A147, FIG. 217A), brake pad 043 will suddenly disengage from brake shaft 137; brake lever 122 and brake pad 043 will rotate clockwise about lever pivot axis 517A of pivot rod 017, in the direction of the "disengaging moment" (arrow A148, FIG. 217A), affected by the expansion force of lower brake spring 023, as indicated by arrow A145. The user may hear a slight "thump" as brake lever 122 makes contact with brake sub-frame 121, indicating the brake system has disengaged.

FIG. 218, a progression from FIG. 217, illustrates the same component sections shown in FIG. 217, with fixed wet cartridge 955 closed and the analog braking system disengaged. FIG. 218A illustrates that brake pad 043 is no longer in contact with brake shaft 137. Referring again to FIG. 218, when the user releases modified WC lid 301, no longer constrained by the analog braking system, under its own weight it will rotate counterclockwise about hinge pivot axis 340A, as indicated by arrow A149, until it achieves its closed position. The closure speed will be dampened by the slow-close rotational dampening system, which functions identically to that described for modified WC lid 101 of master assembly 1003 (Reference Slow-Close Rotational Dampening System, Section 5.5.)

From the user's perspective, the analog braking system of master assembly 1005 will operated in substantially the same manner as described for the incremental braking system employed in master assemblies 1003 and 1004 (Reference Incremental Braking System, Section 5.5; Urinal Use for Tall Users, Section 5.6.) In practicality, however, the analog braking system, not being subject to incremental engagement of its components, will allow the user much finer control when selecting a usage height. Generally, the analog braking system should also engage, and disengage, with less system travel than that required for the incremental braking system.

Cartridge Rinse System—

The cartridge rinse system of Master Assembly 1005 functions identically to that described for master assembly 1004. (Reference Cartridge Rinse System, Section 5.7.) Note that master assembly 1005 utilizes a different pneumatic actuation system than does master assembly 1004. See Automatic Actuation System below (Section 5.9).

Automatic Actuation System—

FIG. 219 illustrates a cutaway view of master assembly 1005. For clarity, the majority of modified WC lid 301 has been cut away, as has part of fixed wet cartridge 955; many components unrelated to the automatic actuation system have been removed. Section line 223 indicates where automatic flush valve 995 is sectioned to illustrate the automatic actuation system.

FIG. 220 illustrates a localized side view of the same components represented in FIG. 219, at greater scale. In FIG. 220, fixed wet cartridge 955, analog brake assembly 970, and automatic actuator 990 appear in partially open states: as fixed wet cartridge 955 rotates open, indicated by arrow A150, brake cover 124 rotates open in response, indicated by arrow A151. (Note: The interaction between removable dry cartridge 855 and brake cover 024 is described in Collapsible Cartridge System, Section 5.5. In comparison, fixed wet cartridge 955 and brake cover 124 of master assembly 1005 interact identically.) FIG. 221 represents a progression from FIG. 220, illustrating the same components of FIG. 220, in different positions: as the user rotates fixed wet cartridge 955 closed, indicated by arrow A152, brake cover 124 rotates closed in response, as indicated by arrow A153. Section lines imposed on FIGS. 220 and 221 depict where these components have been sectioned to illustrate the automatic actuation system.

FIG. 222 represents a section taken through automatic actuator 990 and analog brake assembly 970, as brake cover 124 rotates open (indicated by arrow A154, FIG. 222; arrow A151, FIG. 220) in response to the opening of fixed wet cartridge 955 (indicated by arrow A150, FIG. 220). As brake cover 124 rotates open (indicated by arrow A154), the expansion forces applied by conical springs 076, indicated by arrows A155, cause auto-flush diaphragm 078 to expand; while positioning protrusions 793 of auto-flush diaphragm 078 bear in positioning divots 533 of brake sub-frame 121, brake sub-frame 121 and brake lever 122 also rotate open, in the direction indicated by arrow A154 (also illustrated in FIG. 214 by arrow A135). Auto-flush diaphragm 078 is adhesively bonded to auto-flush actuator body 075, affecting an air-tight seal between these components. Thus, the expansion of auto-flush diaphragm 078 reduces the interior pressure of automatic actuator 990, causing auto-flush reeds 077 to flex upward; as auto-flush diaphragm 078 expands, air molecules originating in the region around point 1 (P1, FIG. 222) will pass through vent apertures 545A of brake lever 122, through vent apertures 532 of brake sub-frame 121 and through venting ports 795 of auto-flush diaphragm 078, as indicated by arrows A156; an air molecule originating at point 1 (P1) may pass through point 2 (P2, FIG. 222), as auto-flush diaphragm 078 expands.

FIG. 223 represents a section view passing through automatic flush valve 995, corresponding to the same operational state represented in FIG. 222. Automatic flush valve 995 resides in its closed state; the expansion force of disk spring 063, indicated by arrows A157, holds valve disk 062, and thus, valve piston 059 and valve diaphragm 058, at the upward extent of their operational travel; the upward force provided by disk spring 063, indicated by arrows A157, also presses vent seal surface 729 of valve diaphragm 058 into vent seal gland 716A of valve cap 156, sealing venting port 721 of valve cap 156.

FIG. 224 represents a progression from FIG. 222, illustrating the same components in different positions. Referring to FIG. 224, as the user rotates fixed wet cartridge 955 closed (indicated by arrow A152, FIG. 221), brake cover 124 and brake sub-frame 121 rotate closed in response (indicated by arrow A153, FIG. 221, and arrow A158, FIG. 224). Note that brake lever 122 may remain fixed during this period, as illustrated in FIG. 224, if the analog braking system is engaged. (Reference Analog Braking System above, Section 5.9.) Referring to FIG. 224, as brake cover 124 and brake sub-frame 121 rotate closed (indicated by arrow A158), brake sub-frame 121 forces auto-flush diaphragm 078 to collapse; the air within the interior of automatic actuator 990 slightly increases in pressure as auto-flush diaphragm 078 collapses, such that the air in the region of point 3 (P3) will have greater pressure than the air at ambient pressure in the region of point 4 (P4); this pressure differential will force auto-flush reeds 077 downward against floor member 791 of auto-flush diaphragm 078, as indicated by arrows A159, substantially sealing venting ports 795 of auto-flush diaphragm 078. The somewhat pressurized air within the interior of automatic actuator 990 passes through pneumatic outlet port 782 of auto-flush actuator body 075 and through pneumatic tube 079, as indicated by arrow A160.

FIG. 225 represents a progression from FIG. 223, corresponding to the same operational state represented in FIG. 224. Referring to FIG. 225, the incoming pressurized air, represented by arrow A161, passes through pneumatic signal port 755 of valve base 064, through pneumatic port 724 of valve gasket 057, through pneumatic port 718 of valve cap 156, and then floods pneumatic cavity 715 of valve cap 156, forcing valve diaphragm 058 to flex downward, in the direction indicated by arrow A162; the downward flexion of valve diaphragm 058 forces valve piston 059 and valve disk 062 to translate downward, also in the direction of arrow A162, compressing disk spring 063, and increasing its expansion force, indicated by arrows A163. As described in Cartridge Rinse System, Section 5.7, the downward translation of valve disk 062 will open the previously sealed fluid passages 736 of valve seat insert 061, and initiate the cartridge rinse system. (Reference FIG. 201A representing manual flush valve 895; Note that manual flush valve 895 differs from automatic flush valve 995 only in pneumatic aspects.)

Again referring to FIG. 225, as valve diaphragm 058 flexes downward, venting port 721 of valve cap 156 will become open, allowing the compressed air within pneumatic cavity 715 of valve cap 156 to expand and slowly exhaust through venting port 721 of valve cap 156, as indicated by arrow A164; the air will escape through the narrow passage occurring between valve cap 156 and valve interference trim 362 of modified WC lid 301, as indicated by arrows A165. The air will evacuate pneumatic cavity 715 of valve cap 156, in several seconds time; in response to the reduced pressure in pneumatic cavity 715 of valve cap 156, the expansion force of disk spring 063, indicated by arrows A163, will cause valve disk 062 and valve piston 059 to translate upward; valve diaphragm 058 will return to its original position, as illustrated in FIG. 223; referring to FIG. 223, vent seal surface 729 of valve diaphragm 058 will mate with vent seal gland 716A of valve cap 156, again sealing venting port 721 of valve cap 156; valve disk 062 will again seal fluid passages 736 of valve seat insert 061, and the cartridge rinse system will terminate. (Reference FIG. 200D representing manual flush valve 895; Note that manual flush valve 895 differs from automatic flush valve 995 only in pneumatic aspects.) In this regard, each time a user closes fixed wet cartridge 955, the automatic actuation system will initiate the cartridge rinse system, and then terminate the cartridge rinse system several seconds later, to automatically maintain the cleanliness of fixed wet cartridge 955.

Similar to FIG. 209 for master assembly 1004, FIG. 226 illustrates master assembly 1005 installed on a water closet (WC) for use, with modified WC lid 301 in a partially open state, held in position by the analog braking system; fixed wet cartridge 955 is illustrated in a partially closed state, with the cartridge rinse system active. As the user presses downward on upper cartridge segment 202 to close fixed wet cartridge 955, as illustrated by arrow A166, the automatic actuation system will initiate operation of the cartridge rinse system.

Similar to FIG. 209A for master assembly 1004, FIG. 226A illustrates the active left water spray (L. SPRAY) and right water spray (R. SPRAY). As previously described in Cartridge Rinse System, Section 5.7, in regard to master assembly 1004, the combination of the left water spray (L. SPRAY), the right water spray (R. SPRAY) and the mist (MIST) affect a thorough interior rinse (RINSE) of fixed wet cartridge 955; the rinse waste will cleanse the interior of fixed wet cartridge 955, as it passes through.

FIG. 227 illustrates master assembly 1005 in the same state represented in FIG. 226, with the rinse system active. Pressurized water (WATER) enters the system through system supply hose 074. As the cartridge rinse first initiates, with fixed wet cartridge 955 in a partially closed state, the rinse waste (WASTE) exiting fixed wet cartridge 955 will flow into the waste receptacle (RECEPTACLE) of the water closet (WC). After fixed wet cartridge 955 is closed, a small amount of rinse water will accumulate in the closed fixed wet cartridge 955. As demonstrated for master assembly 1004 in Collapsible Cartridge System, Section 5.7, the residual rinse water within fixed wet cartridge 955 will flow toward the rear cavity of fixed wet cartridge 955, and remain there even when master assembly 1005 is closed and stored. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1005. By these means, the residual rinse water will continue to wet the rearward interior surfaces of fixed wet cartridge 955, until fixed wet cartridge 955 is opened again, substantially preventing the deposition and buildup of residual urine within fixed wet cartridge 955. Master assembly 1005 may be used normally until fixed wet cartridge 955 is opened again, allowing the residual rinse water to drain.

Debris Screening System—

The debris screening system of master assembly 1005 is substantially identical to that described for master assembly 1003 in Debris Screening System, Section 5.5.

Odor Control System—

The odor control system of master assembly 1005 is substantially identical to that described for master assembly 1004. (Reference Odor Control System, Section 5.7)

5.10 Usage of Master Assembly 1005

Urinal Use for Short Users—

Short users should employ master assembly 1005 in the same manner depicted for master assembly 1003, as described in Urinal Use for Short Users, Section 5.6. However, when using master assembly 1005, with each closure of fixed wet cartridge 955, the automatic actuation system (Reference Automatic Actuation System, Section 5.9) will initiate the cartridge rinse system of master assembly 1005 (Reference Cartridge Rinse System, Section 5.9), and rinse the interior of fixed wet cartridge 955. During the rinse, a small amount of rinse water will accumulate in the closed fixed wet cartridge 955. As demonstrated in Collapsible Cartridge System, Section 5.7, for master assembly 1004, the residual rinse water within fixed wet cartridge 955 will flow toward the rear cavity of fixed wet cartridge 955, even in its closed and stored state. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1005. By these means, the residual rinse water will continue to wet the rearward interior surfaces of fixed wet cartridge 955, until fixed wet cartridge 955 is opened again, substantially preventing the deposition and buildup of residual urine within fixed wet cartridge 955. Master assembly 1005 may be used normally (including seated use, toilet cleaning, and all other normal uses). When fixed wet cartridge 955 is opened again, the rinse water will drain.

Urinal Use for Tall Users—

Tall users should employ master assembly 1005 in the same manner depicted for master assembly 1003, as described in Urinal Use for Tall Users, Section 5.6. However, when using master assembly 1005, with each closure of fixed wet cartridge 955, the automatic actuation system (Reference Automatic Actuation System, Section 5.9) will initiate the cartridge rinse system of master assembly 1005 (Reference Cartridge Rinse System, Section 5.9), and rinse the interior of fixed wet cartridge 955. During the rinse, a small amount of rinse water will accumulate in the closed fixed wet cartridge 955. As demonstrated for master assembly 1004 in Collapsible Cartridge System, Section 5.7, the residual rinse water within fixed wet cartridge 955 will flow toward the rear cavity of fixed wet cartridge 955, and remain there even when master assembly 1005 is closed and stored. As described in Collapsible Cartridge System, Section 5.5 for removable dry cartridge 855 of master assembly 1003, cartridge spout seal 026 (Reference FIG. 147B) will likewise seal fixed wet cartridge 955 of master assembly 1005. By these means, the residual rinse water will continue to wet the rearward interior surfaces of fixed wet cartridge 955, until fixed wet cartridge 955 is opened again, substantially preventing the deposition and buildup of residual urine within fixed wet cartridge 955. Master assembly 1005 may be used normally (including seated use, toilet cleaning, and all other normal uses). When fixed wet cartridge 955 is opened again, the rinse water will drain.

Height Adjustment Range—

The height adjustment range for master assembly 1005 is substantially equivalent to the height adjustment range of master assembly 1003. (Reference Height Adjustment Range, Section 5.6)

Seated Use—

Seated use of master assembly 1005 is substantially identical to that for Master Assembly 1002. (Reference Seated Use, Section 5.4)

Toilet Cleaning Access—

Toilet cleaning access for master assembly 1005 is substantially identical to that described for master assembly 1002. (Reference Toilet Cleaning Access, Section 5.4)

Use of Debris Screen and Chemical Beads—

Use of debris screen and chemical beads for master assembly 1005 is substantially identical to that for master assembly 1004. (Reference Use of Debris Screen and Chemical Beads, Section 5.8.)

6. Comprehensive Interpretation of the Current Invention

While the present invention has been described above in terms of several specific embodiments, it is to be understood that the functional benefits of the present invention are not limited to the specific embodiments presented herein. Rather, the present invention may include any of the numerous features described or illustrated herein, as well as other features not implicitly depicted here. Therefore, the claims of this specification should be interpreted comprehensively to include the numerous modifications and other embodiments of the invention that will come to mind for those skilled in the art to which this invention pertains. Further, the claims of the present invention are covered by both this disclosure and the appended claims. It is indeed intended that the scope of the invention should be determined by proper interpretation and construction of the appended claims, and their legal equivalents, as understood by those of skill in the art, relying upon the comprehensive interpretation of the disclosure in this specification, the detailed description of functions and usage, and the attached drawings.

Additionally, although the art presented with this disclosure illustrates the current invention dimensionally proportioned to a residential western style flush toilet, or water closet, the present invention is mutually applicable to western style toilets of other dimensions, proportions, and styles than that shown. All benefits, features, and functions of the current invention are mutually applicable to any western style toilet, be it a flush toilet or a dry toilet, residential or commercial. The adjustments required to accommodate other western style water toilets will primarily manifest in minor changes to dimensions and proportions of the present invention.

While this invention has been described above with reference to particular means, materials and embodiments, it is to be understood that the invention is not limited to these disclosed particulars, but extends instead to all equivalents within the scope of the following claims.

I claim:

1. A western style toilet seat and lid assembly comprising a toilet seat with a central opening; a toilet lid proportioned to cover said toilet seat; hinge components which allow the toilet seat and toilet lid to rotate independently, when the assembly is mounted to a traditional water closet; a forward facing urine receptacle, openable to receive urine from a user in an interior cavity of the urine receptacle, and closeable to conceal said interior cavity; a flow directing member which will convey received urine away from said urine receptacle and into a waste receptacle of a water closet to which the assembly is mounted; a braking mechanism which will constrain said toilet lid at user-prescribed angles of rotation, such that said urine receptacle may be positioned in close proximity to the user's groin, within an operational usage range, for users of various heights;

the improvement comprising a substantial forward aperture passing vertically through said toilet lid and cartridge mounting features attached to said toilet lid, and said urinal receptacle comprising a collapsible removable urinal cartridge being suspended from said toilet lid, as a singular unit, via said cartridge mounting features; said collapsible removable urinal cartridge further being formed by the union of a receptacle lid and a receptacle floor, adjoined by flexible collapsible side shields, and appended to a rearward member containing a flow directing urine channel; said collapsible removable urinal cartridge further being a distinct unit which may be removed and isolated from the assembly for cleaning or other purposes; said collapsible removable urinal cartridge further including all members and surfaces of the assembly which urine would contact during normal use of the assembly.

2. The assembly of claim 1 wherein the cartridge mounting features comprise a system of laterally translating reference features, and wherein the collapsible removable urinal cartridge includes receiving slide channels; said laterally translating reference features further being proportioned to bear within said receiving slide channels, to capture and suspend the collapsible removable urinal cartridge during removal and during installation and usage in an operational position.

3. The assembly of claim 2 further including operational detent divots within the receiving slide channels; said operational detent divots further being positioned and proportioned to constrain the collapsible removable urinal cartridge in said operational position.

4. The assembly of claim 2 further including installation aiding detent divots within the receiving slide channels; said installation aiding detent divots further being positioned and proportioned to constrain the collapsible removable urinal cartridge temporarily in a secondary position, to aid in removal and installation of the collapsible removable urinal cartridge.

5. The assembly of claim 1 wherein opening of the collapsible removable urinal cartridge will further cause the receptacle floor and the flow directing urine channel to rotate downward, such that both will achieve appreciable drain slope, even when the toilet lid is completely closed so that urine deposited by a user flows gravitationally towards an exit of the flow directing urine channel, and outfalls into the central opening of the toilet seat and then into the waste receptacle of the water closet.

6. The assembly of claim 5 further being proportioned to receive urine from males of a wide range of heights, ranging from very short males (such as young boys) just tall enough to urinate into a toilet, to very tall males.

7. The assembly of claim 1 wherein opening of the collapsible removable urinal cartridge will further cause the receptacle floor to translate forward toward the user, for the purpose of receiving urine from the user.

8. The assembly of claim 1 wherein upon closure of the collapsible removable urinal cartridge, the receptacle floor will translate rearward (away from the user), to prevent contact with the receptacle lid, thus preventing urine contamination of surfaces the user may contact.

9. The assembly of claim 1 wherein for any rotational position of the toilet lid, within the operational usage range, the flow directing urine channel will further direct effluent urine onto an interior porcelain wall of the waste receptacle of the water closet, rather than into standing water within the waste receptacle, thereby reducing splash and noise that typically accompany standing urination.

10. The assembly of claim 1 further having sealing features wherein the exit of the flow directing urine channel will be sealed against fluid leakage when the collapsible removable urinal cartridge is latched closed, thus preventing residual urine from escaping the flow directing urine channel and from dripping down a back of a seated user.

11. The assembly of claim 1 further including at least one feature whereby light may be conveyed into an interior of the collapsible removable urinal cartridge, such that the interior may be illuminated by an external light source for improved visibility of the urine receptacle in low-light conditions.

12. The assembly of claim 1 wherein the collapsible removable urinal cartridge comprises a self-opening adaptation, which causes the collapsible removable urinal cartridge to automatically open due to gravitational forces, unless constrained by an external force; the self-opening adaptation further causing the collapsible removable urinal cartridge to remain open, unless or until the external force is applied to collapse and close the collapsible removable urinal cartridge.

13. The assembly of claim 1 in which the receptacle lid further includes at least one latch engagement feature which will engage with at least one complementary latch engaging feature on the toilet lid, to constrain the collapsible removable urinal cartridge in a closed position such that, when the receptacle lid is latched closed, the collapsible removable urinal cartridge will remain collapsed and closed, until an external force is applied causing said at least one latch engagement feature of the receptacle lid to disengage from the at least one latch engaging feature on the toilet lid, thus allowing the collapsible removable urinal cartridge to open.

14. The assembly of claim 1 wherein the braking mechanism is further characterized as having incremental rotational adjustment and at least one self-engaging feature, whereby, whenever said braking mechanism is activated, the user may select any of numerous rotational adjustment increments within the operational usage range, and the at least one self-engaging feature of the braking mechanism will cause said mechanism to automatically engage and fix the rotational position of the toilet lid at the selected adjustment increment, preventing the toilet lid from rotating downward.

15. The assembly of claim 14 wherein the self-engaging incremental rotational braking mechanism of claim 13 is adapted to further allow the user to adjust the rotational position of the toilet lid incrementally upward, within the operational usage range, even after said self-engaging incremental rotational braking mechanism has already been engaged and the rotational position of the toilet lid has been fixed, preventing its downward rotation.

16. The assembly of claim 15, wherein when an external force is applied causing the at least one latch engagement feature of the receptacle lid to disengage from the at least one latch engaging feature of the toilet lid, the self-opening adaptation will cause the collapsible removable urinal cartridge to open, and in response the at least one self-engaging feature will cause the braking mechanism to activate; as the user raises the toilet lid, said braking mechanism will automatically engage and fix the rotational position of the toilet lid at the selected adjustment increment, but the user may further adjust the rotational position of the toilet lid incrementally upward, even after the rotational position of the toilet lid has been fixed.

17. The assembly of claim 1 further being proportioned to receive urine from females within a wide range of heights, ranging from short females (such as adolescent girls), to very tall females.

18. The assembly of claim 1 further being proportioned to receive odor control beads, such as waterless urinal beads (bio-enzymatic odor control) or chlorine beads within the collapsible removable urinal cartridge, to reduce production and propagation of odors.

19. The assembly of claim 1 wherein the collapsible removable urinal cartridge is further comprised of a forward collapsible section, flexibly adjoined to a rearward rigid section, such that said forward collapsible section may be independently expanded open, and collapsed closed, while the rearward rigid section retains its fixed shape.

20. The assembly of claim 1 wherein the flexible collapsible side shields further have interior folding attributes, such that during closure of the collapsible removable urinal cartridge, said flexible collapsible side shields will fold and/or flex toward a lateral center of the collapsible removable urinal cartridge, and will further fit within an interstitial space between the receptacle lid and the receptacle floor when the collapsible removable urinal cartridge is collapsed closed, thus preventing contamination of surrounding surfaces by surfaces that have been exposed to urine, while also concealing the flexible collapsible side shields from view.

* * * * *